US010149585B2

(12) United States Patent
Conrad

(10) Patent No.: US 10,149,585 B2
(45) Date of Patent: Dec. 11, 2018

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton, Ontario (CA)

( * ) Notice: Subject to any disclaimer, the term of this patent is extended or adjusted under 35 U.S.C. 154(b) by 0 days.

(21) Appl. No.: 15/089,017

(22) Filed: Apr. 1, 2016

(65) Prior Publication Data

US 2016/0213213 A1 Jul. 28, 2016

Related U.S. Application Data

(63) Continuation of application No. 14/822,211, filed on Aug. 10, 2015, now Pat. No. 9,888,817.
(Continued)

(51) Int. Cl.
*A47L 5/28* (2006.01)
*A47L 9/16* (2006.01)
(Continued)

(52) U.S. Cl.
CPC ..... *A47L 5/225* (2013.01); *A47L 5/24* (2013.01); *A47L 5/28* (2013.01); *A47L 9/16* (2013.01);
(Continued)

(58) Field of Classification Search
CPC ... A47L 5/225; A47L 5/24; A47L 5/28; A47L 5/26; A47L 9/1608; A47L 9/1625;
(Continued)

(56) References Cited

U.S. PATENT DOCUMENTS 911,258 A 2/1909 Neumann
1,600,762 A 9/1926 Hawley
(Continued)

FOREIGN PATENT DOCUMENTS

AU 112778 4/1940
CA 1077412 A1 5/1980
(Continued)

OTHER PUBLICATIONS

International Preliminary Report on Patentability, dated Sep. 16, 2008 for International application No. PCT/CA2007/000380.
(Continued)

*Primary Examiner* — Dung Van Nguyen
(74) *Attorney, Agent, or Firm* — Philip C. Mendes da Costa; Bereskin & Parr LLP/ S.E.N.C.R.L, s.r.l.

(57) ABSTRACT

A surface cleaning apparatus comprises a surface cleaning head, a rigid air flow conduit moveably mounted to the surface cleaning head and moveable to a reclined in use position and a hand vacuum cleaner removably mounted to an upstream end of the rigid air flow conduit. The hand vacuum cleaner has a handle and a cyclone having a cyclone axis of rotation which is parallel to the longitudinal axis of the rigid air flow conduit when the hand vacuum cleaner is mounted to the upstream end of the rigid air flow conduit. When the hand vacuum cleaner is mounted to the upstream end of the rigid air flow conduit, the handle is a driving handle for the surface cleaning apparatus.

27 Claims, 130 Drawing Sheets

Related U.S. Application Data

(60) Provisional application No. 62/093,189, filed on Dec. 17, 2014.

(51) Int. Cl.
*A47L 5/22* (2006.01)
*A47L 5/24* (2006.01)
*A47L 9/32* (2006.01)

(52) U.S. Cl.
CPC ..... *A47L 9/1608* (2013.01); *A47L 9/1625* (2013.01); *A47L 9/1641* (2013.01); *A47L 9/1683* (2013.01); *A47L 9/1691* (2013.01); *A47L 9/322* (2013.01); *A47L 9/325* (2013.01)

(58) Field of Classification Search
CPC .... A47L 9/1641; A47L 9/1683; A47L 9/1691; A47L 9/9325
See application file for complete search history.

(56) References Cited

U.S. PATENT DOCUMENTS 1,797,812 A 3/1931 Waring
1,898,608 A 2/1933 Alexander
1,937,765 A 12/1933 Leathers
2,015,464 A 9/1935 Saint Jacques
2,152,114 A 3/1939 Van Tongeren
2,542,634 A 2/1951 Davis
2,678,110 A 5/1954 Madsen
2,731,102 A 1/1956 James
2,811,219 A 10/1957 Wenzl
2,846,024 A 8/1958 Bremi
2,913,111 A 11/1959 Rogers
2,917,131 A 12/1959 Evans
2,937,713 A 5/1960 Stephenson
2,942,691 A 6/1960 Dillon
2,942,692 A 6/1960 Benz
2,946,451 A 7/1960 Culleton
2,952,330 A 9/1960 Winslow
2,981,369 A 4/1961 Yellott
3,032,954 A 5/1962 Racklyeft
3,085,221 A 4/1963 Kelly
3,130,157 A 4/1964 Kelsall
3,200,568 A 8/1965 McNeil
3,204,772 A 9/1965 Ruxton
3,217,469 A 11/1965 Eckert
3,269,097 A 8/1966 German
3,320,727 A 5/1967 Farley
3,372,532 A 3/1968 Campbell
3,426,513 A 2/1969 Bauer
3,518,815 A 7/1970 Peterson
3,530,649 A 9/1970 Porsch
3,543,325 A 12/1970 Hamrick et al.
3,561,824 A 2/1971 Homan
3,582,616 A 6/1971 Wrob
3,675,401 A 7/1972 Cordes
3,684,093 A 8/1972 Kono
3,822,533 A 7/1974 Oranje
3,898,068 A 8/1975 McNeil et al.
3,933,450 A 1/1976 Percevaut
3,988,132 A 10/1976 Oranje
3,988,133 A 10/1976 Schady
4,097,381 A 6/1978 Ritzler
4,187,088 A 2/1980 Hodgson
4,218,805 A 8/1980 Brazier
4,236,903 A 12/1980 Malmsten
4,307,485 A 12/1981 Dessig
4,373,228 A 2/1983 Dyson
4,382,804 A 5/1983 Mellor
4,409,008 A 10/1983 Solymes
4,486,207 A 12/1984 Baillie
4,494,270 A 1/1985 Ritzau et al.
4,523,936 A 6/1985 Disanza, Jr.
4,678,588 A 7/1987 Shortt
4,700,429 A 10/1987 Martin et al.
4,744,958 A 5/1988 Pircon
4,778,494 A 10/1988 Patterson
4,826,515 A 5/1989 Dyson
D303,173 S 8/1989 Masakata et al.
4,853,008 A 8/1989 Dyson
4,853,011 A 8/1989 Dyson
4,853,111 A 8/1989 MacArthur et al.
4,905,342 A 3/1990 Ataka
4,944,780 A 7/1990 Usmani
4,980,945 A 1/1991 Bewley
5,054,157 A 10/1991 Werner et al.
5,078,761 A 1/1992 Dyson
5,080,697 A 1/1992 Finke
5,090,976 A 2/1992 Dyson
5,129,125 A 7/1992 Gamou et al.
5,224,238 A 7/1993 Bartlett
5,230,722 A 7/1993 Yonkers
5,254,019 A 10/1993 Noschese
5,267,371 A 12/1993 Soler et al.
5,287,591 A 2/1994 Rench et al.
5,307,538 A 5/1994 Rench et al.
5,309,600 A 5/1994 Weaver et al.
5,309,601 A 5/1994 Hampton et al.
5,347,679 A 9/1994 Saunders et al.
5,363,535 A 11/1994 Rench et al.
5,481,780 A 1/1996 Daneshvar
5,515,573 A 5/1996 Frey
5,599,365 A 2/1997 Alday et al.
D380,033 S 6/1997 Masterton et al.
5,709,007 A 1/1998 Chiang
5,755,096 A 5/1998 Holleyman
5,815,878 A 10/1998 Murakami et al.
5,815,881 A 10/1998 Sjoegreen
5,858,038 A 1/1999 Dyson et al.
5,858,043 A 1/1999 Geise
5,893,938 A 4/1999 Dyson et al.
5,935,279 A 8/1999 Kilstrom
5,950,274 A 9/1999 Kilstrom
5,970,572 A 10/1999 Thomas
6,071,095 A 6/2000 Verkaar Wesley H
6,071,321 A 6/2000 Trapp et al.
6,080,022 A 6/2000 Shaberman et al.
6,122,796 A 9/2000 Downham et al.
6,210,469 B1 4/2001 Tokar
6,221,134 B1 4/2001 Conrad et al.
6,228,260 B1 5/2001 Conrad et al.
6,231,645 B1 5/2001 Conrad et al.
6,251,296 B1 6/2001 Conrad et al.
6,260,234 B1 7/2001 Wright et al.
6,345,408 B1 2/2002 Nagai et al.
6,406,505 B1 6/2002 Oh et al.
6,434,785 B1 8/2002 Vandenbelt et al.
6,440,197 B1 8/2002 Conrad et al.
6,502,278 B2 1/2003 Oh et al.
6,519,810 B2 2/2003 Kim
6,531,066 B1 3/2003 Saunders et al.
6,553,612 B1 4/2003 Dyson et al.
6,553,613 B2 4/2003 Onishi et al.
6,560,818 B1 5/2003 Hasko
6,581,239 B1 6/2003 Dyson et al.
6,599,338 B2 7/2003 Oh et al.
6,599,350 B1 7/2003 Rockwell et al.
6,613,316 B2 9/2003 Sun et al.
6,623,539 B2 9/2003 Lee et al.
6,625,845 B2 9/2003 Matsumoto et al.
6,640,385 B2 11/2003 Oh et al.
6,648,934 B2 11/2003 Choi et al.
6,712,868 B2 3/2004 Murphy et al.
6,732,403 B2 5/2004 Moore et al.
6,746,500 B1 6/2004 Park et al.
6,782,583 B2 8/2004 Oh
6,782,585 B1 8/2004 Conrad et al.
6,810,558 B2 11/2004 Lee
6,818,036 B1 11/2004 Seaman
6,833,015 B2 12/2004 Oh et al.
6,868,578 B1 3/2005 Kasper
6,874,197 B1 4/2005 Conrad
6,896,719 B2 5/2005 Coates et al.

(56) References Cited

U.S. PATENT DOCUMENTS 6,929,516 B2 8/2005 Brochu et al.
6,968,596 B2 11/2005 Oh et al.
6,976,885 B2 12/2005 Lord
7,113,847 B2 9/2006 Chumura et al.
7,128,770 B2 10/2006 Oh et al.
7,160,346 B2 1/2007 Park
7,162,770 B2 1/2007 Davidshofer
7,175,682 B2 2/2007 Nakai et al.
7,198,656 B2 4/2007 Takemoto et al.
7,222,393 B2 5/2007 Kaffenberger et al.
7,272,872 B2 9/2007 Choi
7,278,181 B2 10/2007 Harris et al.
7,341,611 B2 3/2008 Greene et al.
7,354,468 B2 4/2008 Arnold et al.
7,370,387 B2 5/2008 Walker et al.
7,377,007 B2 5/2008 Best
7,377,953 B2 5/2008 Oh
7,386,915 B2 6/2008 Blocker et al.
7,395,579 B2 7/2008 Oh
7,426,768 B2 9/2008 Peterson et al.
7,429,284 B2 9/2008 Oh
7,448,363 B1 11/2008 Rasmussen et al.
7,449,040 B2 11/2008 Conrad et al.
7,485,164 B2 2/2009 Jeong et al.
7,488,363 B2 2/2009 Jeong et al.
7,547,337 B2 6/2009 Oh
7,547,338 B2 6/2009 Kim et al.
7,563,298 B2 7/2009 Oh
7,565,853 B2 7/2009 Arnold et al.
7,588,616 B2 9/2009 Conrad et al.
7,597,730 B2 10/2009 Yoo et al.
7,628,831 B2 12/2009 Gomiciaga-Pereda et al.
7,691,161 B2 4/2010 Oh et al.
7,717,973 B2 5/2010 Oh et al.
7,740,676 B2 6/2010 Burnham et al.
7,770,256 B1 8/2010 Fester
7,776,120 B2 8/2010 Conrad
7,779,506 B2 8/2010 Kang et al.
7,803,207 B2 9/2010 Conrad
7,805,804 B2 10/2010 Loebig
7,811,349 B2 10/2010 Nguyen
7,867,308 B2 1/2011 Conrad
7,882,593 B2 2/2011 Beskow et al.
7,922,794 B2 4/2011 Morphey
7,931,716 B2 4/2011 Oakham
7,938,871 B2 5/2011 Lloyd
7,958,598 B2 6/2011 Yun et al.
7,979,959 B2 7/2011 Courtney
7,996,956 B2 8/2011 Wood et al.
8,021,453 B2 9/2011 Howes
8,062,398 B2 11/2011 Luo et al.
8,100,999 B2 1/2012 Ashbee et al.
8,101,001 B2 1/2012 Qian
8,117,712 B2 2/2012 Dyson et al.
8,146,201 B2 4/2012 Conrad
8,151,407 B2 4/2012 Conrad
8,152,877 B2 4/2012 Greene
8,156,609 B2 4/2012 Milne et al.
8,161,599 B2 4/2012 Griffith et al.
8,225,456 B2 7/2012 Håkan et al.
8,484,799 B2 7/2013 Conrad
8,673,487 B2 3/2014 Churchill
9,192,269 B2 11/2015 Conrad
9,516,979 B2 12/2016 Gidwell
9,675,218 B2 * 6/2017 Kim ..... A47L 5/225
9,711,986 B2 7/2017 Sunderland et al.
2002/0011050 A1 1/2002 Hansen et al.
2002/0011053 A1 1/2002 Oh
2002/0062531 A1 5/2002 Oh
2002/0088208 A1 7/2002 Lukac et al.
2002/0112315 A1 8/2002 Conrad
2002/0134059 A1 9/2002 Oh
2002/0134238 A1 * 9/2002 Conrad ..... A47L 9/122 95/79
2002/0178535 A1 12/2002 Oh et al.
2002/0178698 A1 12/2002 Oh et al.
2002/0178699 A1 12/2002 Oh
2003/0046910 A1 3/2003 Lee
2003/0066273 A1 4/2003 Choi et al.
2003/0106180 A1 6/2003 Tsen
2003/0159238 A1 8/2003 Oh
2003/0159411 A1 8/2003 Hansen et al.
2003/0200736 A1 10/2003 Ni
2004/0010885 A1 1/2004 Hitzelberger et al.
2004/0025285 A1 2/2004 McCormick et al.
2004/0216264 A1 11/2004 Shaver et al.
2005/0081321 A1 4/2005 Milligan et al.
2005/0115409 A1 6/2005 Conrad
2005/0132528 A1 6/2005 Yau
2005/0198769 A1 9/2005 Lee et al.
2005/0198770 A1 9/2005 Jung et al.
2005/0252179 A1 11/2005 Oh et al.
2005/0252180 A1 11/2005 Oh et al.
2006/0037172 A1 2/2006 Choi
2006/0042206 A1 3/2006 Arnold et al.
2006/0090290 A1 5/2006 Lau
2006/0123590 A1 6/2006 Fester et al.
2006/0137304 A1 6/2006 Jeong et al.
2006/0137306 A1 6/2006 Jeong et al.
2006/0137309 A1 6/2006 Jeong et al.
2006/0137314 A1 6/2006 Conrad et al.
2006/0156508 A1 7/2006 Khalil
2006/0162298 A1 7/2006 Oh et al.
2006/0162299 A1 7/2006 North
2006/0168922 A1 8/2006 Oh
2006/0168923 A1 8/2006 Lee et al.
2006/0207055 A1 9/2006 Ivarsson et al.
2006/0207231 A1 9/2006 Arnold
2006/0230715 A1 10/2006 Oh et al.
2006/0230723 A1 10/2006 Kim et al.
2006/0230724 A1 10/2006 Han et al.
2006/0236663 A1 10/2006 Oh
2006/0254226 A1 11/2006 Jeon
2006/0277711 A1 12/2006 Hong et al.
2006/0278081 A1 12/2006 Han et al.
2006/0288516 A1 12/2006 Sawalski
2007/0067944 A1 3/2007 Kitamura
2007/0077810 A1 4/2007 Gogel
2007/0079473 A1 4/2007 Min
2007/0079585 A1 4/2007 Oh et al.
2007/0095028 A1 5/2007 Kim
2007/0095029 A1 5/2007 Min
2007/0136984 A1 6/2007 Hsu
2007/0209334 A1 9/2007 Conrad
2007/0209335 A1 9/2007 Conrad
2007/0271724 A1 11/2007 Hakan et al.
2007/0289089 A1 12/2007 Yacobi
2007/0289266 A1 12/2007 Oh
2008/0040883 A1 2/2008 Beskow et al.
2008/0047091 A1 2/2008 Nguyen
2008/0134460 A1 6/2008 Conrad
2008/0134462 A1 6/2008 Jansen et al.
2008/0178416 A1 7/2008 Conrad
2008/0178420 A1 7/2008 Conrad
2008/0190080 A1 8/2008 Oh et al.
2008/0196194 A1 8/2008 Conrad
2008/0196745 A1 * 8/2008 Conrad ..... A47L 9/125 134/21
2008/0301903 A1 12/2008 Cunningham et al.
2009/0100633 A1 4/2009 Bates et al.
2009/0113659 A1 5/2009 Jeon
2009/0144932 A1 6/2009 Yoo
2009/0165431 A1 7/2009 Oh
2009/0205160 A1 8/2009 Conrad
2009/0205161 A1 8/2009 Conrad
2009/0205298 A1 8/2009 Hyun et al.
2009/0209666 A1 8/2009 Hellberg et al.
2009/0265877 A1 10/2009 Dyson et al.
2009/0282639 A1 11/2009 Dyson et al.
2009/0300874 A1 12/2009 Tran et al.
2009/0300875 A1 12/2009 Inge et al.
2009/0307564 A1 12/2009 Vedantham et al.
2009/0307863 A1 12/2009 Milne et al.
2009/0307864 A1 12/2009 Dyson

(56) References Cited

U.S. PATENT DOCUMENTS

| | | | | |
|---|---|---|---|---|
| 2009/0308254 | A1 | 12/2009 | Oakham | |
| 2009/0313958 | A1 | 12/2009 | Gomiciaga-Pereda et al. | |
| 2009/0313959 | A1 | 12/2009 | Gomiciaga-Pereda et al. | |
| 2010/0083459 | A1 | 4/2010 | Beskow et al. | |
| 2010/0132319 | A1 | 6/2010 | Ashbee et al. | |
| 2010/0154150 | A1 | 6/2010 | McLeod | |
| 2010/0175217 | A1 | 7/2010 | Conrad | |
| 2010/0212104 | A1 | 8/2010 | Conrad | |
| 2010/0224073 | A1 | 9/2010 | Oh et al. | |
| 2010/0229321 | A1 | 9/2010 | Dyson et al. | |
| 2010/0229324 | A1 | 9/2010 | Conrad | |
| 2010/0229328 | A1 | 9/2010 | Conrad | |
| 2010/0242210 | A1 | 9/2010 | Conrad | |
| 2010/0243158 | A1 | 9/2010 | Conrad | |
| 2010/0293745 | A1 | 11/2010 | Coburn | |
| 2010/0299865 | A1 | 12/2010 | Conrad | |
| 2010/0299866 | A1 | 12/2010 | Conrad | |
| 2011/0023261 | A1 | 2/2011 | Proffitt, II et al. | |
| 2011/0146024 | A1 | 6/2011 | Conrad | |
| 2011/0168332 | A1 | 7/2011 | Bowe et al. | |
| 2011/0219576 | A1 | 9/2011 | Conrad | |
| 2011/0289719 | A1 | 12/2011 | Han et al. | |
| 2012/0060322 | A1 | 3/2012 | Simonelli et al. | |
| 2012/0079671 | A1* | 4/2012 | Stickney | A47L 5/225 15/344 |
| 2012/0216361 | A1 | 8/2012 | Millington et al. | |
| 2012/0222245 | A1 | 9/2012 | Conrad | |
| 2012/0222260 | A1 | 9/2012 | Conrad | |
| 2012/0222262 | A1 | 9/2012 | Conrad | |
| 2013/0160232 | A1* | 6/2013 | Peace | A47L 9/165 15/353 |
| 2014/0137362 | A1 | 5/2014 | Smith | |
| 2014/0137363 | A1 | 5/2014 | Wilson | |
| 2014/0137364 | A1 | 5/2014 | Stickney et al. | |
| 2014/0182080 | A1 | 7/2014 | Lee et al. | |
| 2014/0208538 | A1 | 7/2014 | Visel et al. | |
| 2014/0237956 | A1* | 8/2014 | Conrad | B04C 3/00 55/336 |
| 2015/0135474 | A1* | 5/2015 | Gidwell | A47L 5/225 15/323 |
| 2015/0230677 | A1 | 8/2015 | Andrikanish | |
| 2015/0297050 | A1* | 10/2015 | Marsh | A47L 9/242 15/344 |
| 2016/0113460 | A1* | 4/2016 | Williams | A47L 9/1683 55/438 |

FOREIGN PATENT DOCUMENTS

| | | | |
|---|---|---|---|
| CA | 1218962 | A | 3/1987 |
| CA | 2450450 | A1 | 12/2004 |
| CA | 2484587 | A1 | 4/2005 |
| CA | 2438079 | C | 8/2009 |
| CA | 2658014 | A1 | 9/2010 |
| CA | 2659212 | A1 | 9/2010 |
| CN | 1336154 | A | 2/2002 |
| CN | 1434688 | A | 8/2003 |
| CN | 1493244 | A | 5/2004 |
| CN | 1875846 | A | 12/2006 |
| CN | 1875855 | A | 12/2006 |
| CN | 1887437 | A | 1/2007 |
| CN | 101061932 | A | 10/2007 |
| CN | 101108081 | A | 1/2008 |
| CN | 101108106 | A | 1/2008 |
| CN | 101108110 | A | 1/2008 |
| CN | 201290642 | Y | 8/2009 |
| CN | 202739907 | U | 2/2013 |
| CN | 202932850 | U | 5/2013 |
| CN | 204363891 | U | 6/2015 |
| CN | 105816104 | A | 8/2016 |
| CN | 205671986 | U | 11/2016 |
| DE | 875134 | C | 4/1953 |
| DE | 9216071.9 | U1 | 2/1993 |
| DE | 4232382 | C1 | 3/1994 |
| DE | 10056935 | C2 | 1/2003 |
| DE | 69907201 | T2 | 2/2004 |
| DE | 60201666 | T2 | 6/2006 |
| DE | 60211663 | T2 | 5/2007 |
| DE | 102007011457 | A1 | 10/2007 |
| DE | 112010001135 | T5 | 8/2012 |
| DE | 102012211246 | A1 | 1/2014 |
| EP | 0489498 | A1 | 6/1992 |
| EP | 493950 | B1 | 7/1992 |
| EP | 1200196 | B1 | 6/2005 |
| EP | 1779761 | A2 | 5/2007 |
| EP | 1815777 | A1 | 8/2007 |
| EP | 1594386 | B1 | 4/2009 |
| EP | 1676516 | B1 | 1/2010 |
| EP | 2308360 | A2 | 4/2011 |
| EP | 1629758 | A3 | 10/2013 |
| EP | 2848173 | A1 | 3/2015 |
| FR | 2812531 | B1 | 11/2004 |
| GB | 700791 | A | 12/1953 |
| GB | 1111074 | A | 4/1968 |
| GB | 2035787 | B | 10/1982 |
| GB | 2163703 | B | 1/1988 |
| GB | 2268875 | A | 1/1994 |
| GB | 2307849 | A | 6/1997 |
| GB | 2282979 | B | 10/1997 |
| GB | 2365324 | B | 7/2002 |
| GB | 2440111 | A | 1/2008 |
| GB | 2465781 | A | 6/2010 |
| GB | 2441962 | B | 3/2011 |
| GB | 2466290 | B | 10/2012 |
| GB | 2508035 | | 5/2014 |
| JP | 61131720 | A | 6/1986 |
| JP | 2000140533 | A | 5/2000 |
| JP | 2002085297 | A | 3/2002 |
| JP | 2003135335 | A | 5/2003 |
| JP | 2005040246 | A | 2/2005 |
| JP | 2006102034 | A | 4/2006 |
| JP | 2008206613 | A | 9/2008 |
| JP | 2009261501 | A | 11/2009 |
| JP | 2010081968 | A | 4/2010 |
| JP | 2010178773 | A | 8/2010 |
| JP | 2010220632 | A | 10/2010 |
| JP | 2011189132 | A | 9/2011 |
| JP | 2011189133 | A | 9/2011 |
| JP | 2013086228 | A | 5/2013 |
| KR | 1020010045598 | A | 6/2001 |
| KR | 1020020067489 | A | 8/2002 |
| KR | 1020020085478 | A | 11/2002 |
| KR | 1020040050174 | A | 6/2004 |
| KR | 1020060008365 | A | 1/2006 |
| KR | 1020060118795 | A | 11/2006 |
| KR | 1020060118800 | A | 11/2006 |
| KR | 1020060118802 | A | 11/2006 |
| KR | 1020060118803 | A | 11/2006 |
| KR | 1020060122249 | A | 11/2006 |
| KR | 1020060125952 | A | 12/2006 |
| KR | 1020060125954 | A | 12/2006 |
| KR | 1020100084127 | A | 7/2010 |
| WO | 1980002561 | A1 | 11/1980 |
| WO | 9627446 | A1 | 9/1996 |
| WO | 97/20492 | A1 | 6/1997 |
| WO | 9809121 | A1 | 3/1998 |
| WO | 9843721 | A1 | 10/1998 |
| WO | 01/07168 | A1 | 2/2001 |
| WO | 0147247 | A3 | 6/2001 |
| WO | 02/017766 | A3 | 3/2002 |
| WO | 2004069021 | A1 | 8/2004 |
| WO | 2006076363 | A2 | 7/2006 |
| WO | 2006076363 | A3 | 12/2006 |
| WO | 2006026414 | A3 | 8/2007 |
| WO | 2007104238 | A1 | 9/2007 |
| WO | 2008009883 | A1 | 1/2008 |
| WO | 2008009888 | A1 | 1/2008 |
| WO | 2008009890 | A1 | 1/2008 |
| WO | 2008009891 | A1 | 1/2008 |
| WO | 2008035032 | A2 | 3/2008 |
| WO | 2008070973 | A1 | 6/2008 |
| WO | 2008088278 | A2 | 7/2008 |
| WO | 2008135708 | A1 | 11/2008 |
| WO | 2009026709 | A1 | 3/2009 |

(56) References Cited

FOREIGN PATENT DOCUMENTS

| | | | |
|---|---|---|---|
| WO | 2010102396 | A1 | 9/2010 |
| WO | 2010142968 | A1 | 12/2010 |
| WO | 2010142969 | A1 | 12/2010 |
| WO | 2010142970 | A1 | 12/2010 |
| WO | 2010142971 | A1 | 12/2010 |
| WO | 2011054106 | A1 | 5/2011 |
| WO | 2012042240 | A1 | 4/2012 |
| WO | 2012117231 | A1 | 9/2012 |
| WO | 2015129387 | A1 | 9/2015 |
| WO | 2016065151 | A1 | 4/2016 |
| WO | 2017046557 | A1 | 3/2017 |
| WO | 2017046559 | A1 | 3/2017 |
| WO | 2017046560 | A1 | 3/2017 |

OTHER PUBLICATIONS

Supplementary European Search Report, dated Jun. 16, 2009, as received on the corresponding EP application No. 07719394.4.
Office Action received in connection to the corresponding Chinese Patent Application No. 200880126486.6 dated Mar. 23, 2012.
Office Action received in connection to the corresponding U.S. Appl. No. 12/720,901 dated Jun. 10, 2011.
Office Action received in connection to the related Chinese Patent Application No. 00813438.3 dated Jul. 11, 2003.
Handbook of Air Pollution Prevention and Contriol, pp. 397-404, 2002.
Makita 4071 Handy Vac.
Makita BCL180 User Manual.
European Communication pursuant to Article 94(3) on European Patent Application No. 04078261.7, dated Apr. 24, 2012.
European Communication pursuant to Article 94(3) on European Patent Application No. 04078261.7, dated Feb. 26, 2010.
International Preliminary Examination Report on International application No. PCT/CA00/00873, dated Oct. 26, 2001.
Office Action dated Jul. 7, 2010, for Canadian Patent Application No. 2,675,714.
International Search Report and Written Opinion received in connection to International patent application No. PCT/CA2007/002211, dated Apr. 21, 2008.
International Search Report and Written Opinion received in connection to international patent application No. PCT/CA2015/050661, dated Oct. 19, 2015.
United States Office Action, dated Feb. 16, 2011, for U.S. Appl. No. 11/953,292.
United States Office Action, dated Jul. 22, 2010, for U.S. Appl. No. 11/953,292.
Euro-Pro Shark Cordless Hand Vac Owner's Manual, published in 2002.
International Preliminary Examination Report on International application No. PCT/CA2015/051332, dated Mar. 7, 2016.
English machine translation CN101108081A published on Jan. 23, 2008.
English machine translation CN101108106A published on Jan. 23, 2008.
English machine translation CN101108110A published on Jan. 23, 2008.
English machine translation CN1336154A published on Feb. 20, 2002.
English machine translation CN1434688A published on Aug. 6, 2003.
English machine translation CN1875846A published on Dec. 13, 2006.
English machine translation CN1875855A published on Dec. 13, 2006.
English machine translation CN201290642Y published on Aug. 19, 2009.
English machine translation DE10056935C2 published on Jan. 16, 2003.
English machine translation DE102007011457A1 published on Oct. 25, 2007.
English machine translation DE102012211246A1 published on Jan. 2, 2014.
English machine translation DE112010001135T5 published on Aug. 2, 2012.
English machine translation DE60201666T2 published on Jun. 1, 2006.
English machine achine translation DE60211663T2 published on May 10, 2007.
English machine achine translation DE69907201T2 published on Feb. 5, 2004.
English machine translation JP2003135335A published on May 13, 2003.
English machine translation JP2005040246A published on Feb. 17, 2005.
English machine translation JP2009261501A published on Nov. 12, 2009.
English machine translation JP2010081968A published on Apr. 15, 2010.
English machine translation KR1020010045598A published on Jun. 5, 2001.
English machine translation KR1020020067489A published on Aug. 22, 2002.
English machine translation KR1020020085478A published on Nov. 16, 2002.
English machine translation KR1020040050174A published on Jun. 16, 2004.
English machine translation KR1020060008365A published on Jan. 26, 2006.
English machine translation KR1020060118795A published on Nov. 24, 2006.
English machine translation KR1020060118800A published on Nov. 24, 2006.
English machine translation KR1020060118802A published on Nov. 24, 2006.
English machine translation KR1020060118803A published on Nov. 24, 2006.
English machine translation KR1020060122249A published on Nov. 30, 2006.
English machine translation KR1020060125952A published on Dec. 7, 2006.
English machine translation KR1020060125954A published on Dec. 7, 2006.
English machine translation KR1020100084127A published on Jul. 23, 2010.
English machine translation CN204363891U published on Jun. 3, 2015.
English machine translation JP2008206613A published on Sep. 11, 2008.
English machine translation JP2002085297A published on Mar. 26, 2002.
English machine translation WO2015129387A1 published on Sep. 3, 2015.
English machine translation CN202739907U published on Feb. 20, 2013.
English machine translation CN205671986U published on Nov. 9, 2016.
English machine translation CN105816104A published on Aug. 3, 2016.
English machine translation JP2013086228A published on May 13, 2013.
English machine translation JP2006102034A published on Apr. 20, 2006.
Combined Search and Examination Report under Sections 17 & 18(3) received in connection to the corresponding GB Patent Application No. 1522195.5 dated Jun. 16, 2016.
Combined Search and Examination Report under Sections 17 & 18(3) received in connection to the corresponding GB Patent Application No. 1706875.0 dated May 25, 2017.
International Preliminary Report on Patentability in International Application No. PCT/CA2015/051332 dated Jun. 29, 2017.

(56) References Cited

OTHER PUBLICATIONS

International Search Report and Written Opinion received in connection to International Patent Application No. PCT/CA2014/000133, dated May 26, 2014.
International Search Report and Written Opinion received in connection to International patent application No. PCT/CA2017/050436, dated Jul. 21, 2017.
International Search Report and Written Opinion received in connection to International patent application No. PCT/CA2017/050014, dated Apr. 5, 2017.

* cited by examiner

SURFACE CLEANING APPARATUS

CROSS REFERENCE TO RELATED APPLICATIONS

This application is a continuation of co-pending U.S. patent application Ser. No. 14/822,211, filed Aug. 10, 2015, which claimed priority from U.S. Provisional Patent Application No. 62/093,189, filed Dec. 17, 2014 entitled SURFACE CLEANING APPARATUS, the entirety of which is hereby incorporated by reference.

FIELD

This disclosure relates to the field of surface cleaning apparatus. In some aspects, this disclosure relates to a type of stick vacuum cleaner wherein a hand vacuum cleaner is removably mounted to a drive handle and provides motive power to draw dirty air into the surface cleaning head.

INTRODUCTION

Various types of surface cleaning apparatus are known. These include upright vacuum cleaner, stick vacuum cleaners, hand vacuum cleaners and canister vacuum cleaners. Stick vacuum cleaners and hand vacuum cleaners are popular as they tend to be smaller and may be used to clean a small area or when a spill has to be cleaned up. Hand vacuum cleaners or handvacs are advantageous as they are lightweight and permit above floor cleaning and cleaning in hard to reach locations. However, they have a limited dirt collection capacity. Upright vacuum cleaners enable a user to clean a floor and may be have a pod that is removably attached for above floor cleaning. In such cases, the pod comprises, e.g., a cyclone, a dirt collection chamber and the suction motor for the upright vacuum cleaner. However, such the pods tend to be bulky since they comprise the total dirt collection capacity for the upright vacuum cleaner.

SUMMARY

In accordance with one aspect of this disclosure, a stick vacuum cleaner is provided which has a removable hand vacuum cleaner and also a supplemental bin which may function as a main dirt collection bin when the hand vacuum cleaner forms part of the stick vacuum cleaners. An advantage of this design is that the supplemental bin may provide enhanced dirt collection capacity for the stick vacuum cleaner. The supplemental bin may be removable so as to reduce the size of the stick vacuum cleaner when a smaller sized stick vacuum cleaner is desired, e.g., for cleaning in small or confined spaces.

In accordance with this aspect, there is provided a multimode surface cleaning apparatus comprising:

(a) a surface cleaning head having a dirty air inlet;

(b) an upright section moveably mounted to the surface cleaning head, the upright section moveable between a plurality of reclined floor cleaning positions;

(c) a hand vacuum cleaner removably mounted to the upright section, the hand vacuum cleaner comprising a cyclone chamber, a dirt collection region, a suction motor and a clean air outlet; and, (d) an auxiliary dirt collection assembly removably mounted to the upright section wherein, in a first upright mode of operation, the auxiliary dirt collection assembly is removed from the upright section and the hand vacuum cleaner is in airflow communication with the dirty air inlet and, in a second upright mode of operation, the multimode surface cleaning apparatus is operable with the auxiliary dirt collection assembly mounted to the upright section.

In some embodiments, the auxiliary dirt collection assembly may comprise a dirt collection chamber and when the auxiliary dirt collection assembly is mounted to the upright section, dirt separated in the cyclone chamber is collectable in the dirt collection chamber of the auxiliary dirt collection assembly.

In some embodiments, when the auxiliary dirt collection assembly may be mounted to the upright section, the dirt collection chamber of the auxiliary dirt collection assembly is selectively connectable in communication with the dirt collection region of the hand vacuum cleaner.

In some embodiments, in the second upright mode of operation, the dirt collection region of the hand vacuum cleaner may be positioned above the dirt collection chamber of the auxiliary dirt collection assembly.

In some embodiments, the cyclone chamber may have a dirt outlet and the dirt collection region comprises a dirt collection chamber of the hand vacuum cleaner.

In some embodiments, the dirt collection chamber may have a manually openenable dumping door and the dirt collection chamber of the auxiliary dirt collection assembly may be in communication with the dirt collection chamber of the hand vacuum cleaner when the dumping door is opened.

In some embodiments, when the auxiliary dirt collection assembly is mounted to the upright section, the dirt collection chamber of the auxiliary dirt collection assembly may be automatically connected in communication with a dirt outlet of the cyclone chamber.

In some embodiments, in the second upright mode of operation, the dirt collection region of the hand vacuum cleaner may be positioned above the dirt collection chamber of the auxiliary dirt collection assembly.

In some embodiments, the dirt collection region of the hand vacuum cleaner may be in communication with the dirt outlet of the cyclone chamber and the dirt collection region may have a dumping door that is automatically opened when the auxiliary dirt collection assembly is mounted to the upright section and the dirt collection chamber of the auxiliary dirt collection assembly is in communication with the dirt collection region of the hand vacuum cleaner when the dumping door is opened.

In some embodiments, the auxiliary dirt collection assembly may comprise a cyclone chamber and a dirt collection region.

In some embodiments, in the second upright mode of operation, the cyclone chamber of the auxiliary dirt collection assembly may be connected in series with the cyclone chamber of the hand vacuum cleaner.

In some embodiments, in the second upright mode of operation, the cyclone chamber of the auxiliary dirt collection assembly may be connected in parallel with the cyclone chamber of the hand vacuum cleaner.

In some embodiments, in the second upright mode of operation, the cyclone chamber of the hand vacuum cleaner may be bypassed and air exiting the cyclone chamber of the auxiliary dirt collection assembly passes through a pre-motor filter of the hand vacuum cleaner, the suction motor and exits via the clean air outlet of the hand vacuum cleaner.

In some embodiments, the auxiliary dirt collection assembly may further comprise a pre-motor filter.

In some embodiments, in the second upright mode of operation, the cyclone chamber of the auxiliary dirt collection assembly may be connected in parallel with the cyclone chamber of the hand vacuum cleaner.

In some embodiments, in the second upright mode of operation, the cyclone chamber of the hand vacuum cleaner and a pre-motor filter of the hand vacuum cleaner may be bypassed and air exiting the cyclone chamber of the auxiliary dirt collection assembly may pass through the pre-motor filter of the auxiliary dirt collection assembly, the suction motor and exits via the clean air outlet of the hand vacuum cleaner.

In some embodiments, the auxiliary dirt collection assembly may further comprise an auxiliary dirt collection assembly suction motor.

In some embodiments, in the second upright mode of operation, at least a portion of air entering the dirty air inlet may bypass the hand vacuum cleaner and exit via an alternate clean air outlet.

In some embodiments, the alternate clean air outlet may be provided on the auxiliary dirt collection assembly.

In some embodiments, the hand vacuum cleaner may have a handle and, when the multimode surface cleaning apparatus is in the first and second upright modes of operation, the handle may be a drive handle of the multimode surface cleaning apparatus.

In some embodiments, the upright section may comprise an up flow duct and the auxiliary dirt collection assembly may be removably mounted to the up flow duct.

In some embodiments, the up flow duct may comprise a rigid extension cleaning wand and the rigid extension cleaning wand may be removable from one of the upright section and the surface cleaning head and, in a first above floor mode of operation, an above floor cleaning unit may comprise the hand vacuum cleaner and the rigid extension cleaning wand.

In some embodiments, the up flow duct may comprise a rigid tube, the hand vacuum cleaner may have a handle and, the hand vacuum cleaner may have an air inlet that is drivingly engageable with the rigid tube whereby, when the multimode surface cleaning apparatus is in the first and second upright modes of operation, the handle may be a drive handle of the multimode surface cleaning apparatus.

In some embodiments, the auxiliary dirt collection assembly may have a longitudinal axis that is generally parallel to the up flow duct.

In some embodiments, the auxiliary dirt collection assembly may comprise a cyclone chamber having a longitudinal axis that is generally parallel to the up flow duct.

In some embodiments, the hand vacuum cleaner may be provided on a rear portion of the upright section and the auxiliary dirt collection assembly may be provided on a front portion of the upright section.

In some embodiments, the upright section may comprise an up flow duct and the auxiliary dirt collection assembly may be removably mounted to a front side of the up flow duct and a portion of the hand vacuum cleaner may be positioned rearward of the up flow duct.

In some embodiments, the suction motor may be positioned rearward of the up flow duct.

In some embodiments, the upright section may comprise a lower portion and an upper portion and the upper section may be moveable forwardly relative to the lower section and the auxiliary dirt collection assembly may be removably mounted to the lower section.

In some embodiments, the upright section may comprise an up flow duct having a lower portion and an upper portion and the upper section may be moveable forwardly relative to the lower section and the auxiliary dirt collection assembly may be removably mounted to the lower section.

In some embodiments, the up flow duct may comprise a rigid tube, the hand vacuum cleaner may have a handle and, the hand vacuum cleaner may have an air inlet that is drivingly engageable with the rigid tube whereby, when the multimode surface cleaning apparatus is in the first and second upright modes of operation, the handle may be a drive handle of the multimode surface cleaning apparatus.

DRAWINGS

Figure 1:
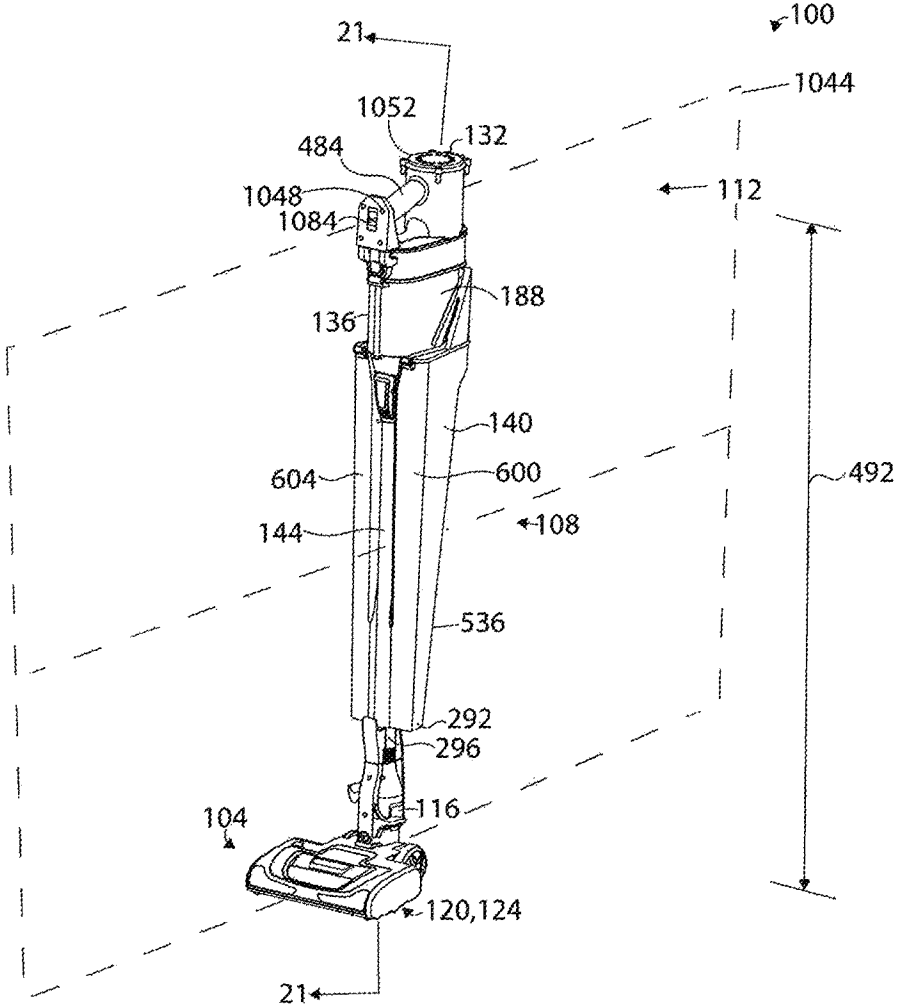
FIG. 1 is a front perspective view of a surface cleaning apparatus in accordance with at least one embodiment.
Figure 5:
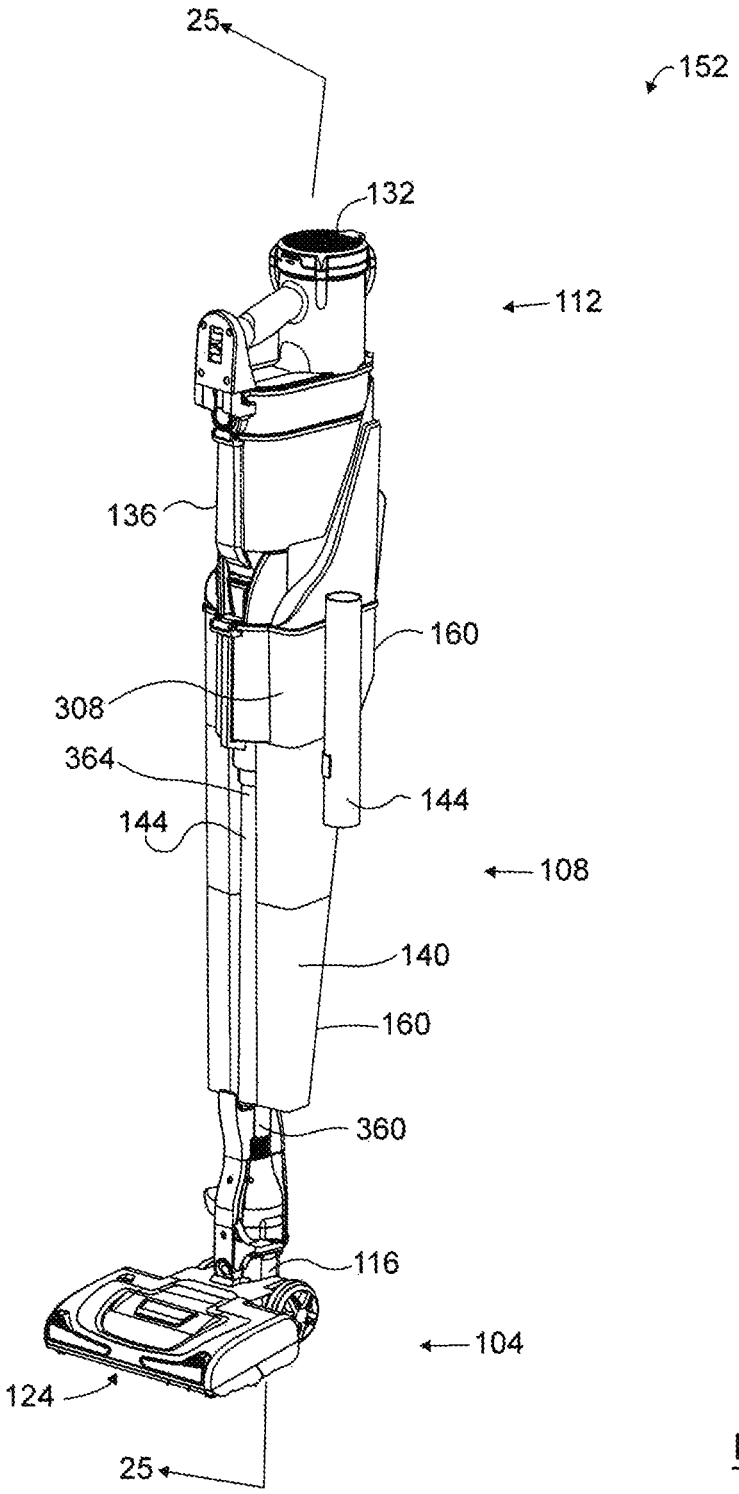
FIG. 5 is a front perspective view of a surface cleaning apparatus in accordance with another embodiment.
Figure 6:
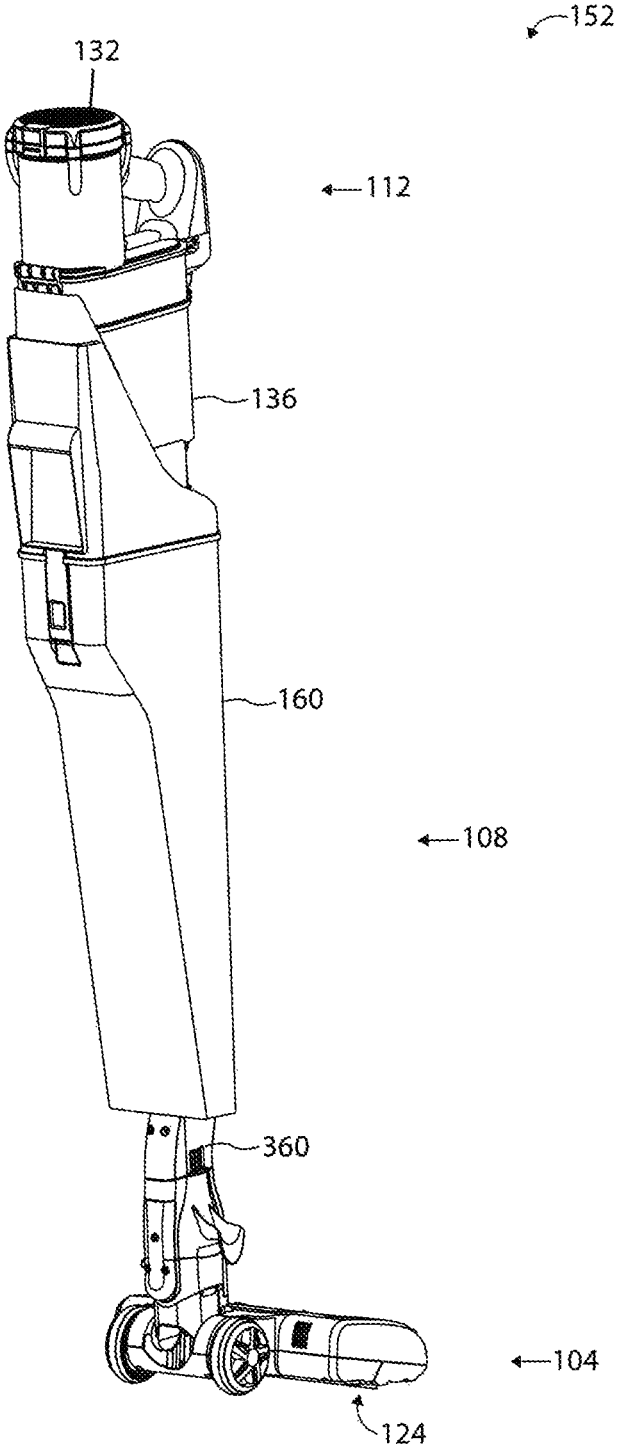
FIG. 6 is a rear perspective view of the apparatus of FIG. 5.
Figure 12:
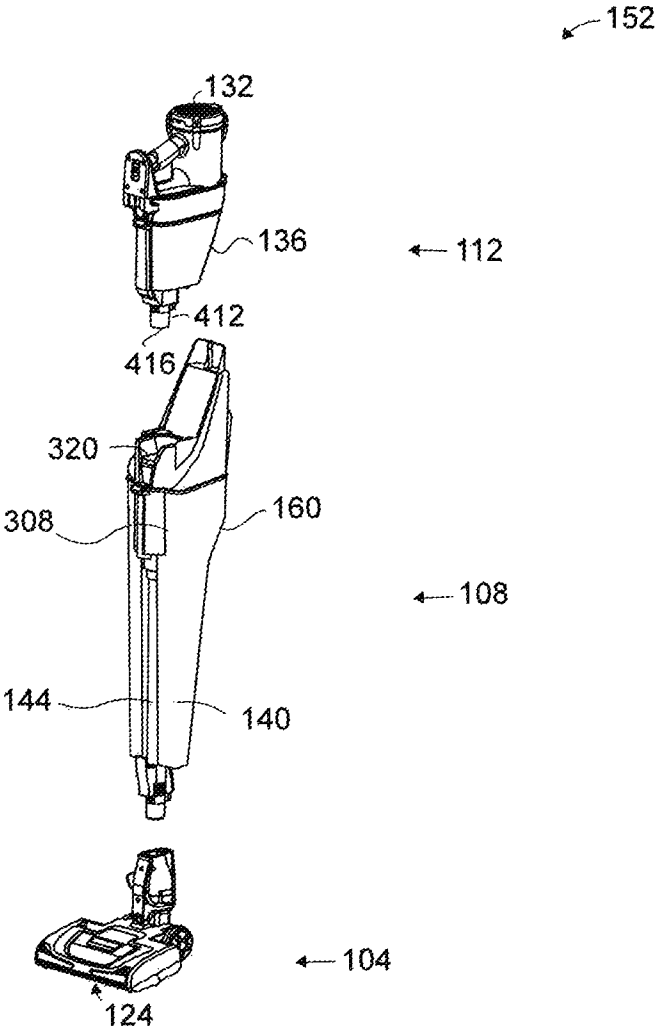
FIG. 12 is an exploded front perspective view of the apparatus of FIG. 5.
Figure 12A:
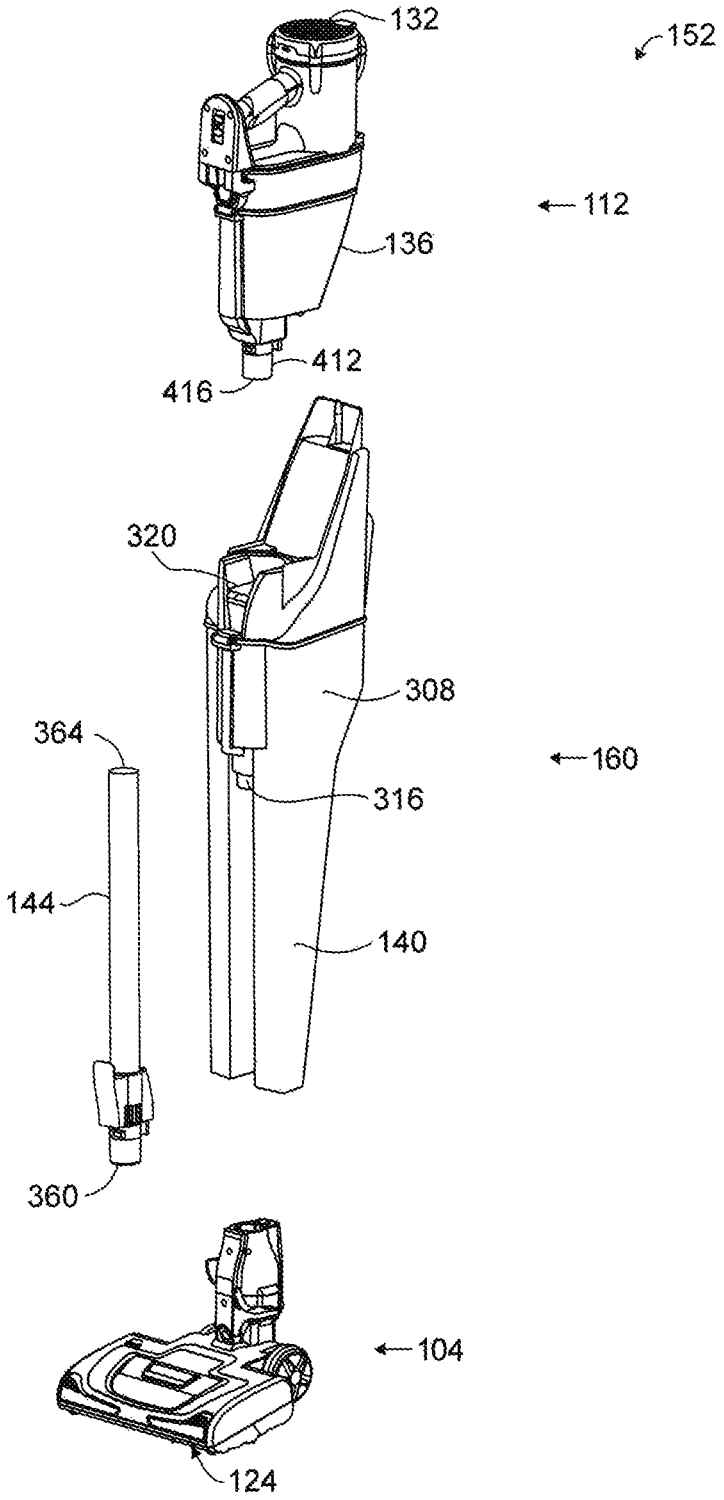
Figure 13:
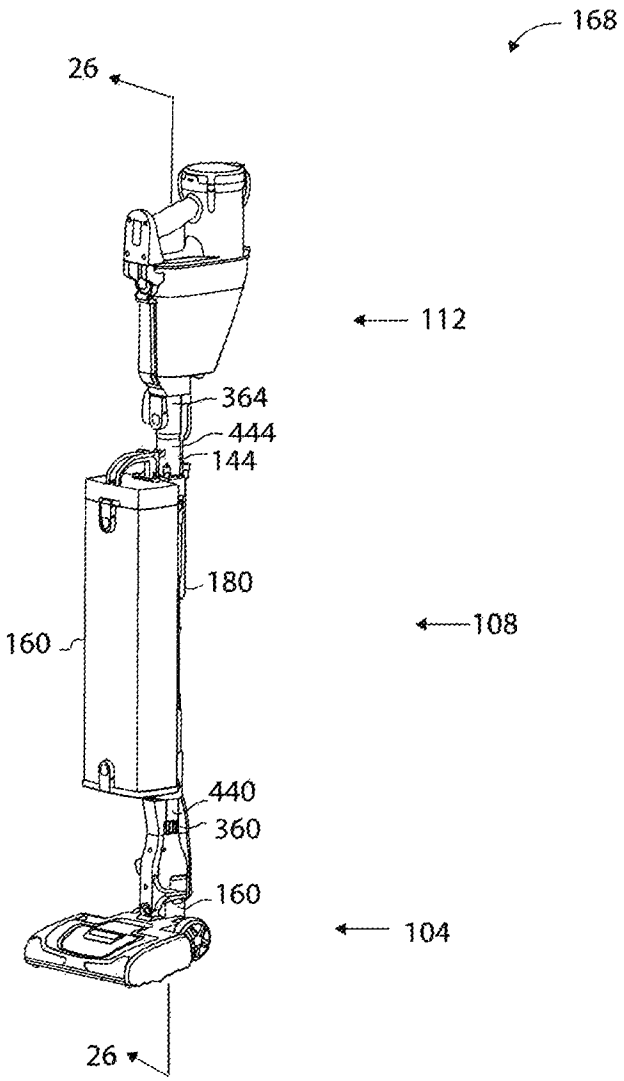
Figure 14:
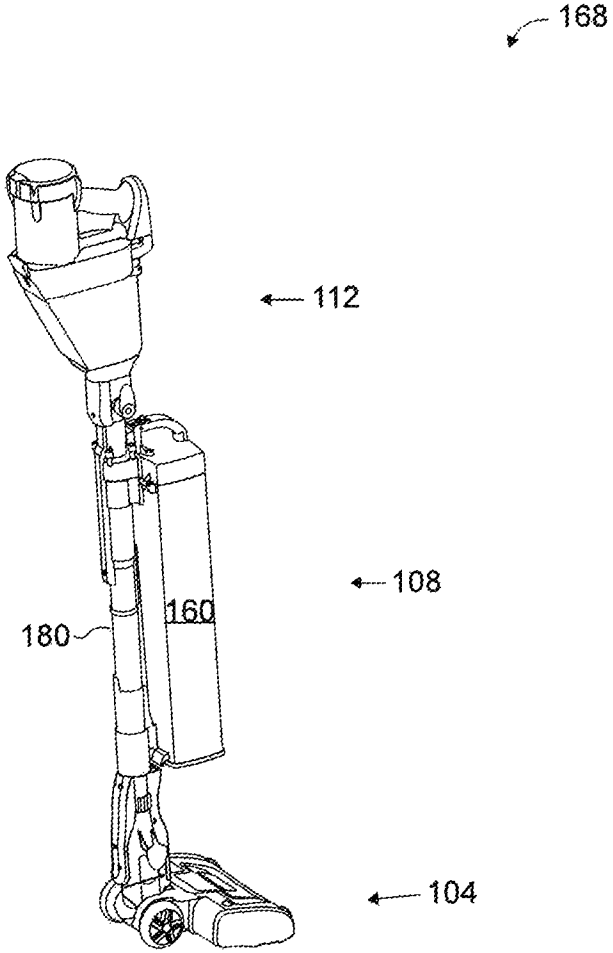
Figure 15:
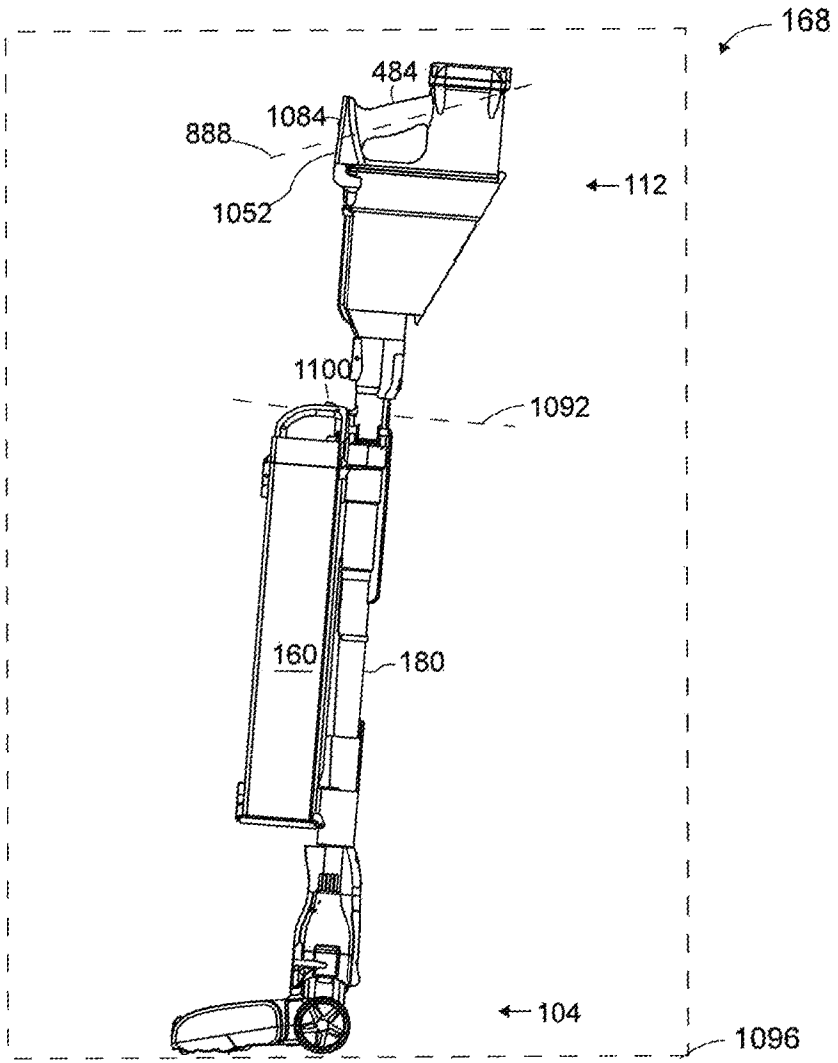
Figure 16:
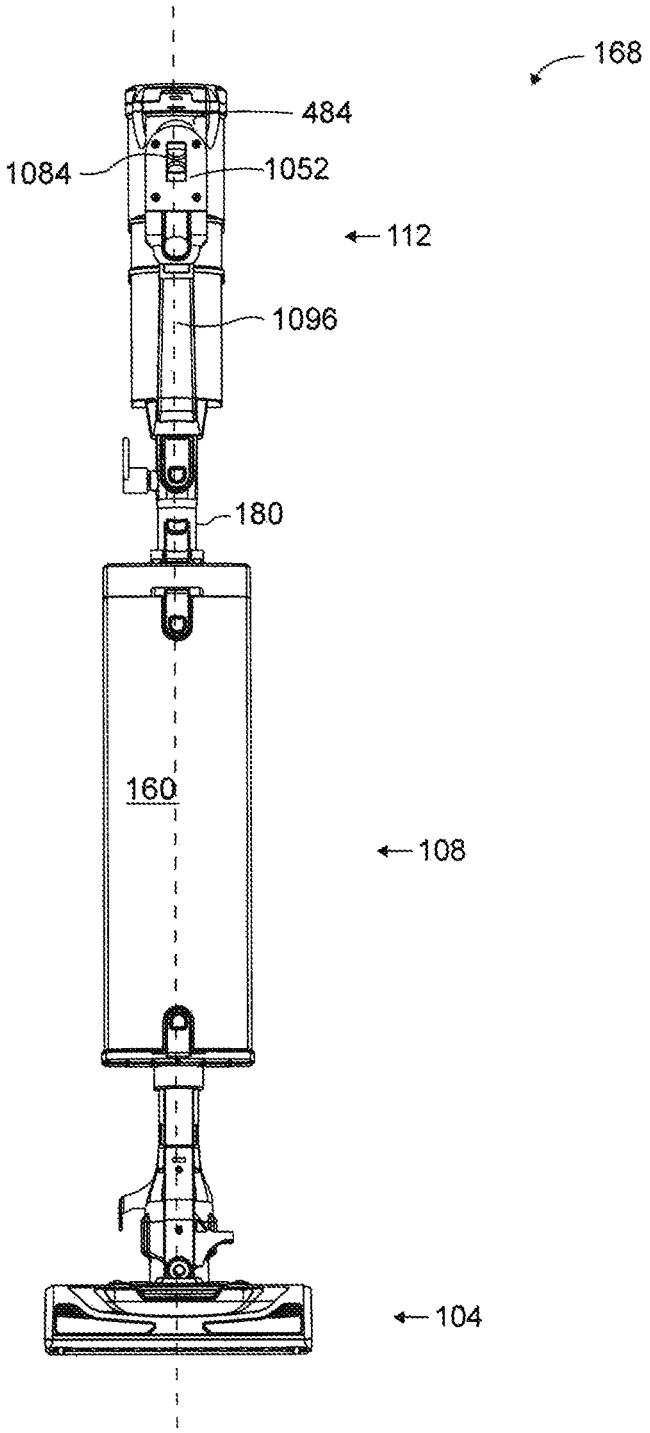
Figure 17:
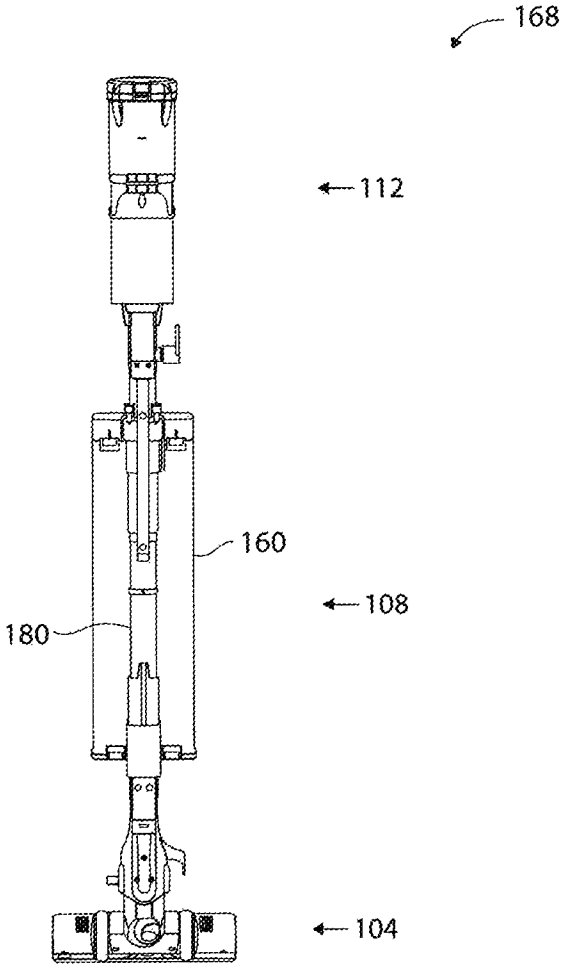
Figure 18:
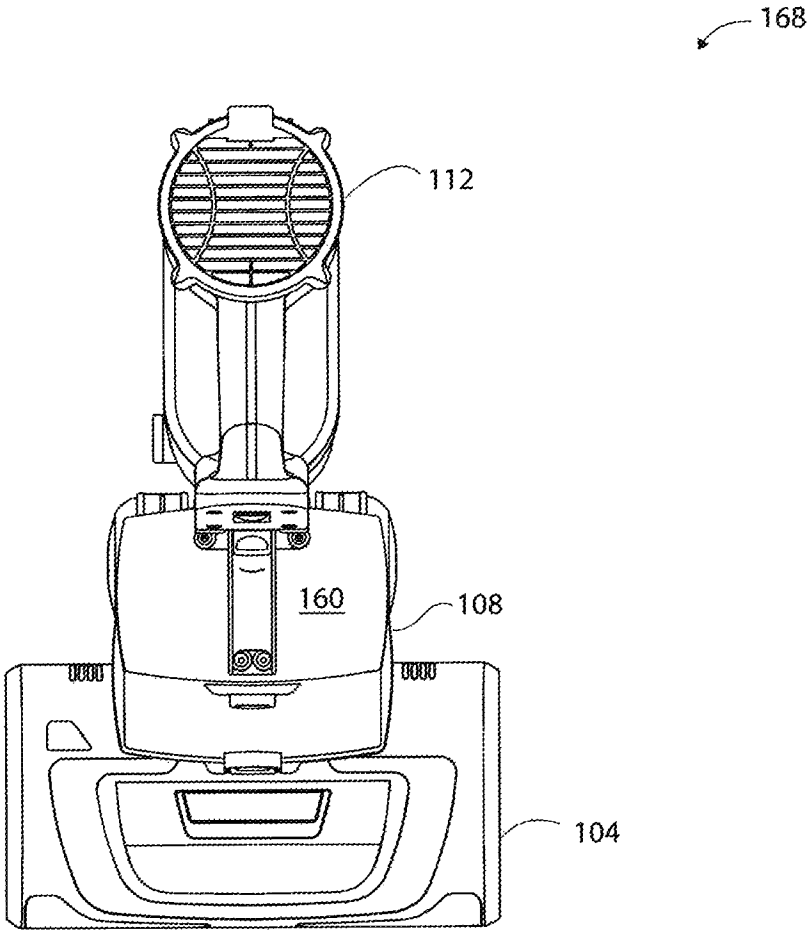
Figure 19:
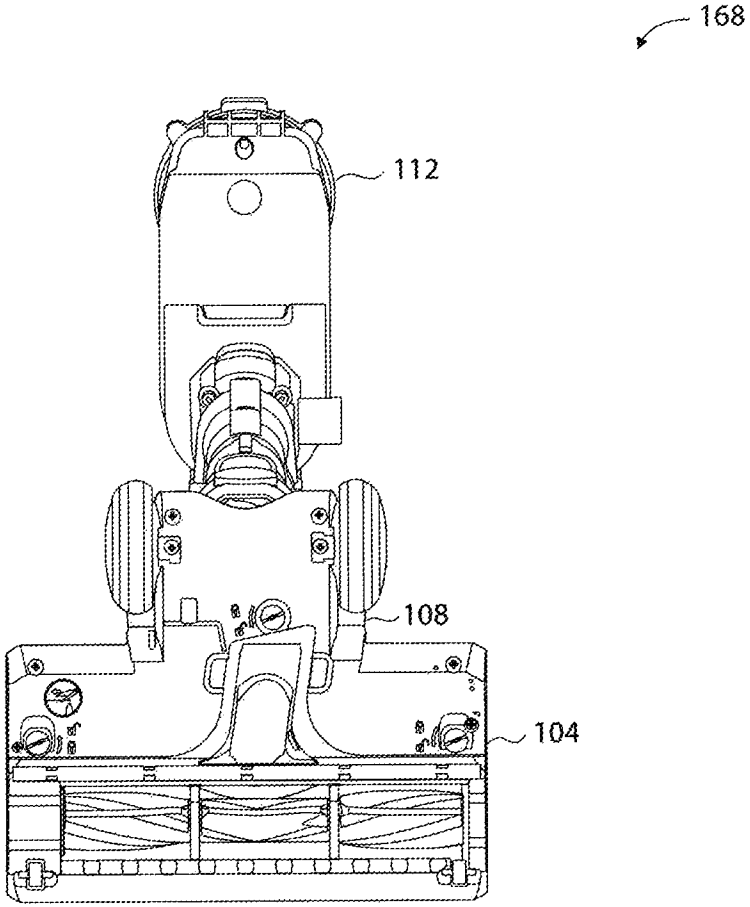
Figure 20:
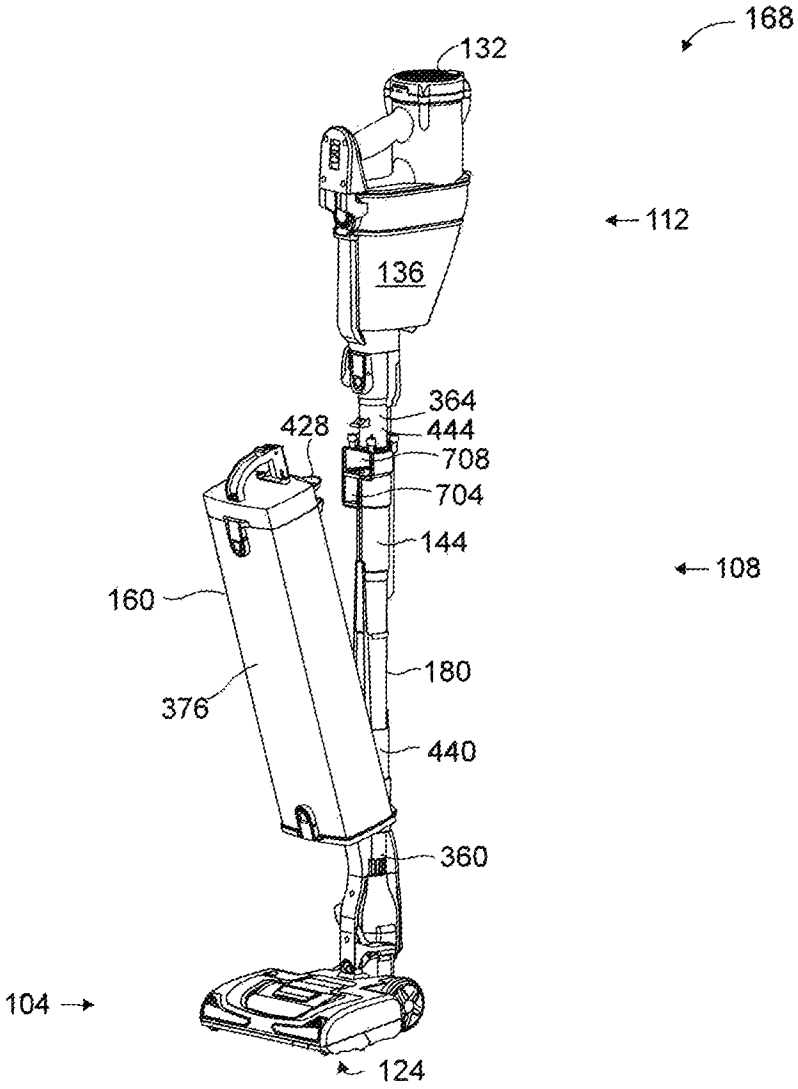
Figure 21:
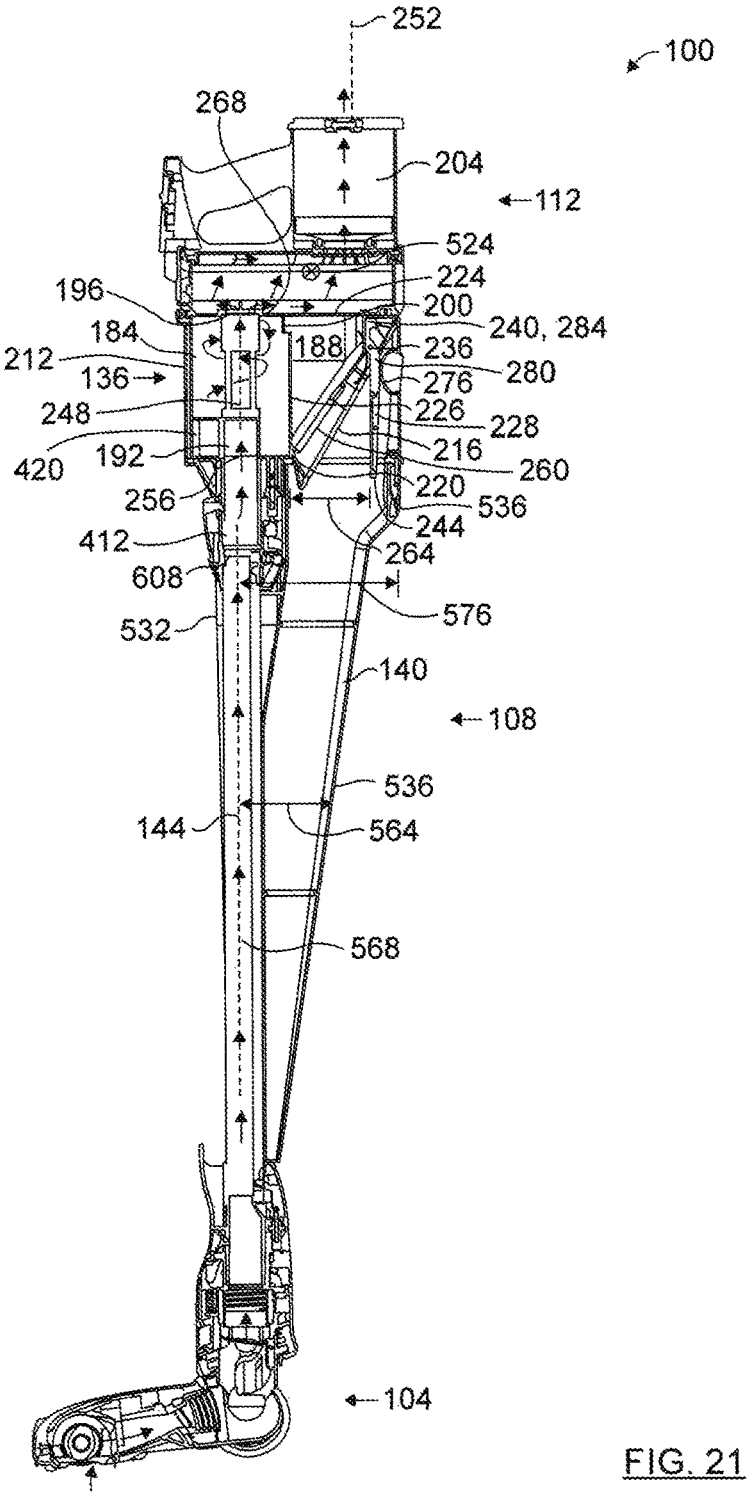
Figure 22:
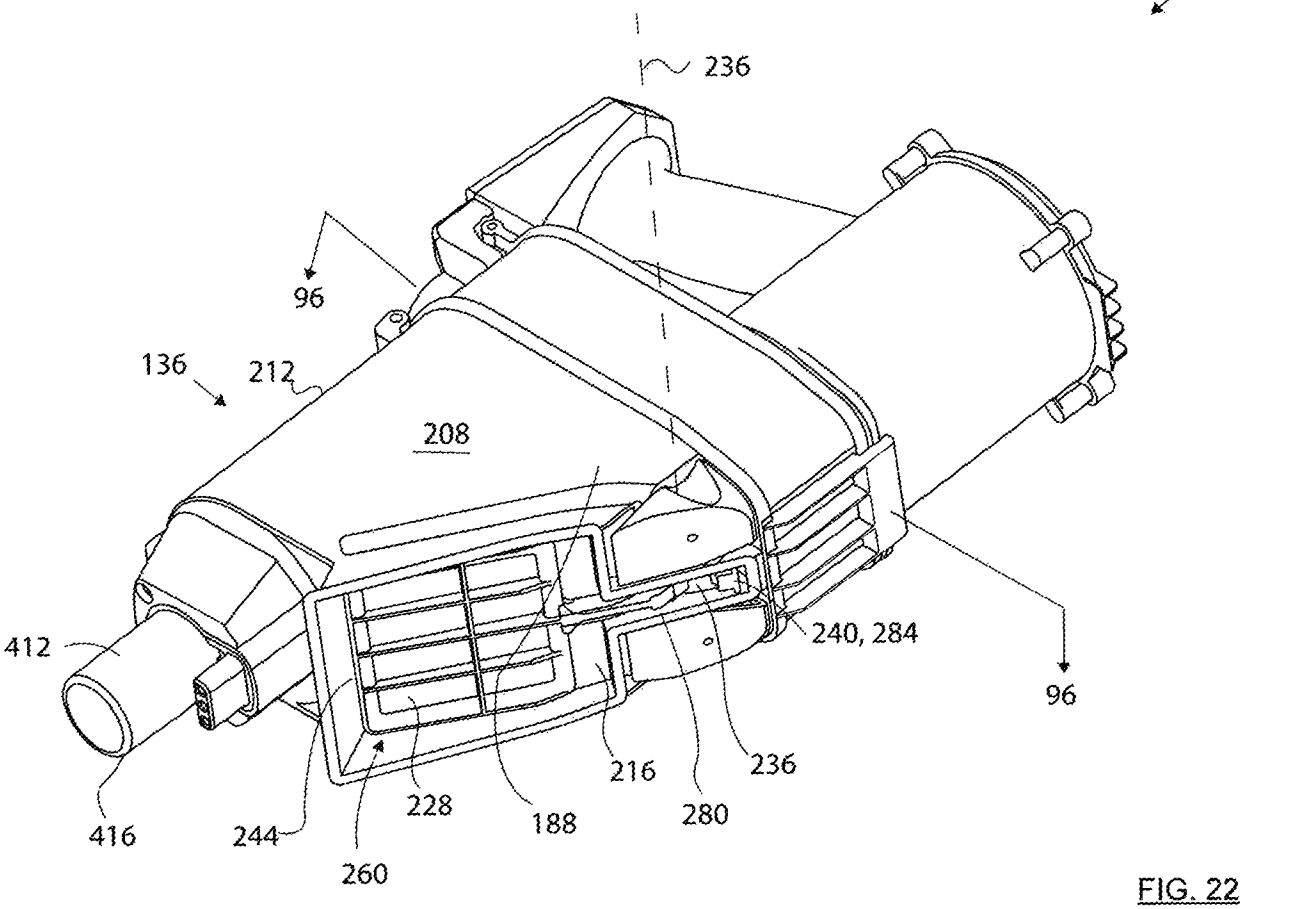
Figure 23:
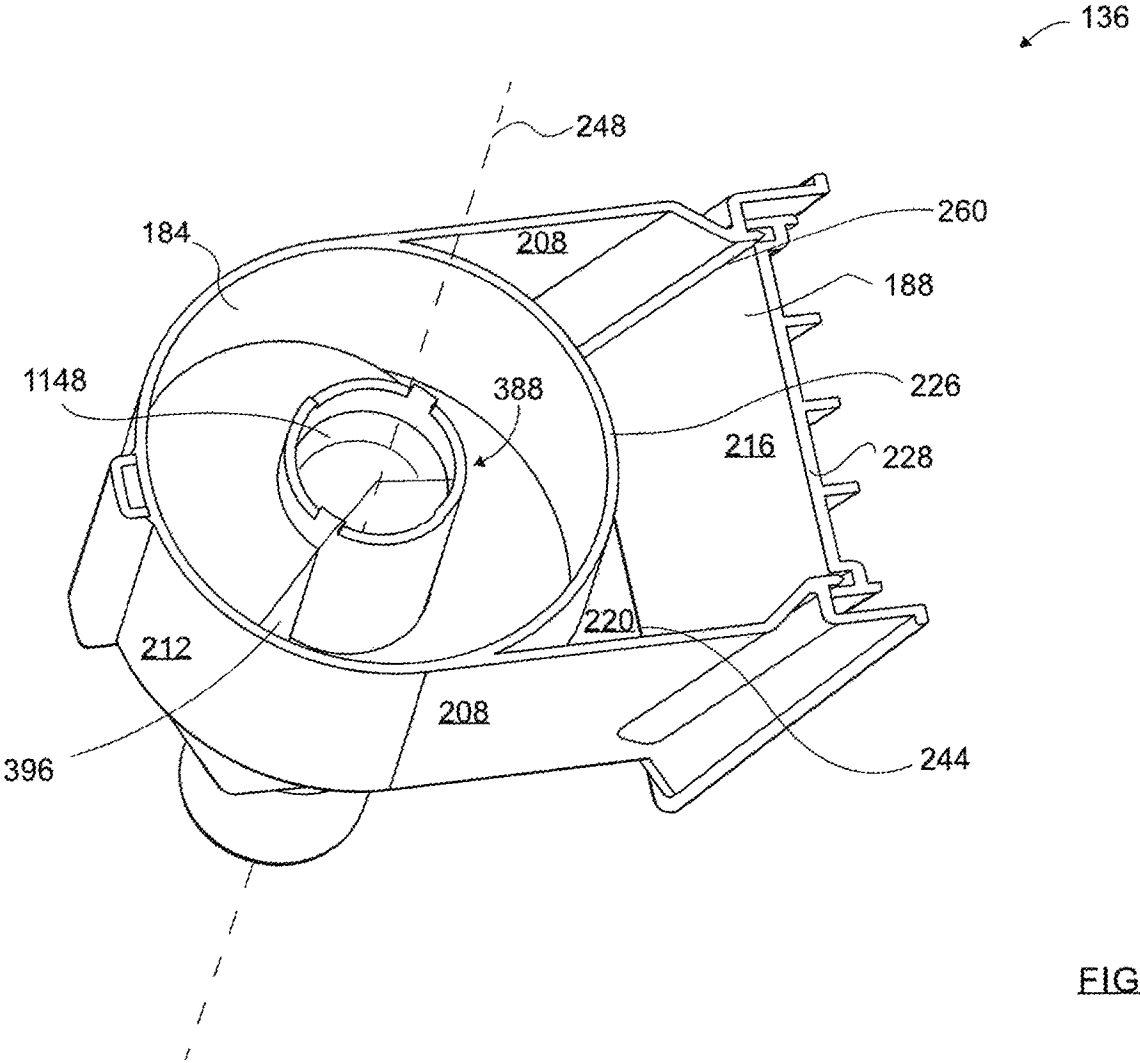
Figure 23A:
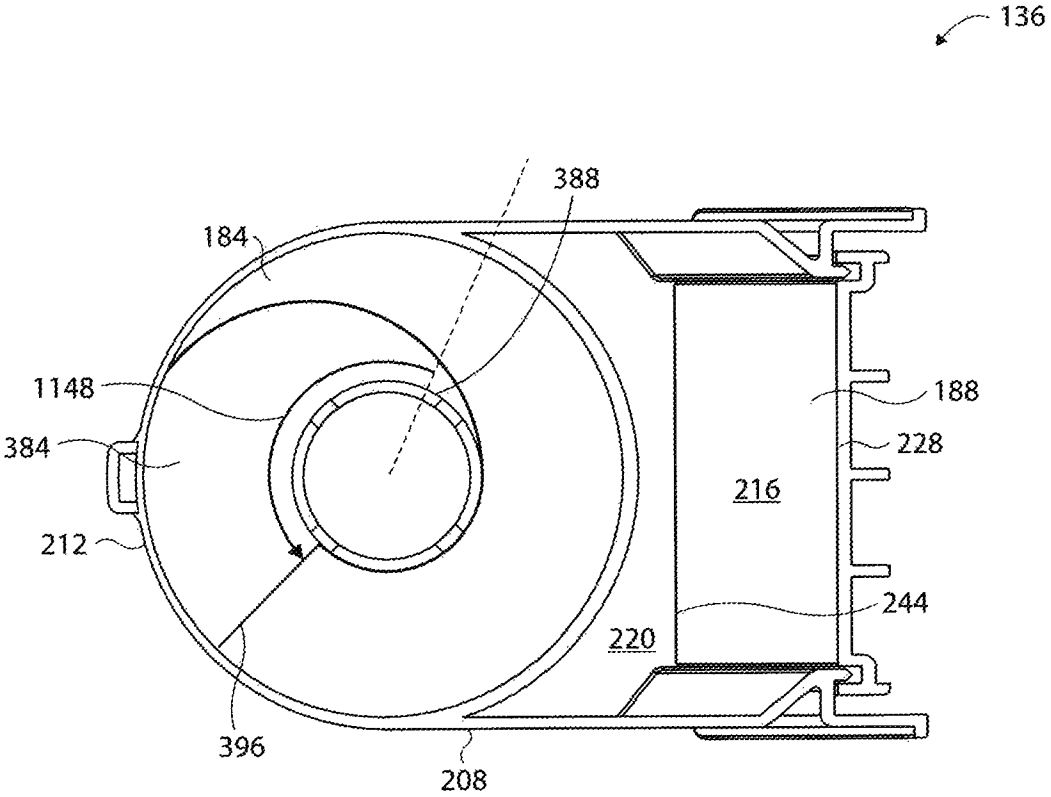
Figure 24:
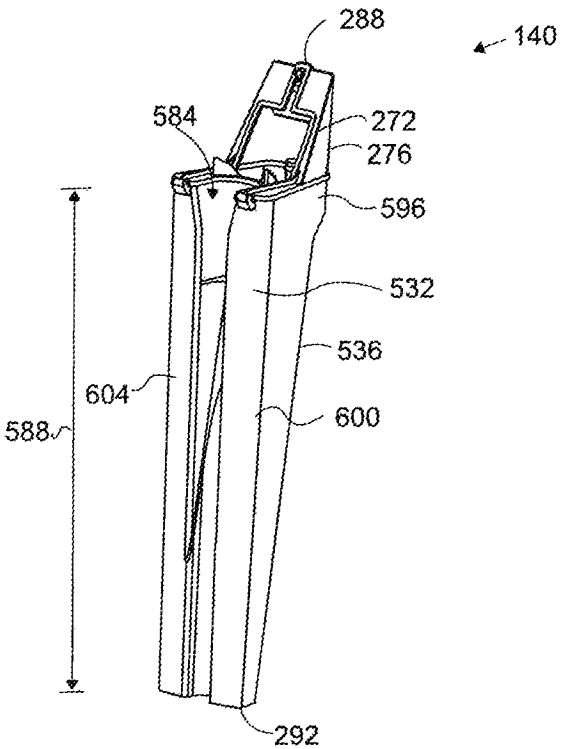
Figure 25:
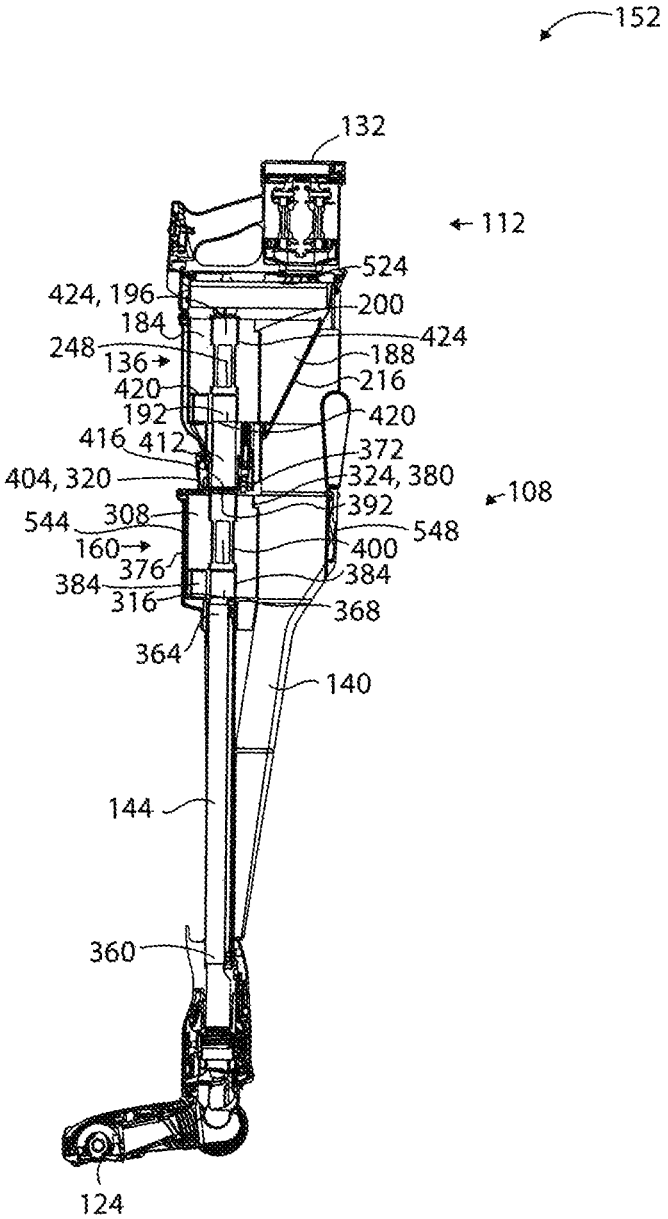
Figure 26:
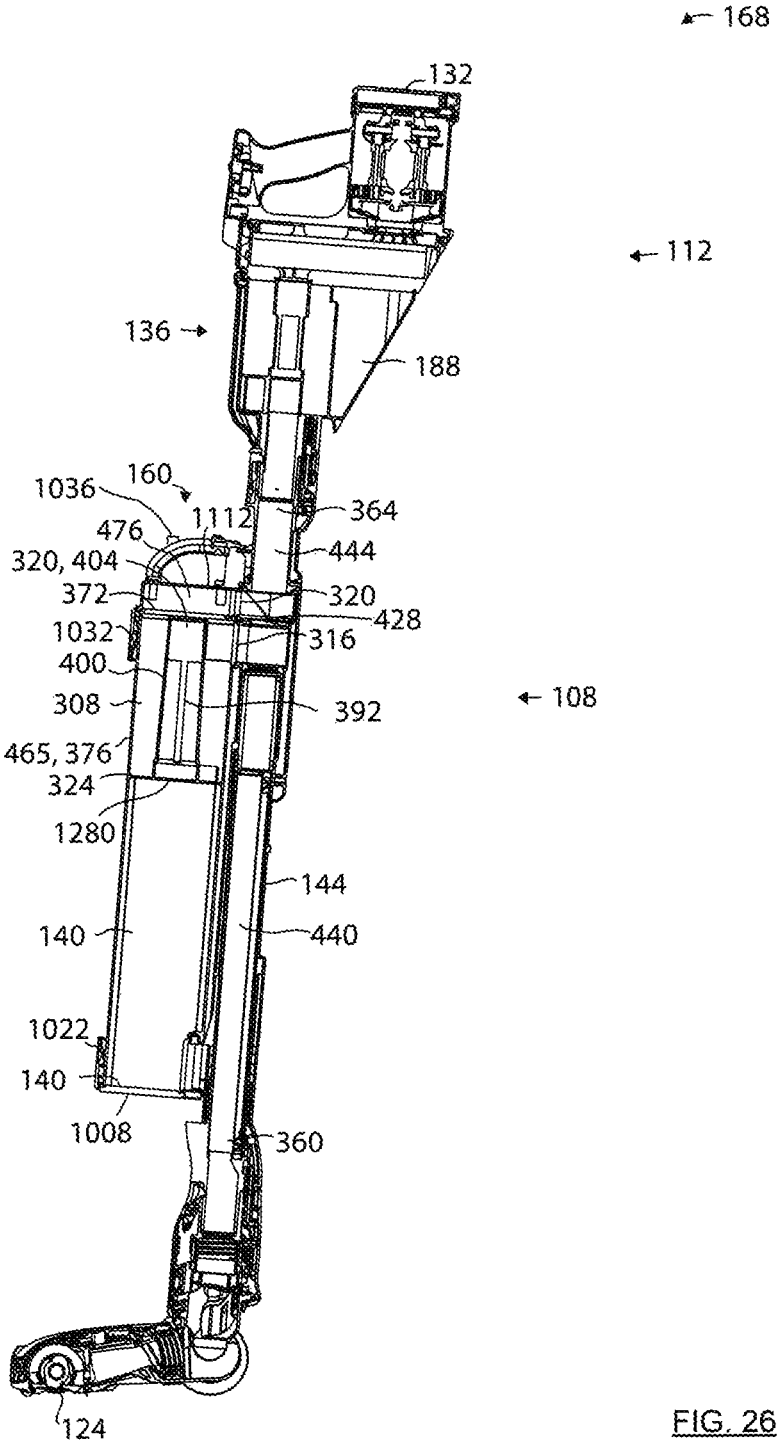
Figures 27, 28, 29:
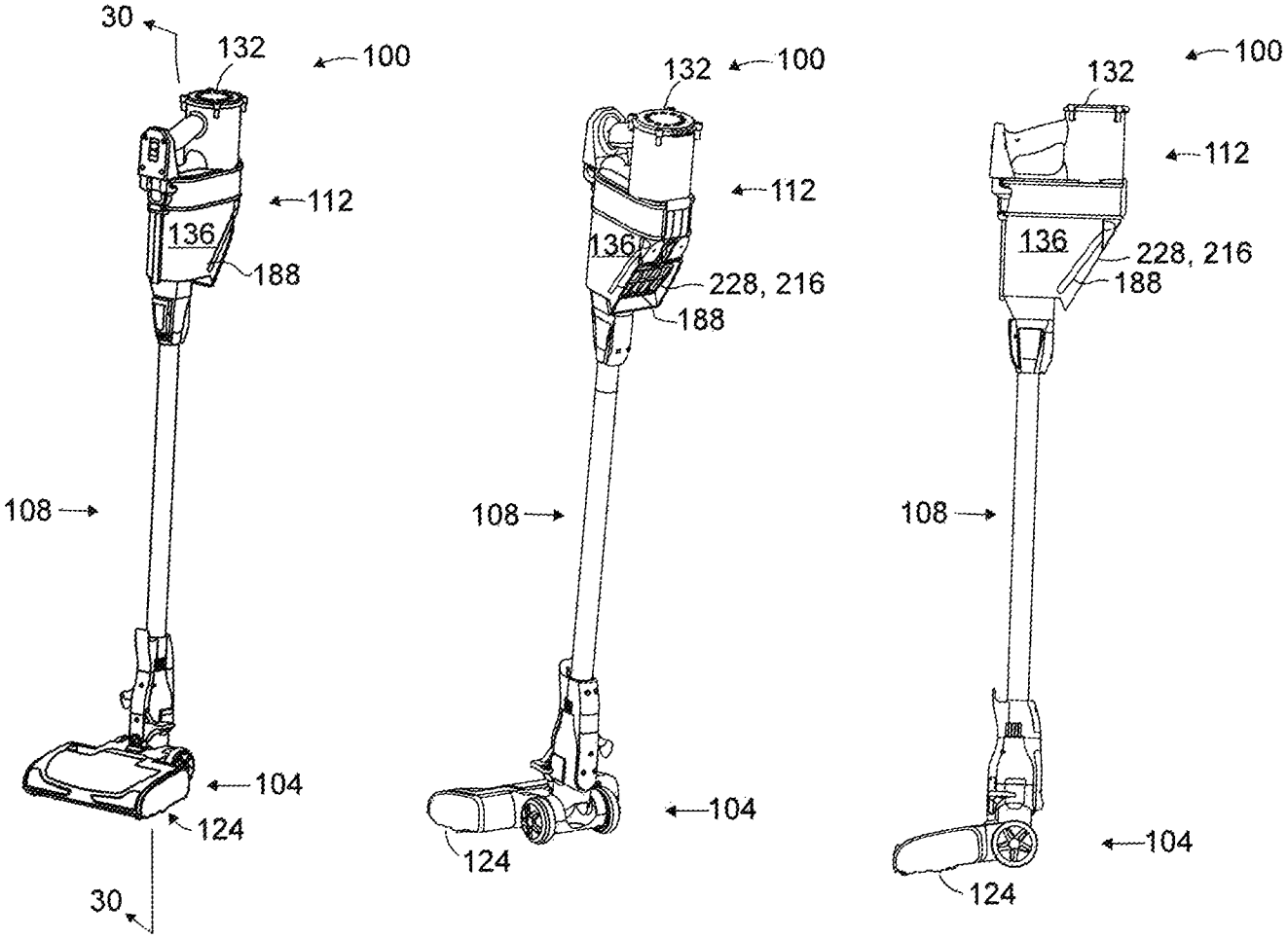
Figure 30:
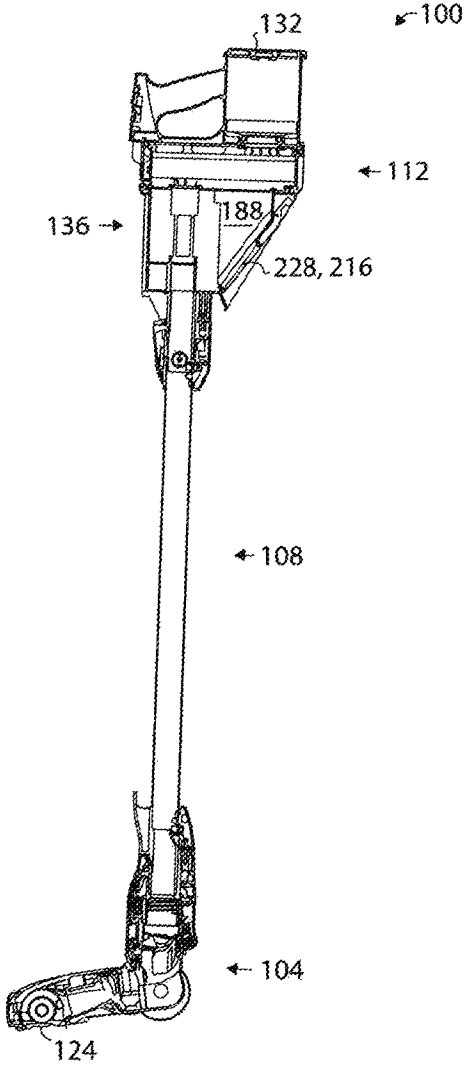
Figure 33:
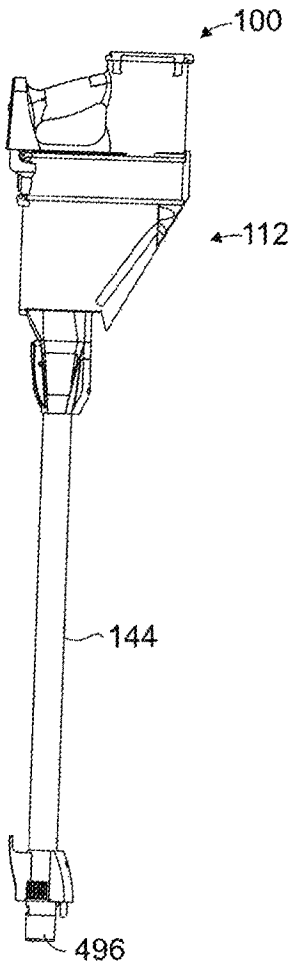
Figure 32:
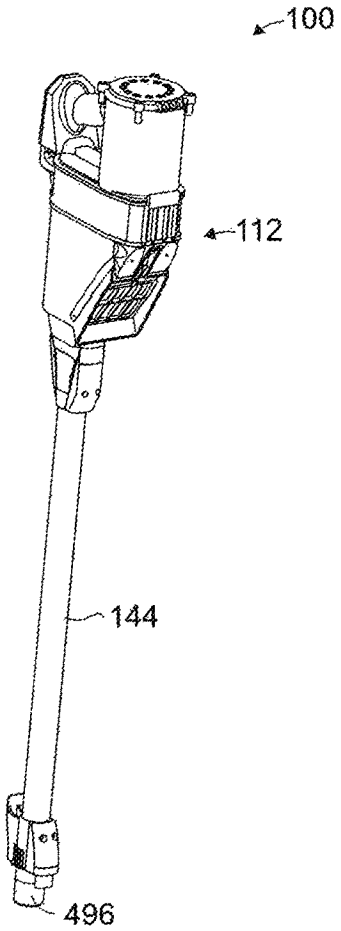
Figure 31:
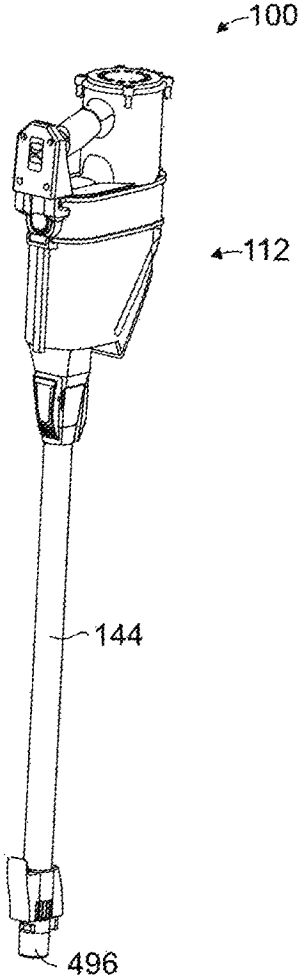
Figure 36:
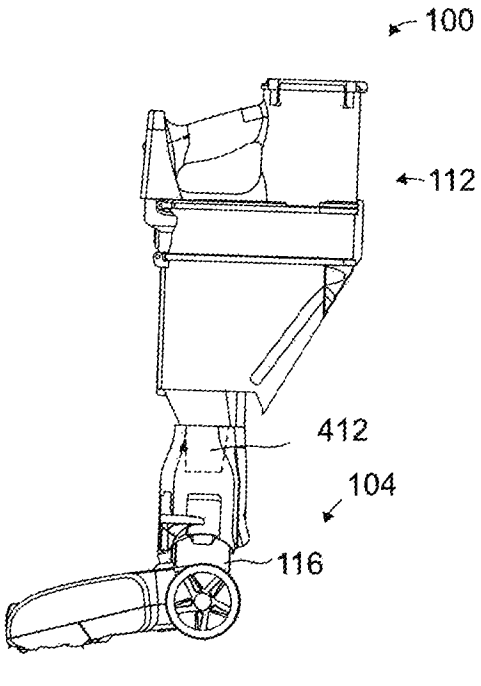
Figure 35:
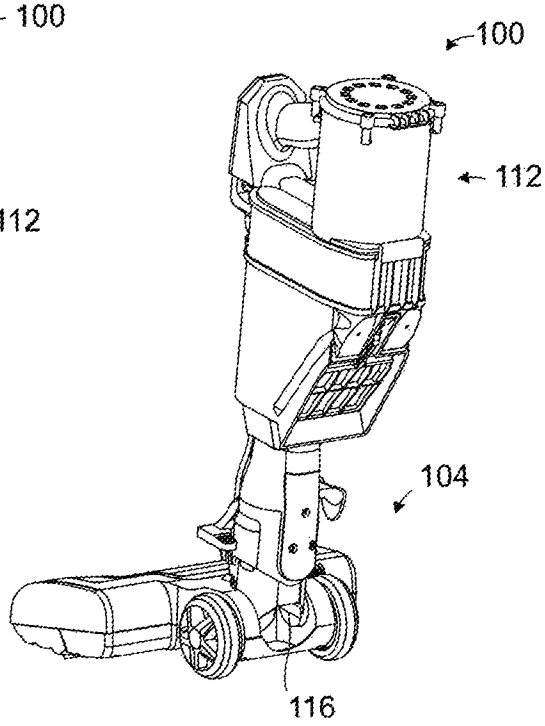
Figure 34:
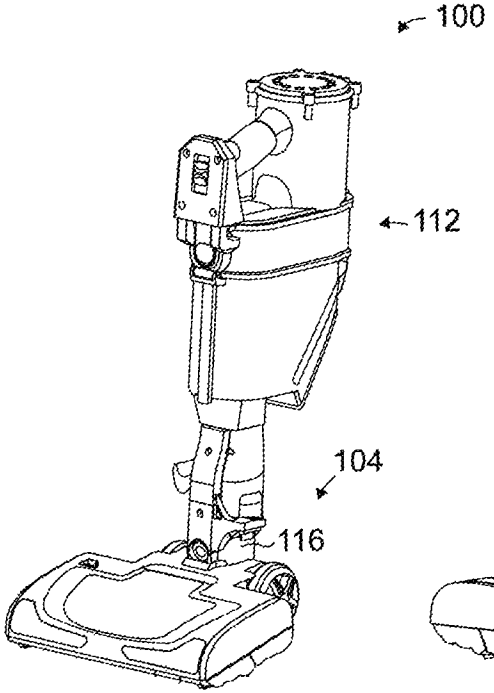
Figure 36A:
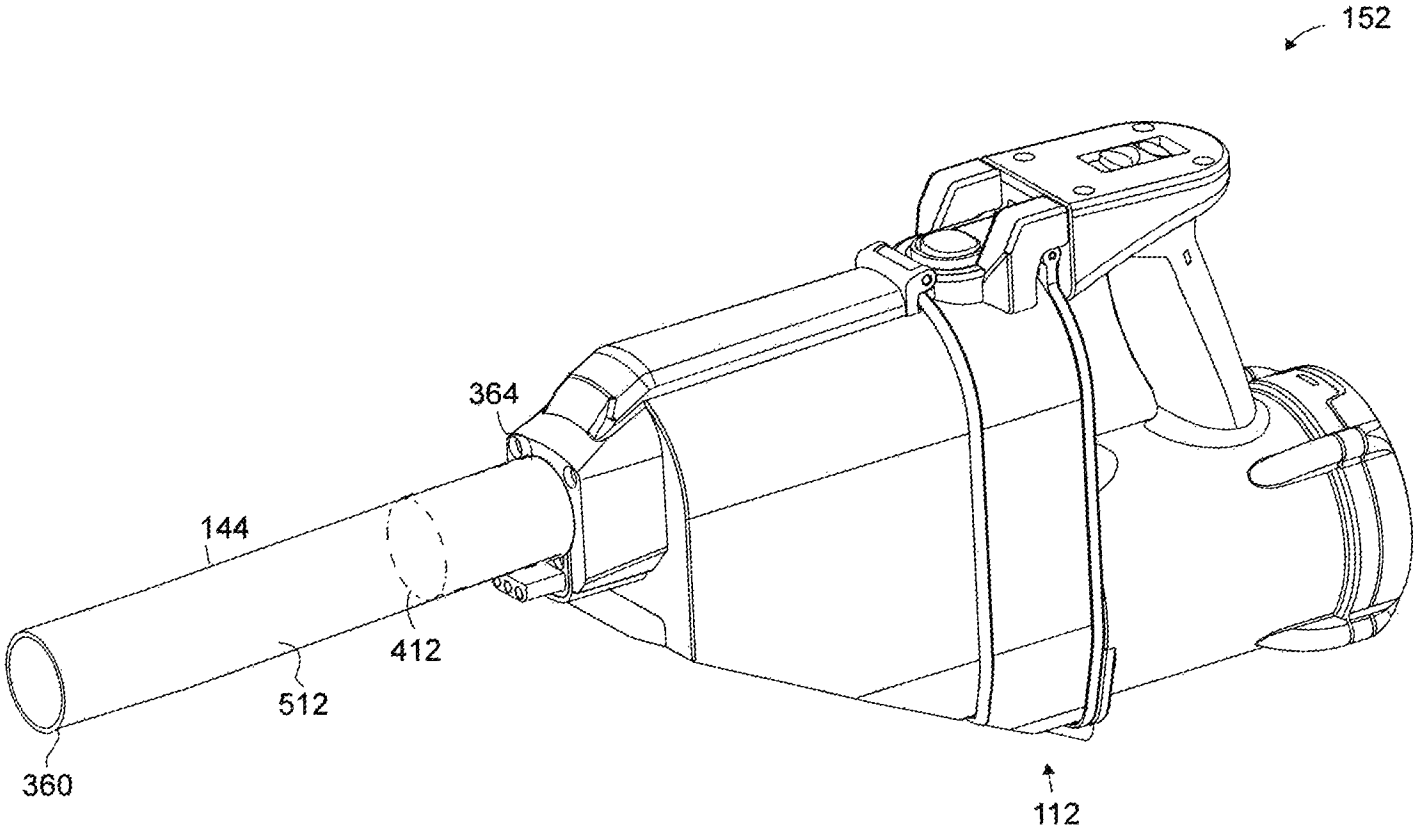
Figure 37:
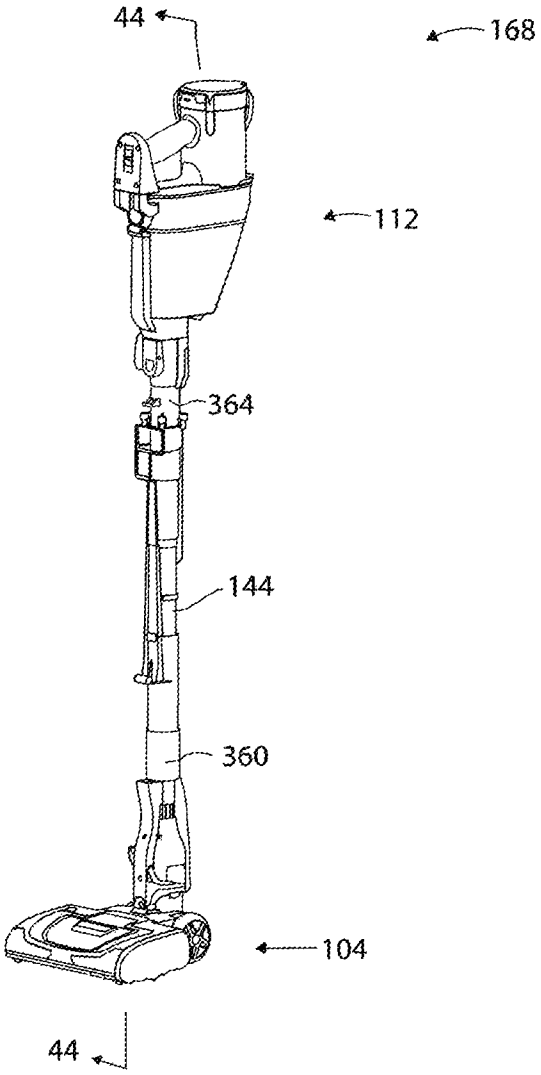
Figure 38:
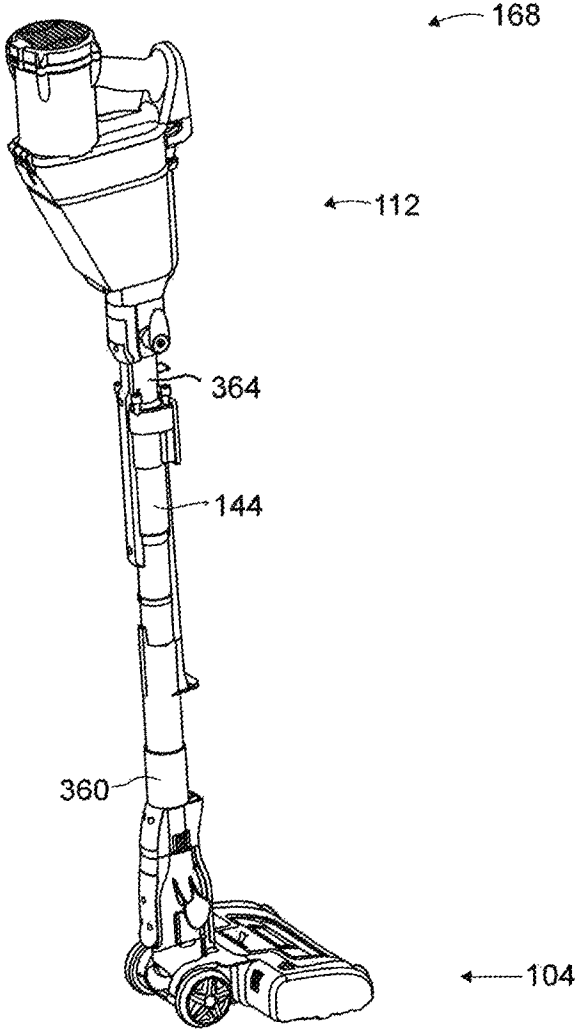
Figure 39:
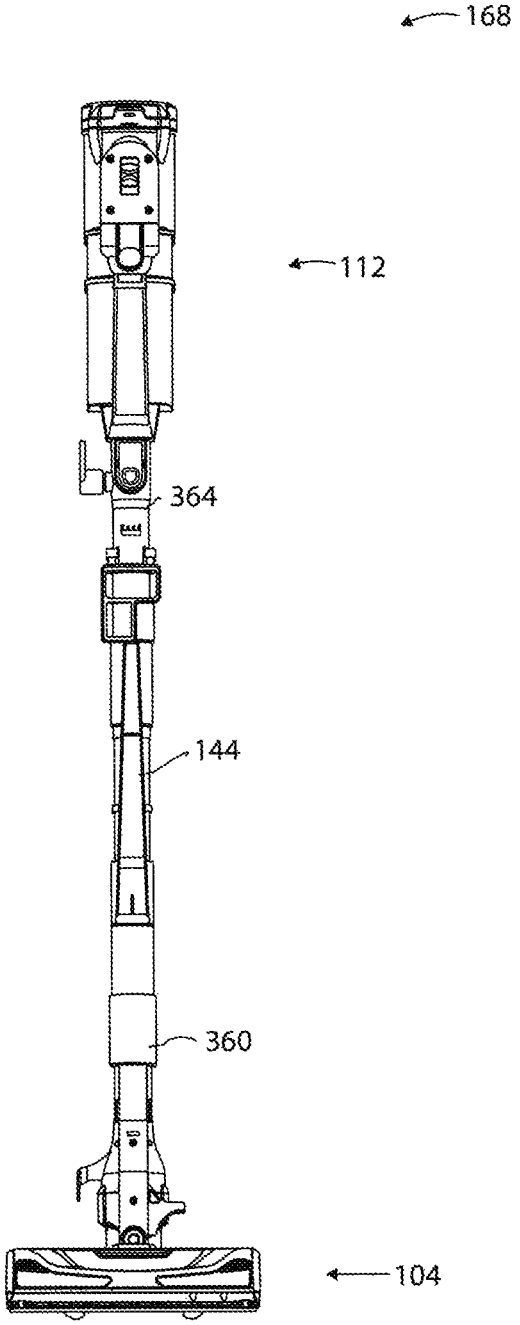
Figure 40:
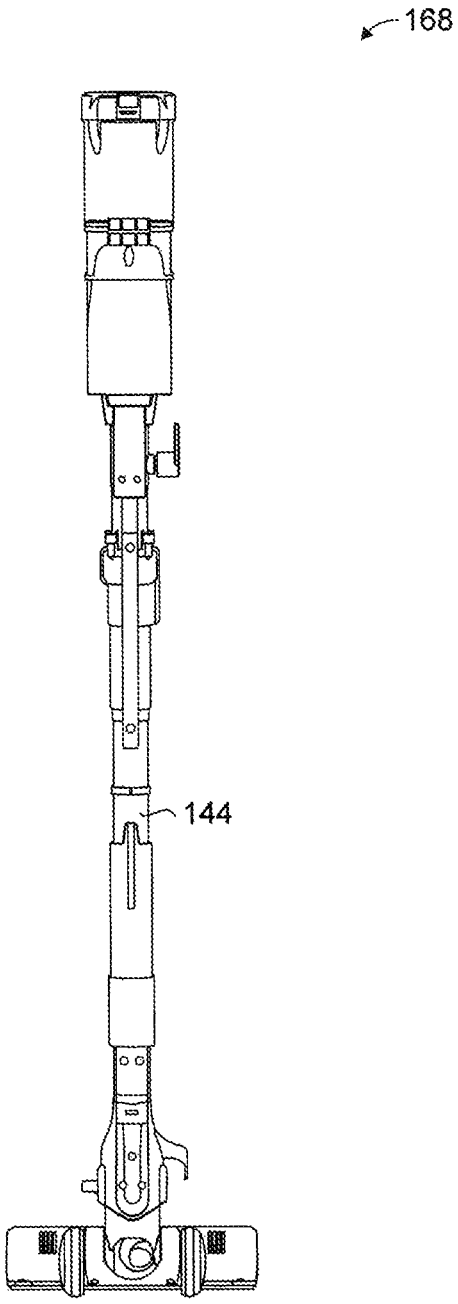
Figure 41:
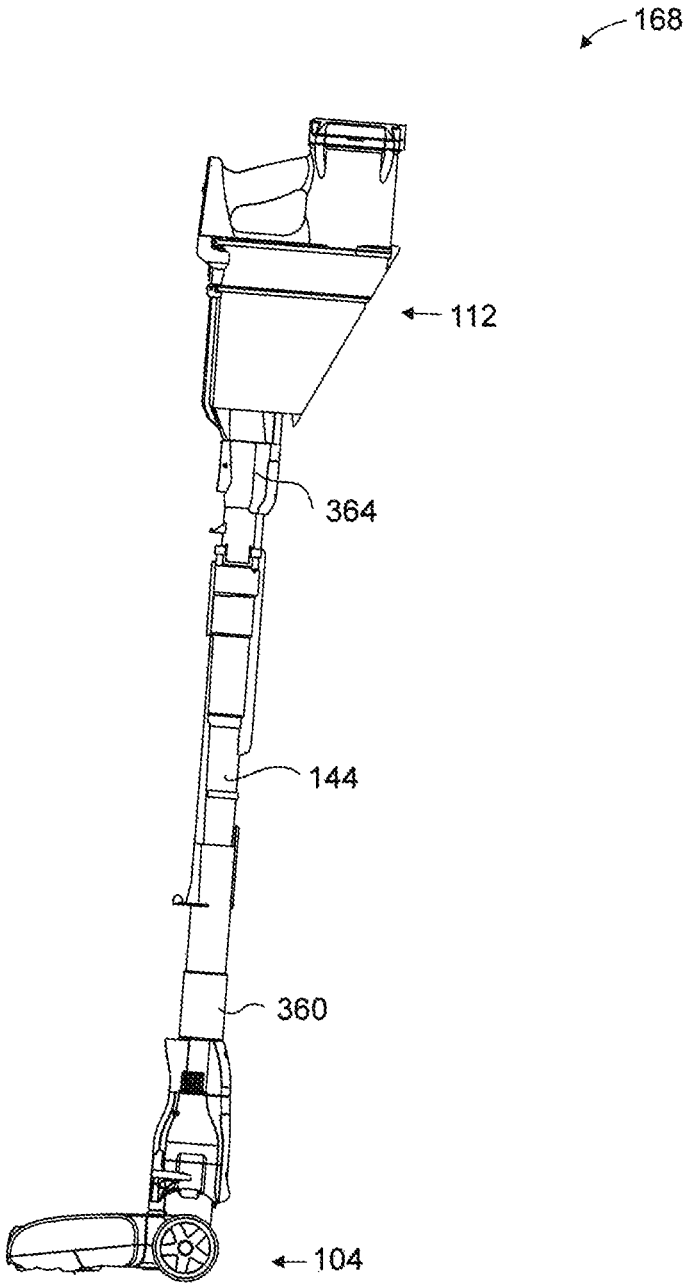
Figure 42:
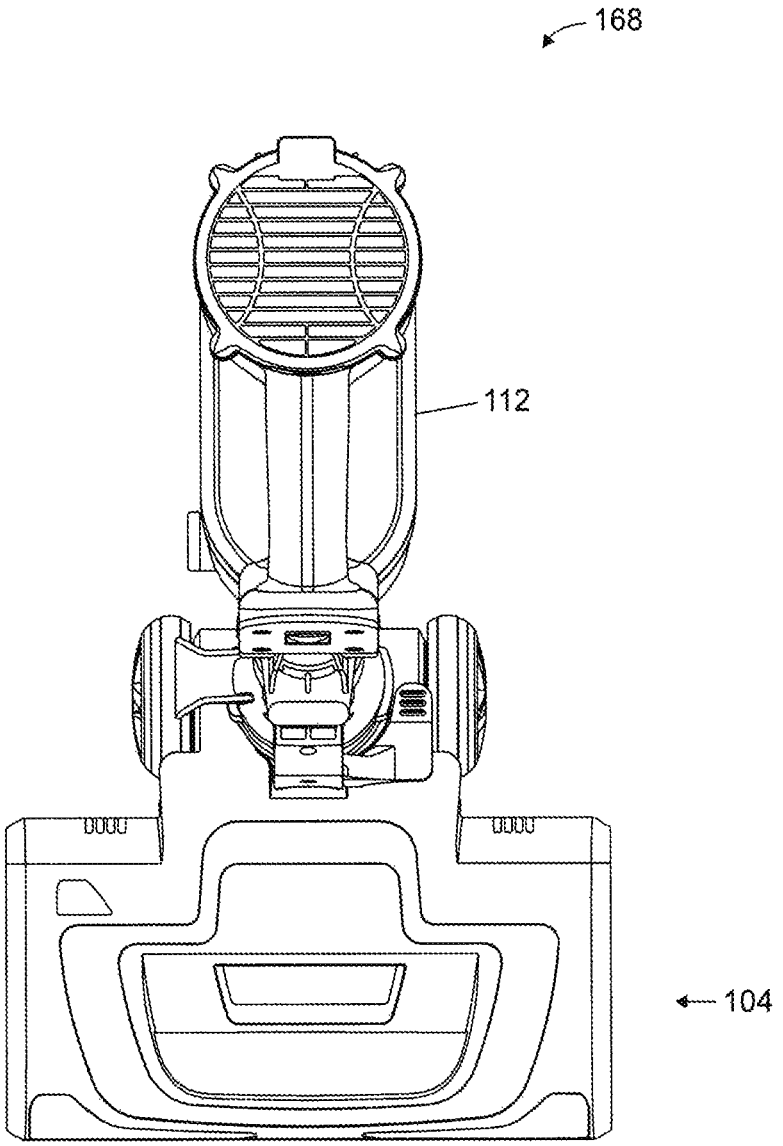
Figure 43:
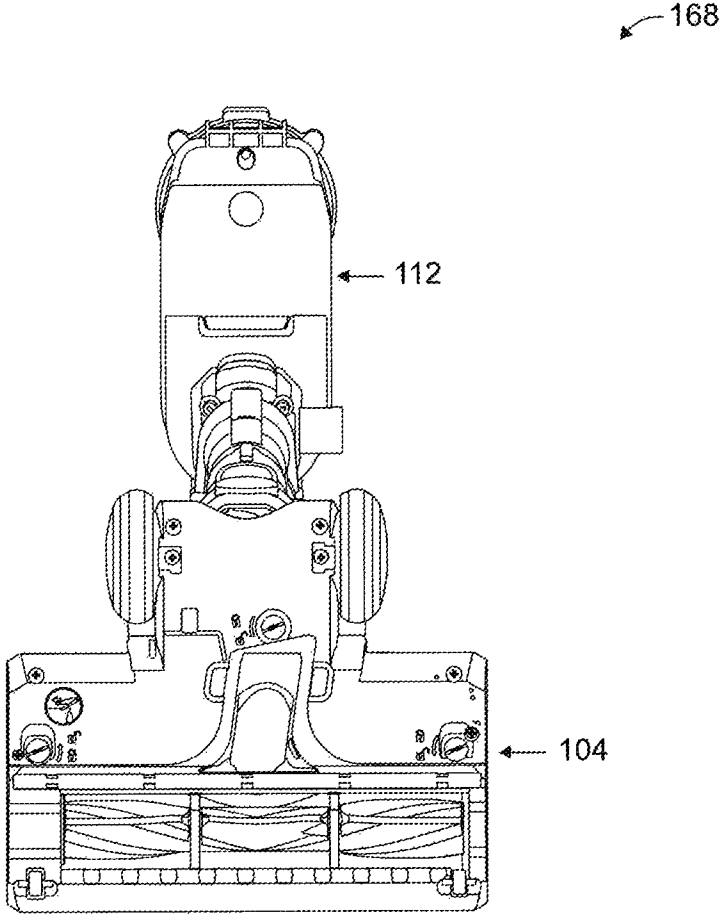
Figure 44:
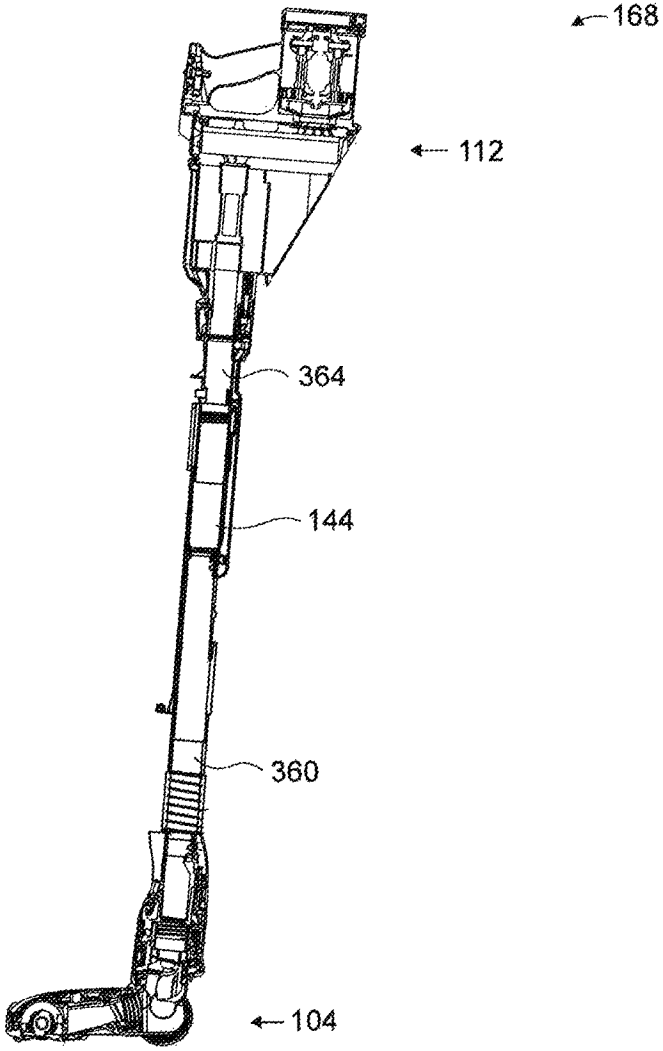
Figure 44A:
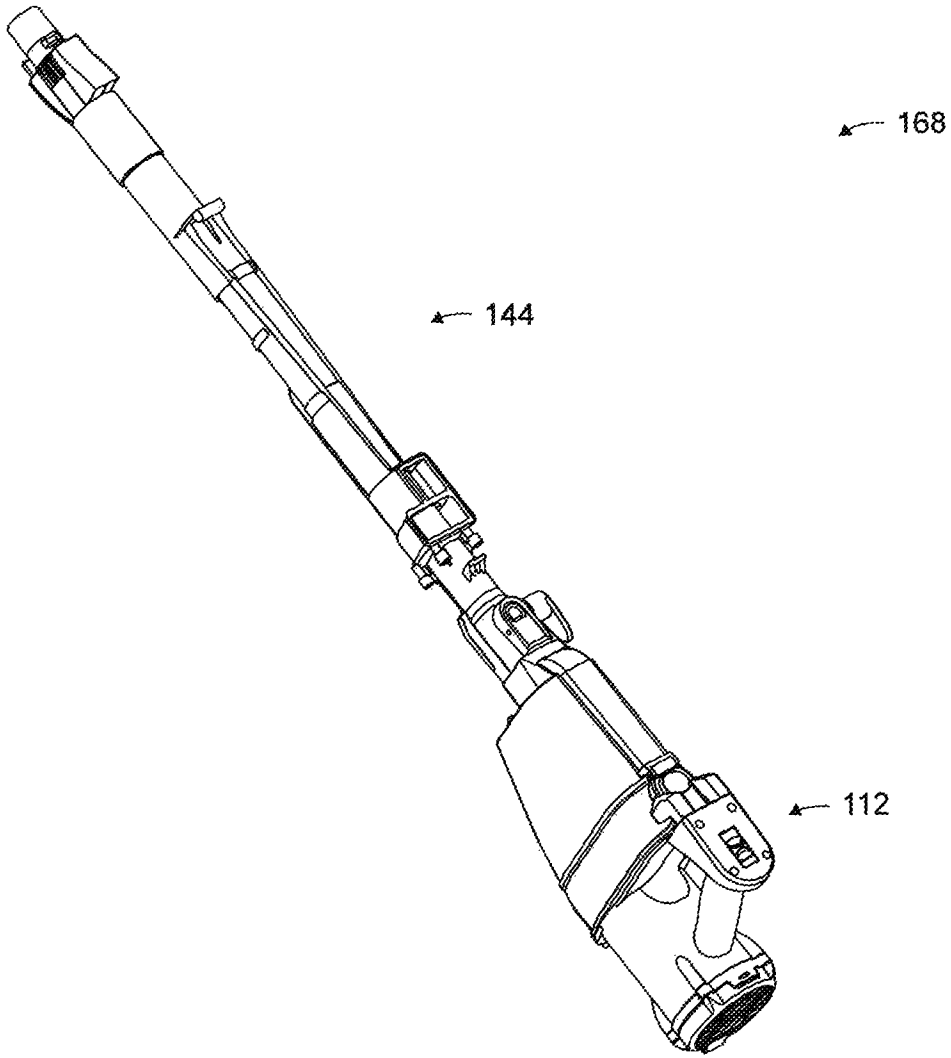
Figure 44B:
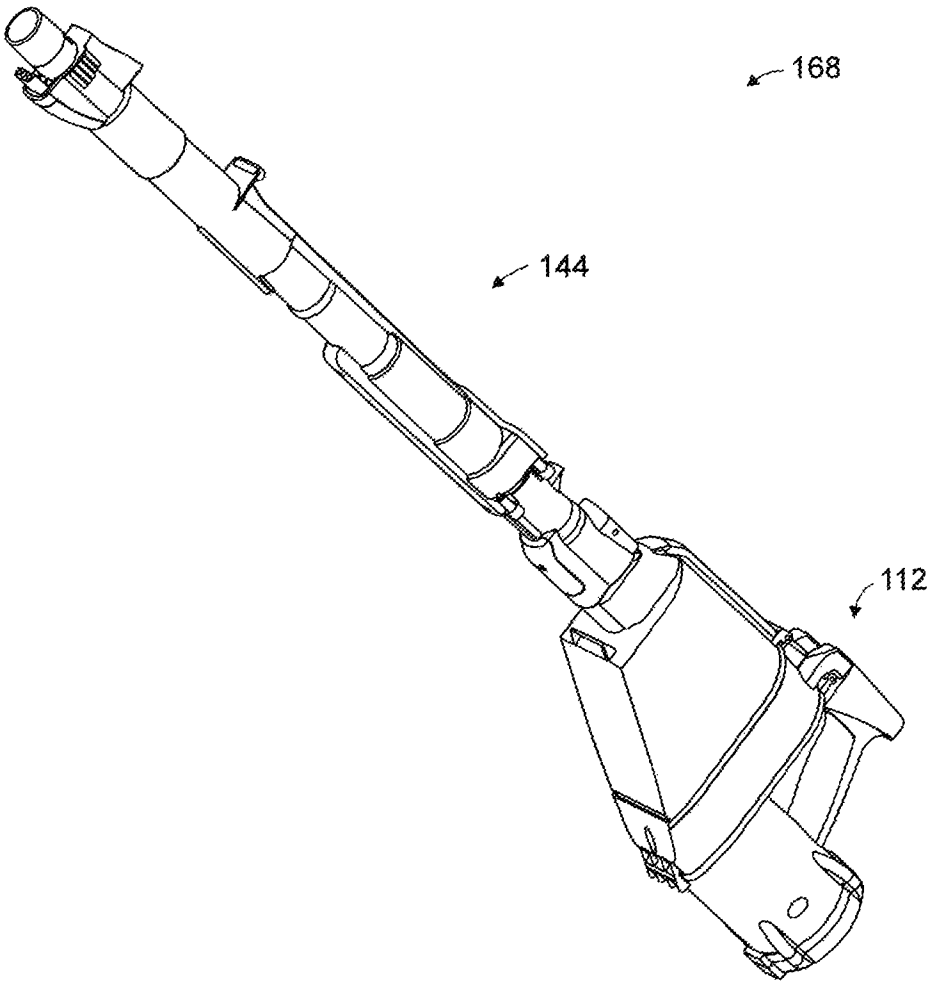

FIG. 12*a* is an exploded front perspective view of an alternate apparatus of FIG. 5;

FIG. 13 is a front perspective view of a surface cleaning apparatus in accordance with another embodiment;

FIG. 14 is a rear perspective view of the apparatus of FIG. 13;

FIG. 15 is a side elevation view of the apparatus of FIG. 13;

FIG. 16 is a front elevation view of the apparatus of FIG. 13;

FIG. 17 is a rear elevation view of the apparatus of FIG. 13;

FIG. 18 is a top plan view of the apparatus of FIG. 13;

FIG. 19 is a bottom plan view of the apparatus of FIG. 13;

FIG. 20 is a front perspective view of the apparatus of FIG. 13 with a supplemental cyclone bin assembly partially removed;

FIG. 21 is a cross-sectional view taken along line 21-21 in FIG. 1;

FIG. 22 is a bottom perspective view of a handvac of the apparatus of FIG. 1;

FIG. 23 is a perspective cross-sectional view of a cyclone bin assembly of the handvac of FIG. 22 transverse to the cyclone axis;

FIG. 23*a* is a top plan view of the cross-section of FIG. 23;

FIG. 24 is a front perspective view of the supplemental dirt collection chamber of the apparatus of FIG. 1;

FIG. 25 is a cross-sectional view taken along line 25-25 in FIG. 5;

FIG. 26 is a cross-sectional view taken along line 26-26 in FIG. 13;

FIG. 27 is a front perspective view of the apparatus of FIG. 1 in a lightweight upright mode;

FIG. 28 is a rear perspective view of the apparatus of FIG. 1 in the lightweight upright mode of FIG. 27;

FIG. 29 is a side elevation view of the apparatus of FIG. 1 in the lightweight upright mode of FIG. 27;

FIG. 30 is a cross-sectional view taken along line 30-30 in FIG. 27;

FIG. 31 is a front perspective view of the apparatus of FIG. 1 in an above-floor cleaning mode;

FIG. 32 is a rear perspective view of the apparatus of FIG. 1 in the above-floor cleaning mode of FIG. 31;

FIG. 33 is a side elevation view of the apparatus of FIG. 1 in the above-floor cleaning mode of FIG. 31;

FIG. 34 is a front perspective view of the apparatus of FIG. 1 in a stair-cleaning mode;

FIG. 35 is a rear perspective view of the apparatus of FIG. 1 in the stair-cleaning mode of FIG. 34;

FIG. 36 is a side elevation view of the apparatus of FIG. 1 in the stair cleaning mode of FIG. 34;

FIG. 36*a* is a front perspective view of the apparatus of FIG. 5 in an above-floor cleaning mode;

FIG. 37 is a front perspective view of the apparatus of FIG. 13 in a lightweight upright mode;

FIG. 38 is a rear perspective view of the apparatus of FIG. 13 in the lightweight upright mode of FIG. 37;

FIG. 39 is a front elevation view of the apparatus of FIG. 13 in the lightweight upright mode of FIG. 37;

FIG. 40 is a rear elevation view of the apparatus of FIG. 13 in the lightweight upright mode of FIG. 37;

FIG. 41 is a side elevation view of the apparatus of FIG. 13 in the lightweight upright mode of FIG. 37;

FIG. 42 is a top plan view of the apparatus of FIG. 13 in the lightweight upright mode of FIG. 37;

FIG. 43 is a bottom plan view of the apparatus of FIG. 13 in the lightweight upright mode of FIG. 37;

FIG. 44 is a cross-sectional view taken along line 44-44 in FIG. 37;

FIG. 44*a* is a perspective view of the apparatus of FIG. 13 in an above-floor cleaning mode;

FIG. 44*b* is another perspective view of the apparatus of FIG. 13 in the above-floor cleaning mode of FIG. 44*a;*

Figure 46:
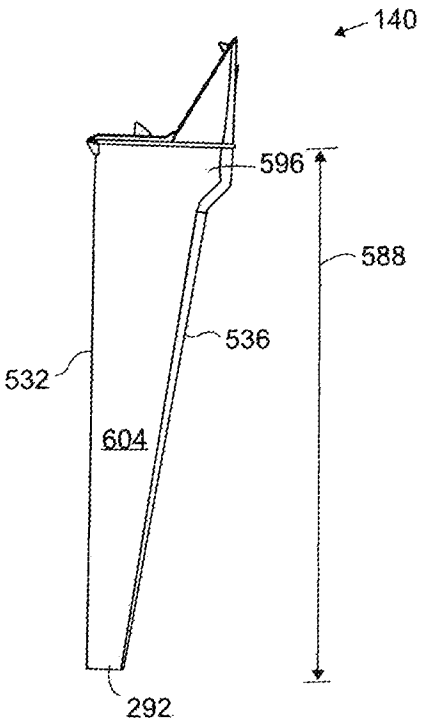
Figure 45:
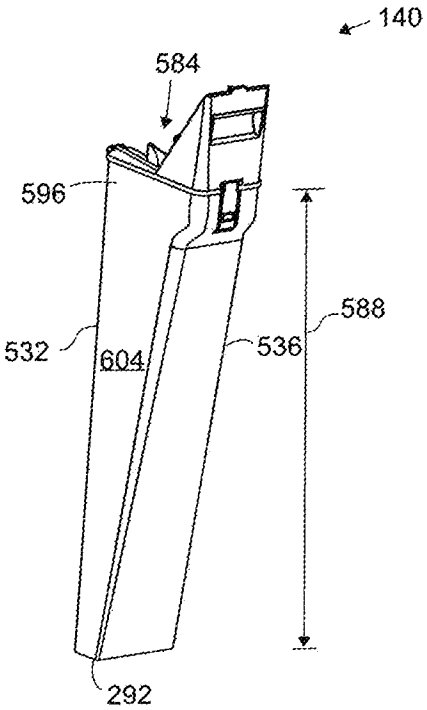
Figure 47:
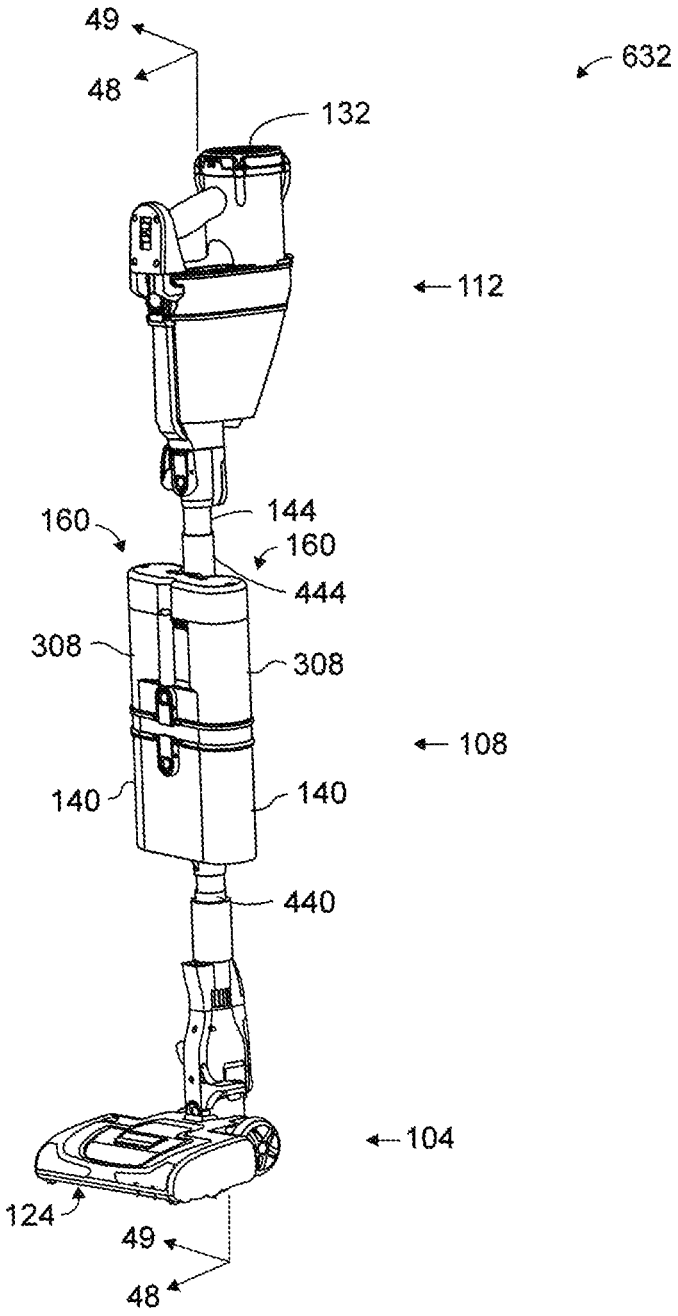
Figure 48:
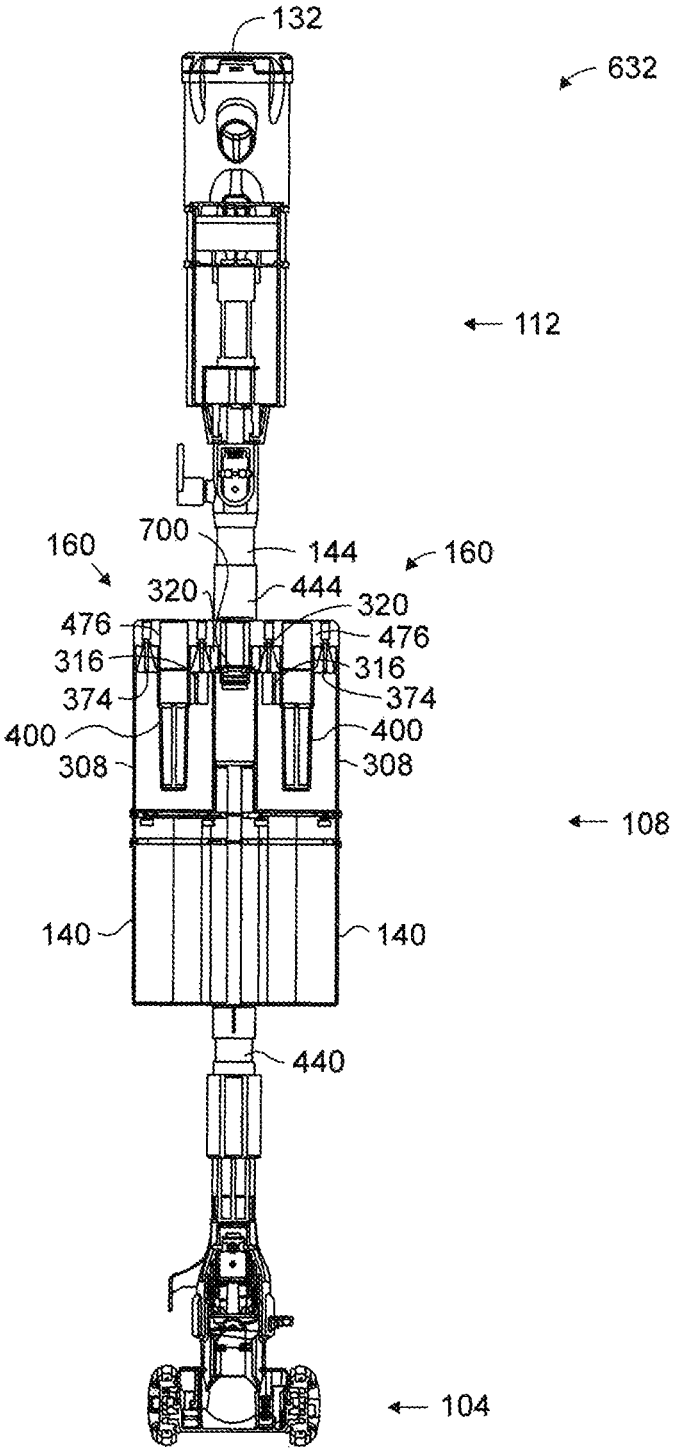
Figure 49:
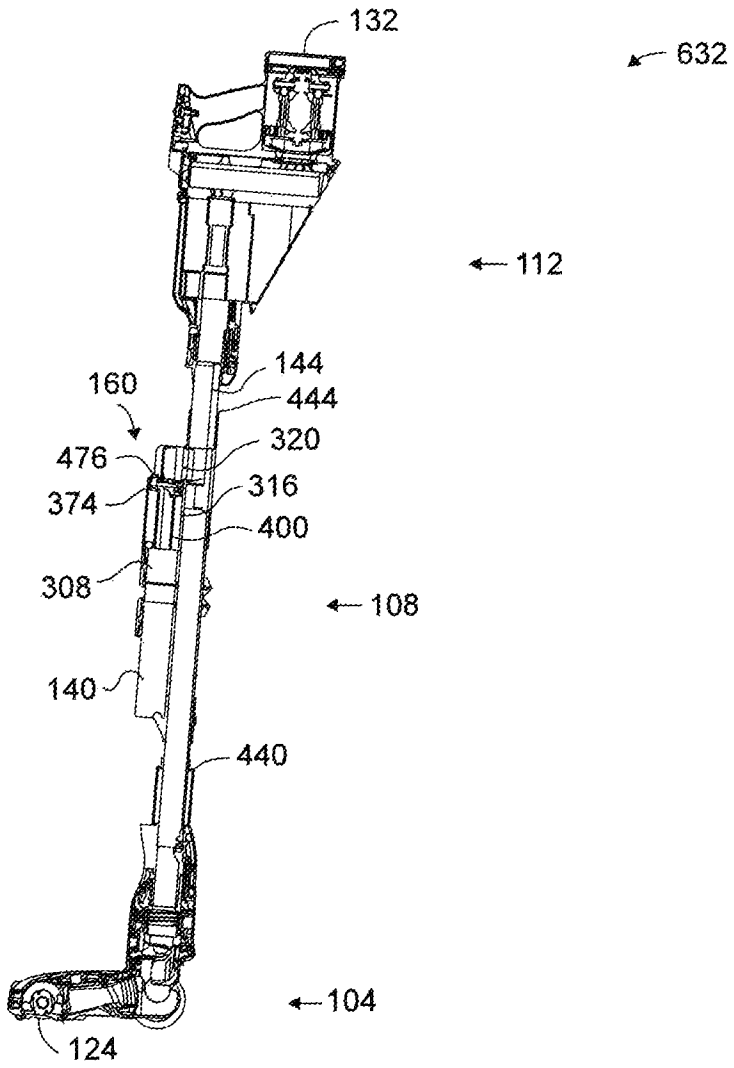
Figure 50:
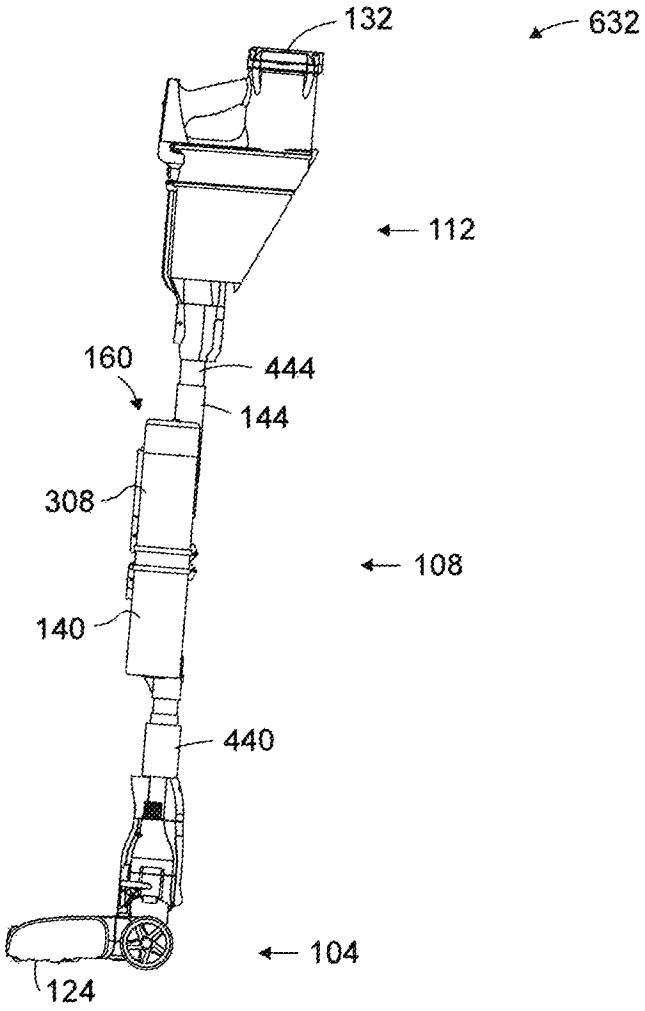
Figure 51:
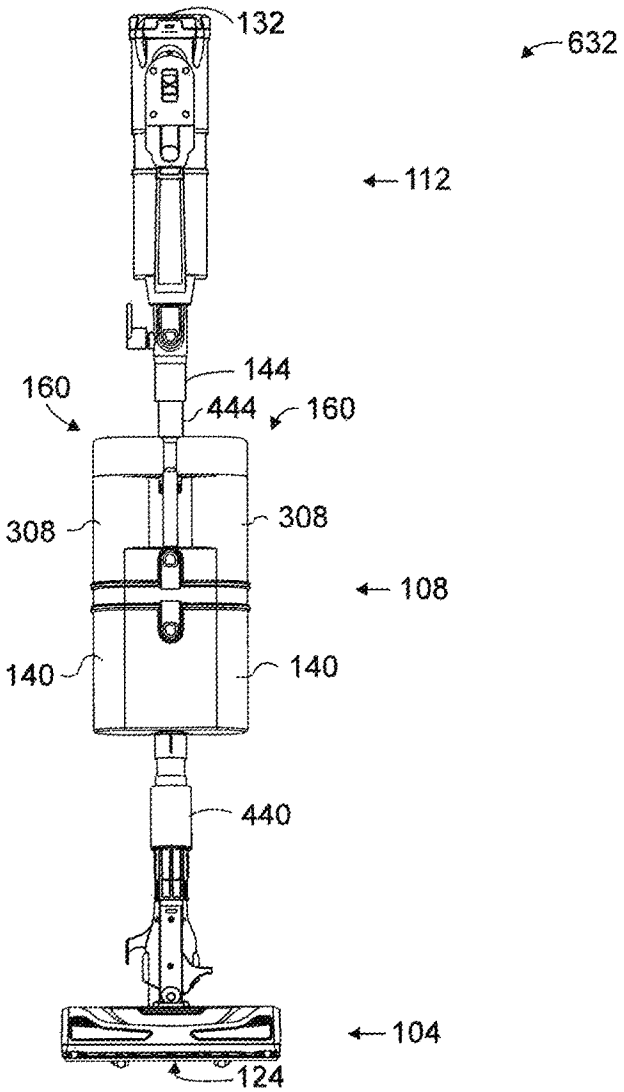
Figure 52:
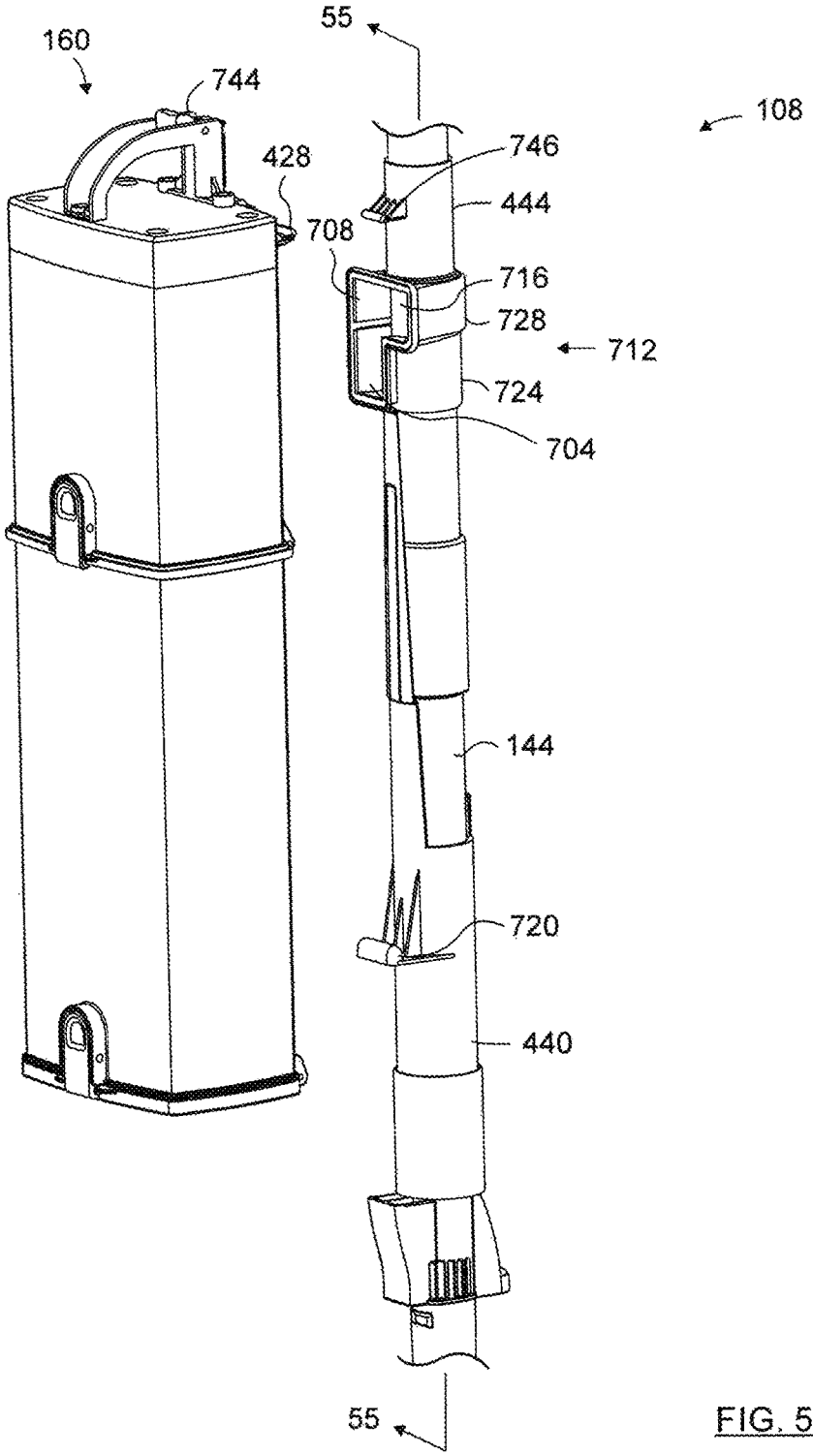
Figure 53:
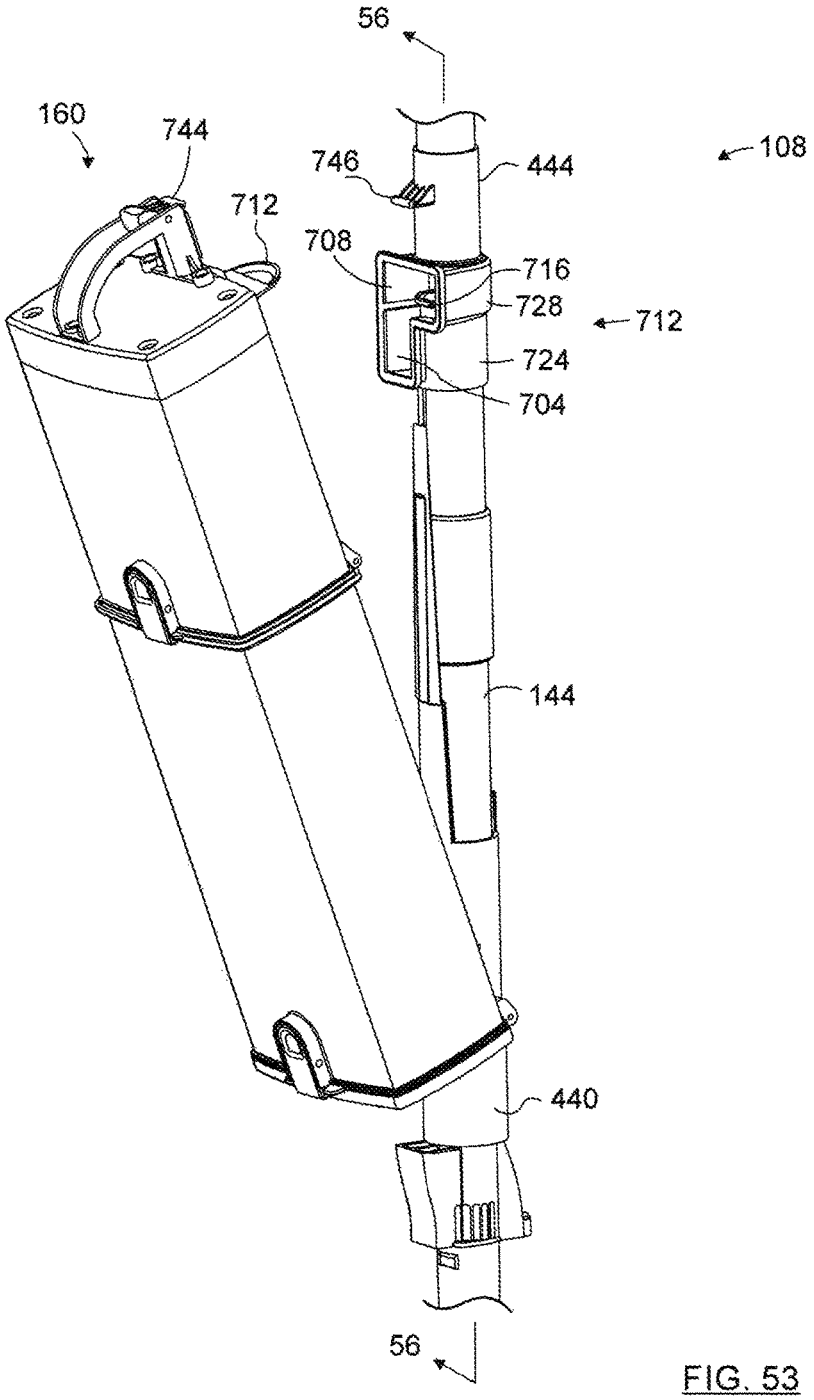
Figure 54:
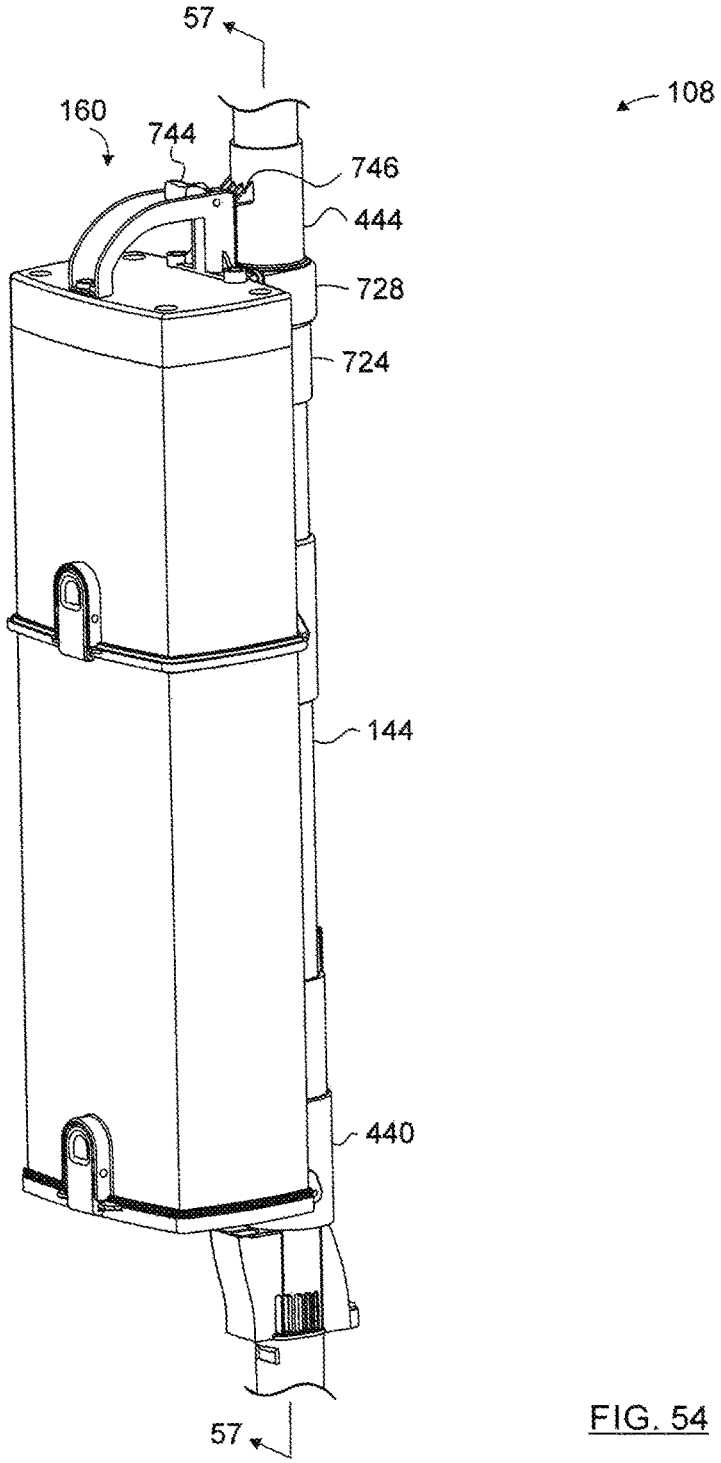
Figure 55:
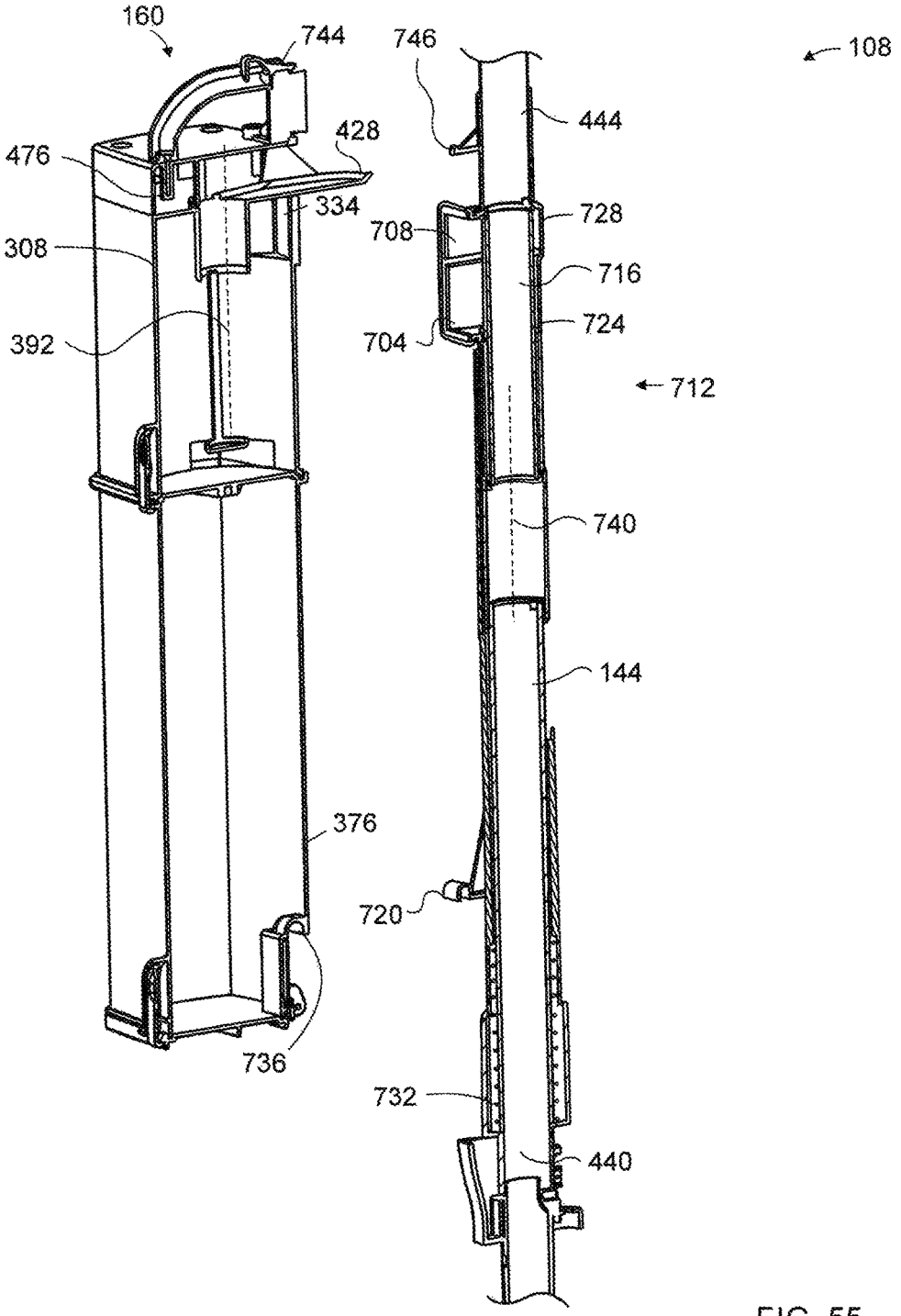
Figure 56:
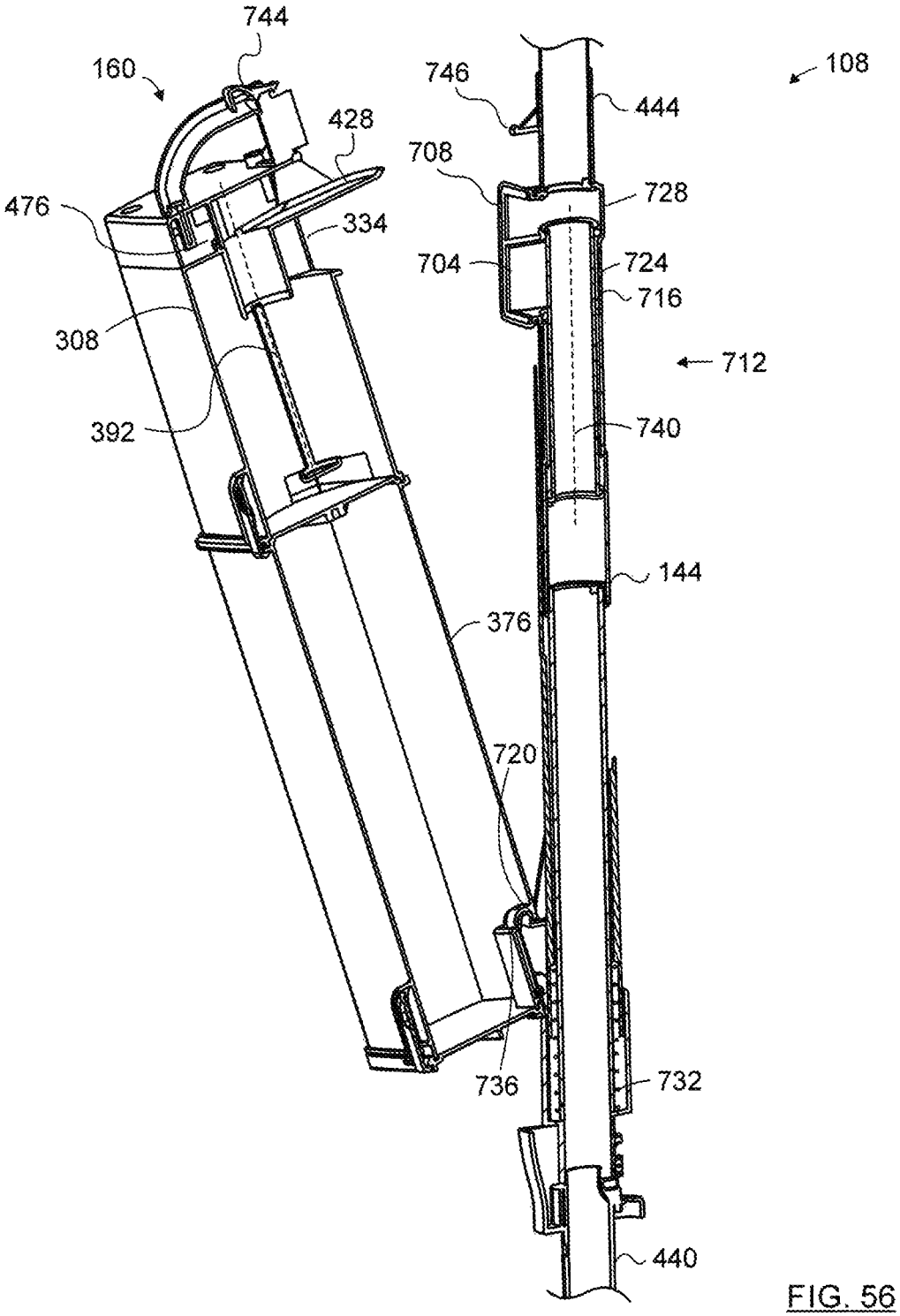
Figure 57:
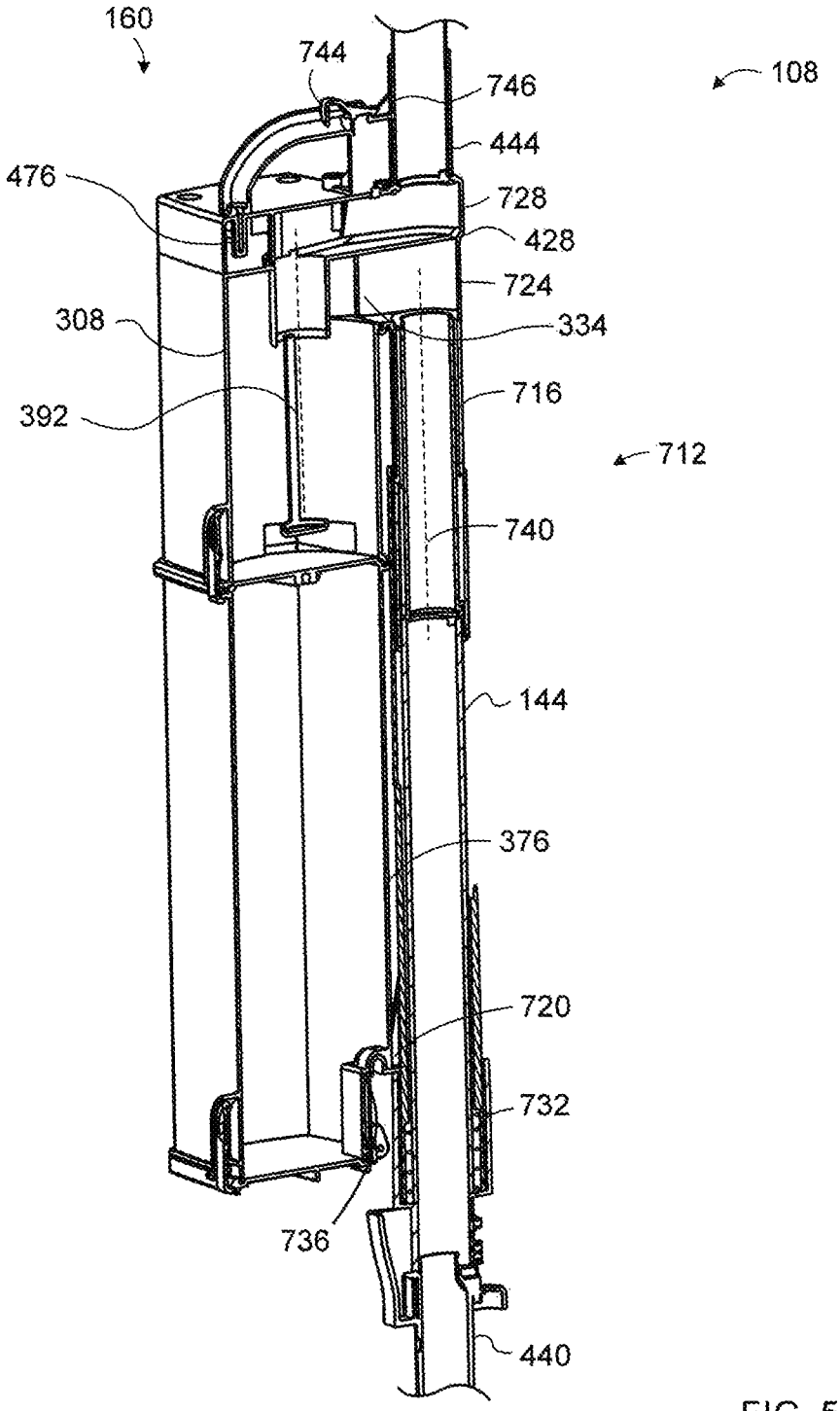
Figure 58:
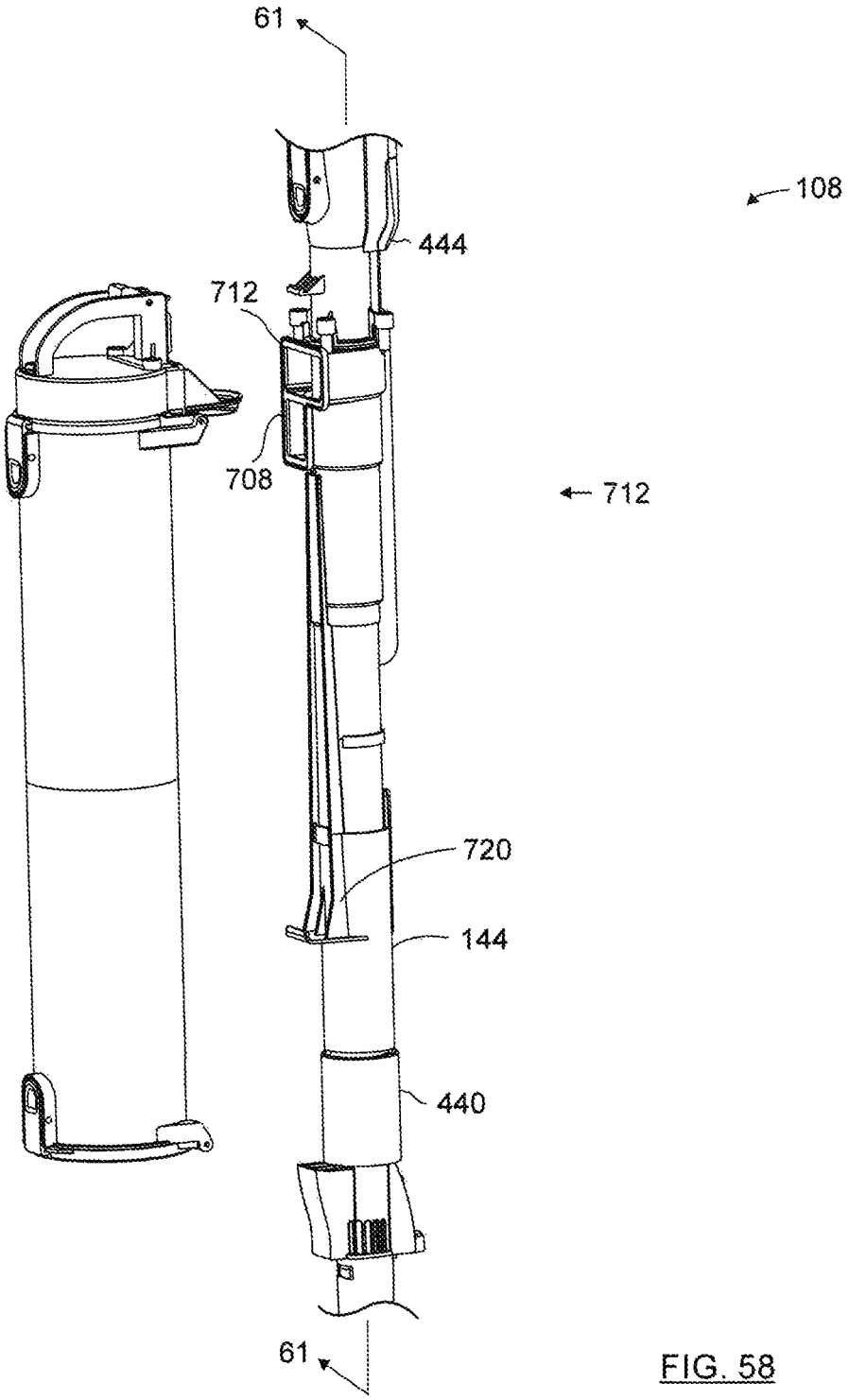
Figure 59:
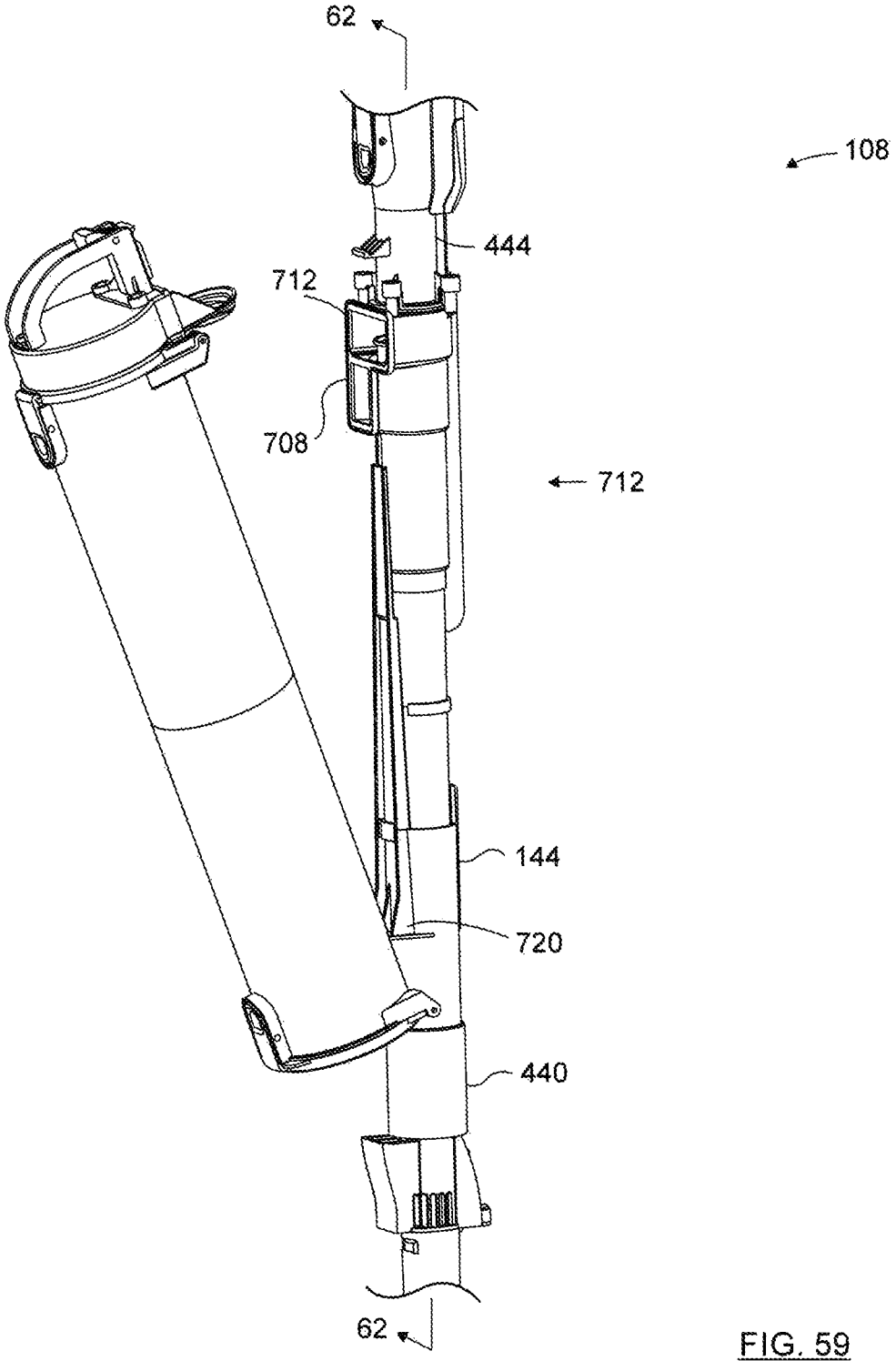
Figure 60:
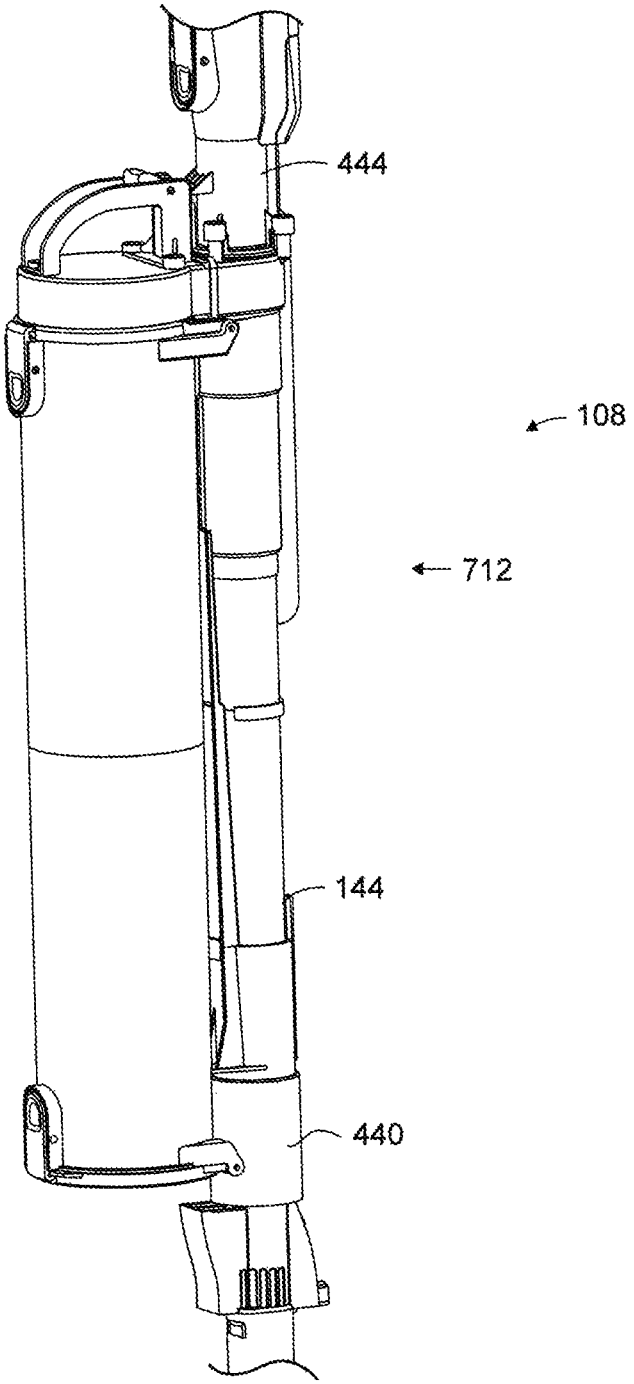
Figure 61:
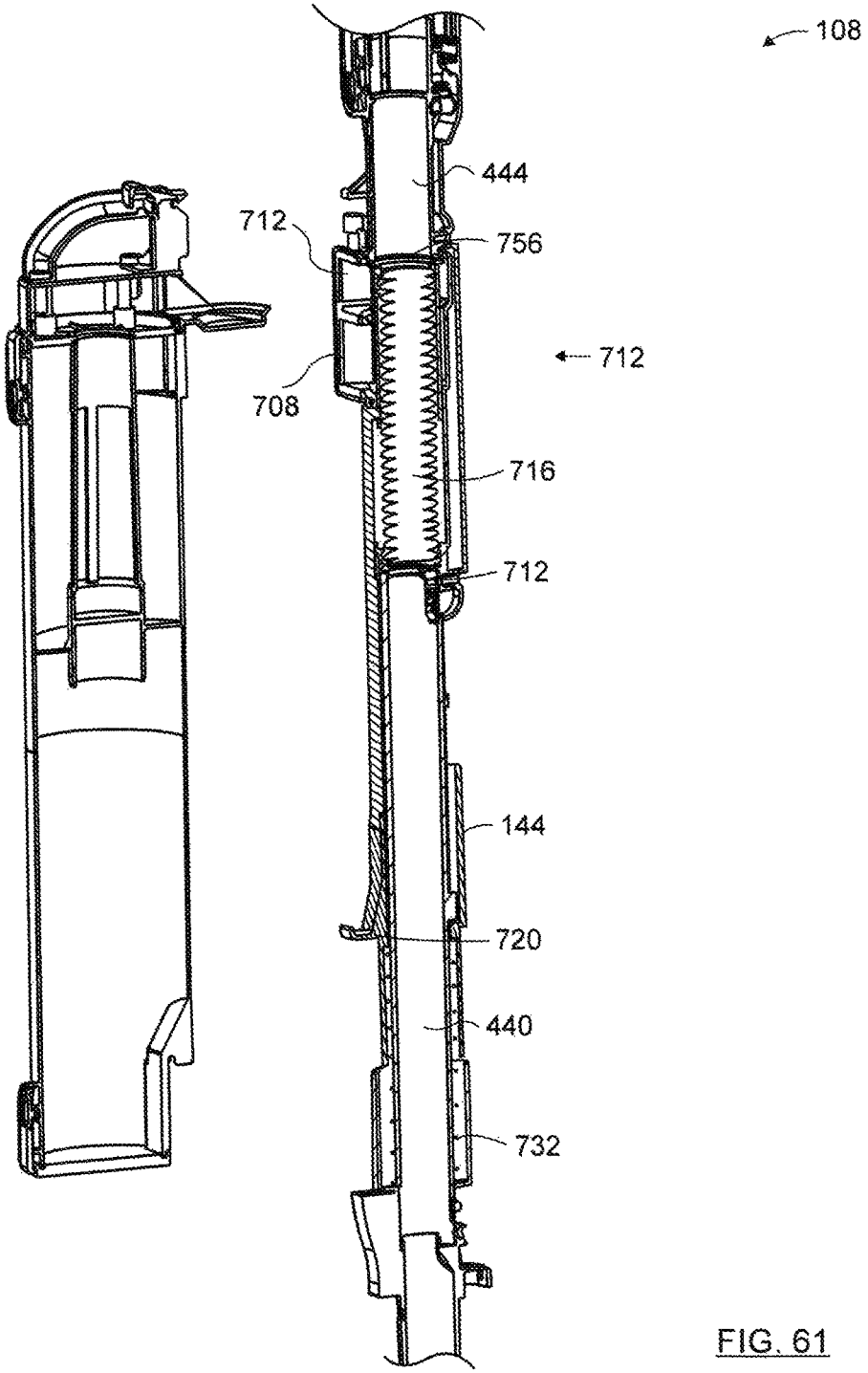
Figure 62:
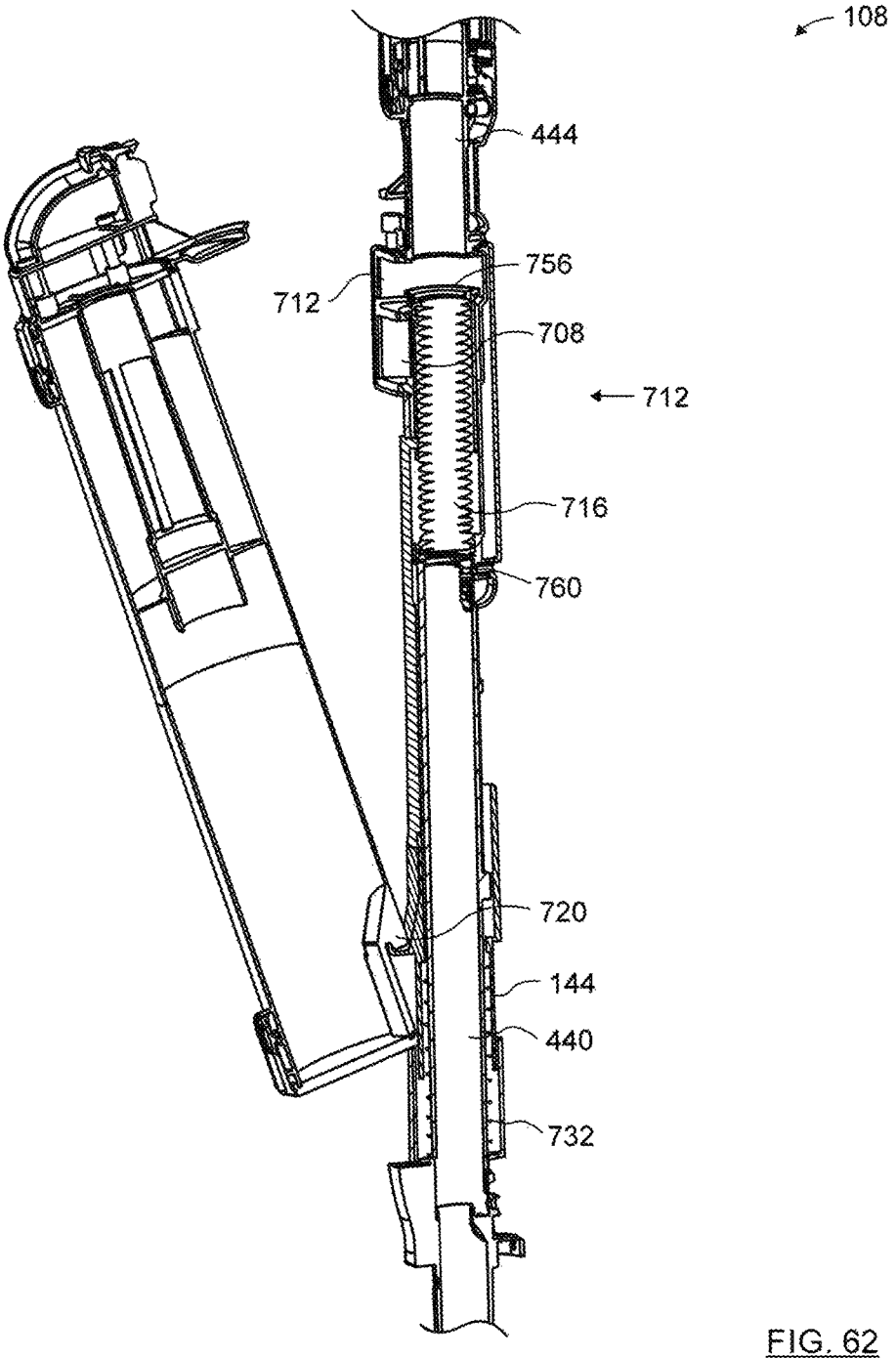
Figure 63:
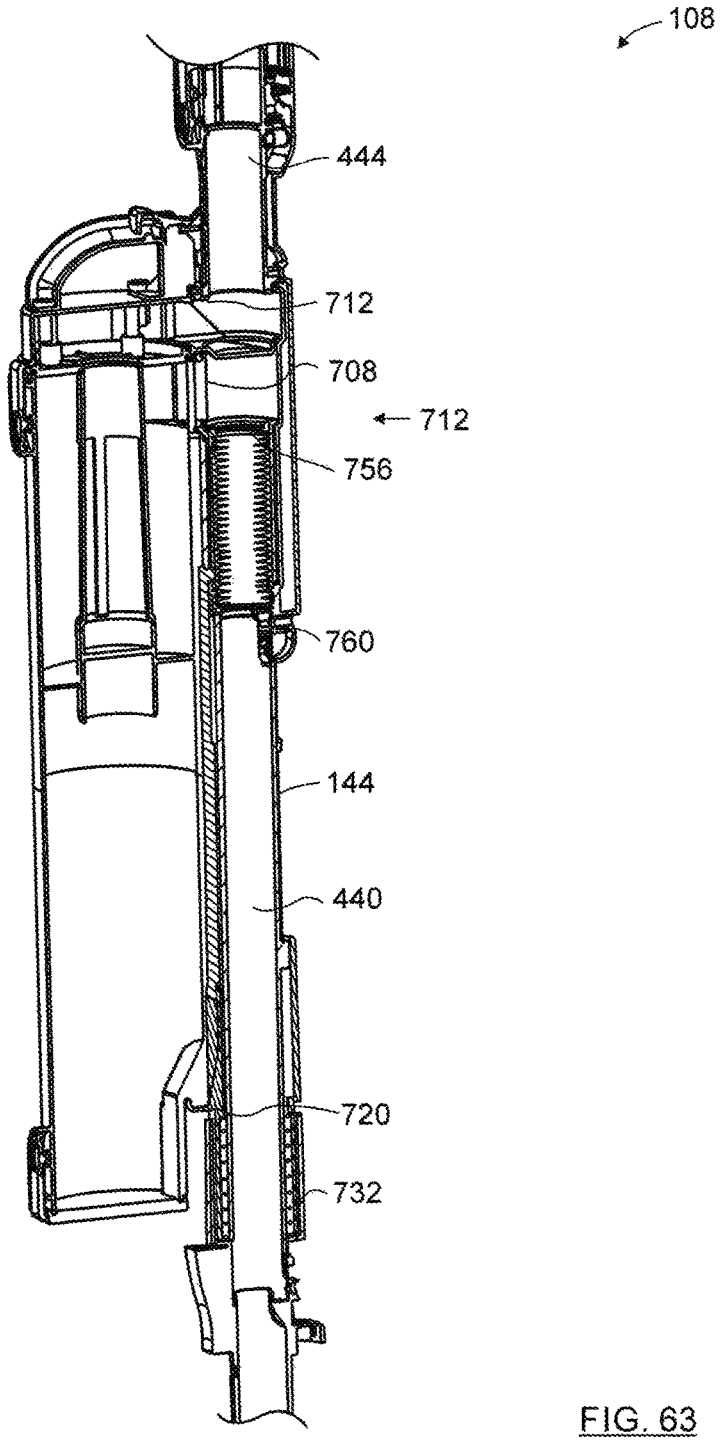
Figure 64:
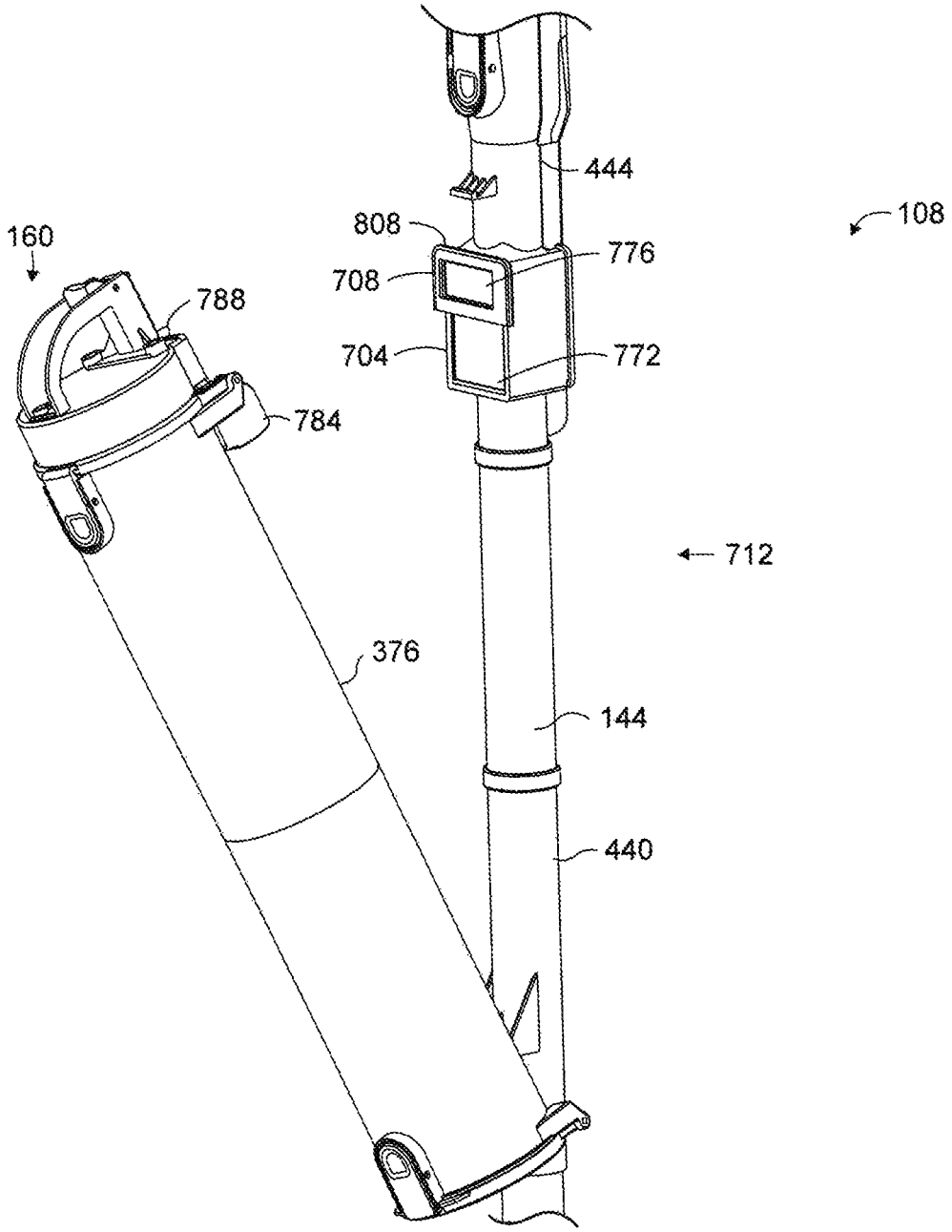
Figure 65:
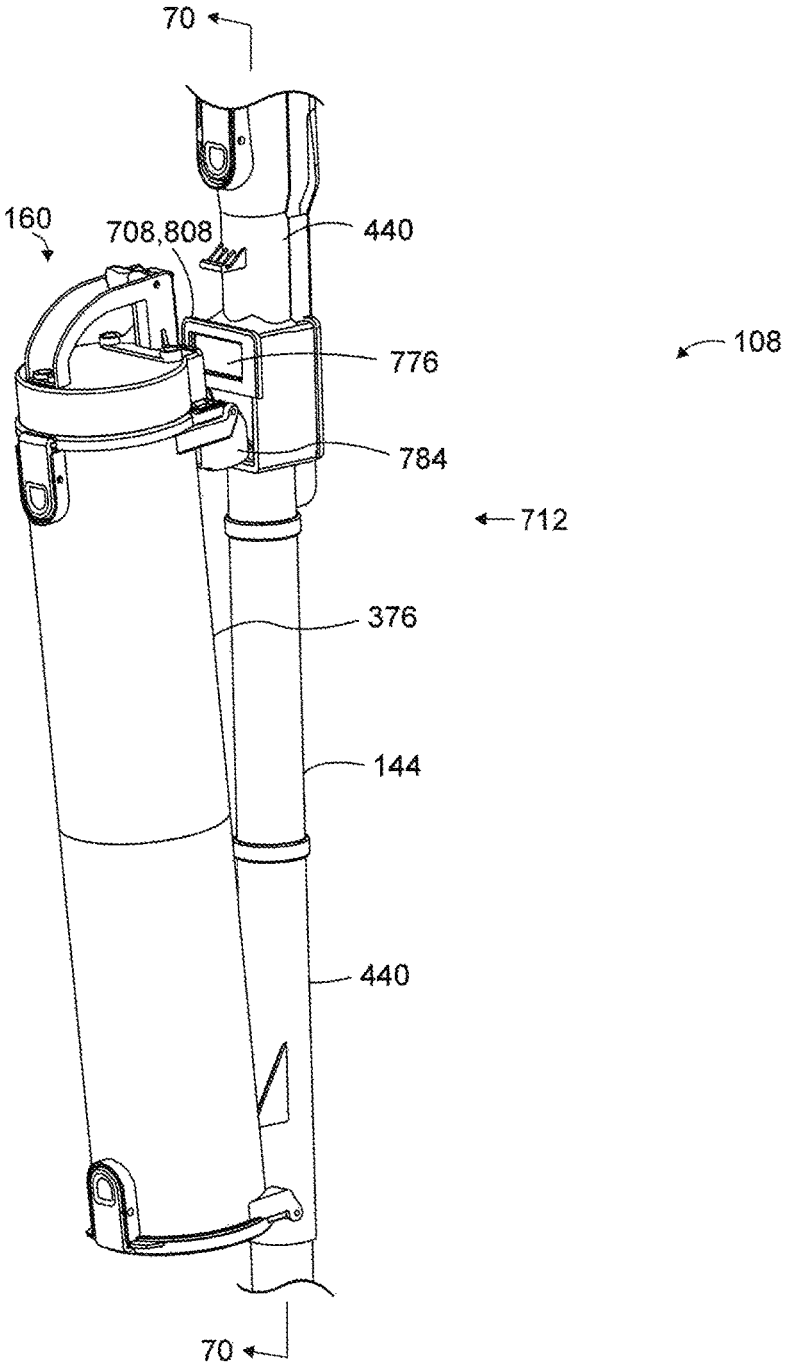
Figure 66:
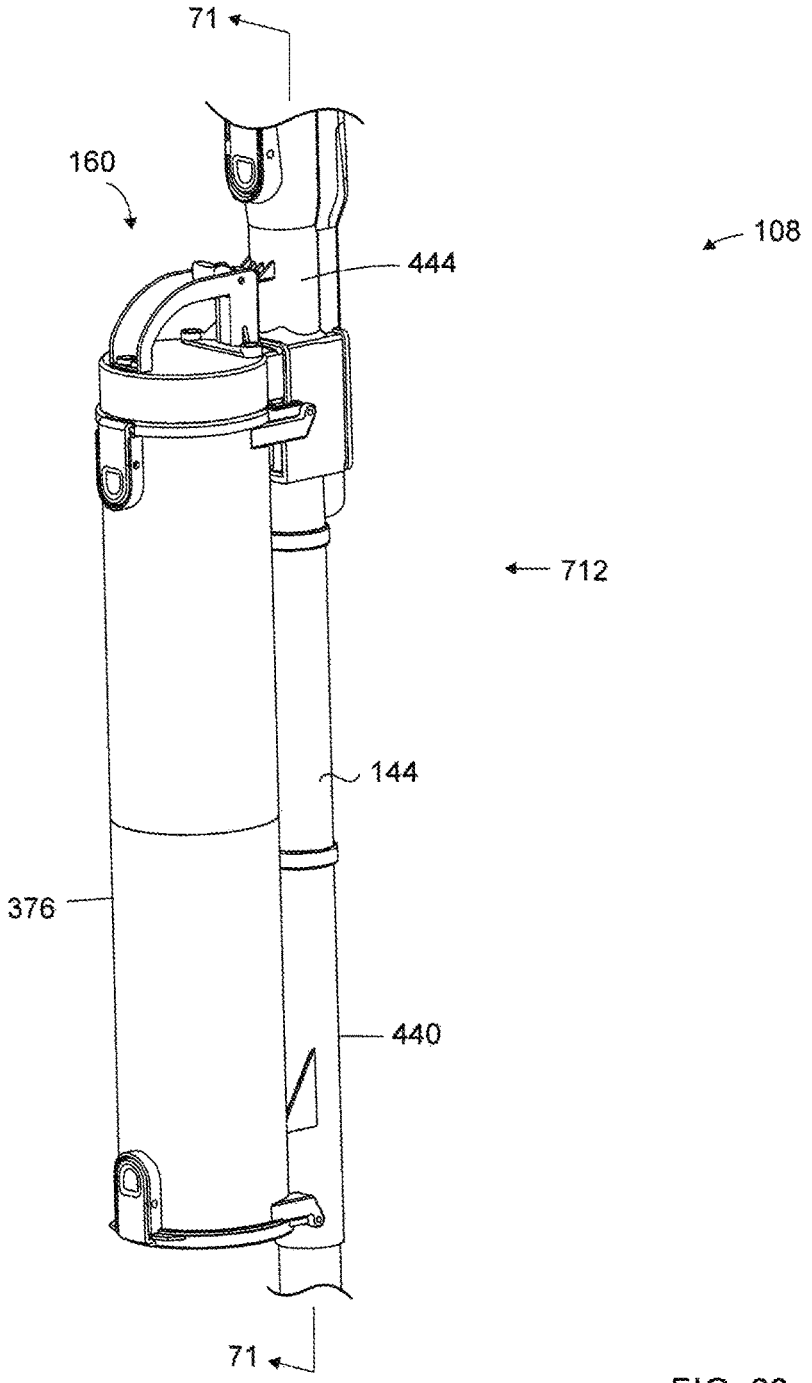
Figure 67:
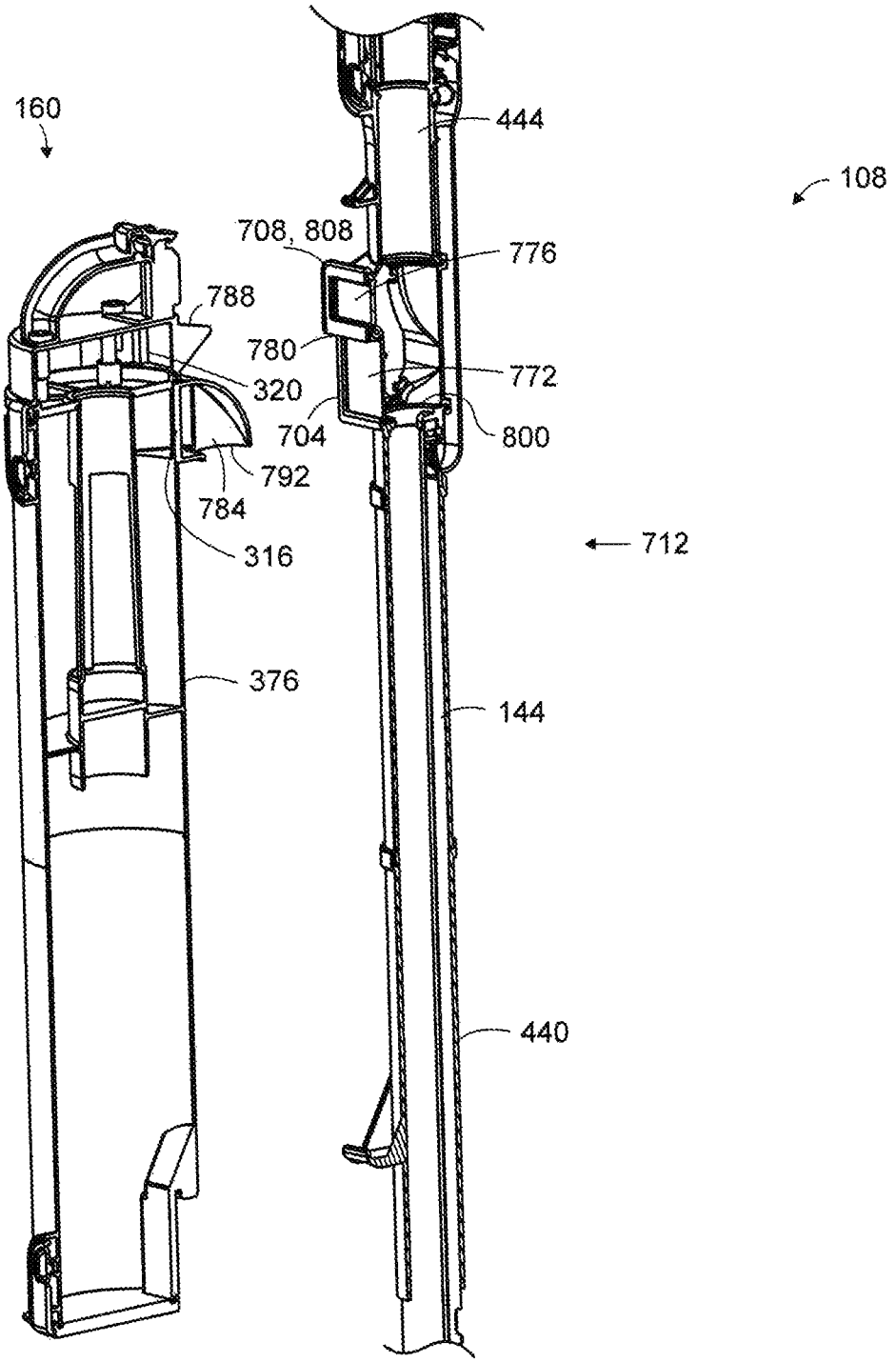
Figure 68:
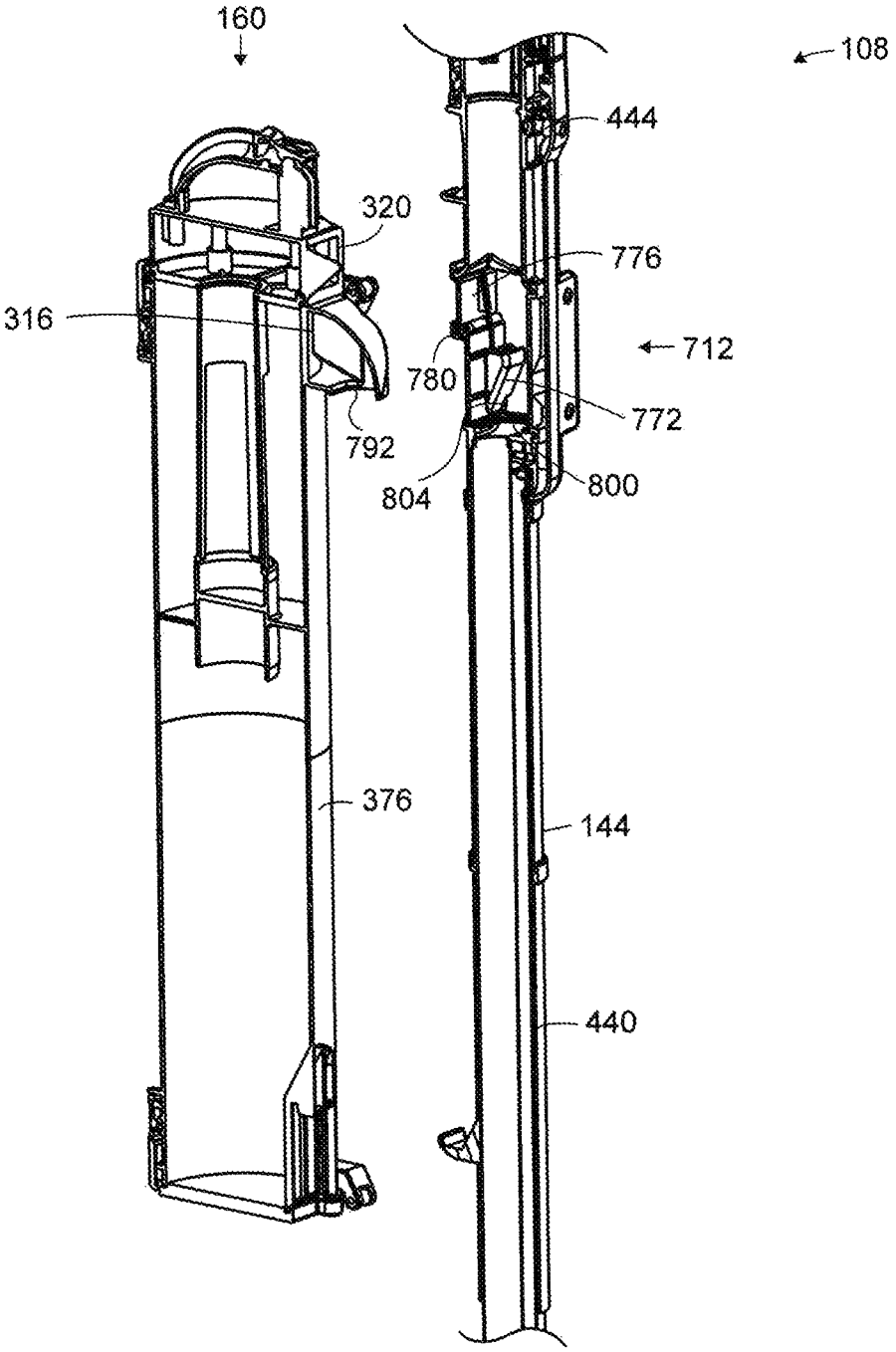
Figure 69:
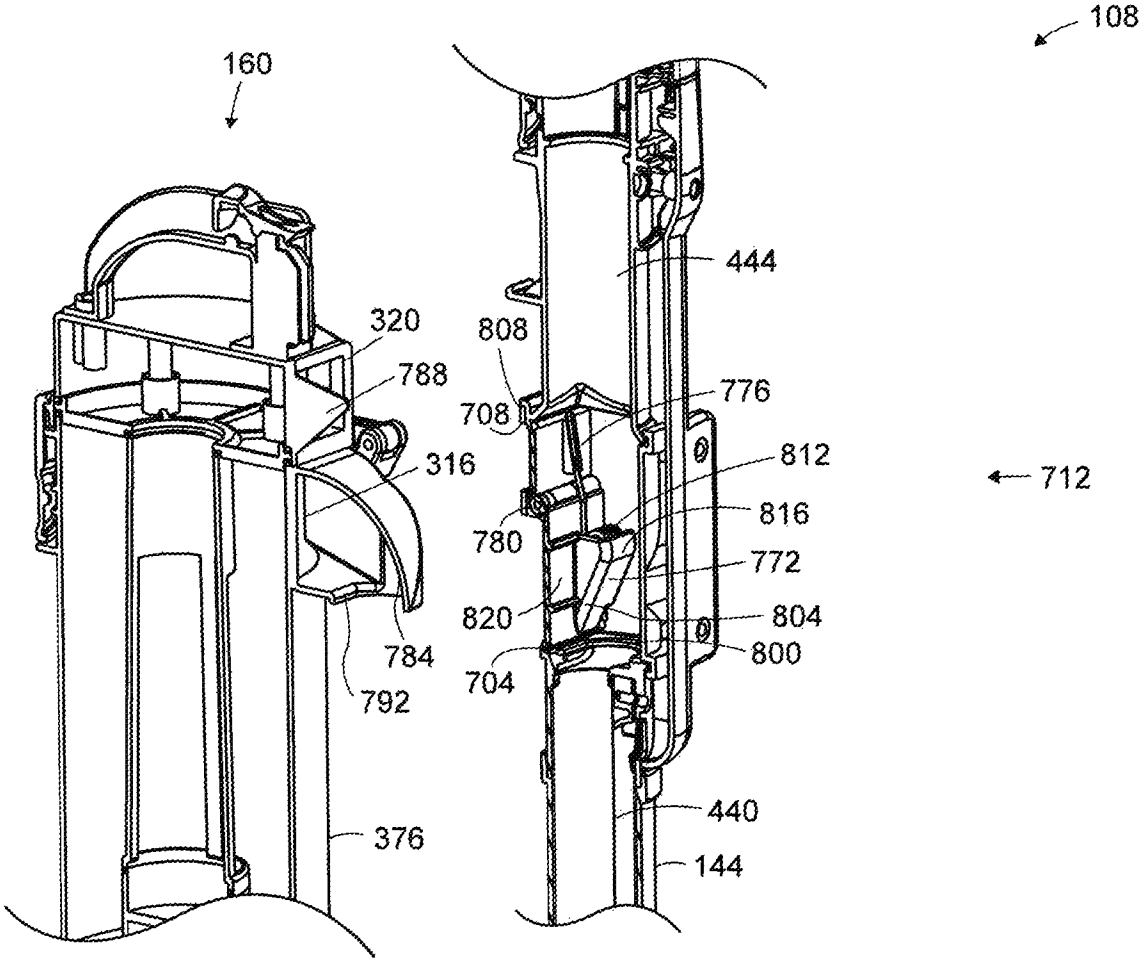
Figure 70:
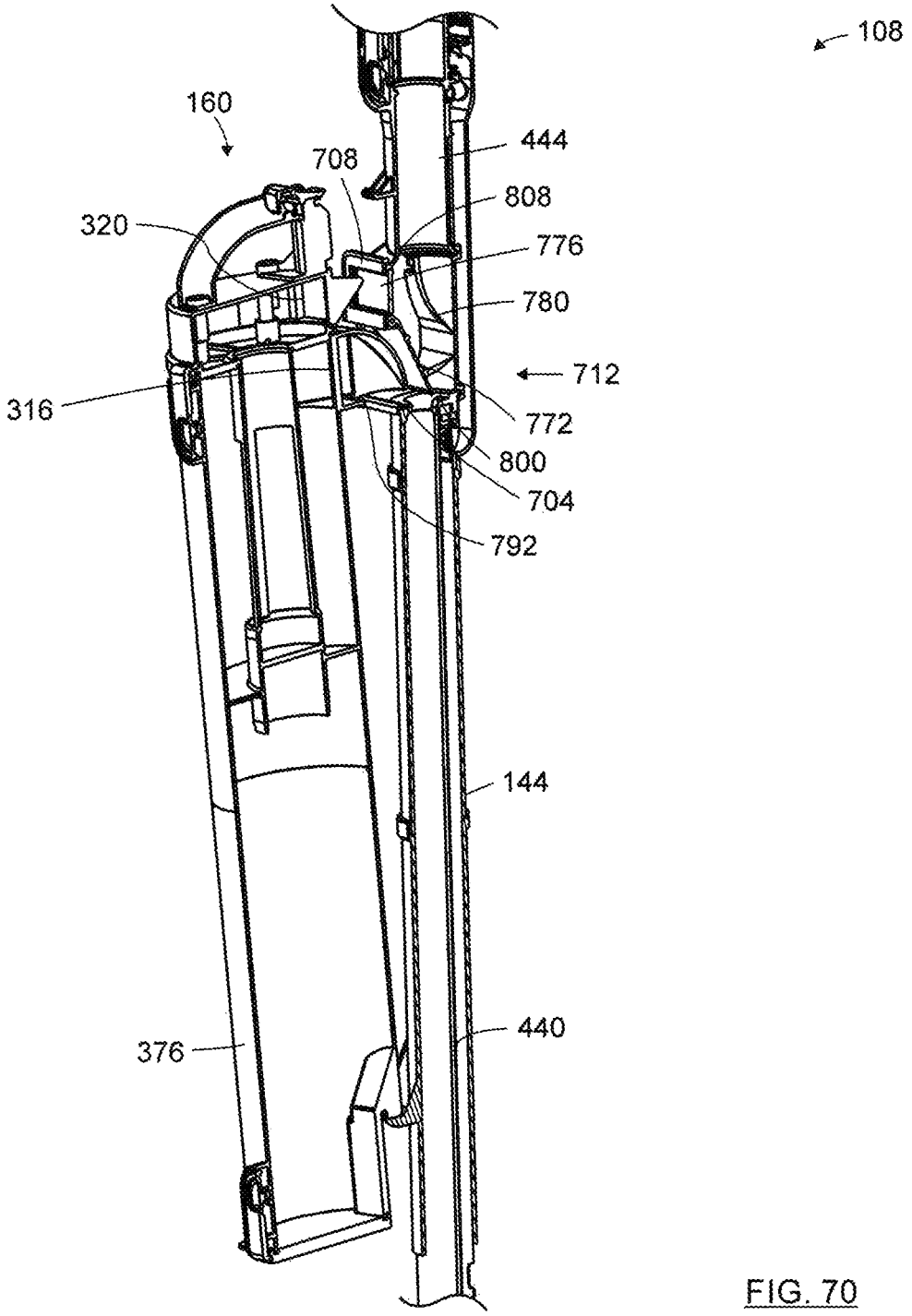
Figure 71:
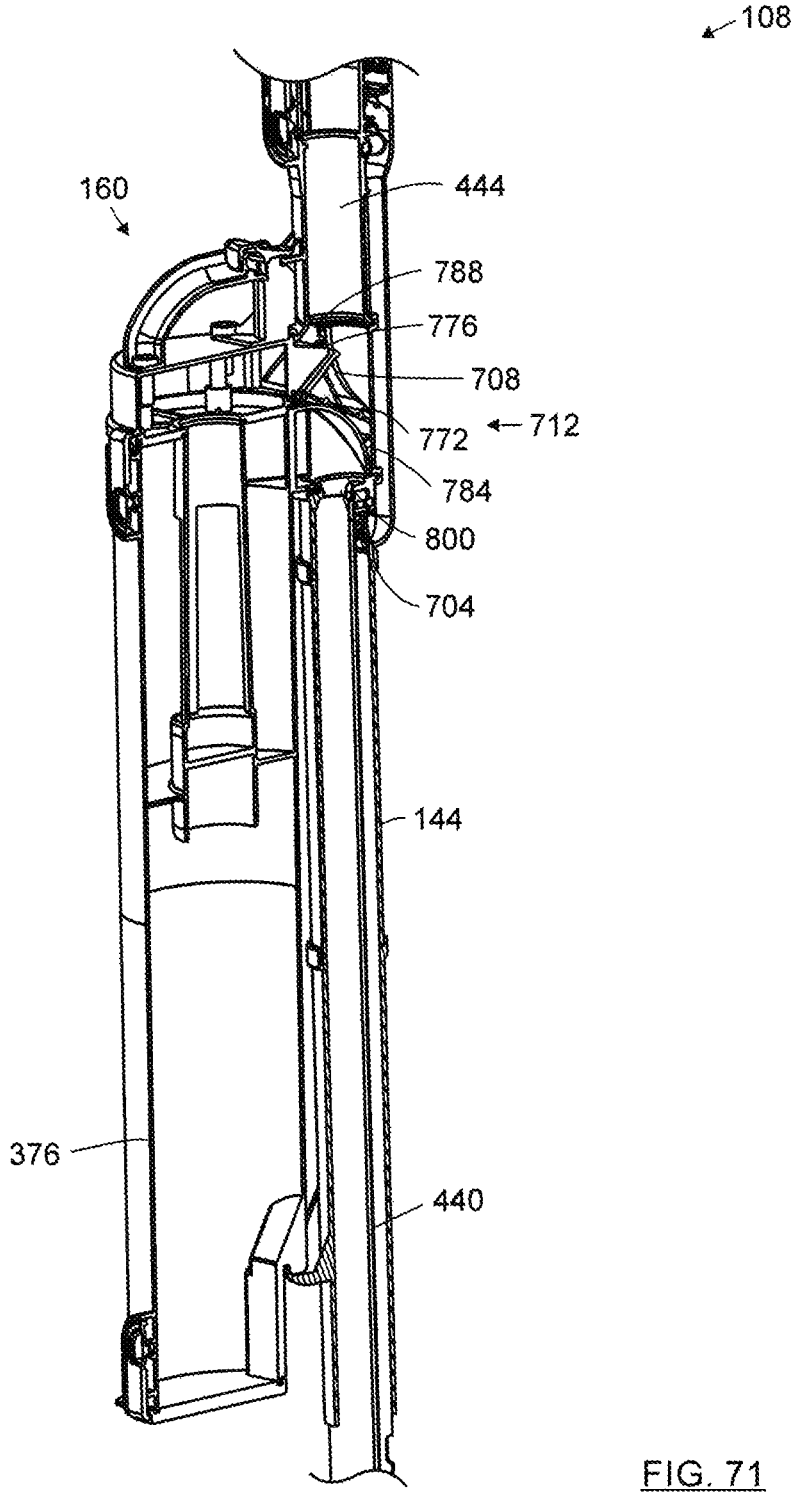
Figure 72:
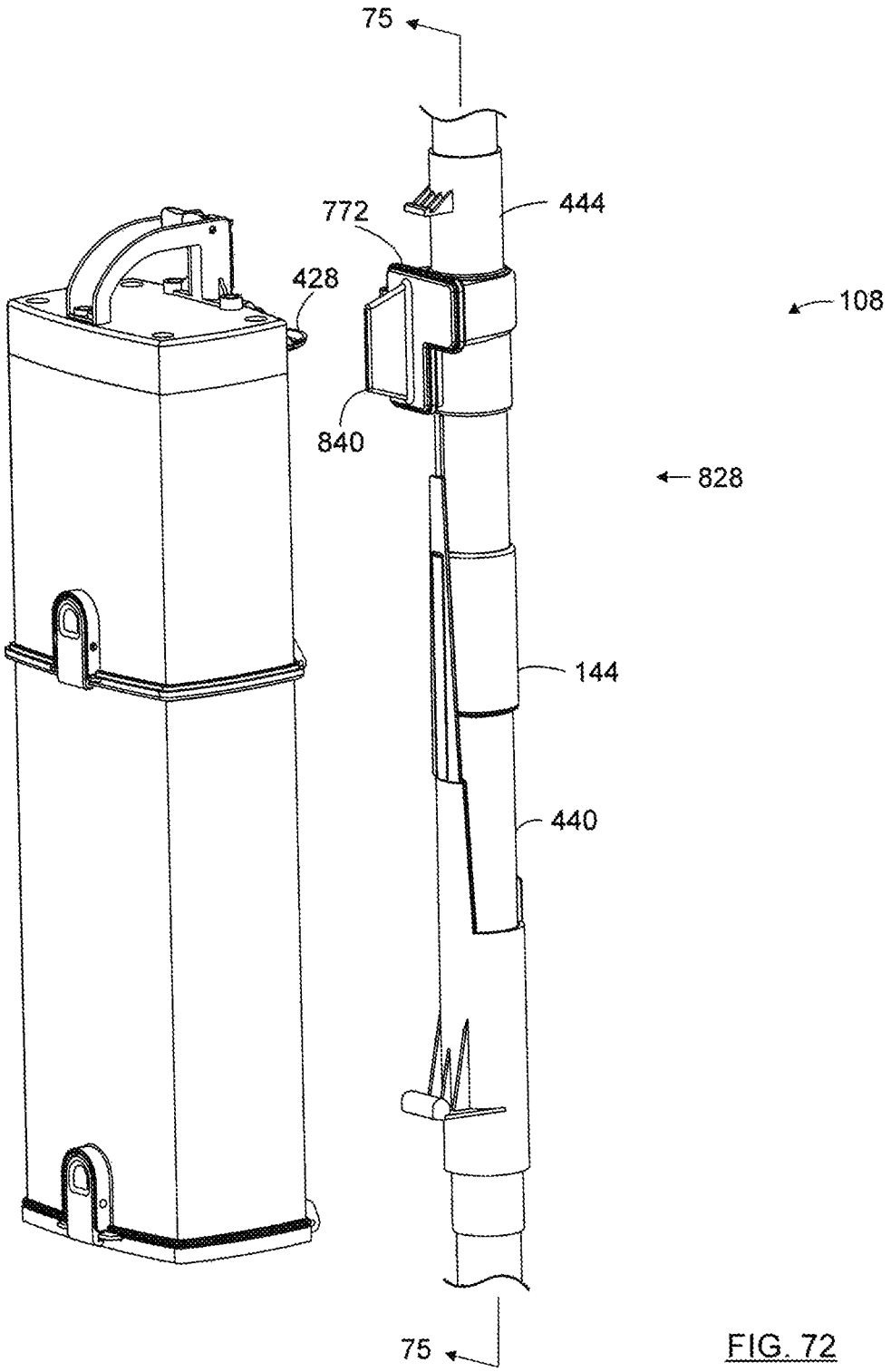
Figure 73:
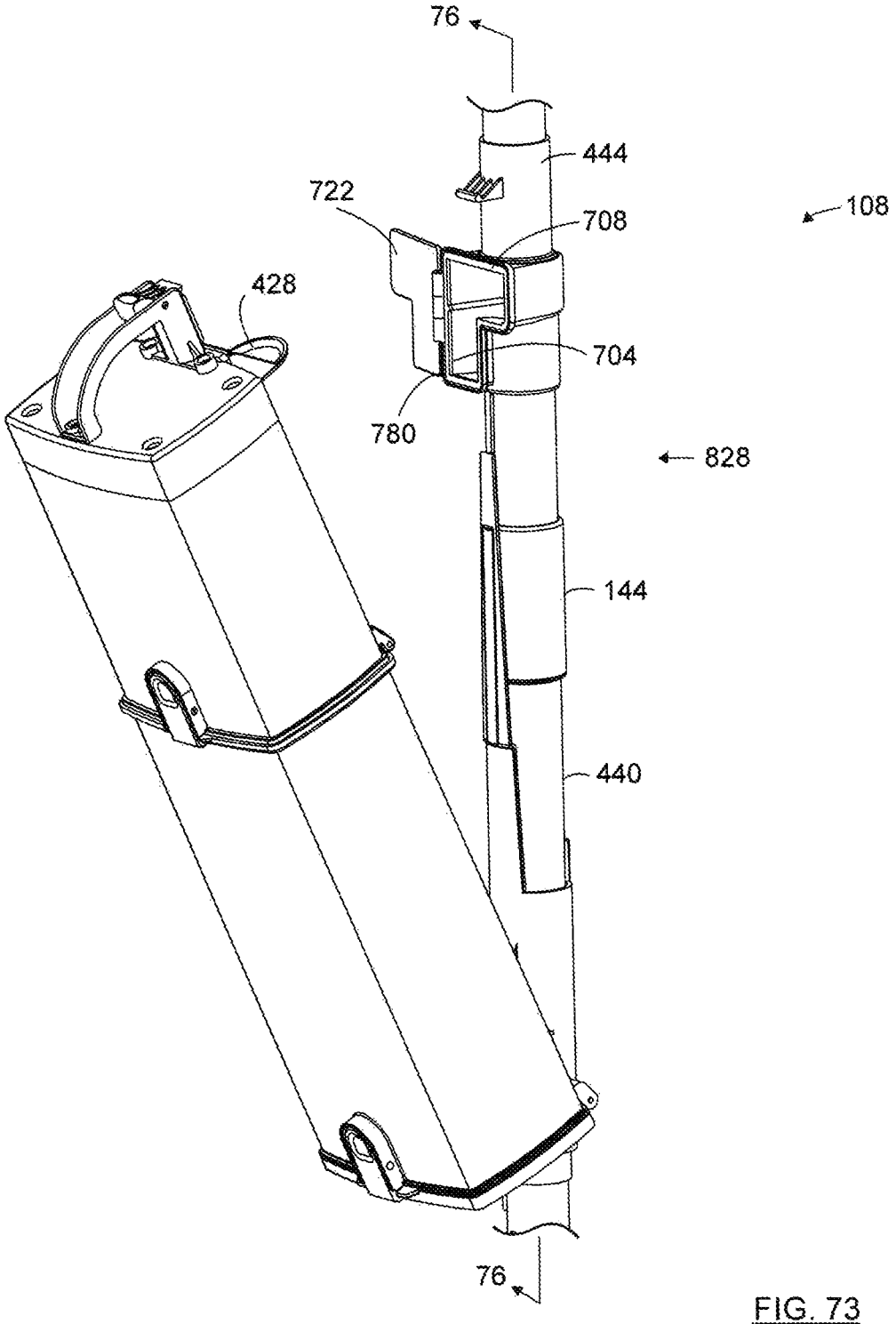
Figure 74:
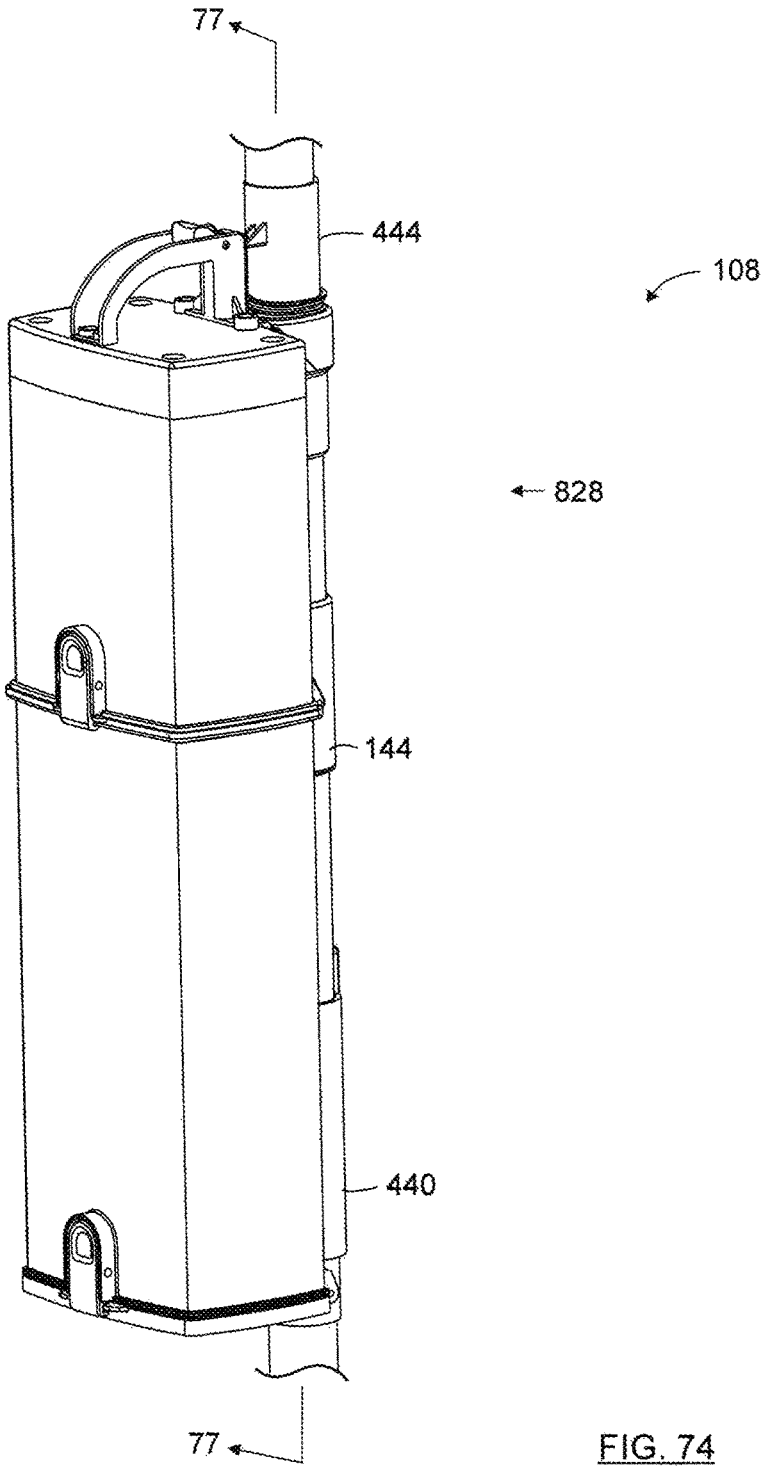
Figure 75:
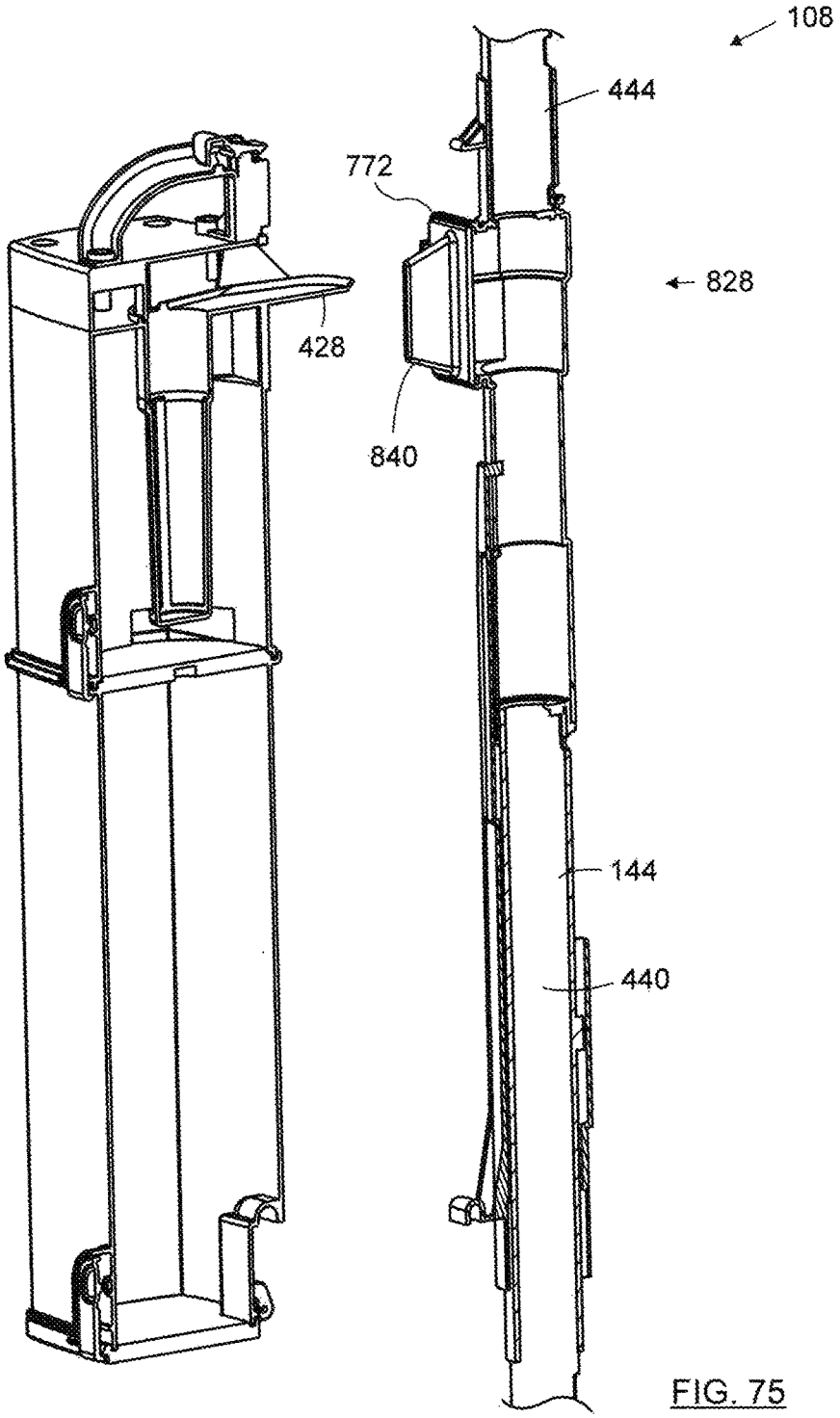
Figure 76:
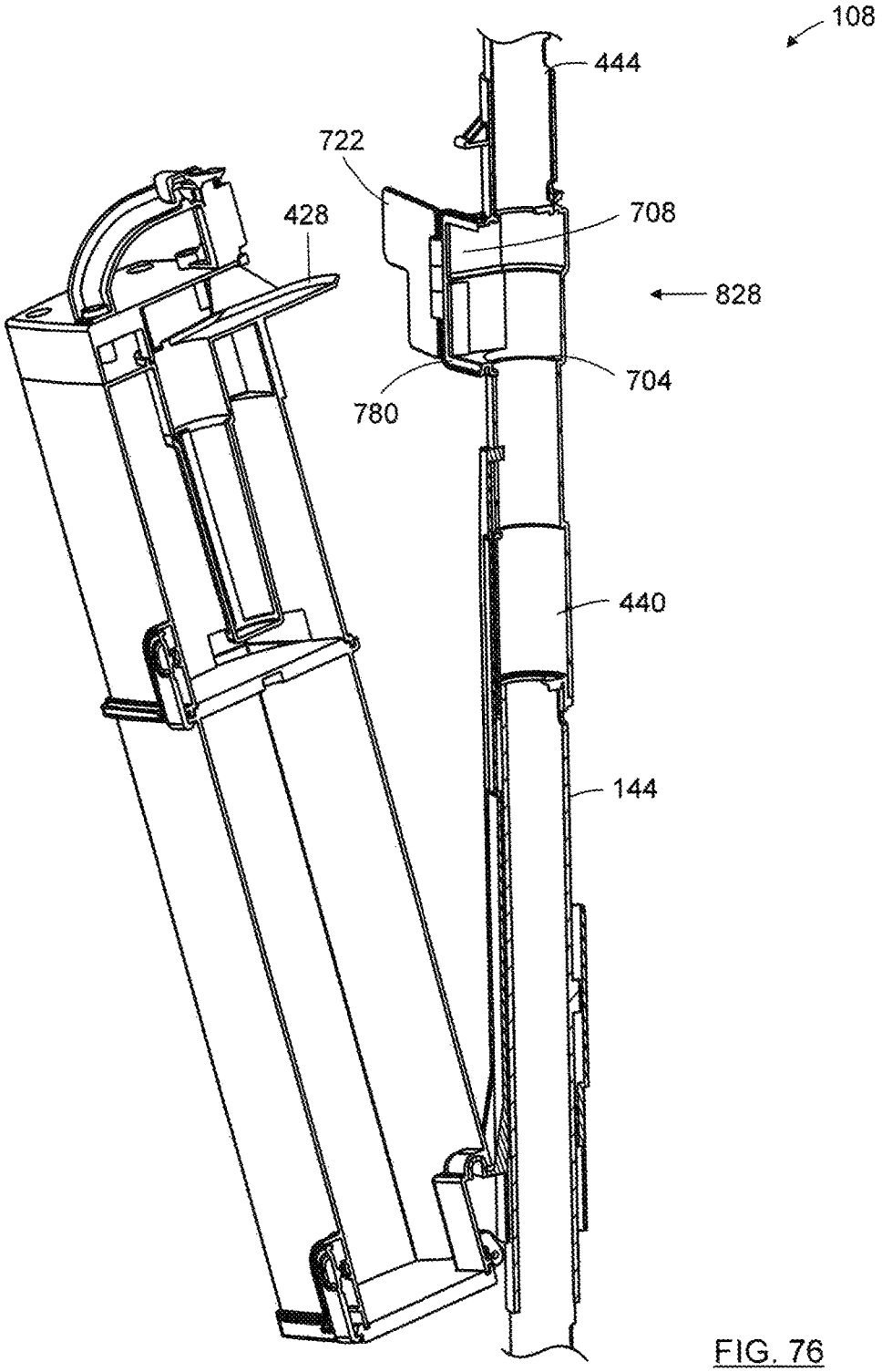
Figure 77:
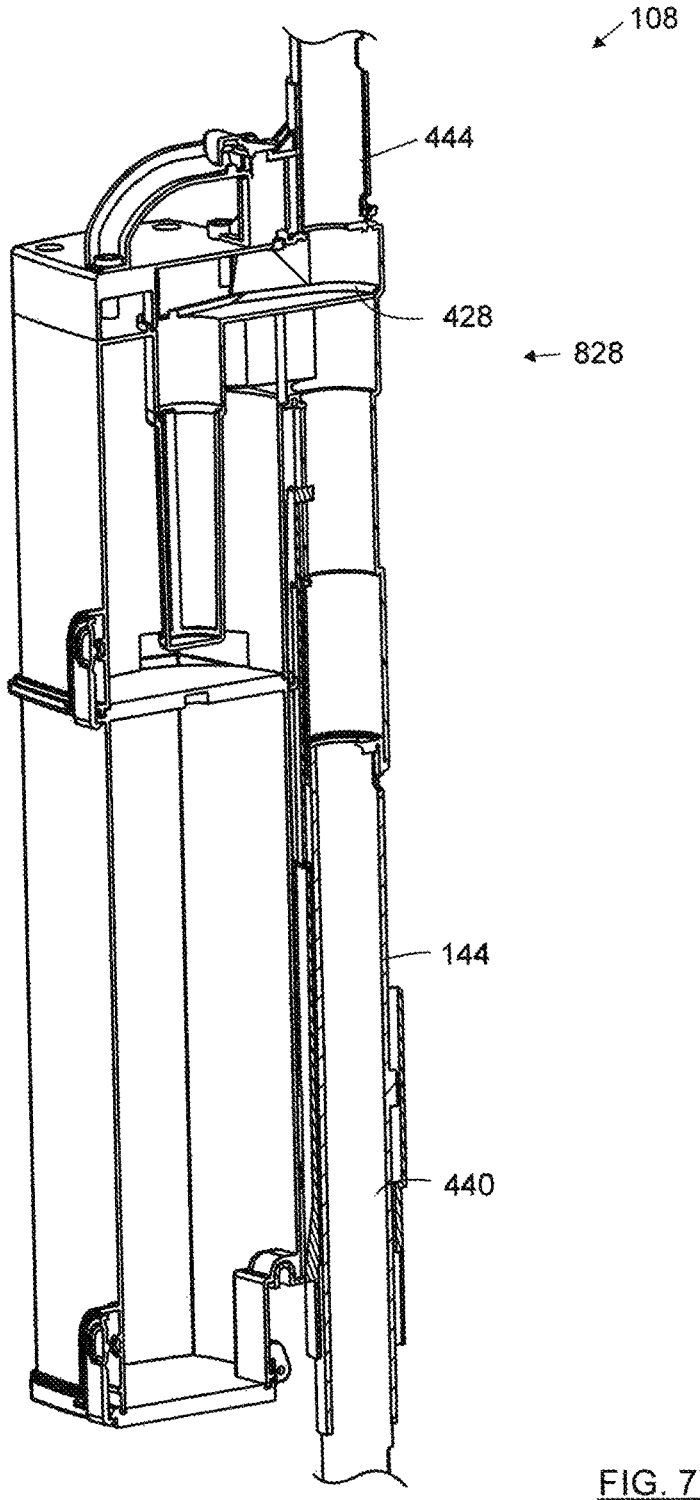
Figure 78:
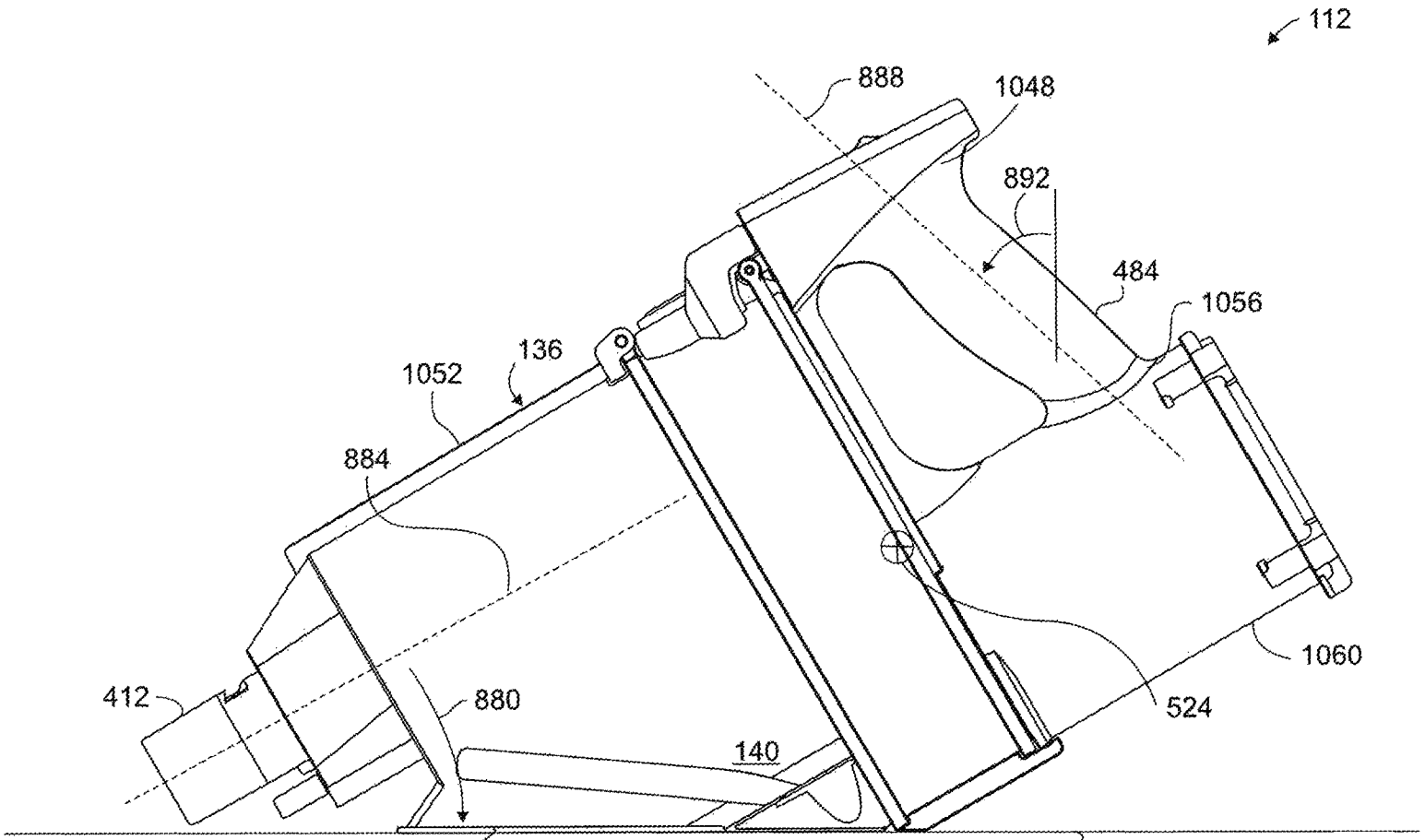
Figure 79:
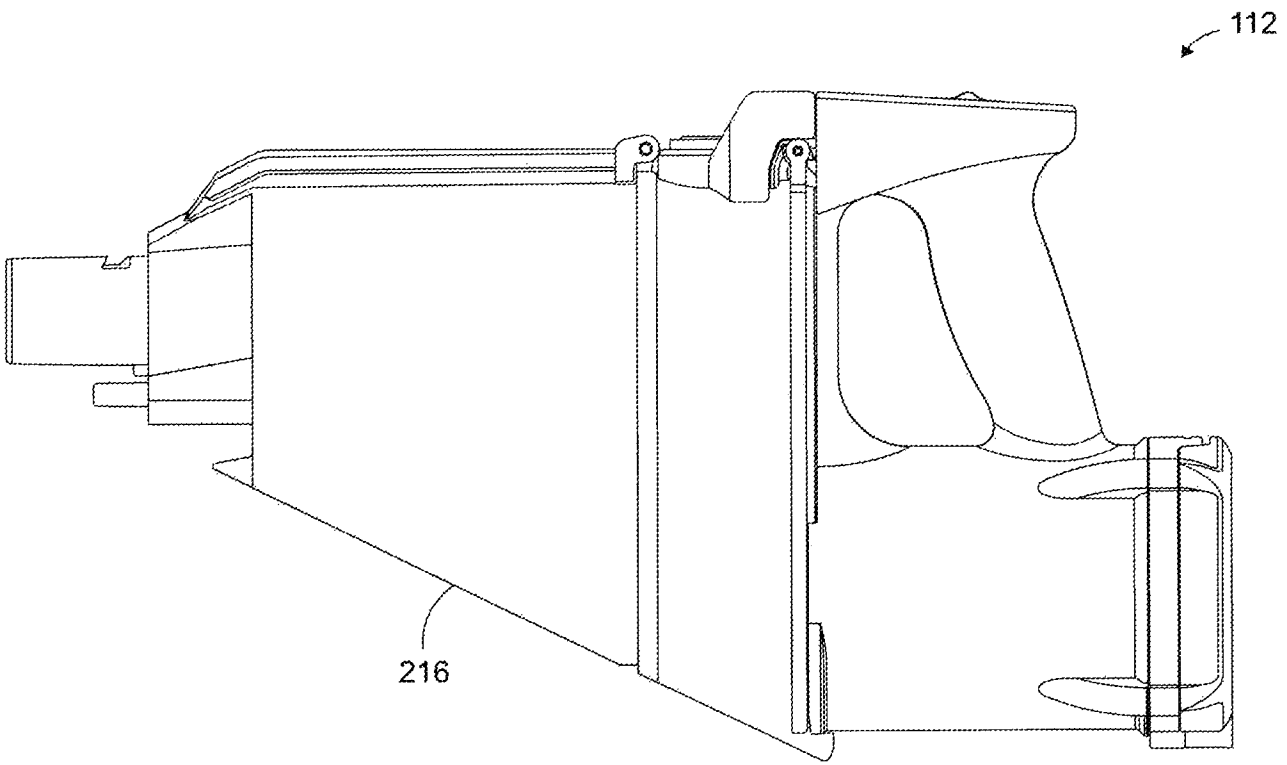
Figure 80:
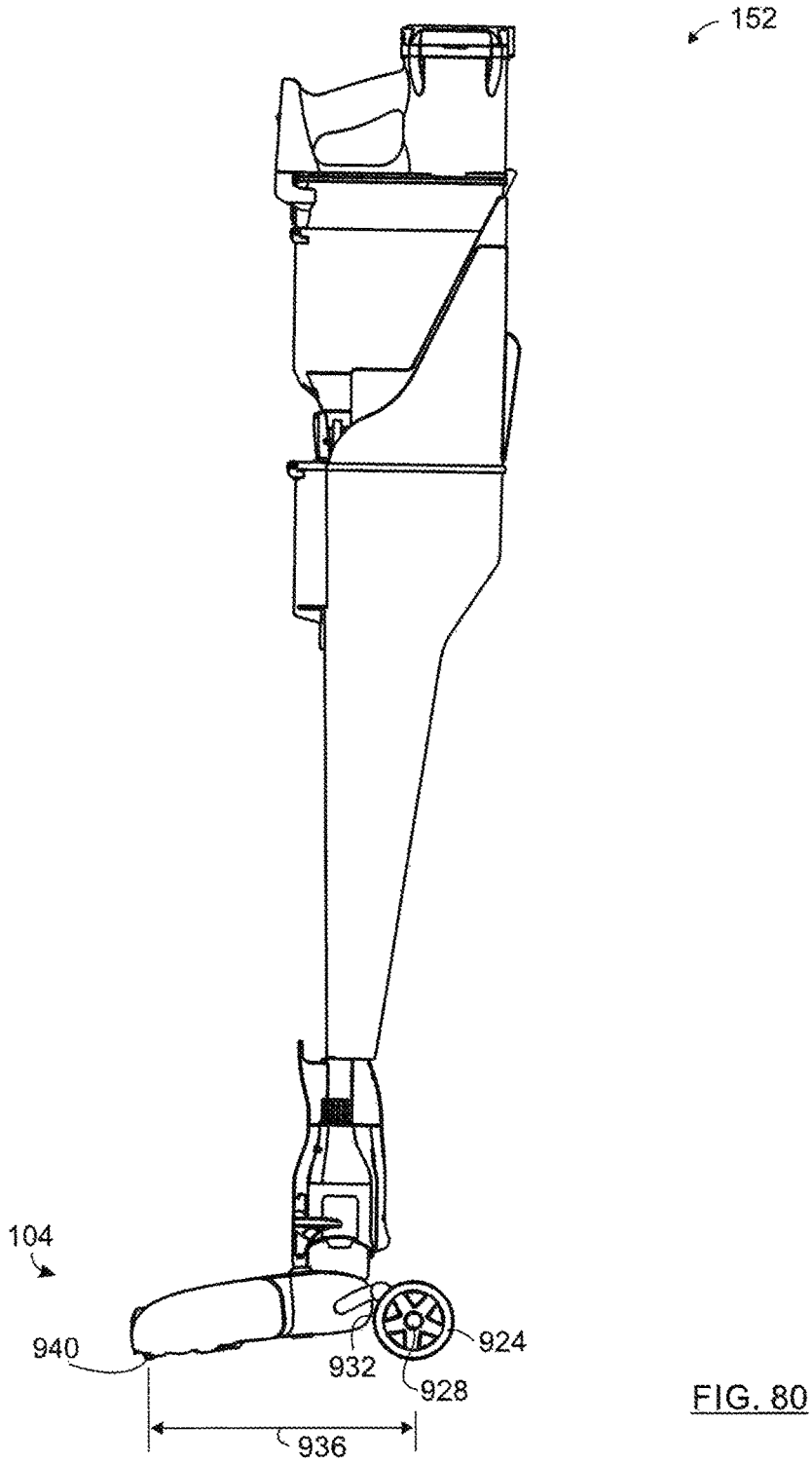
Figure 81:
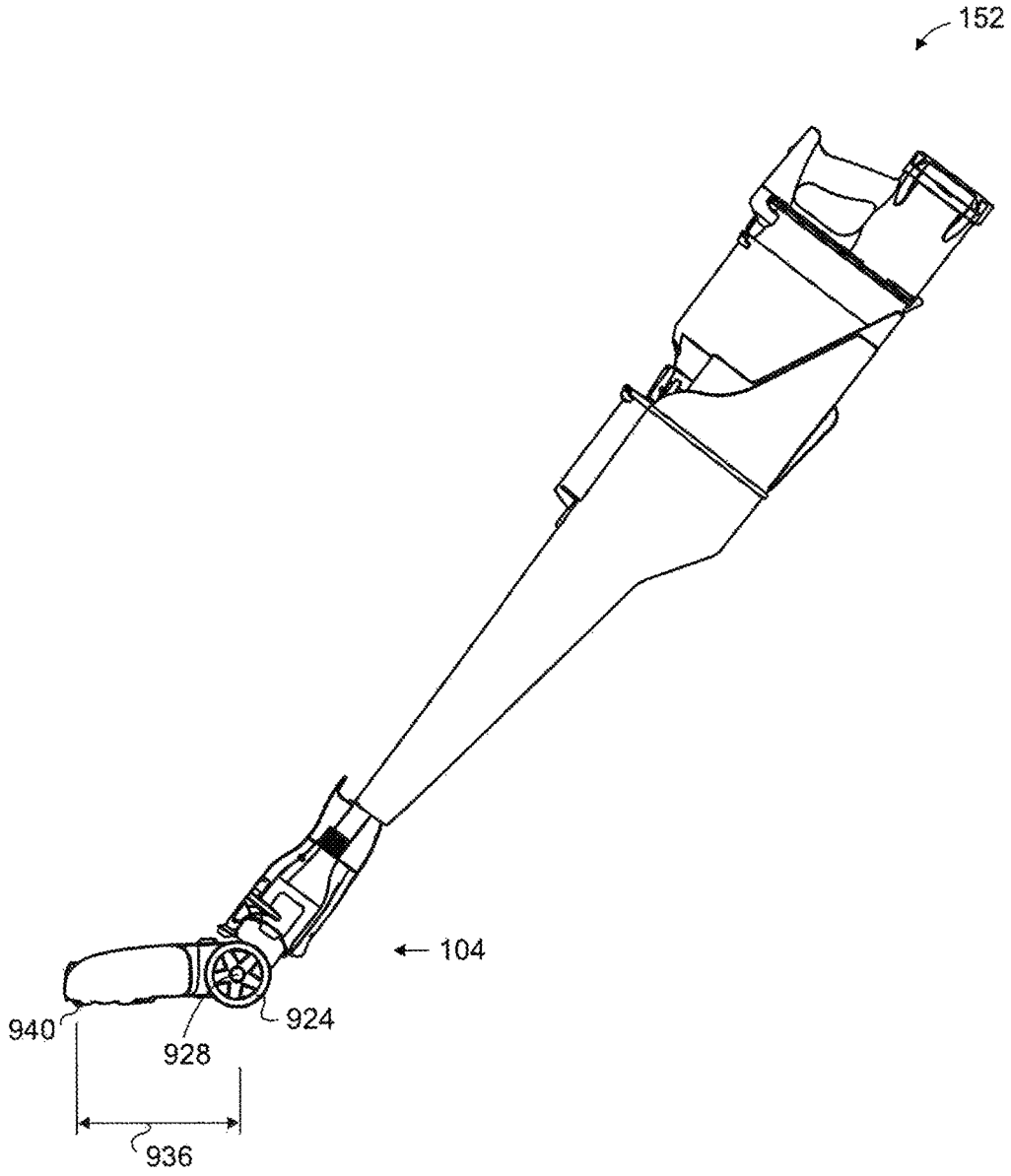
Figure 82:
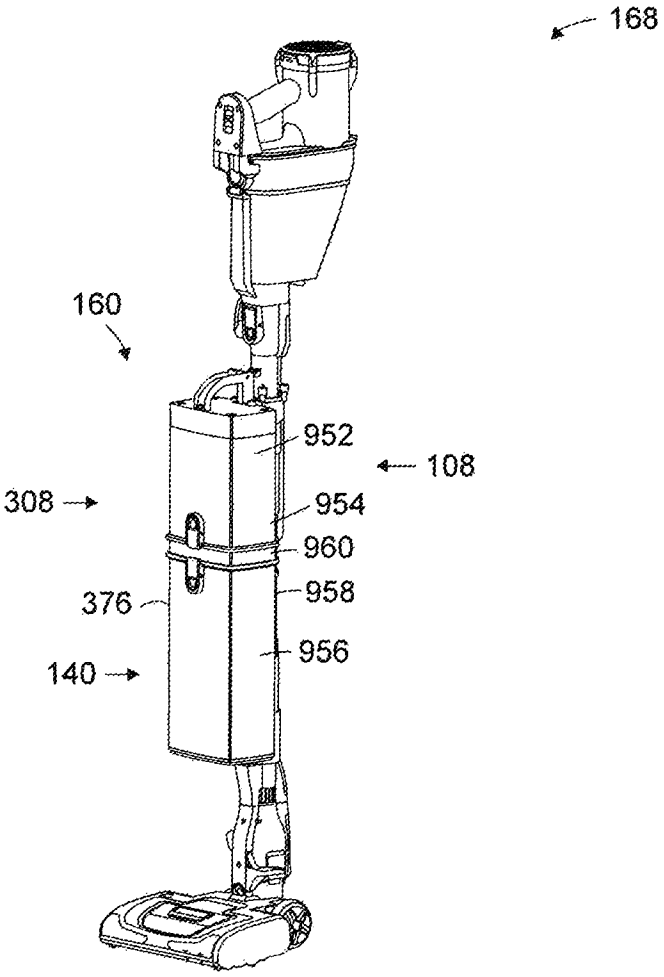
Figure 83:
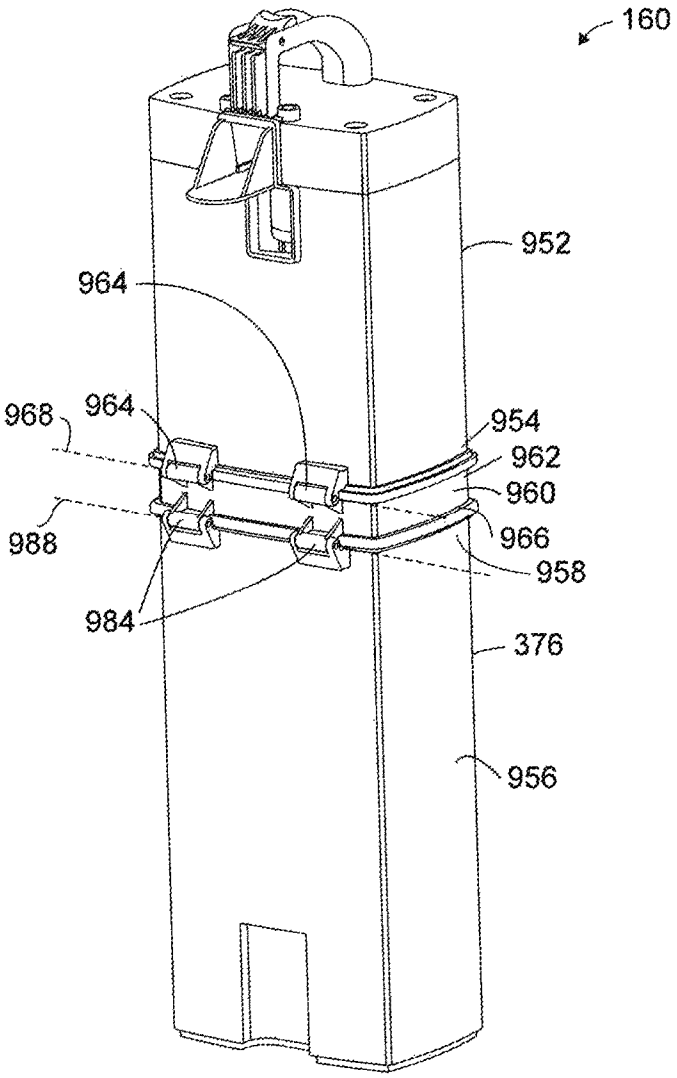
Figure 84:
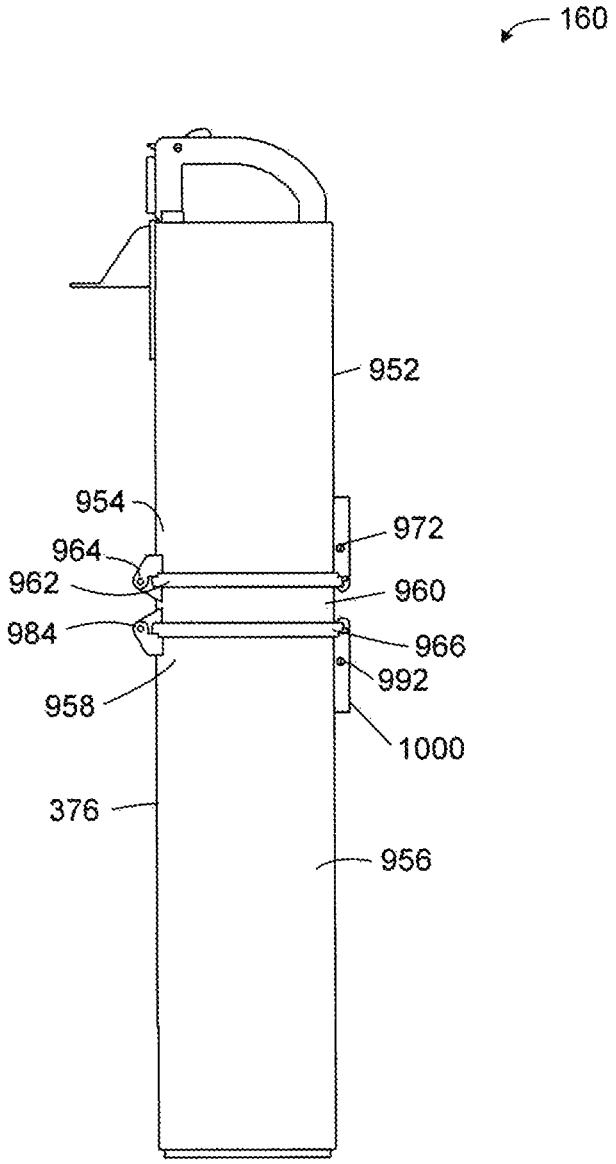
Figure 85:
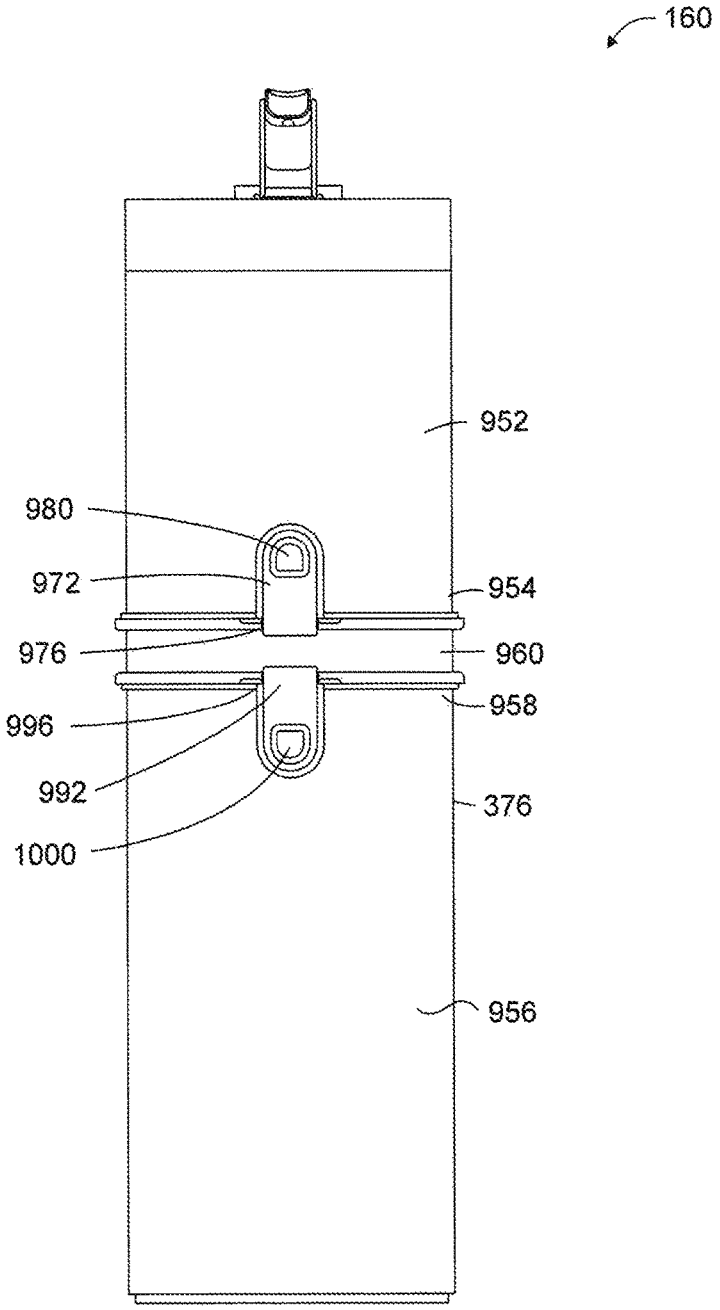
Figure 86:
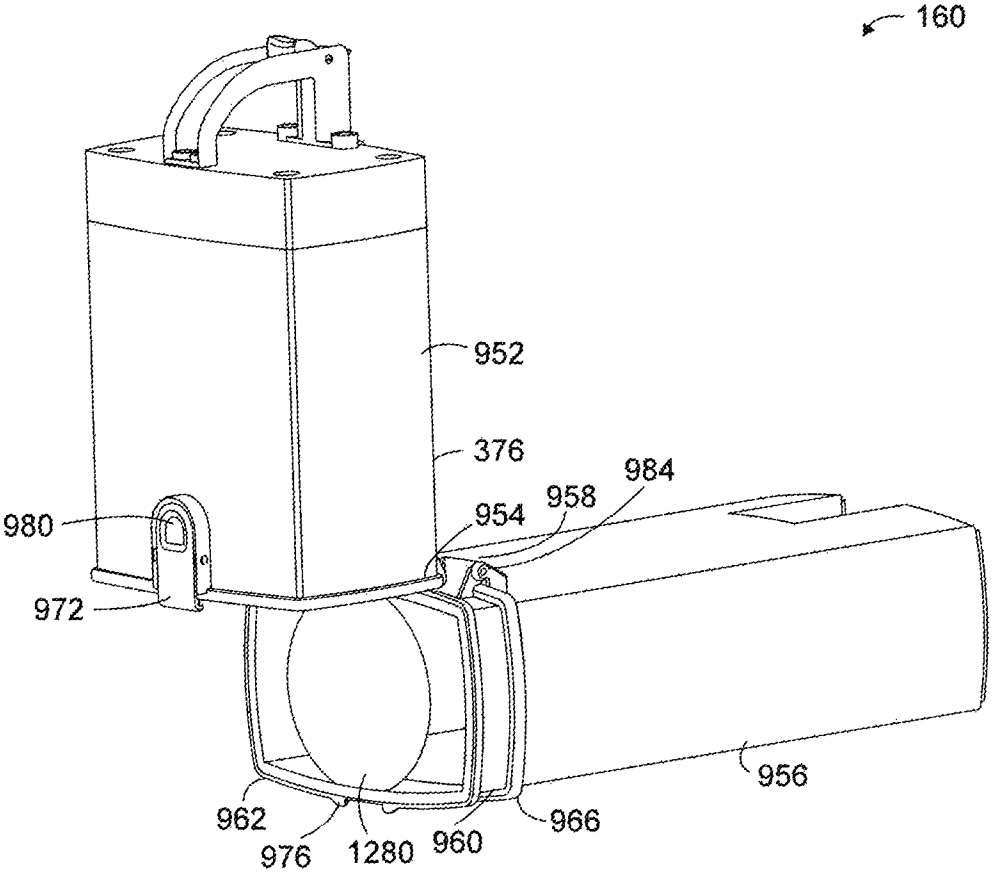
Figure 87:
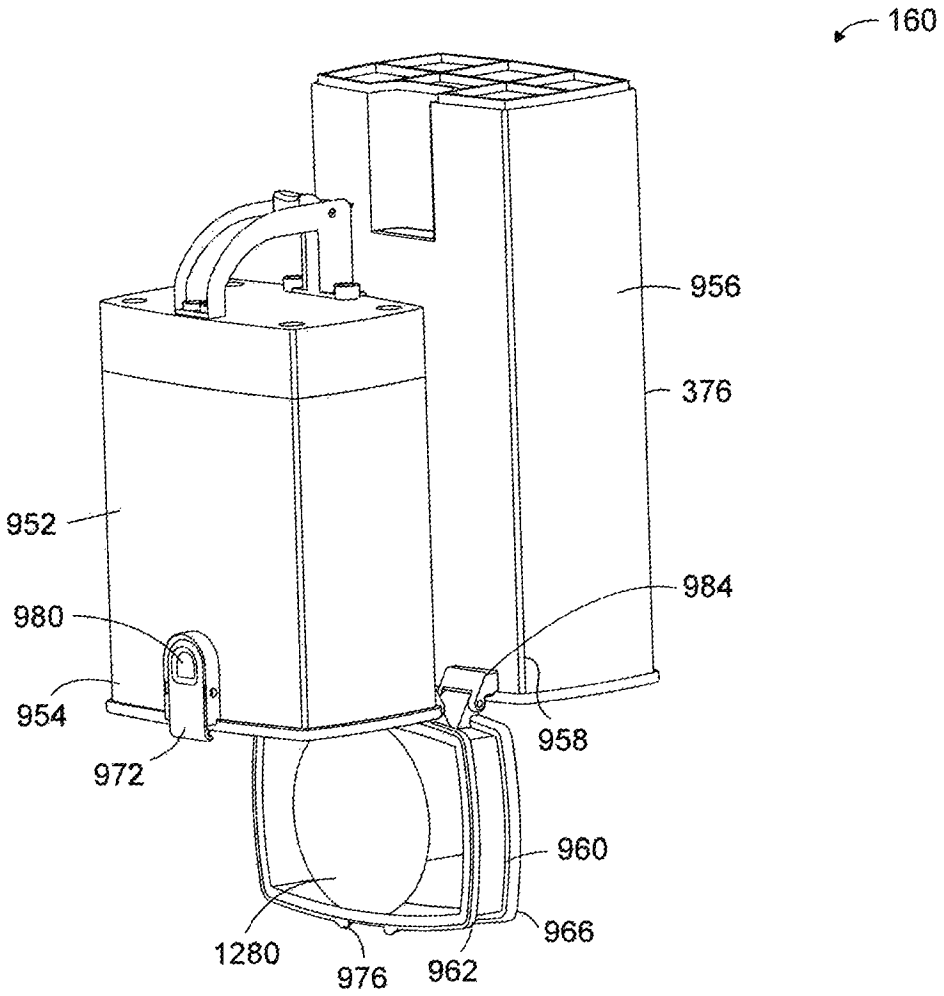
Figure 88:
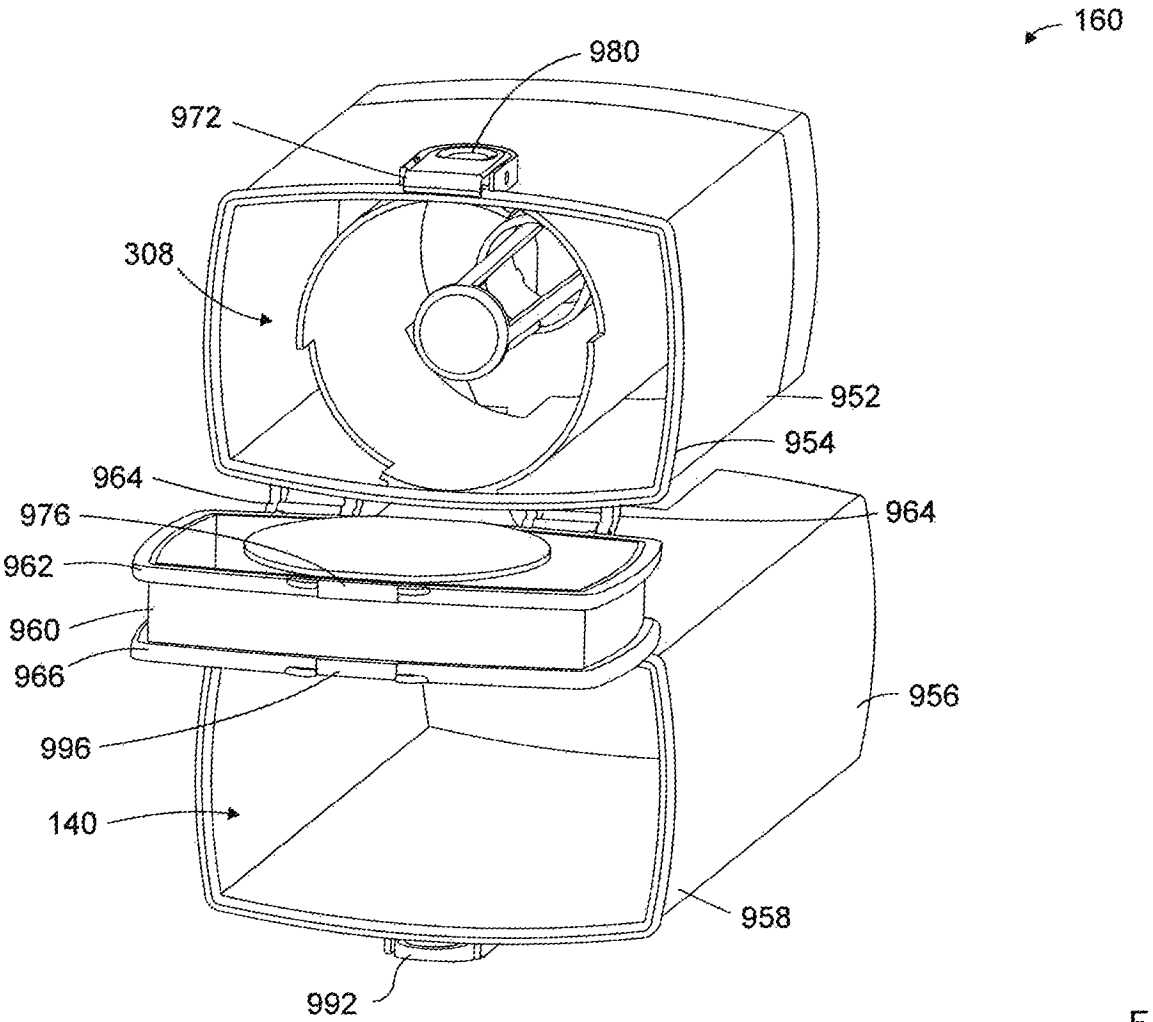
Figure 89:
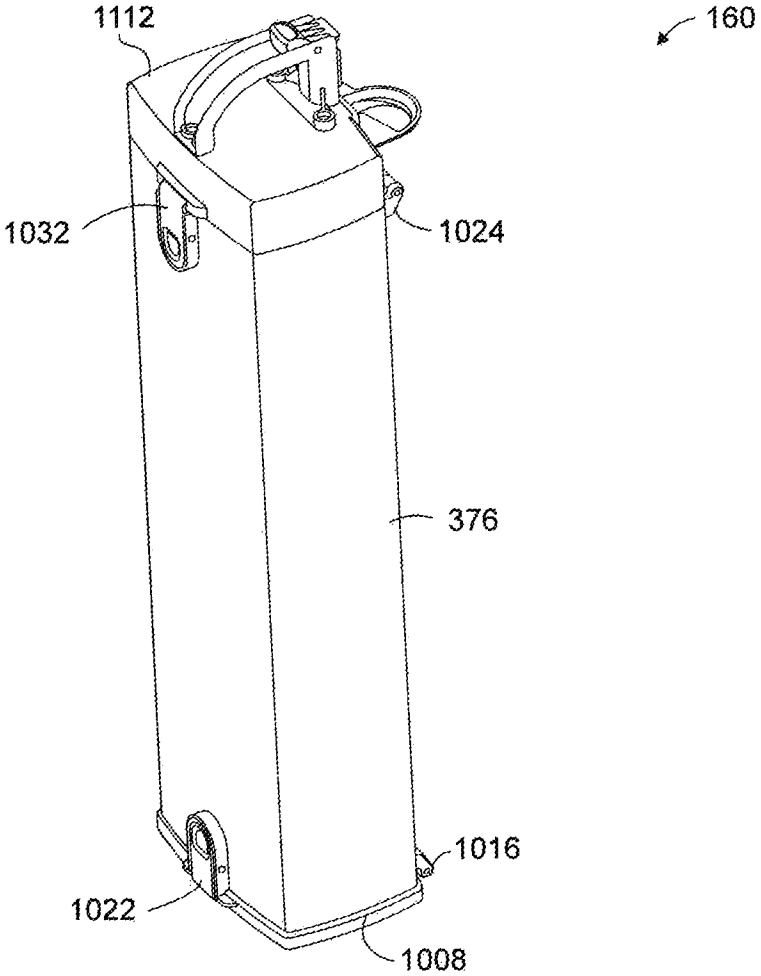
Figure 90:
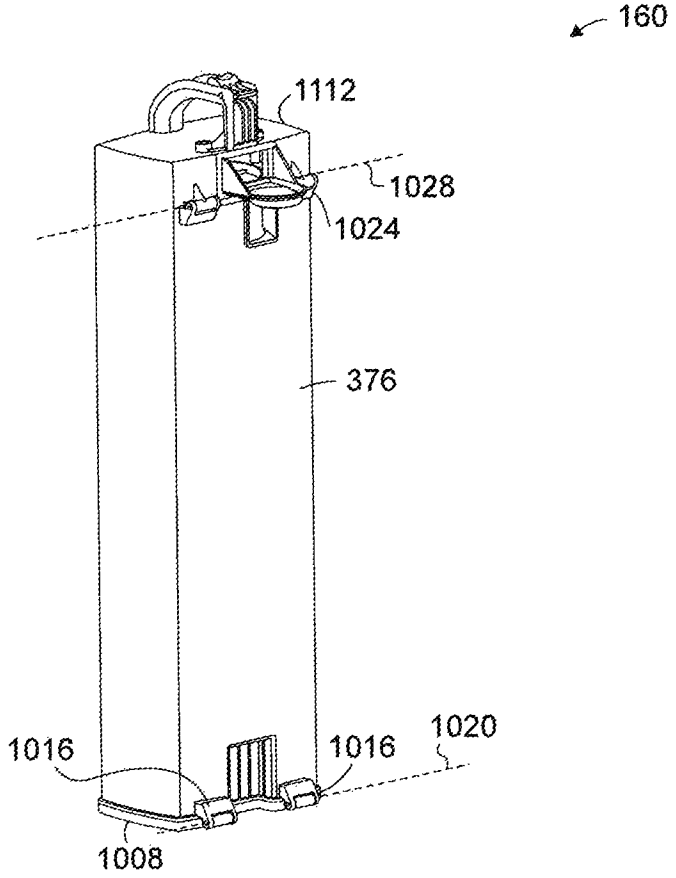
Figure 91:
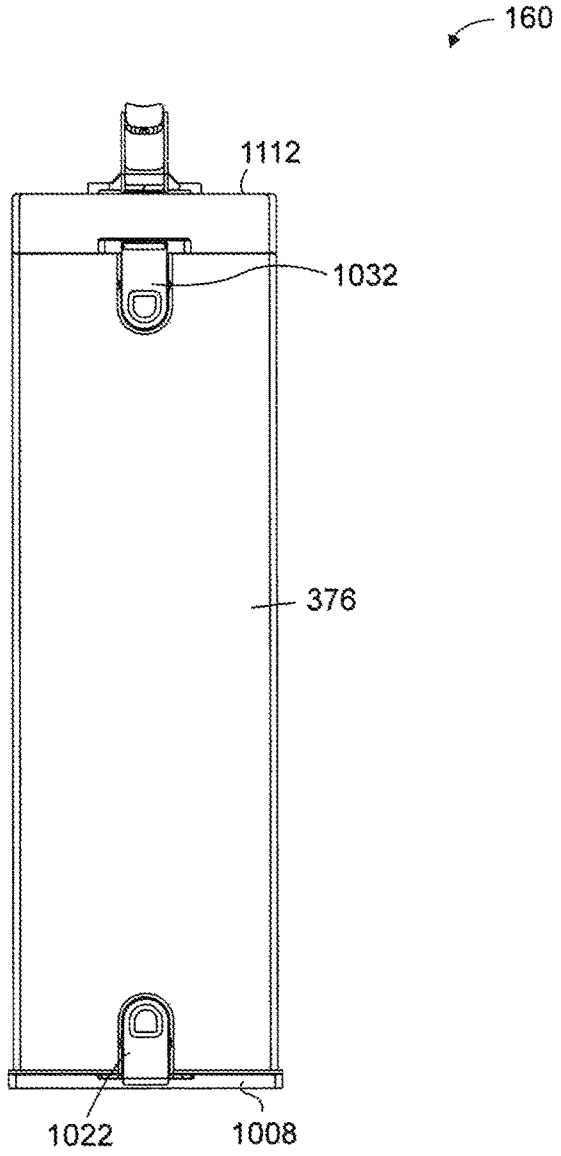
Figure 92:
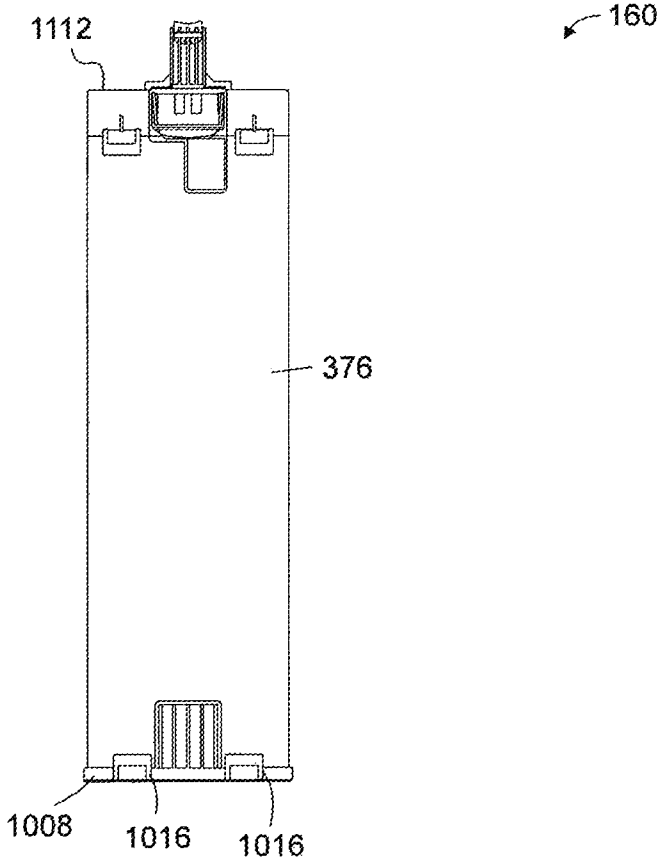
Figure 93:
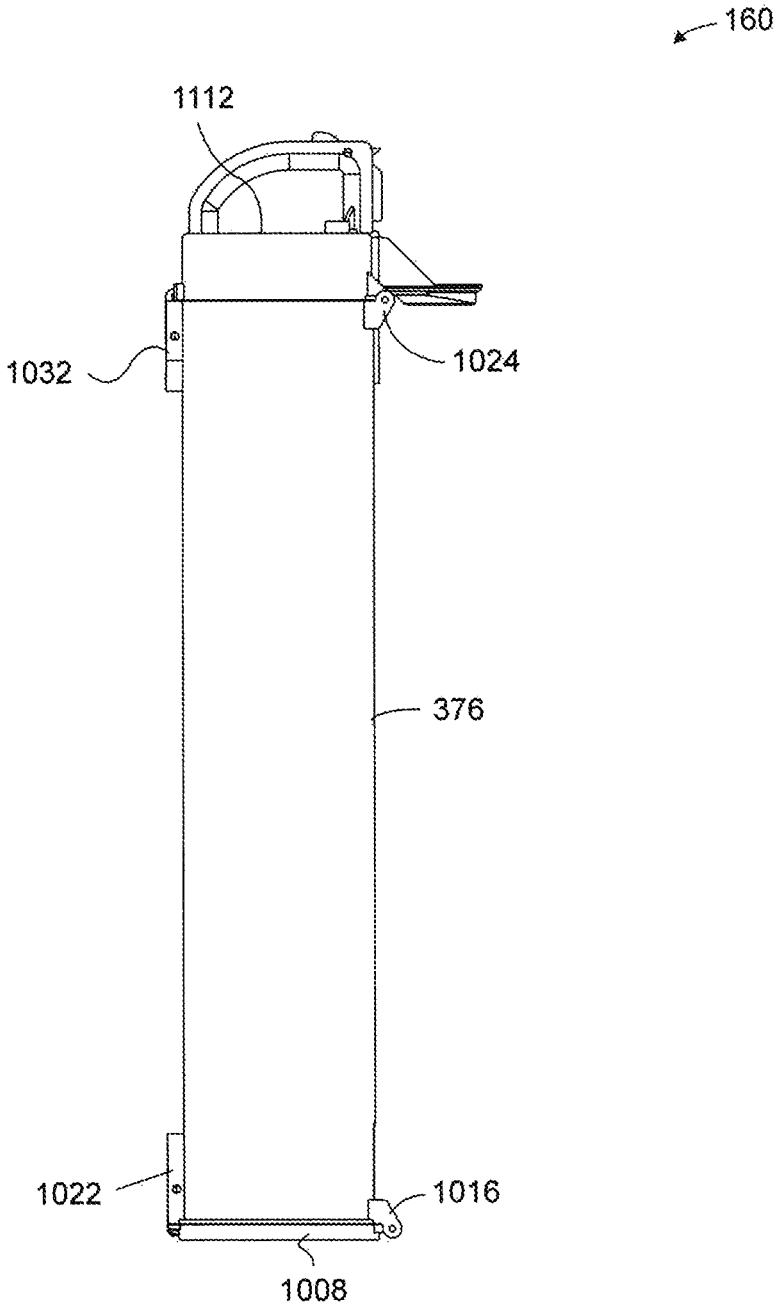
Figure 94:
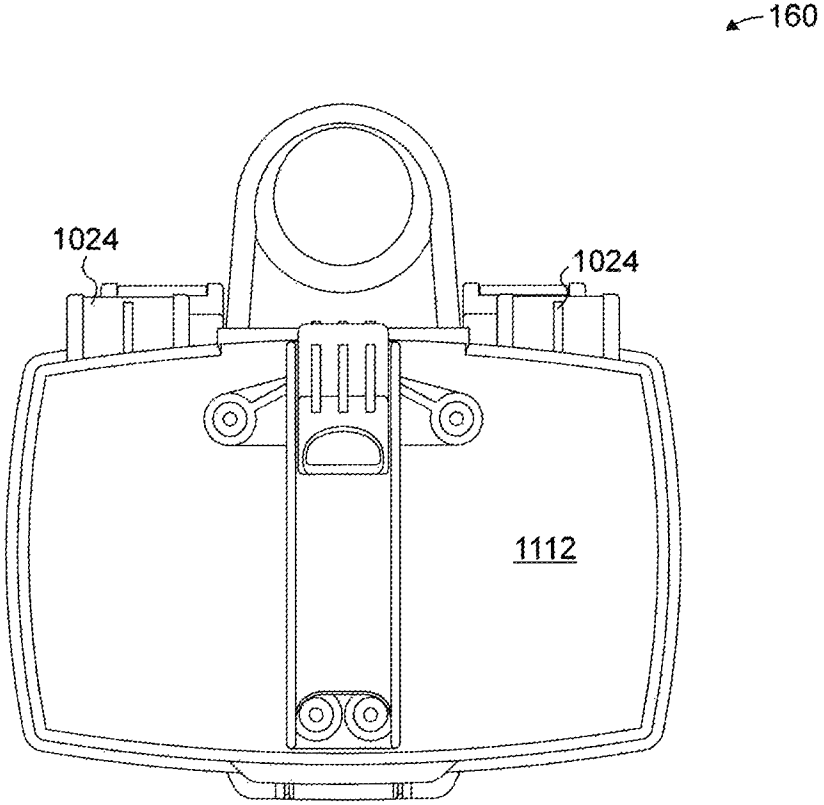
Figure 95:
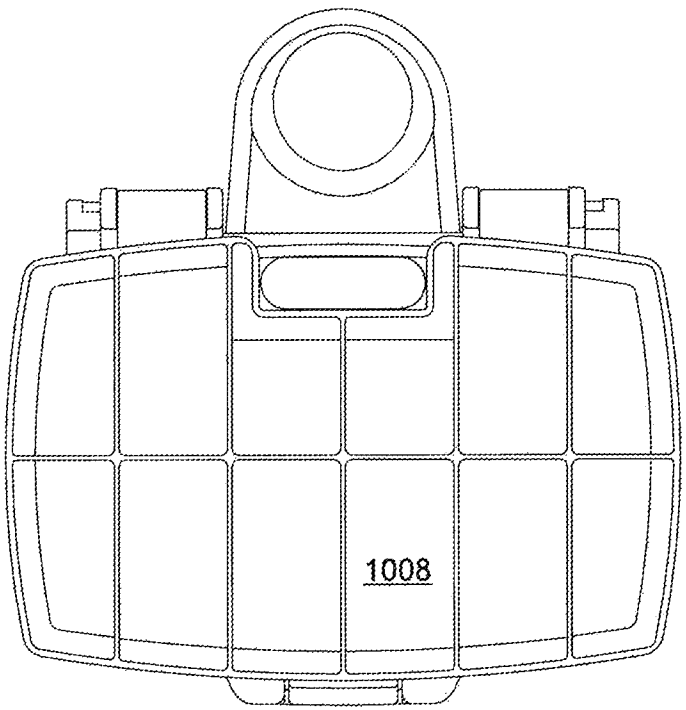
Figure 95B:
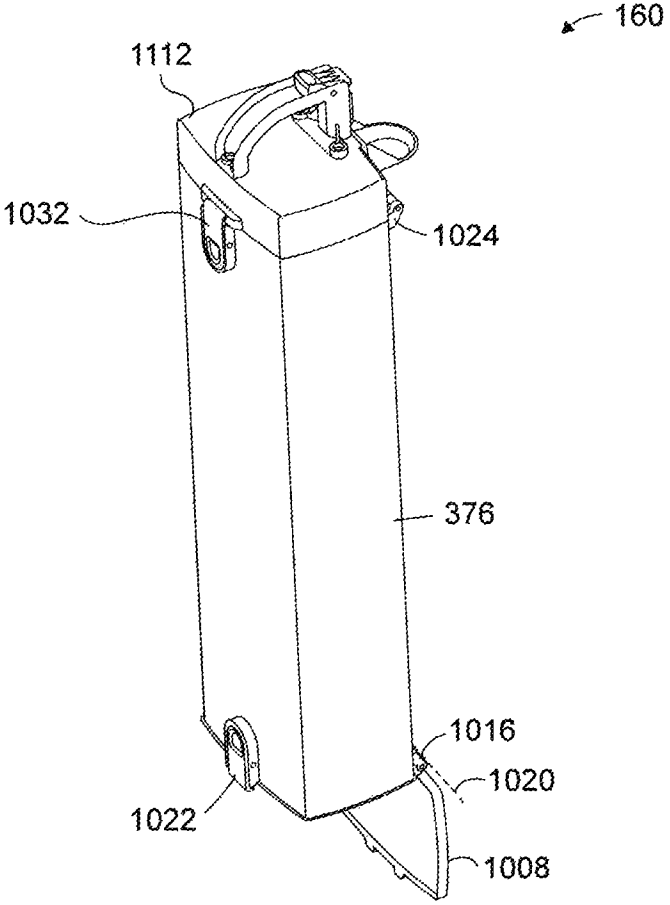
Figure 95C:
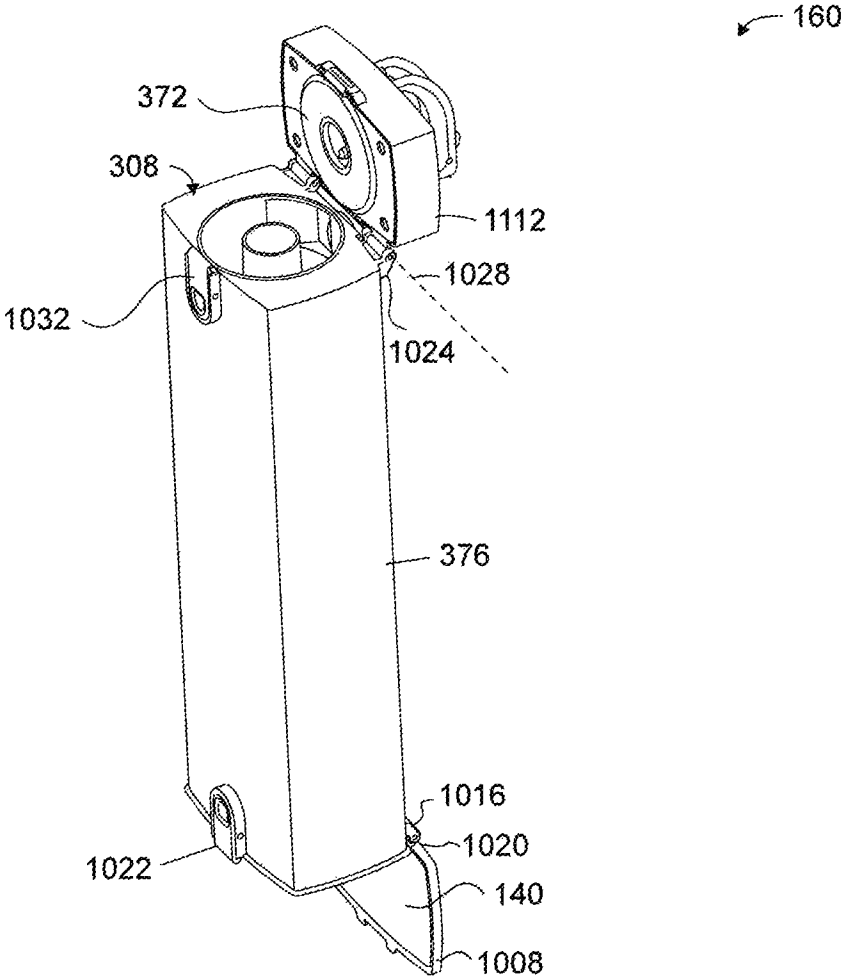
Figure 96:
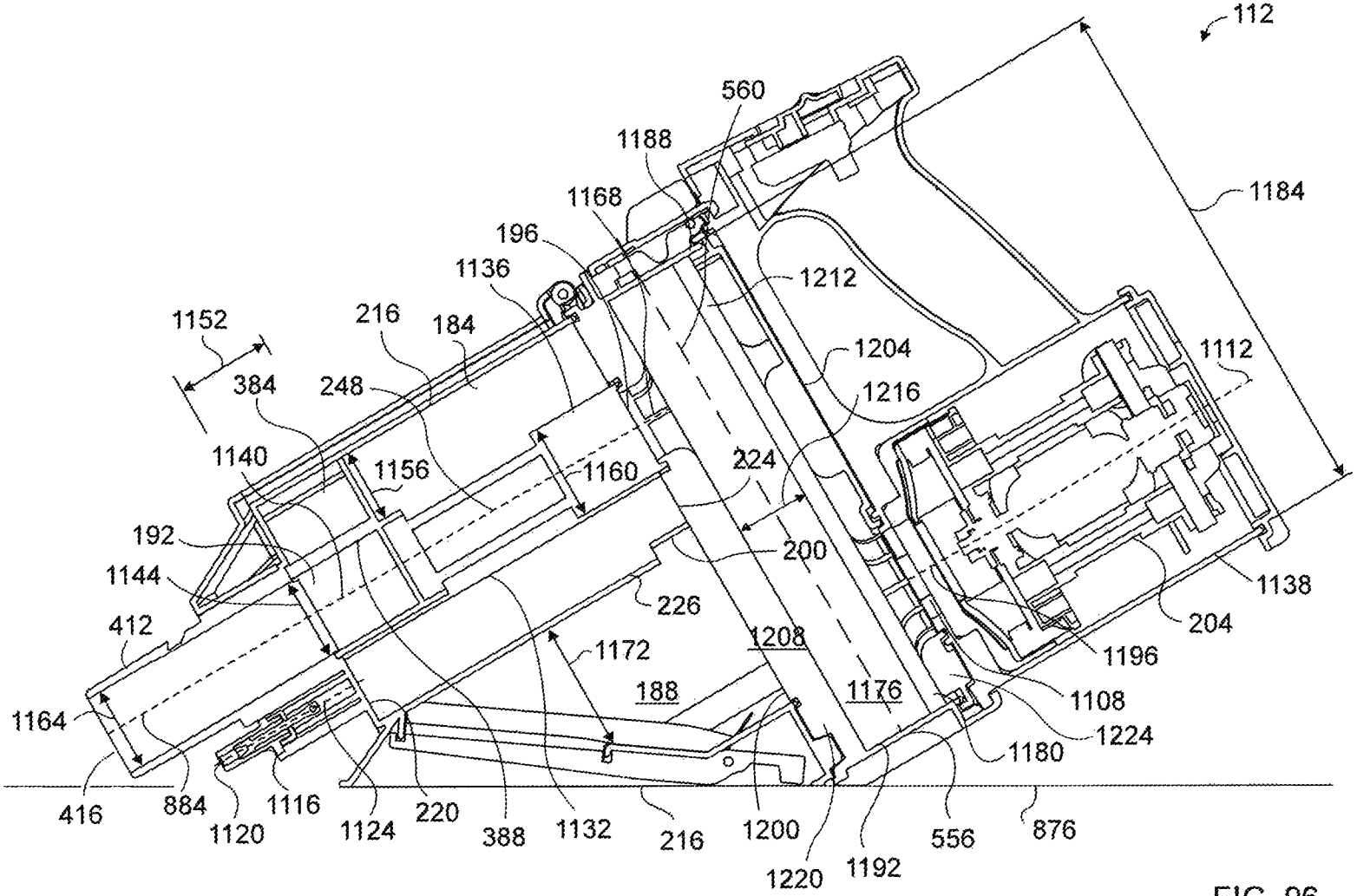
Figure 97A:
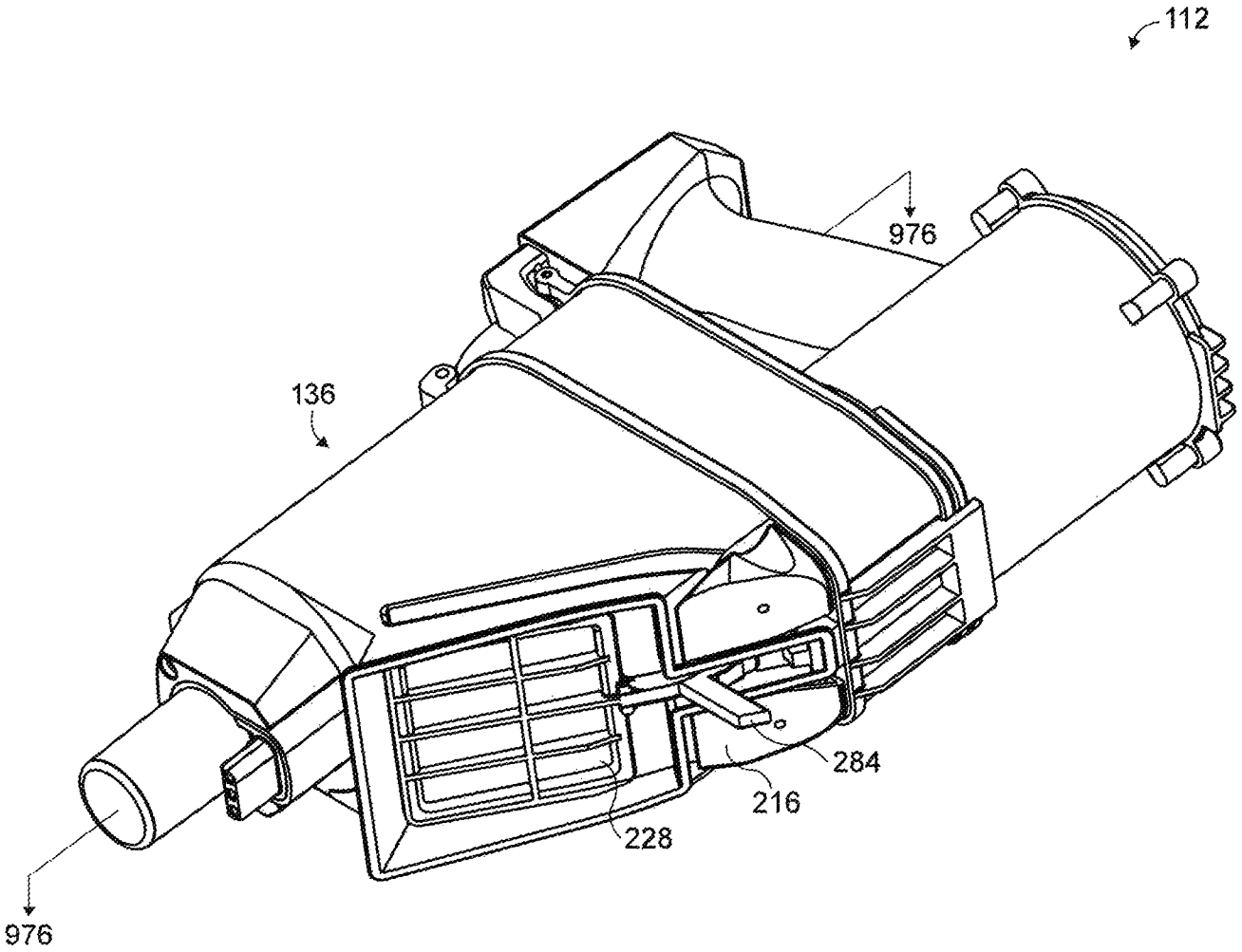
Figure 97B:
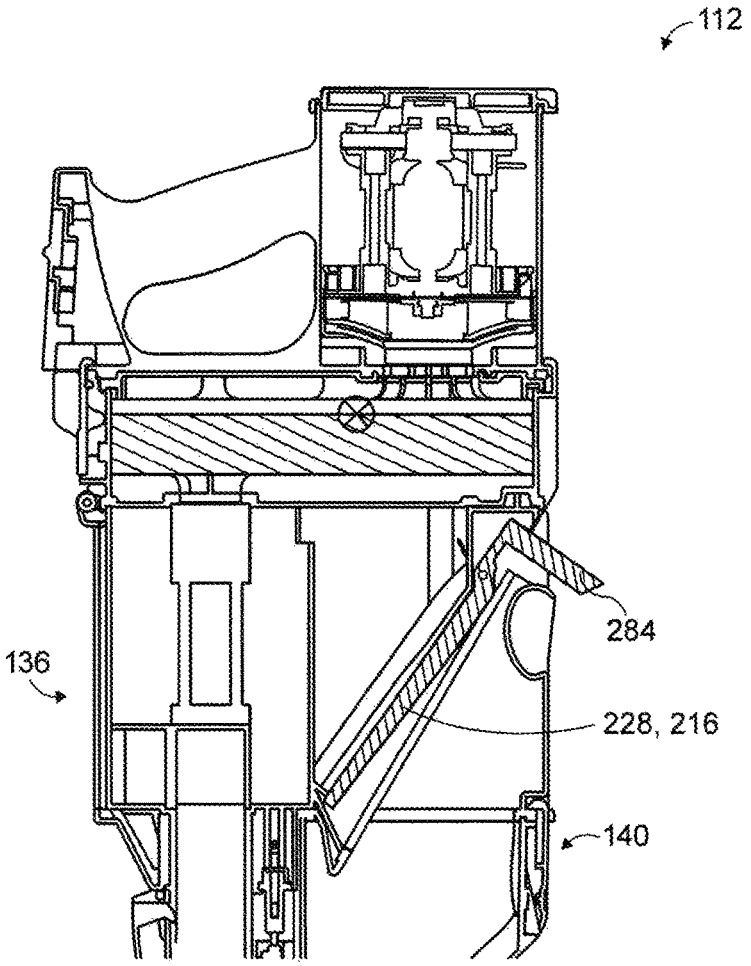

FIG. 45 is a rear perspective view of the supplemental dirt collection chamber of FIG. 24;

FIG. 46 is a side elevation view of the supplemental dirt collection chamber of FIG. 24;

FIG. 47 is a front perspective view of a surface cleaning apparatus in accordance with another embodiment;

FIG. 48 is a cross-sectional view taken along line 48-48 in FIG. 47;

FIG. 49 is a cross-section view taken along line 49-49 in FIG. 47;

FIG. 50 is a side elevation view of the apparatus of FIG. 47;

FIG. 51 is a front elevation view of the apparatus of FIG. 47;

FIG. 52 is a front perspective view of an upright section of the apparatus of FIG. 13 including a diversion valve in a closed position;

FIG. 53 is a front perspective view of the upright section of FIG. 52 with a cyclone bin assembly seated on a pedal of the diversion valve;

FIG. 54 is a front perspective view of the upright section of FIG. 52 with the cyclone bin assembly connected to a wand, and the diversion valve in the open position;

FIG. 55 is a cross-sectional view taken along line 55-55 in FIG. 52;

FIG. 56 is a cross-sectional view taken along line 56-56 in FIG. 53;

FIG. 57 is a cross-sectional view taken along line 57-57 in FIG. 54;

FIG. 58 is a front perspective view of an upright section of the apparatus of FIG. 13 including another diversion valve in a closed position FIG. 59 is a front perspective view of the upright section of FIG. 58 with the cyclone bin assembly being connected to a wand, and the diversion valve in the closed position;

FIG. 60 is a front perspective view of the upright section of FIG. 58 with the cyclone bin assembly connected to the wand, and the diversion valve in the open position FIG. 61 is a cross-sectional view taken along line 61-61 in FIG. 58;

FIG. 62 is a cross-sectional view taken along line 62-62 in FIG. 59;

FIG. 63 is a cross-sectional view taken along line 63-63 in FIG. 60;

FIG. 64 is a front perspective view of an upright section of the apparatus of FIG. 13 including another diversion valve in a closed position;

FIG. 65 is a front perspective view of the upright section of FIG. 64 with the diversion valve in a partially opened position;

FIG. 66 is a front perspective view of the upright section of FIG. 64 mounted to the wand with the diversion valve in an open position;

FIG. 67 is a cross-sectional view of the upright section of FIG. 64;

FIG. 68 is another cross-sectional view of the upright section of FIG. 64;

FIG. 69 is an enlarged view of a portion of FIG. 68;

FIG. 70 is a cross-sectional view taken along line 70-70 in FIG. 65;

FIG. 71 is a cross-sectional view taken along line 71-71 in FIG. 66;

FIG. 72 is a front perspective view of an upright section of the apparatus of FIG. 13 with another diversion valve in a closed position;

FIG. 73 is a front perspective view of the upright section of FIG. 72 being connected to the wand and with the diversion valve in a closed position;

FIG. 74 is a front perspective view of the upright section of FIG. 72 connected to the wand and with the diversion valve in an open position;

FIG. 75 is a cross-section view taken along line 75-75 in FIG. 72;

FIG. 76 is a cross-section view taken along line 76-76 in FIG. 73;

FIG. 77 is a cross-section view taken along line 77-77 in FIG. 74;

FIG. 78 is a side elevation view of the handvac of the apparatus of FIG. 1;

FIG. 79 is a side elevation view of the handvac of the apparatus of FIG. 5;

FIG. 80 is a side elevation view of the apparatus of FIG. 5 in an upright storage position with a surface cleaning head having rearwardly deployed wheels;

FIG. 81 is a side elevation view of the apparatus of FIG. 80 in a reclined in-use position with the rear wheels of the surface cleaning head retracted;

FIG. 82 is a front perspective view of the apparatus of FIG. 13 with a cyclone bin assembly in accordance with at least one embodiment;

FIG. 83 is a rear perspective view of the cyclone bin assembly of FIG. 82 in a closed position;

FIG. 84 is a side elevation view of the cyclone bin assembly of FIG. 82 in a closed position;

FIG. 85 is a front elevation view of the cyclone bin assembly of FIG. 82 in a closed position;

FIG. 86 is a front elevation view of the cyclone bin assembly of FIG. 82 with a cyclone chamber portion in an open position;

FIG. 87 is a front elevation view of the cyclone bin assembly of FIG. 82 with the cyclone chamber portion and a dirt collection portion in open positions;

FIG. 88 is a top perspective view of the cyclone bin assembly of FIG. 82 with the cyclone chamber portion and the dirt collection portion in open positions;

FIG. 89 is a front perspective view of the cyclone bin assembly of the apparatus of FIG. 13;

FIG. 90 is a rear perspective view of the cyclone bin assembly of FIG. 89;

FIG. 91 is a front elevation view of the cyclone bin assembly of FIG. 89;

FIG. 92 is a rear elevation view of the cyclone bin assembly of FIG. 89;

FIG. 93 is a side elevation view of the cyclone bin assembly of FIG. 89;

FIG. 94 is a top plan view of the cyclone bin assembly of FIG. 89;

FIG. 95 is a bottom plan view of the cyclone bin assembly of FIG. 89;

FIG. 95*b* is a front perspective view of the cyclone bin assembly of FIG. 89 with a bottom portion in an open position;

FIG. 95*c* is a front perspective view of the cyclone bin assembly of FIG. 89 with top and bottom portions in open positions;

FIG. 96 is a cross-sectional view taken along line 96-96 in FIG. 22;

FIG. 97*a* is a bottom perspective view of the handvac of the apparatus of FIG. 1;

FIG. 97*b* is a partial cross-sectional view taken along line 97*b*-97*b* of FIG. 97*a;*

Figure 98A:
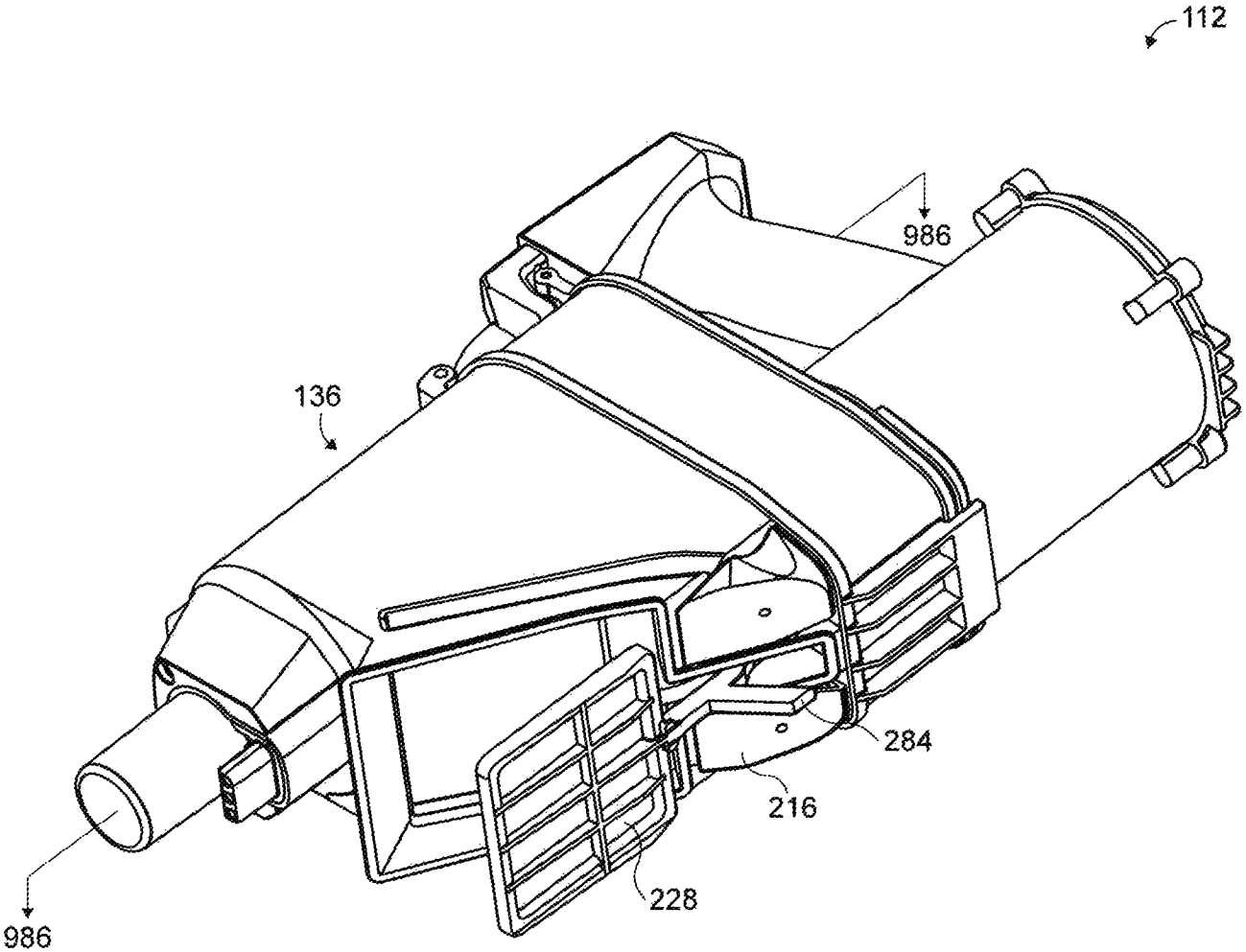
Figure 98B:
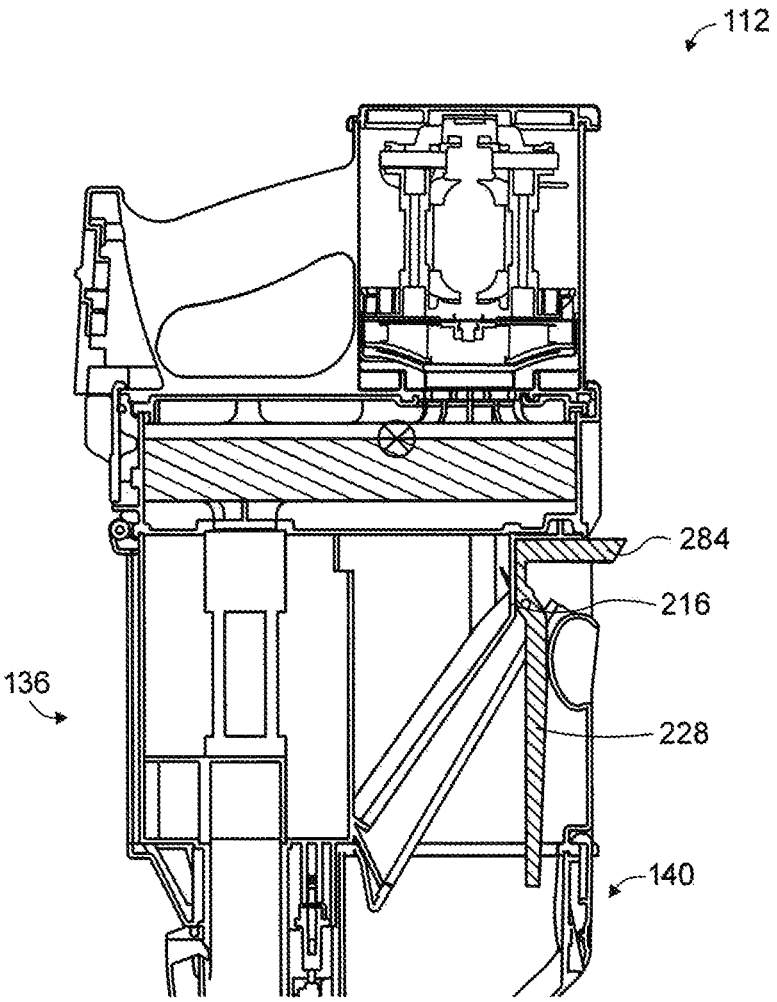

FIG. 98*a* is a bottom perspective view of the handvac of the apparatus of FIG. 1 with an open door;

FIG. 98*b* a partial cross-sectional view taken along line 98*b*-98*b* of FIG. 98*a;*

Figure 99:
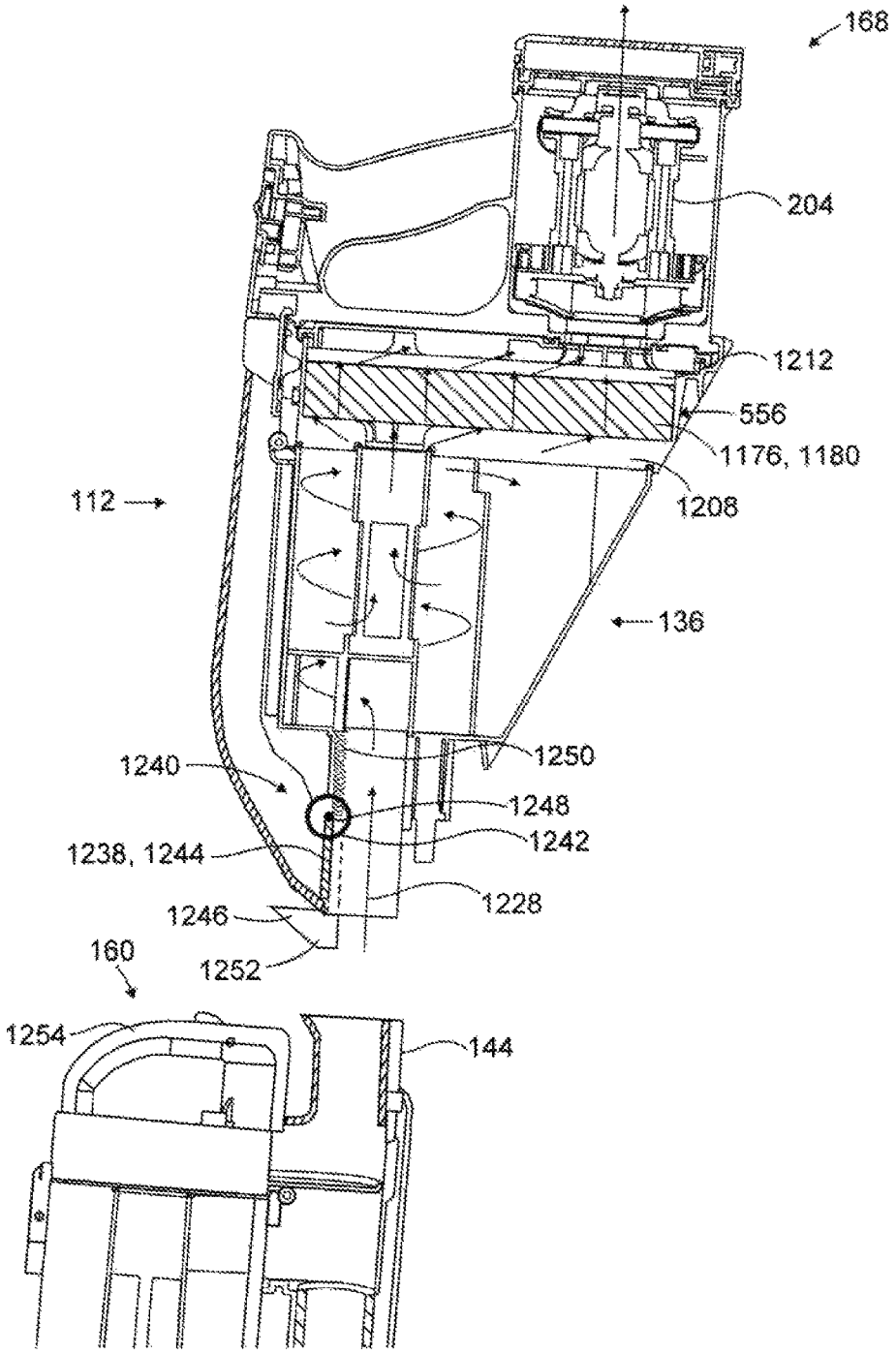
Figure 100:
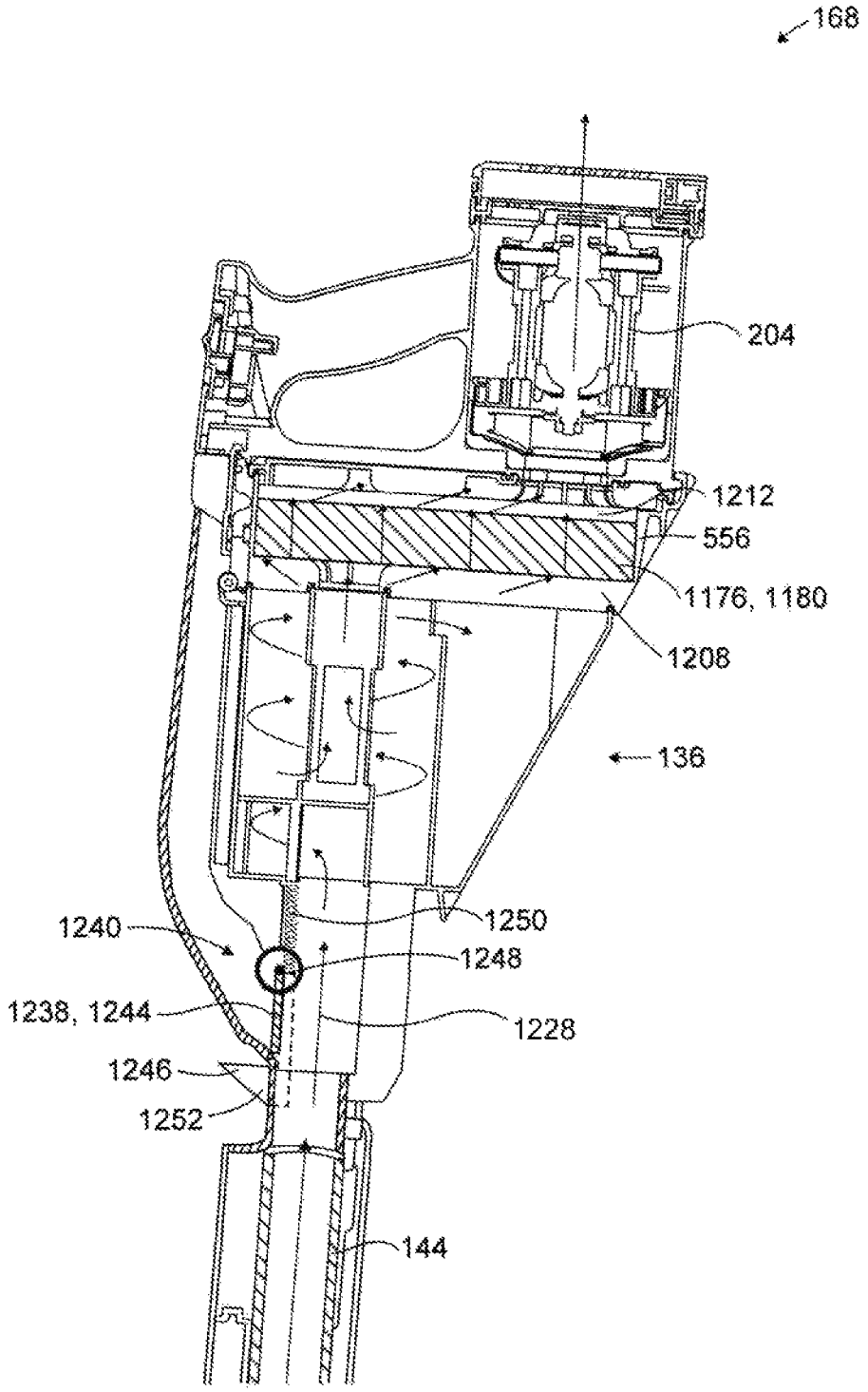
Figure 101:
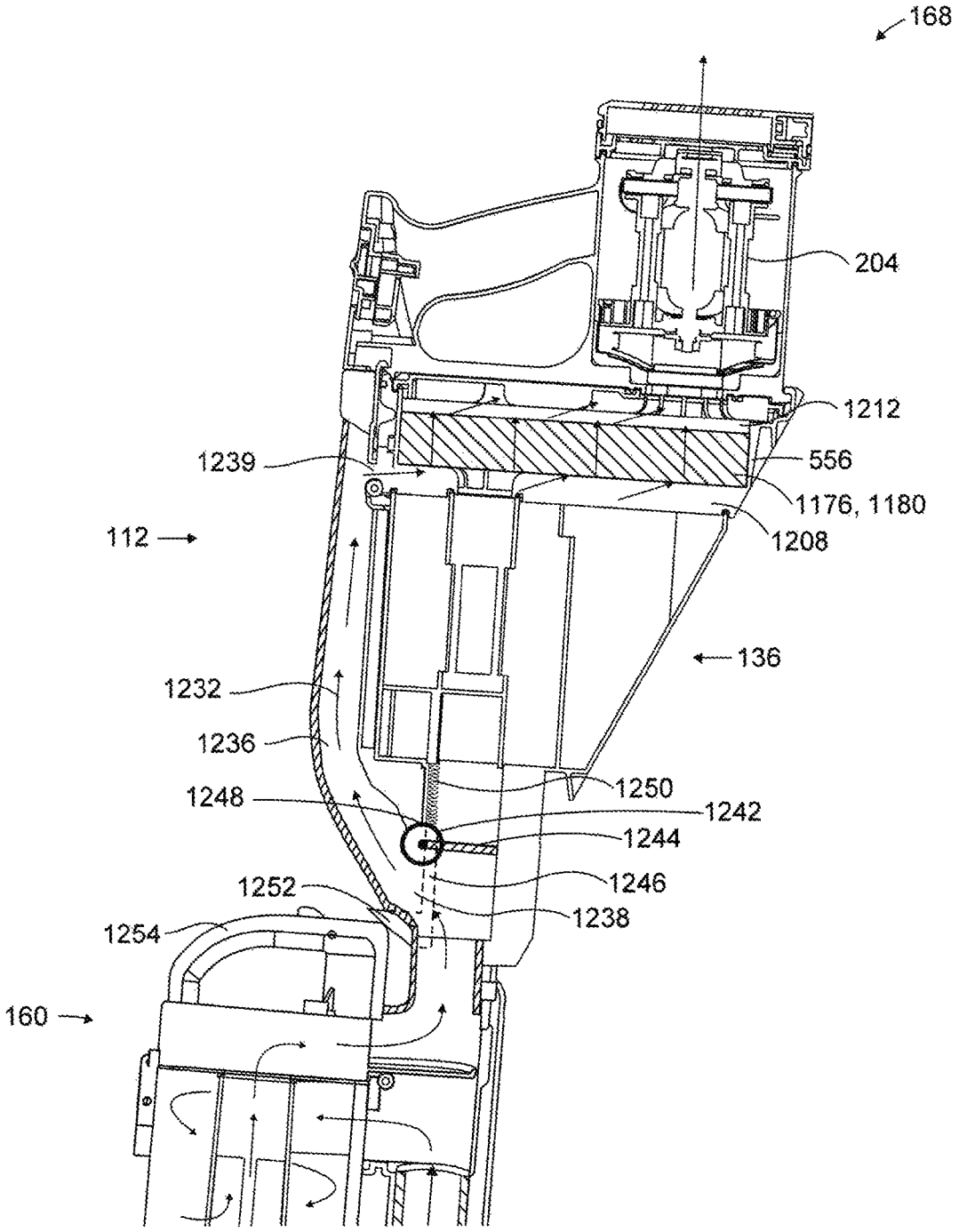
Figure 102:
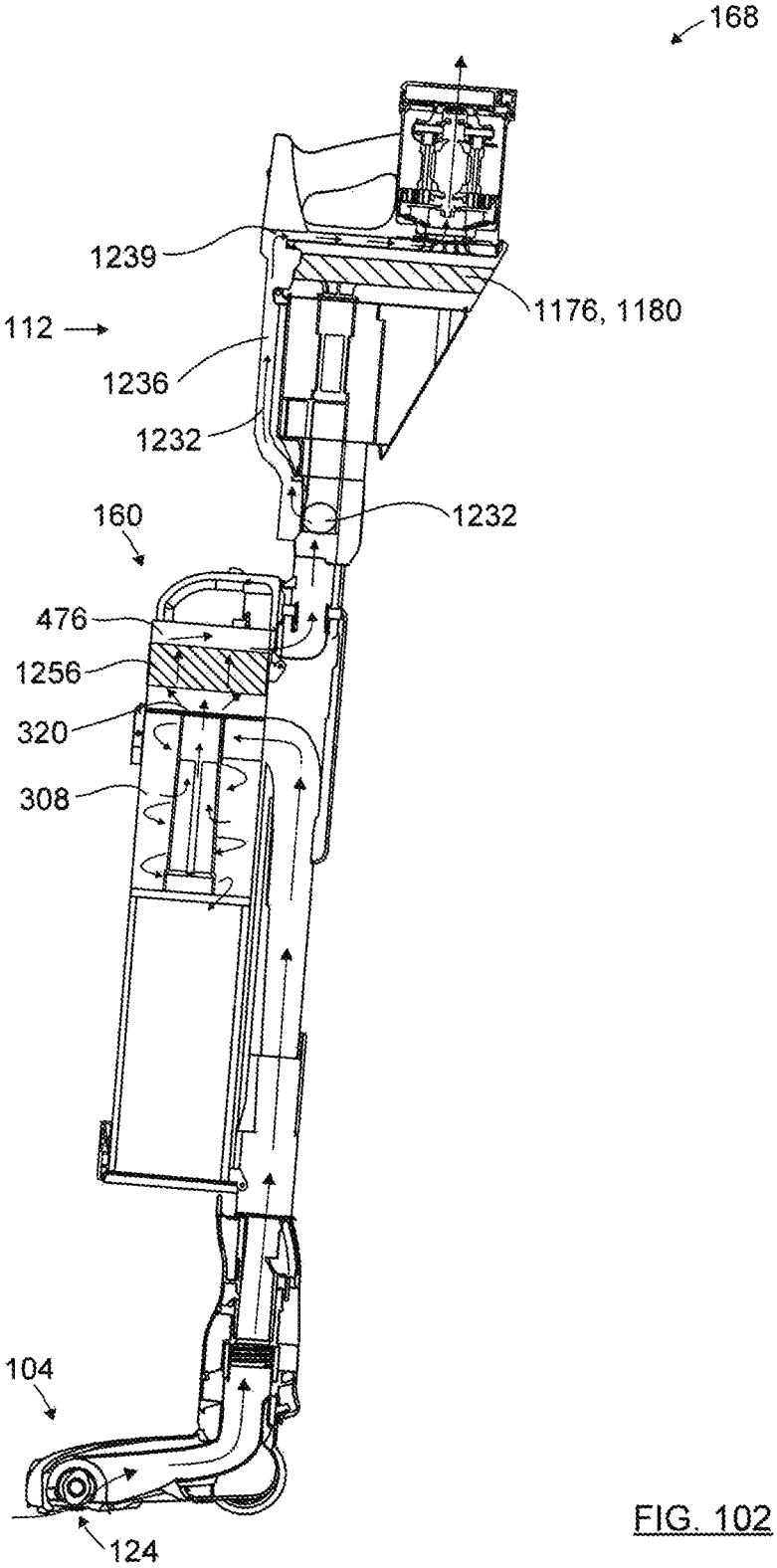
Figure 103:
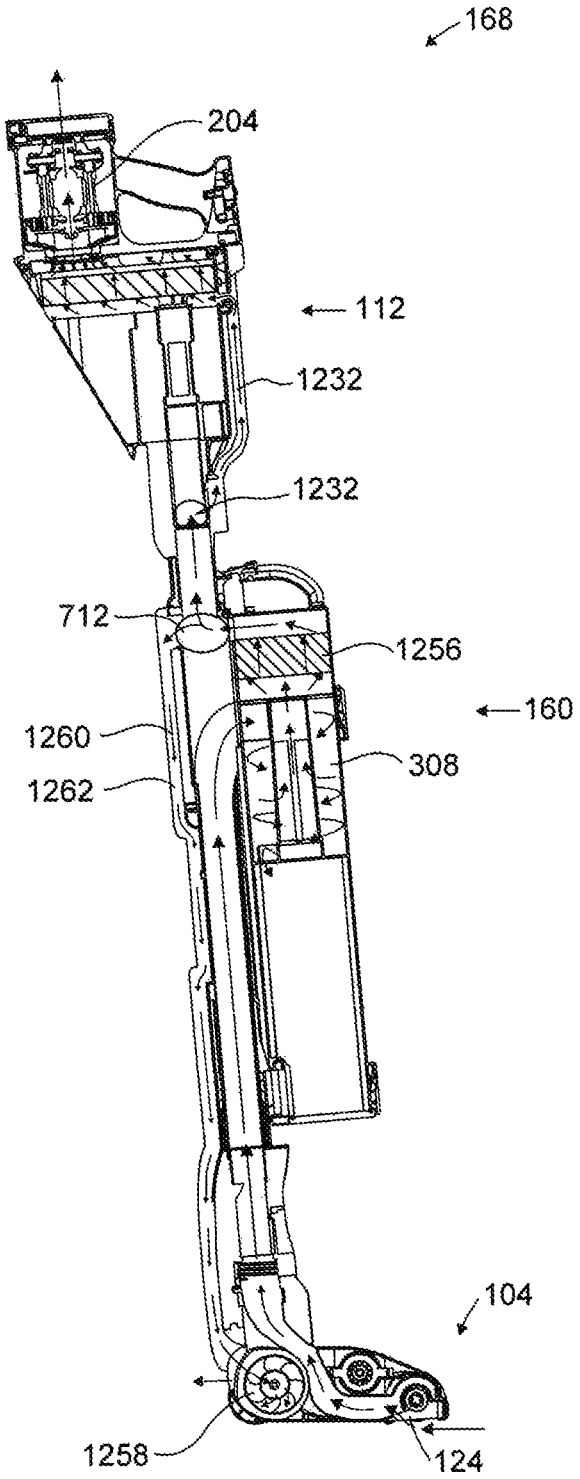
Figure 104A:
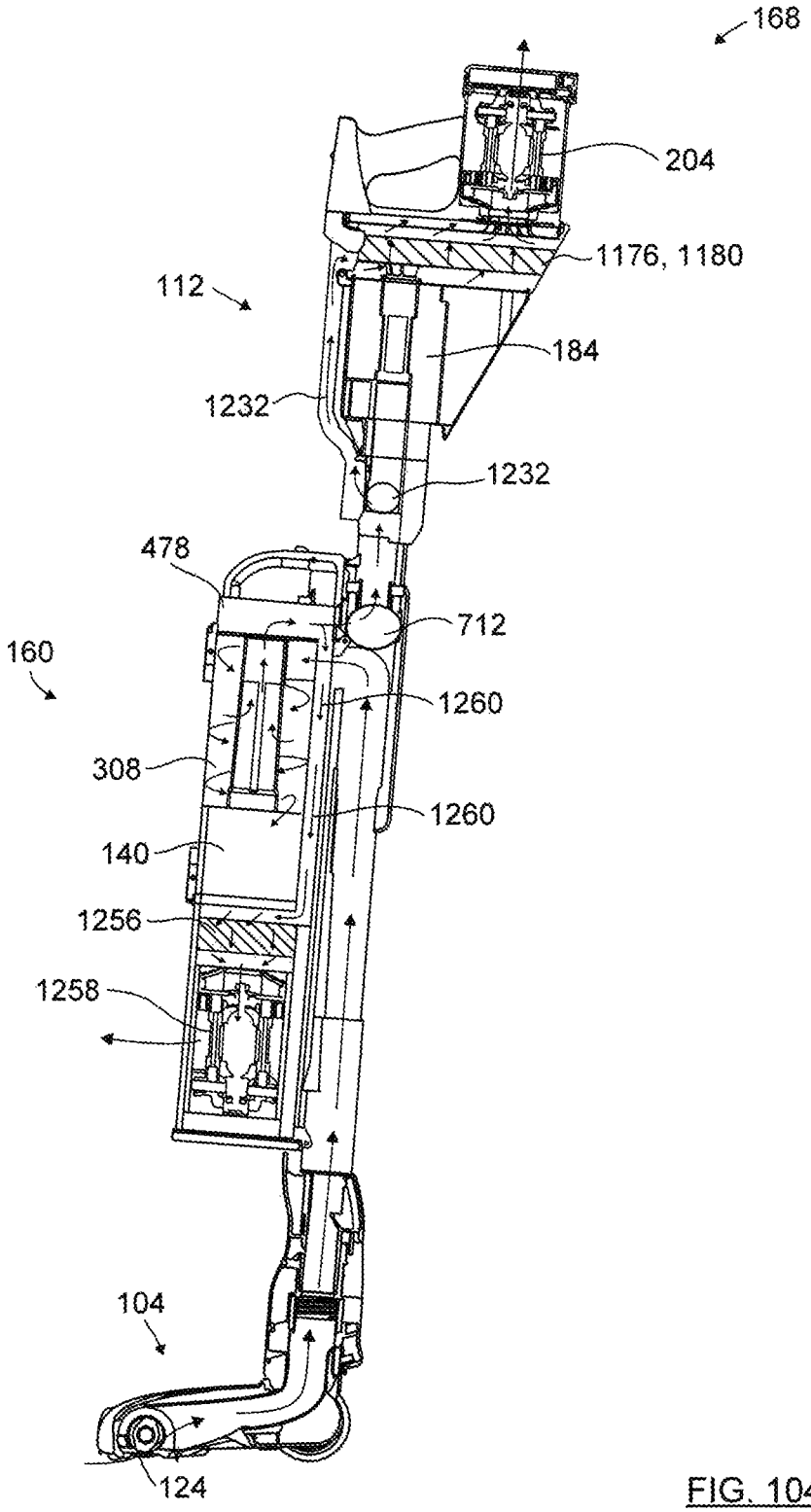
Figure 104B:
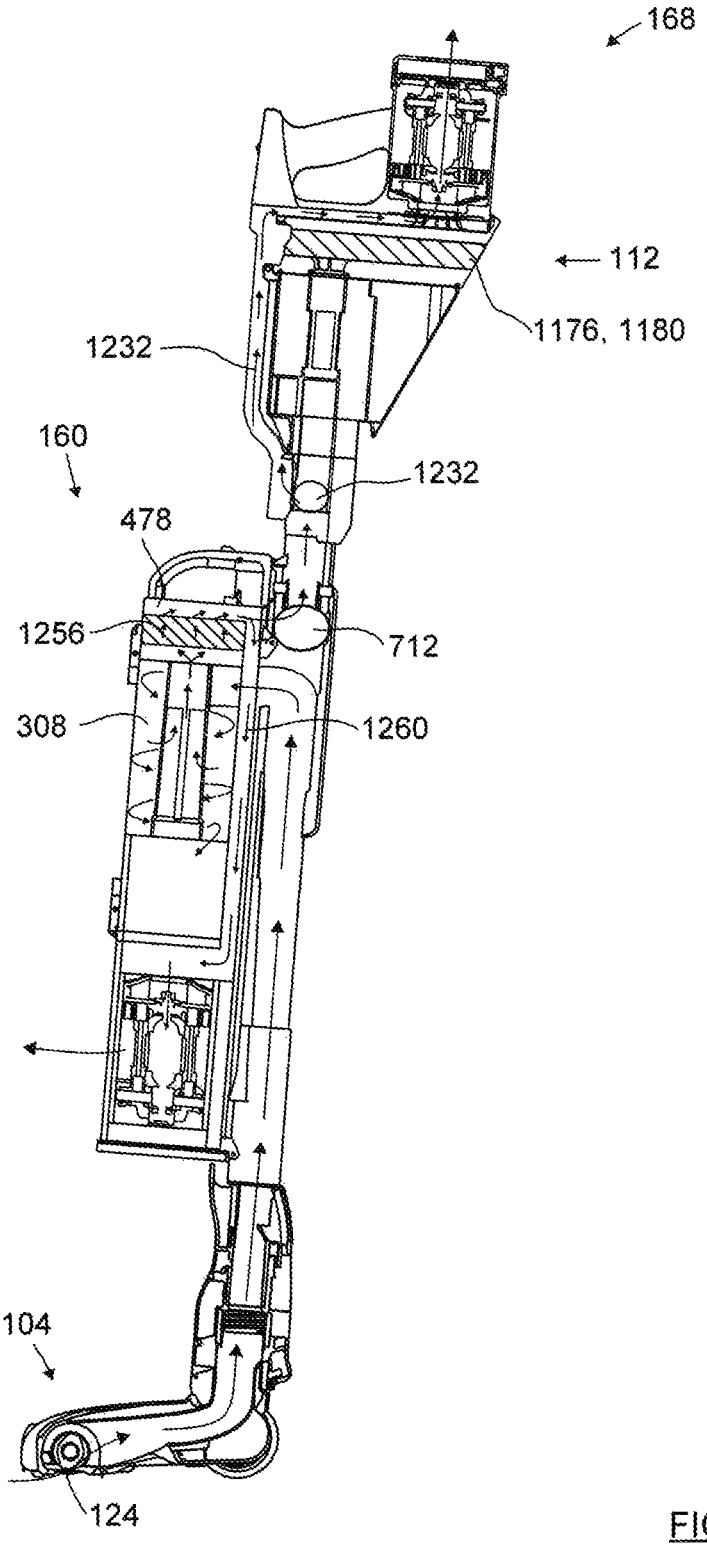
Figure 105A:
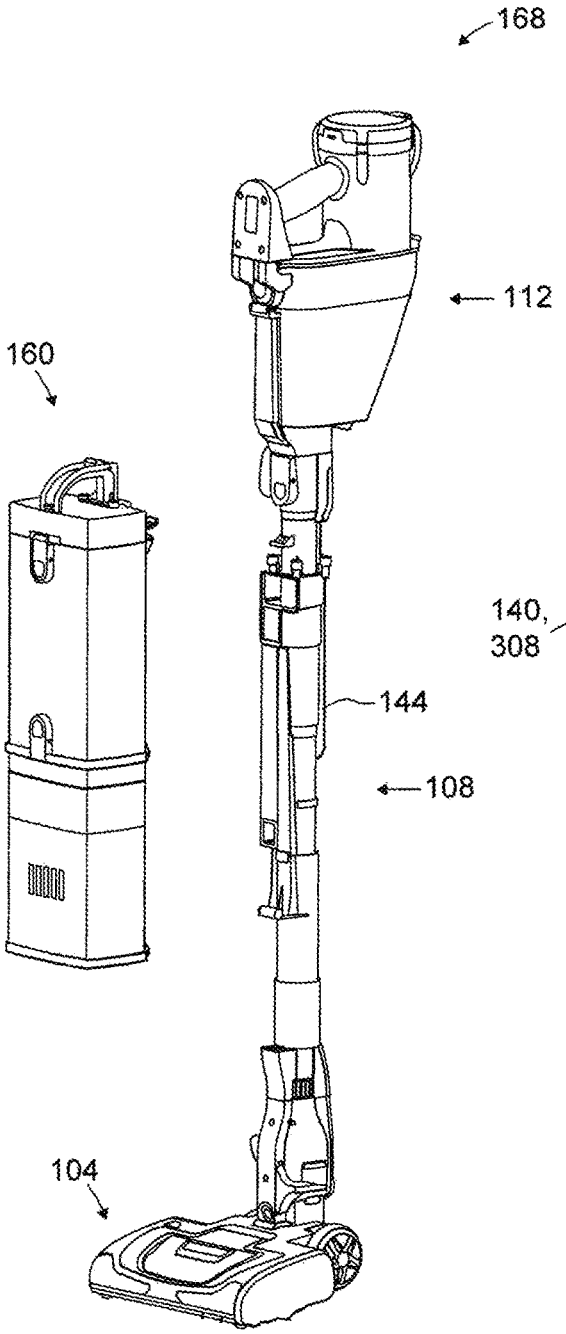
Figure 105B:
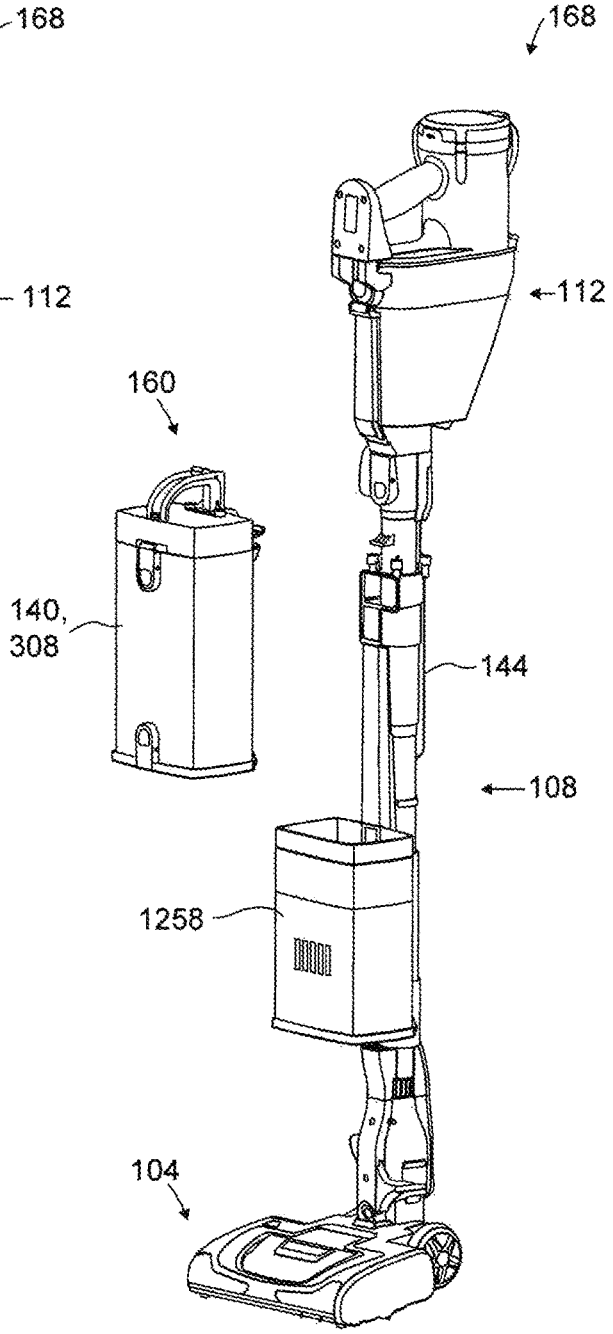
Figure 106:
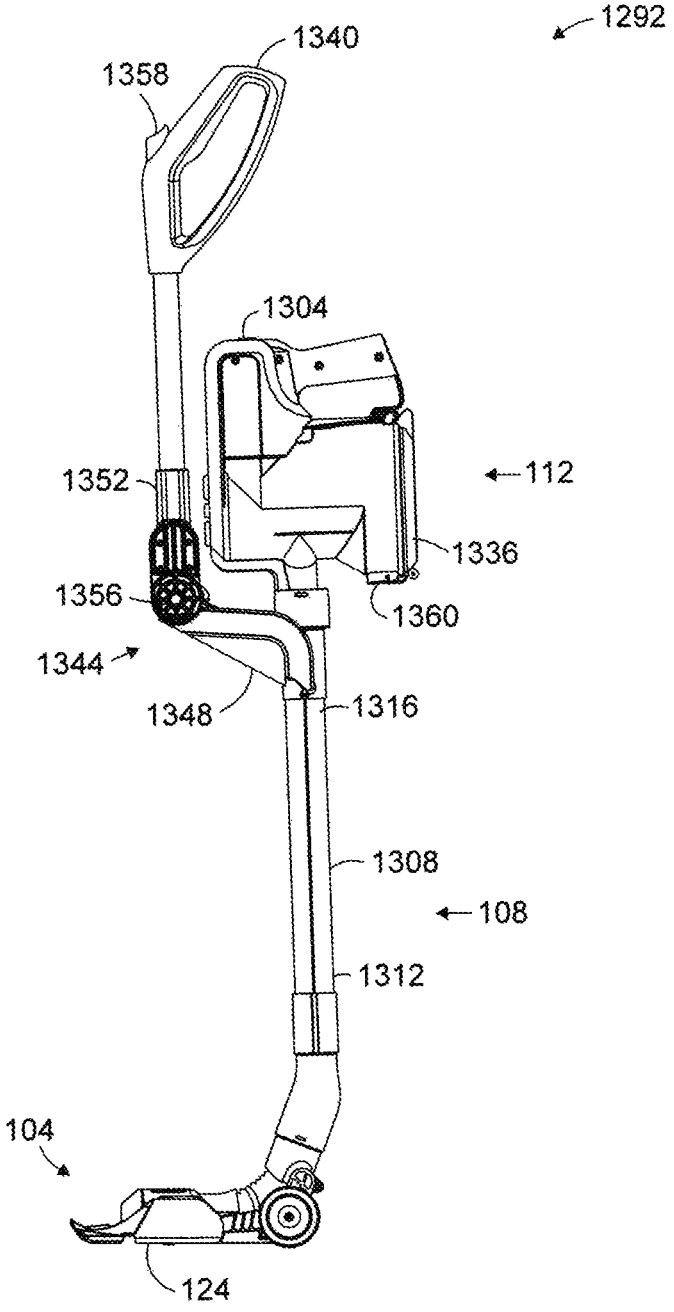
Figure 107:
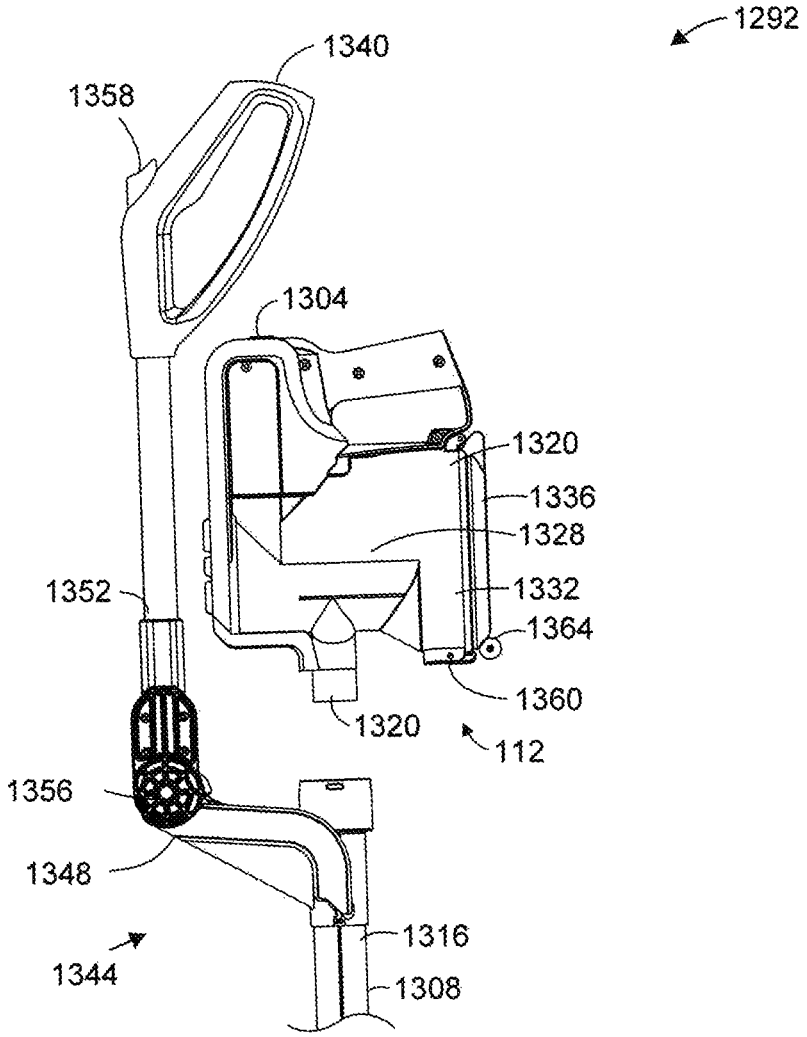
Figure 108:
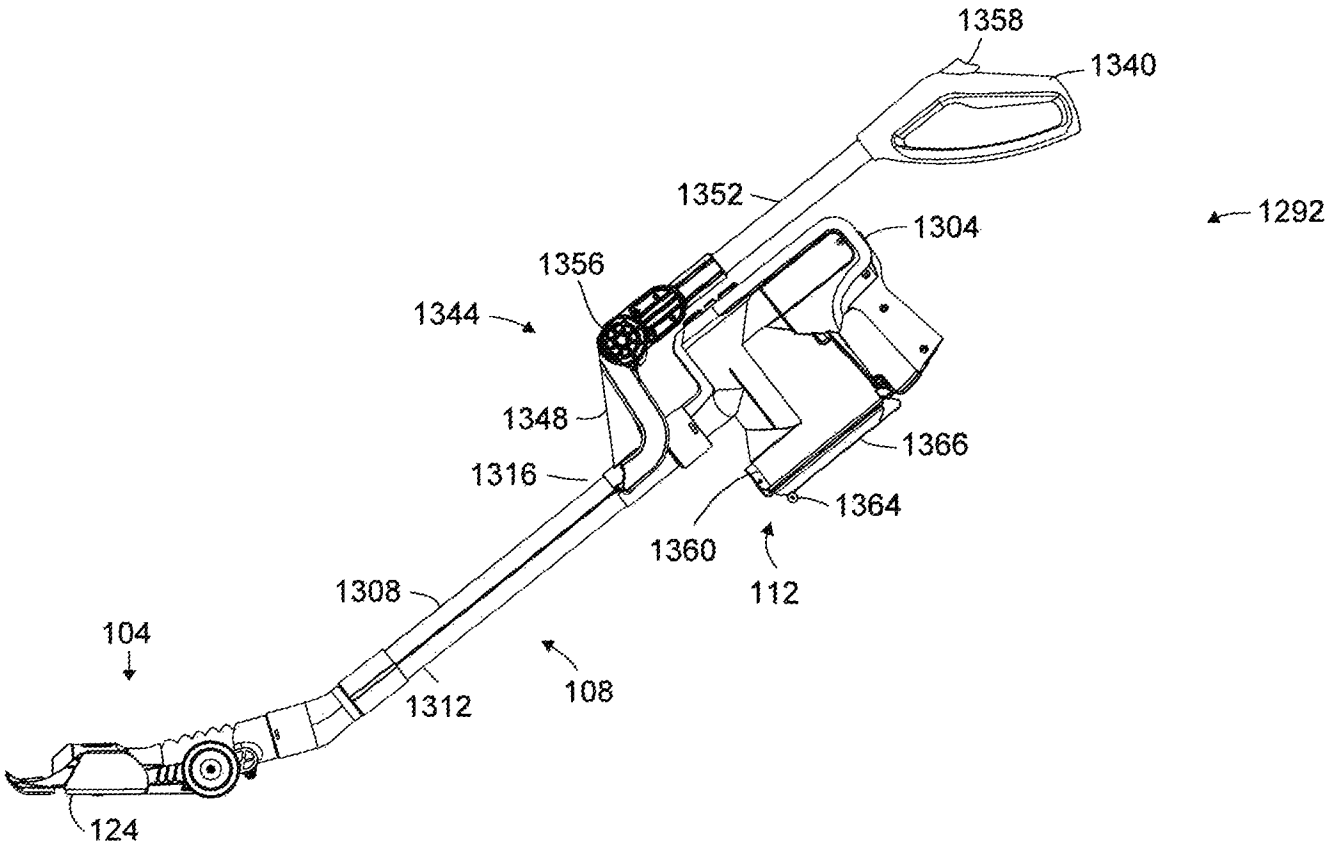
Figure 109:
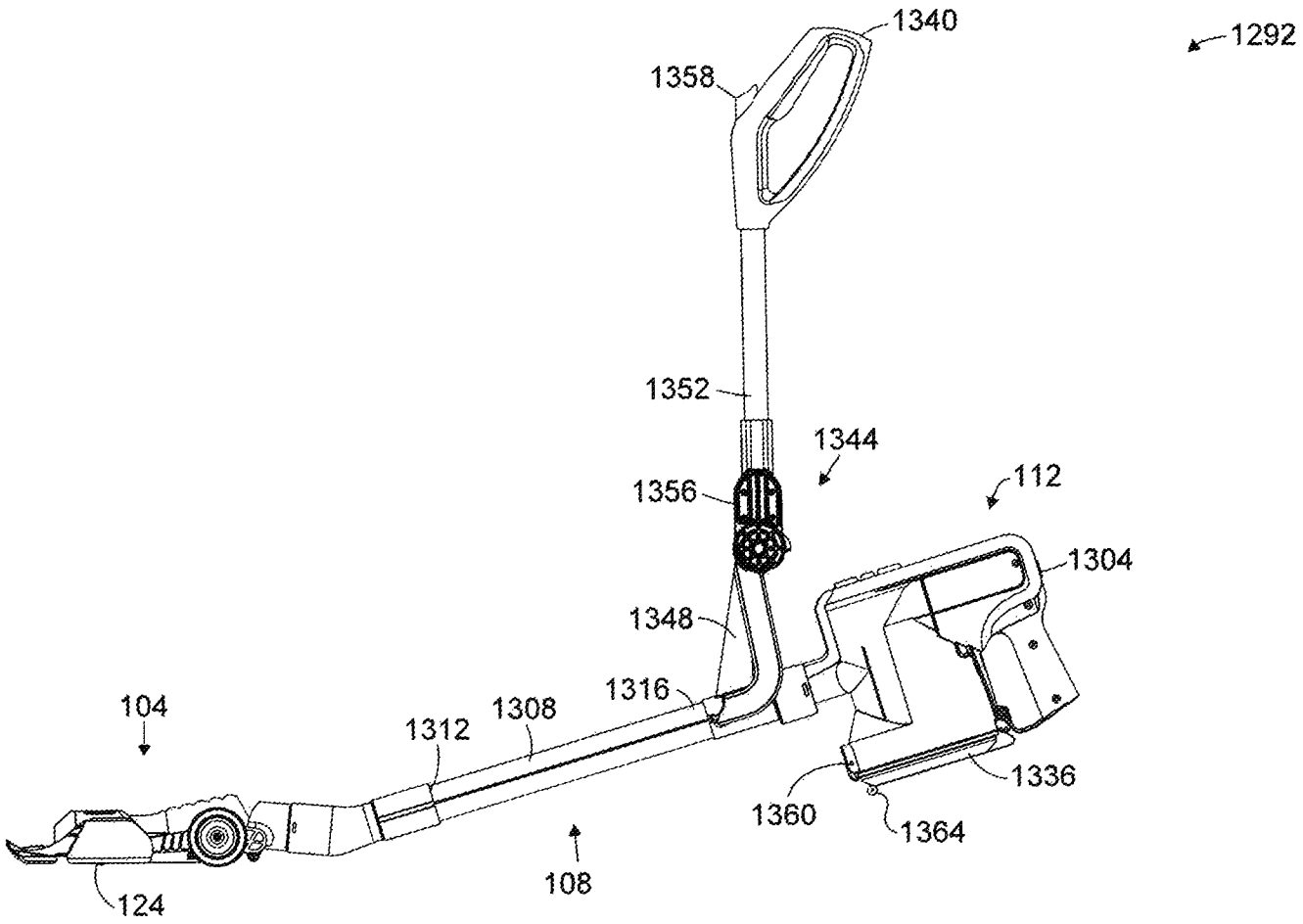
Figure 110A:
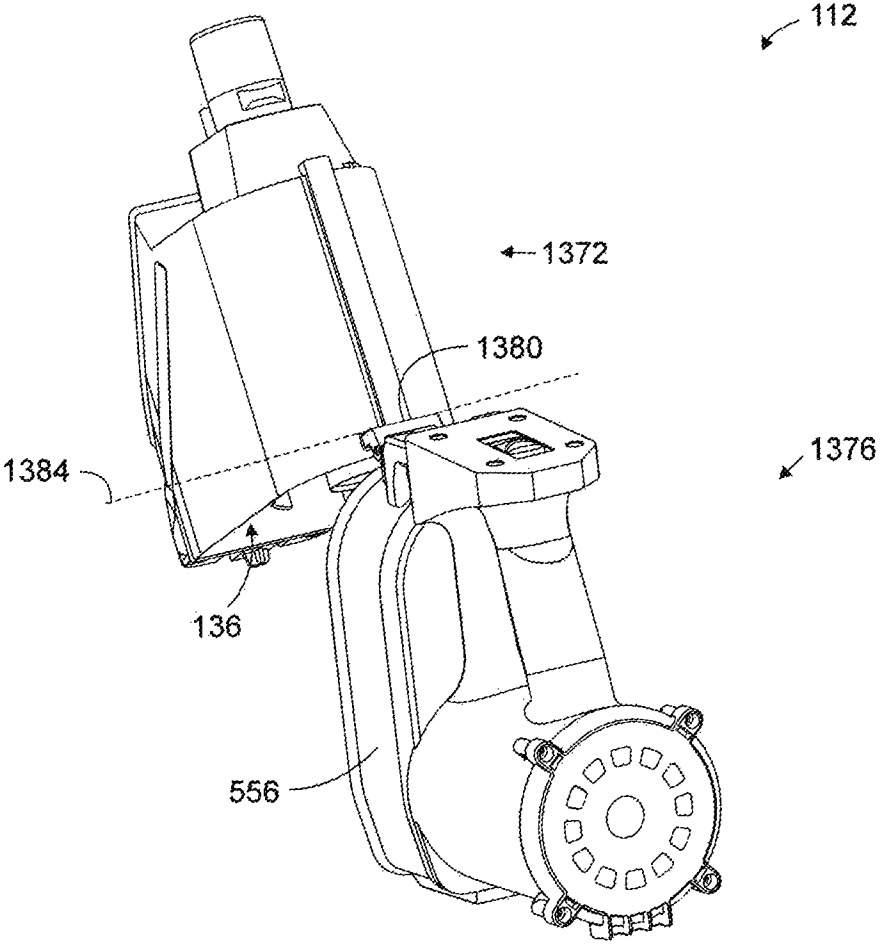
Figure 110B:
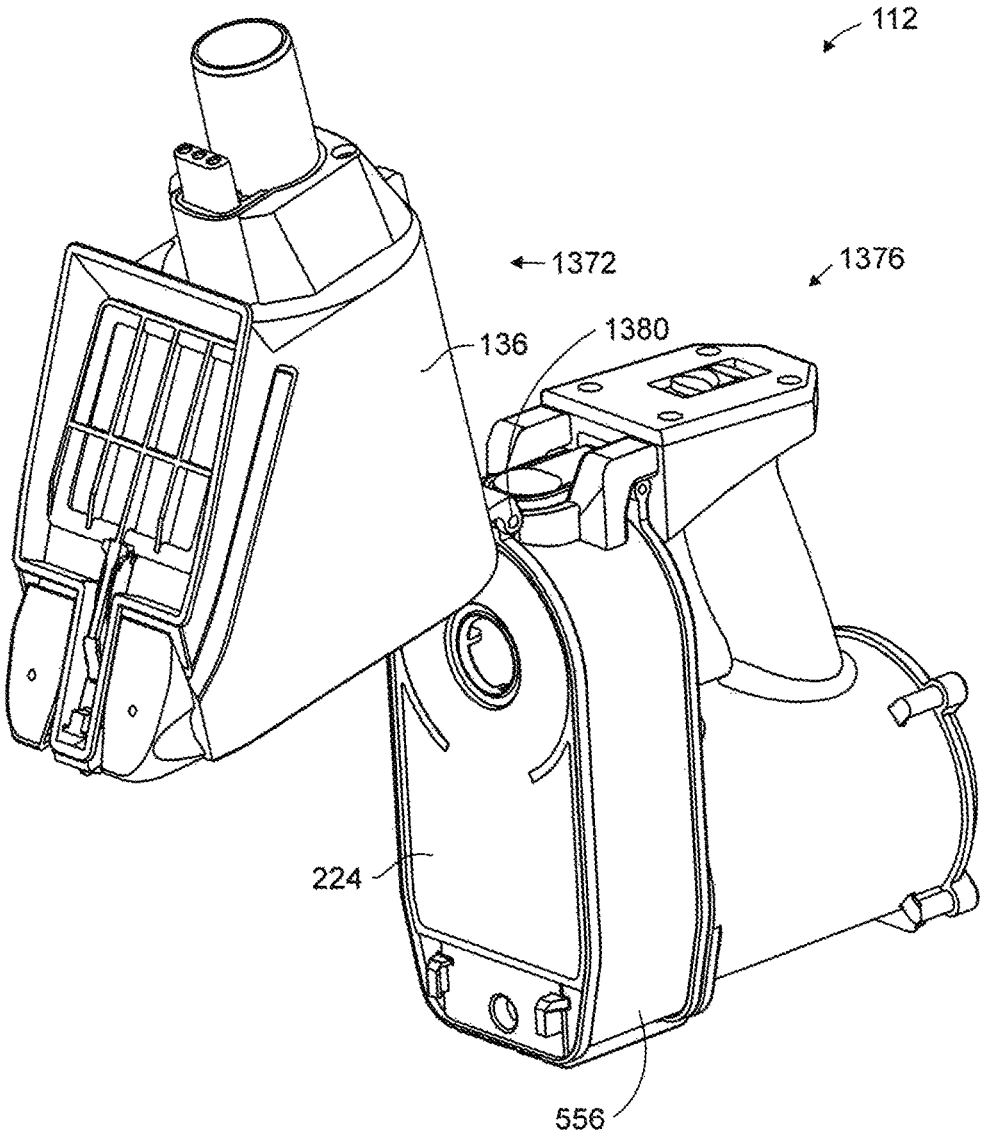
Figure 113:
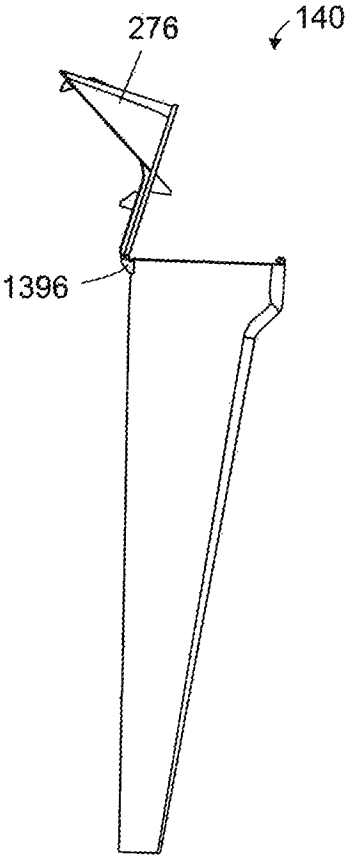
Figure 112:
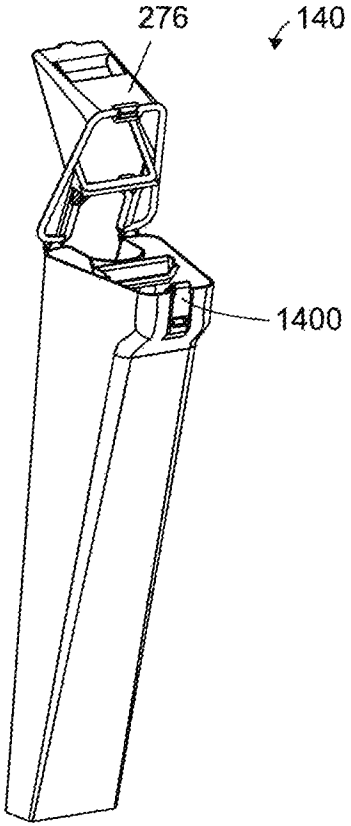
Figure 111:
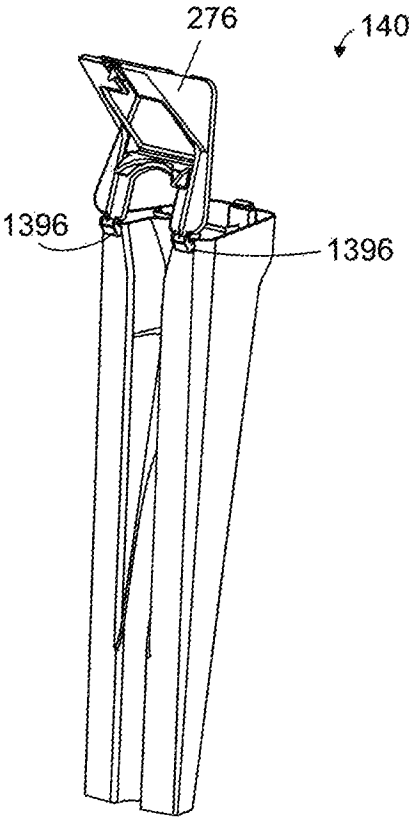
Figure 114:
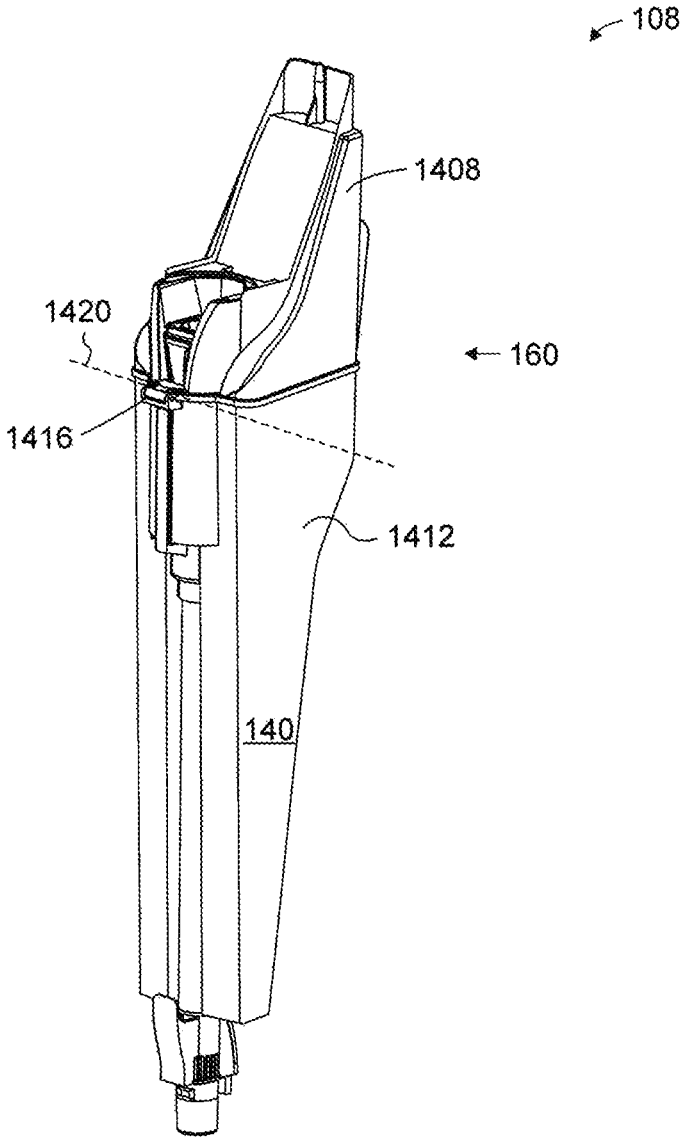
Figure 115:
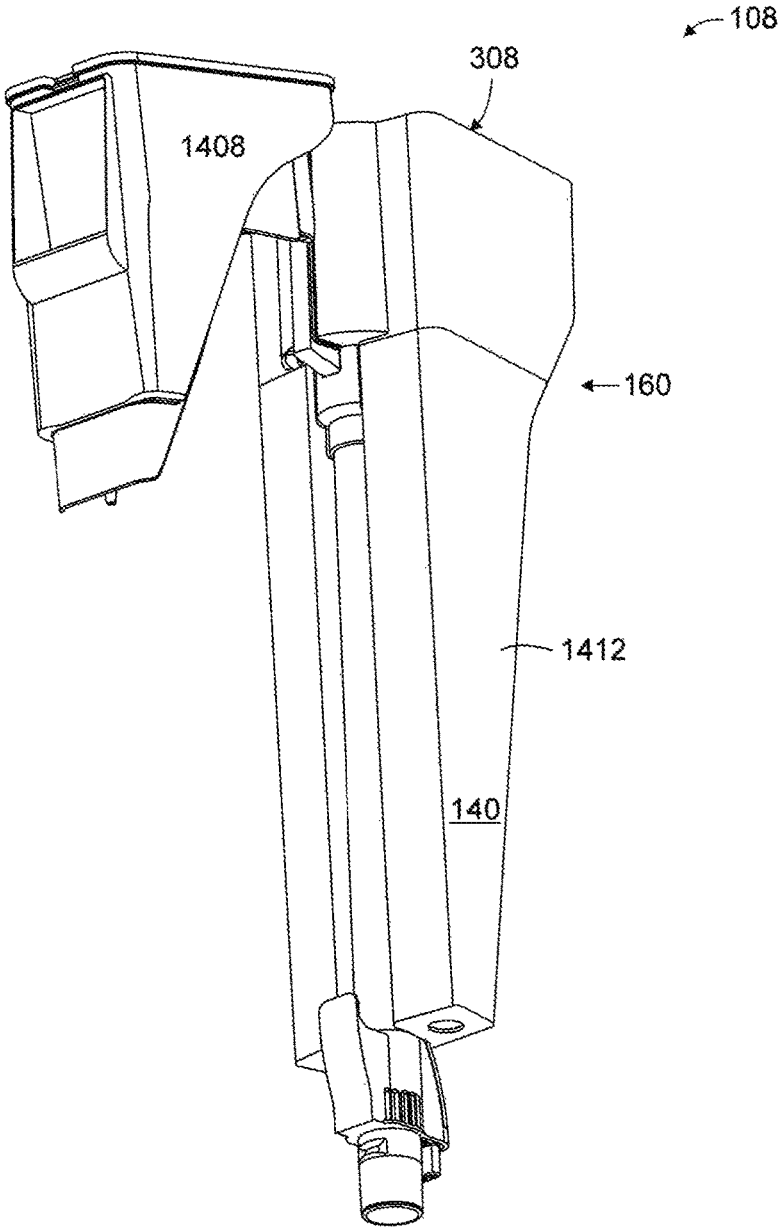
Figure 116:
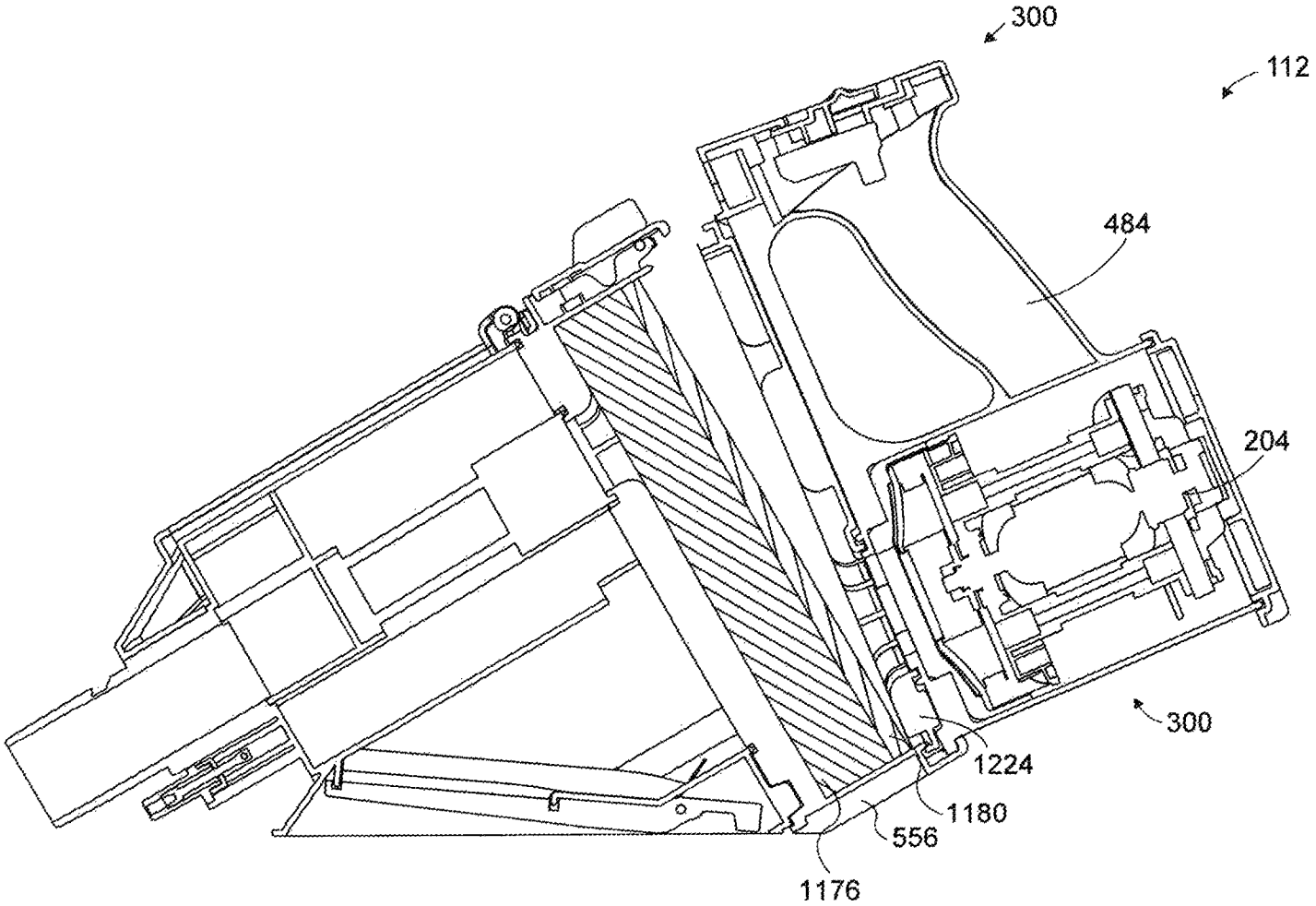
Figure 117:
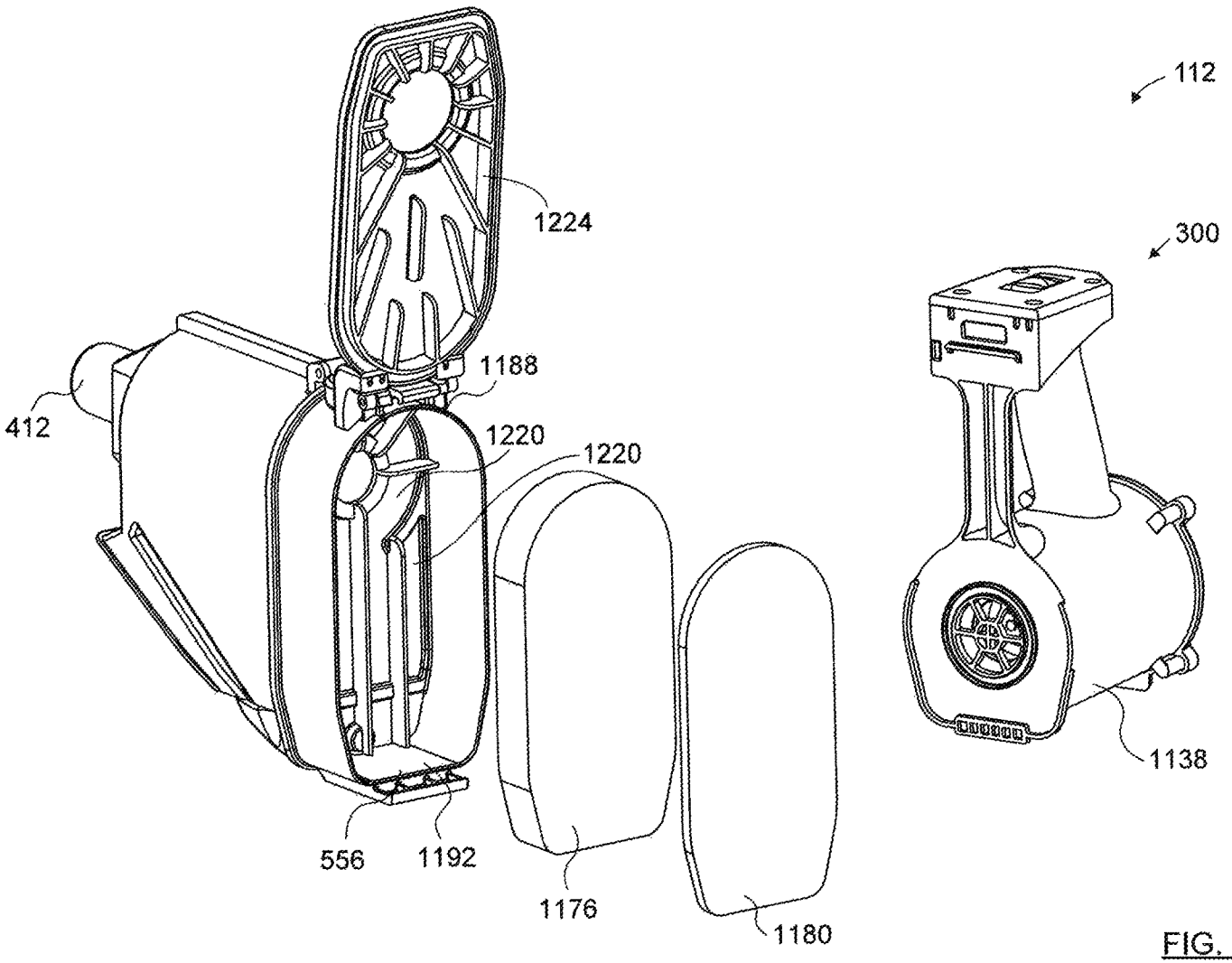
Figure 118:
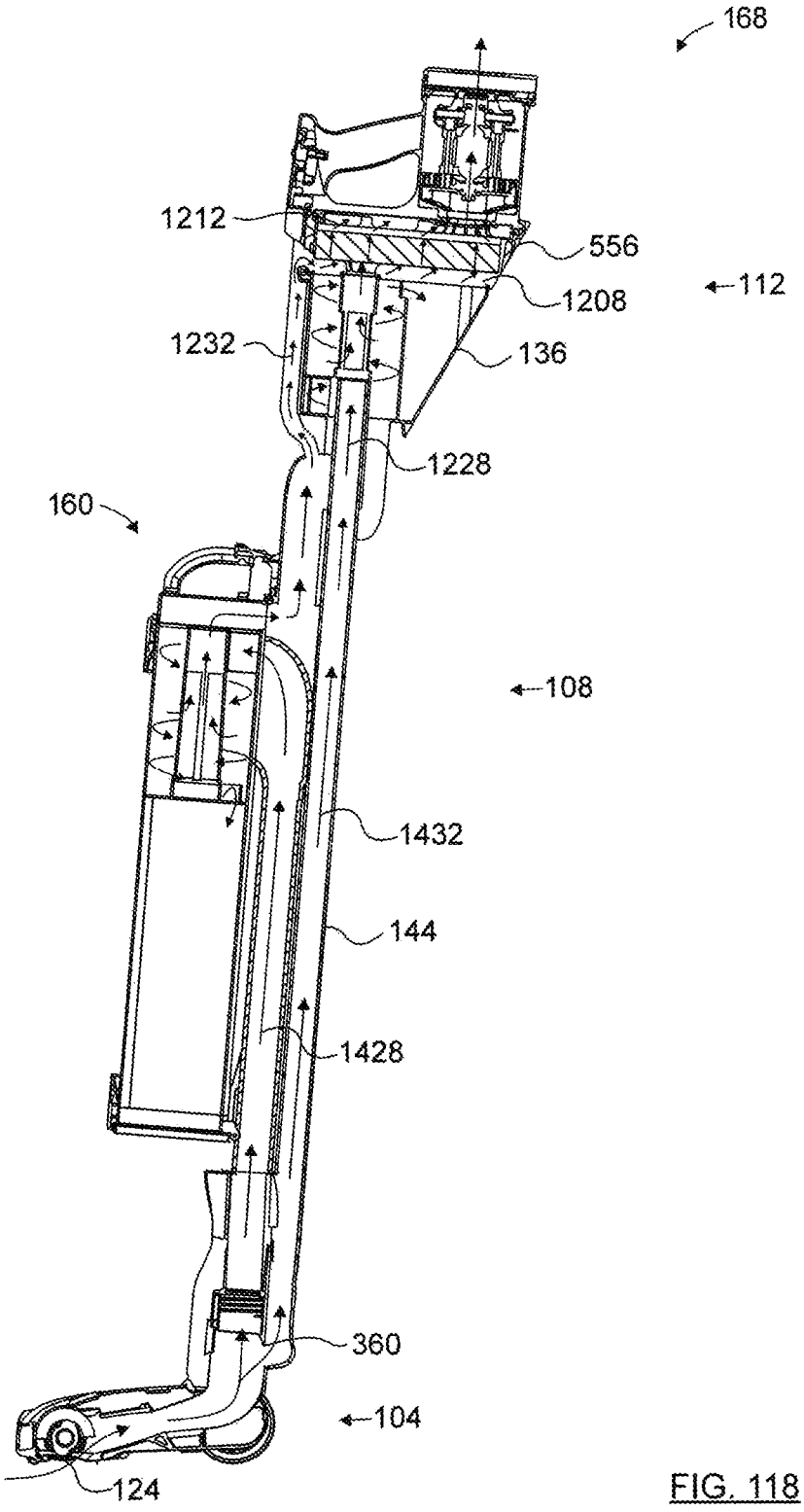
Figure 119A:
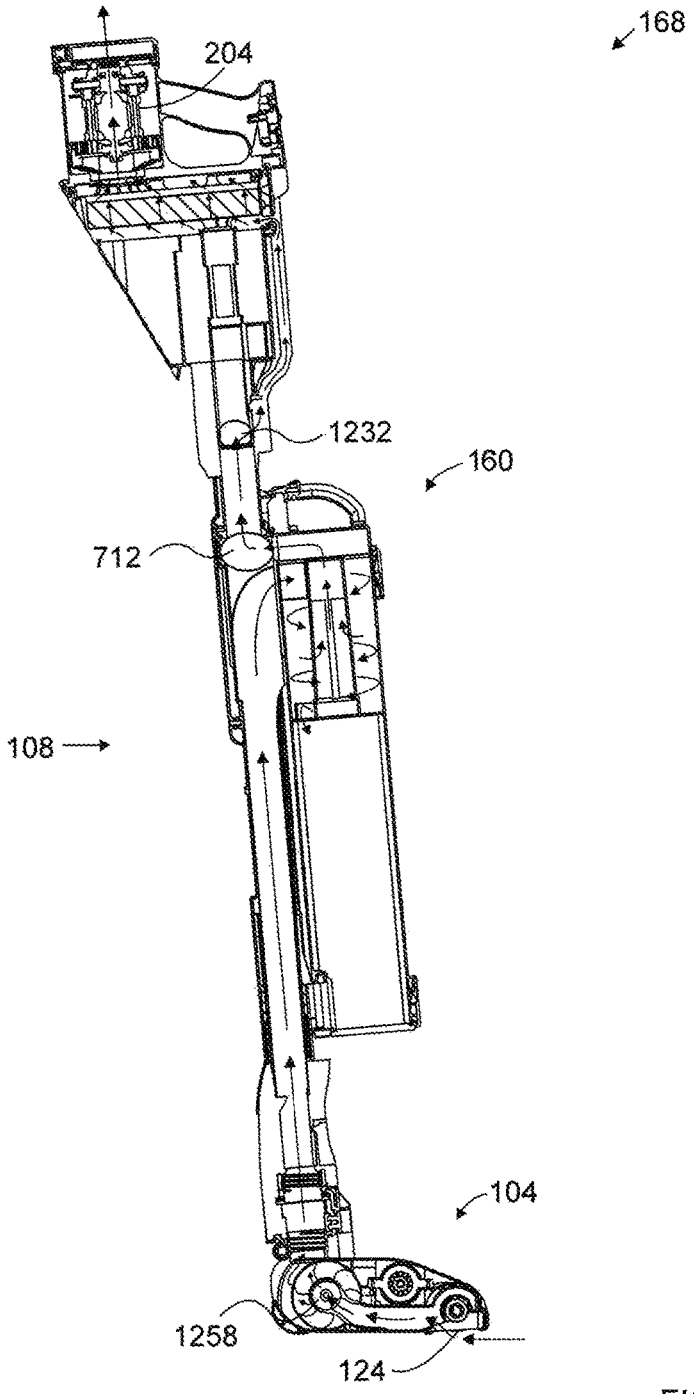
Figure 119B:
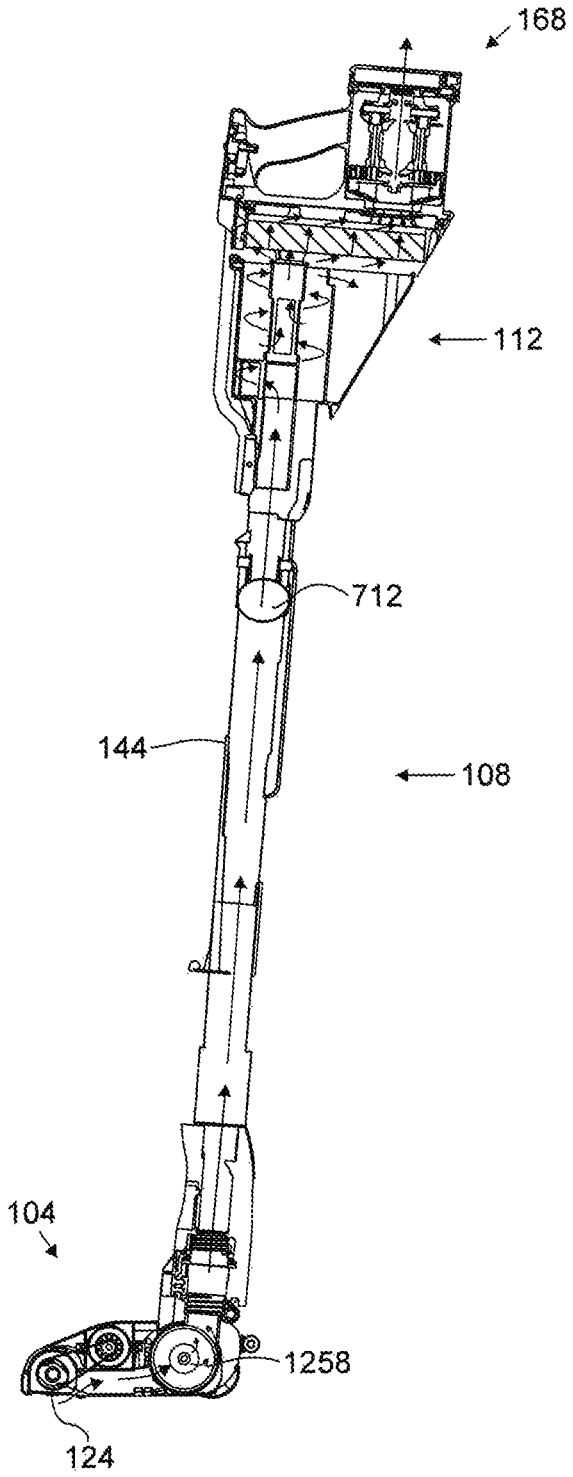
Figure 120:
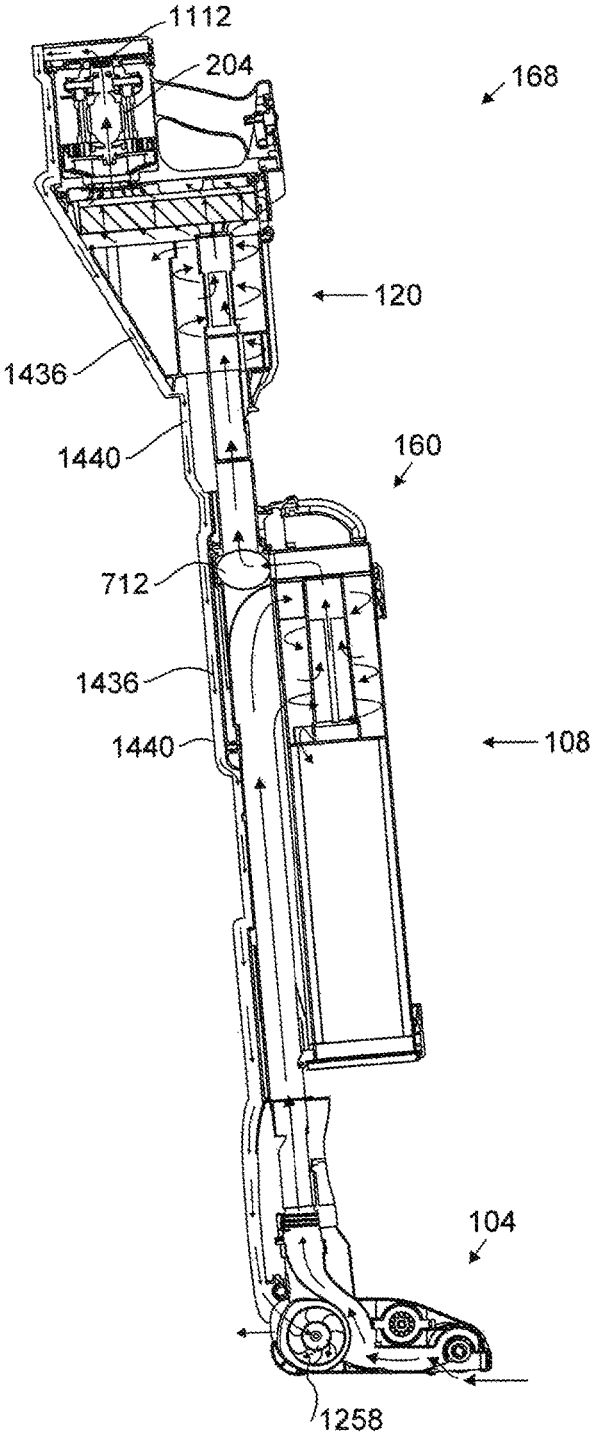
Figure 121A:
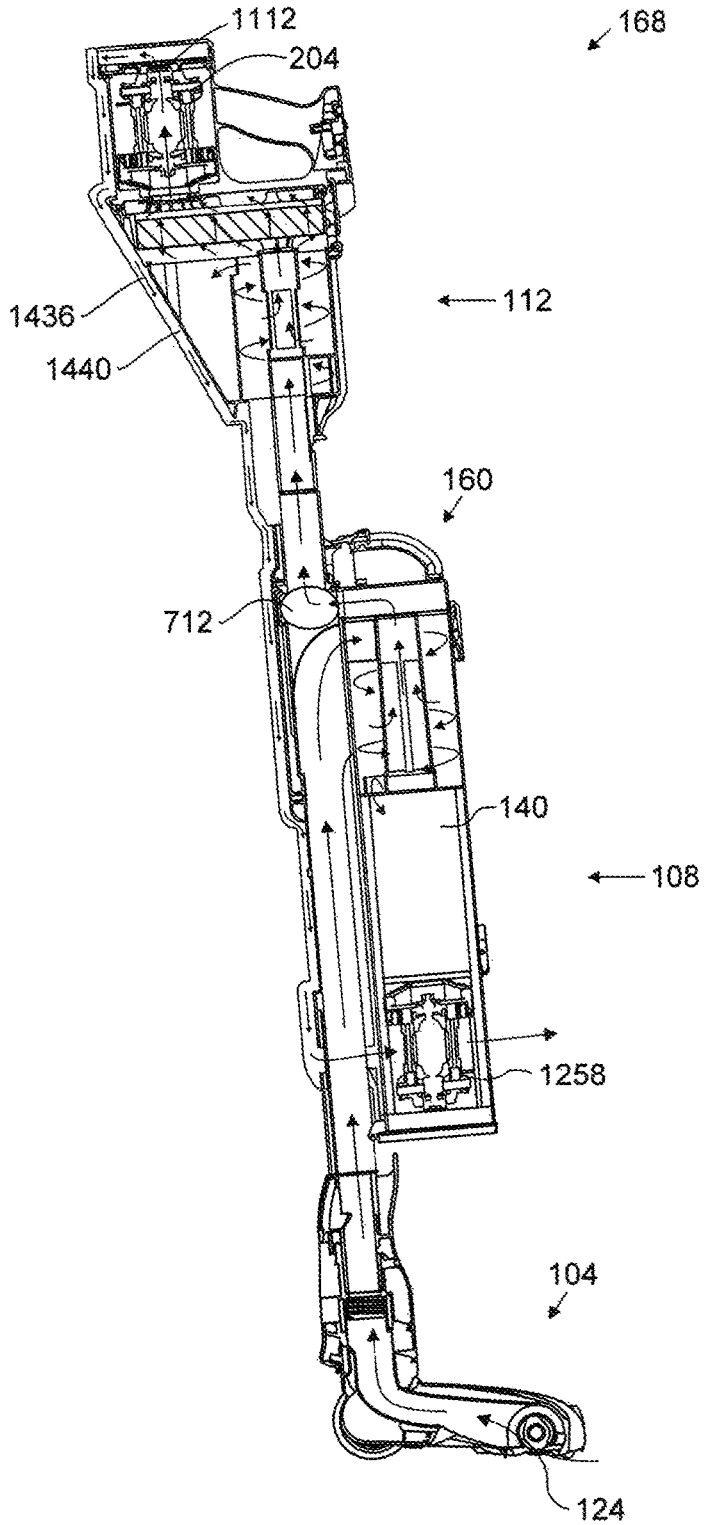
Figure 121B:
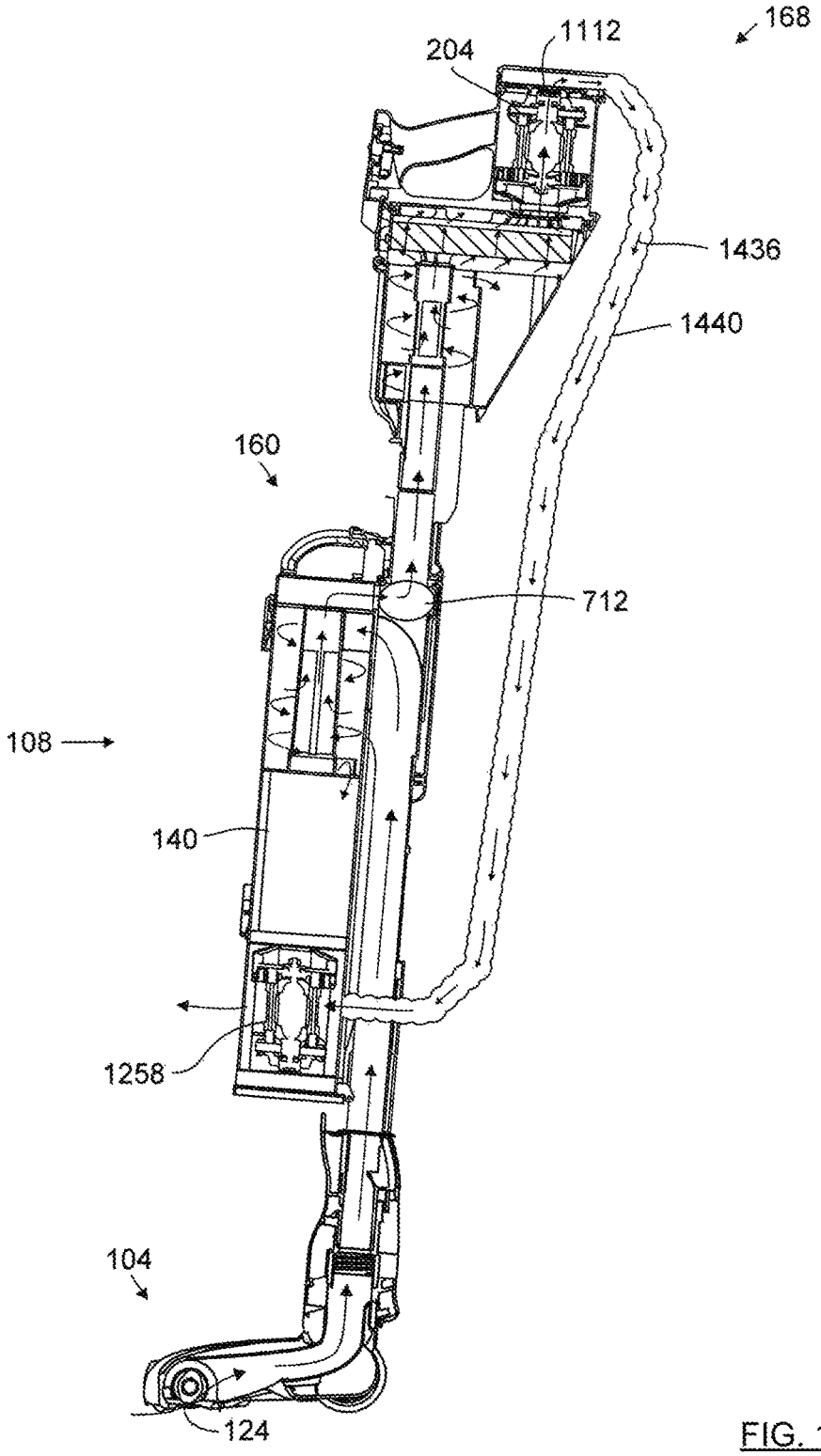
Figure 122:
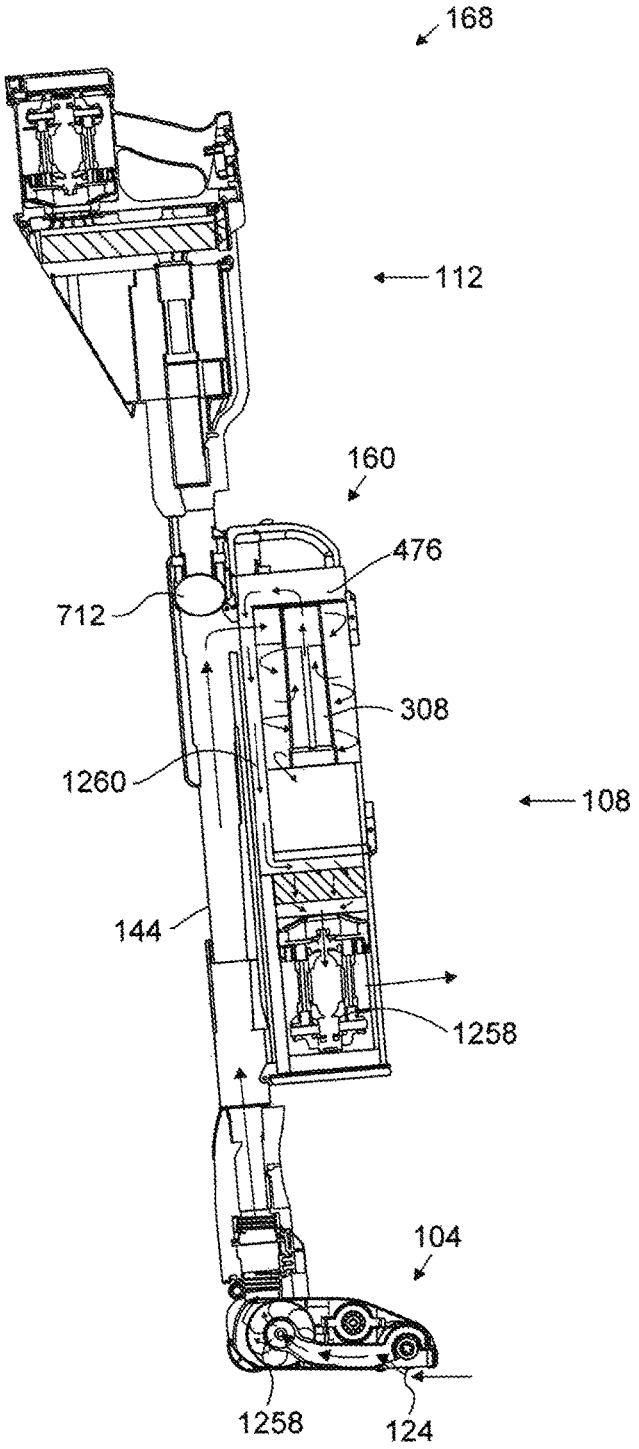
Figure 123:
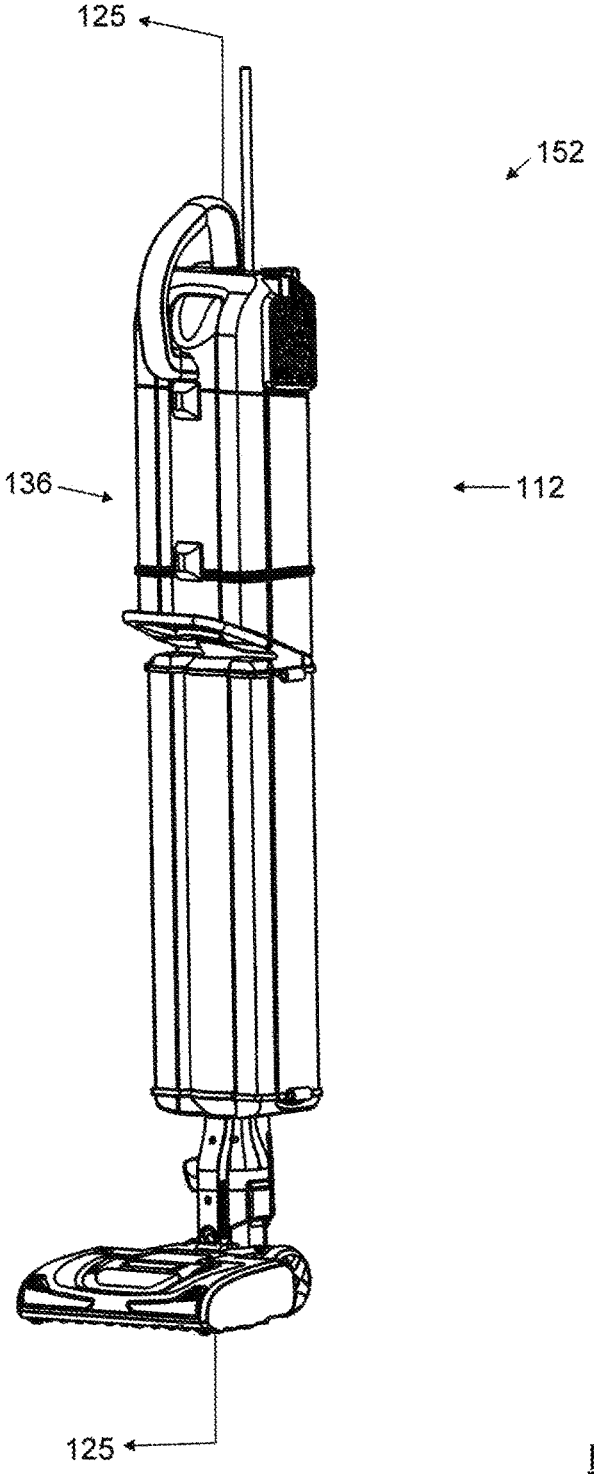
Figure 124:
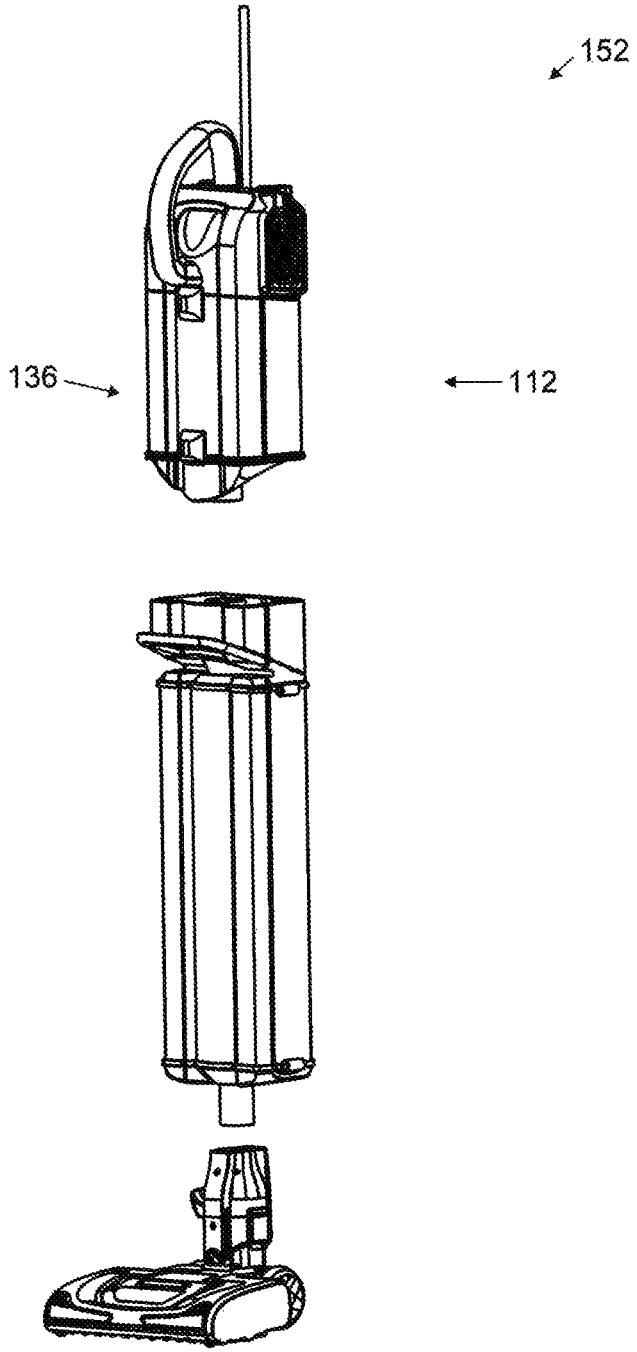
Figure 125:
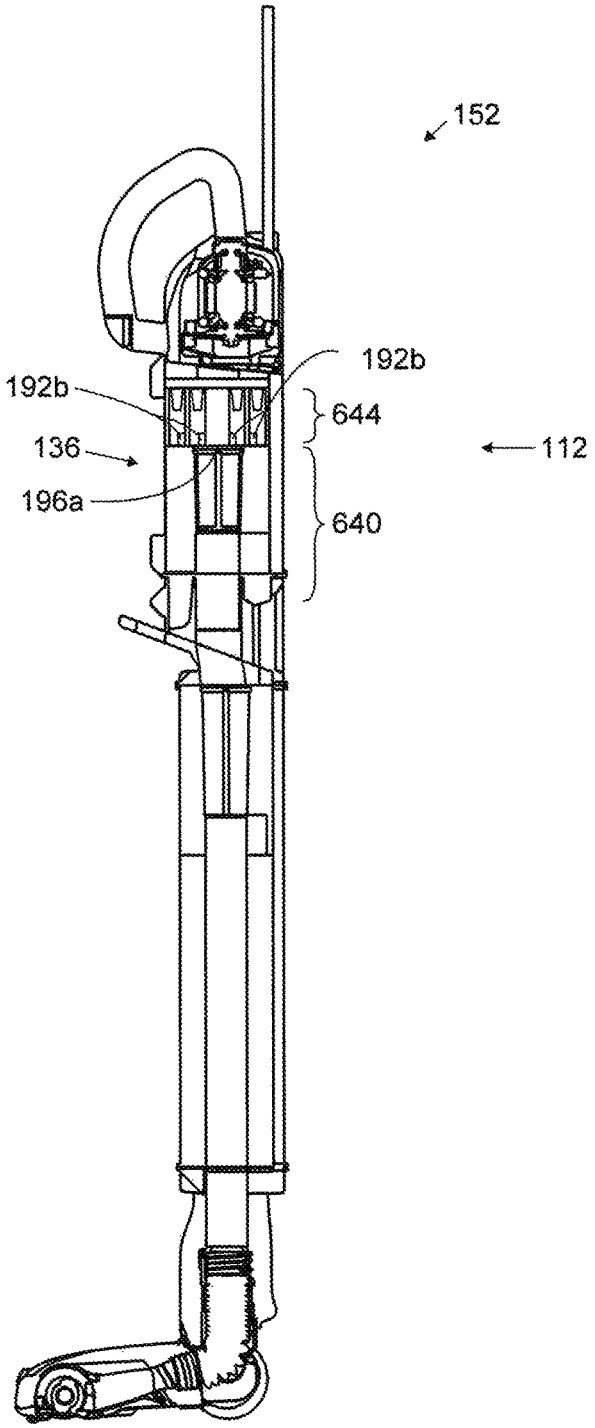
Figure 126:
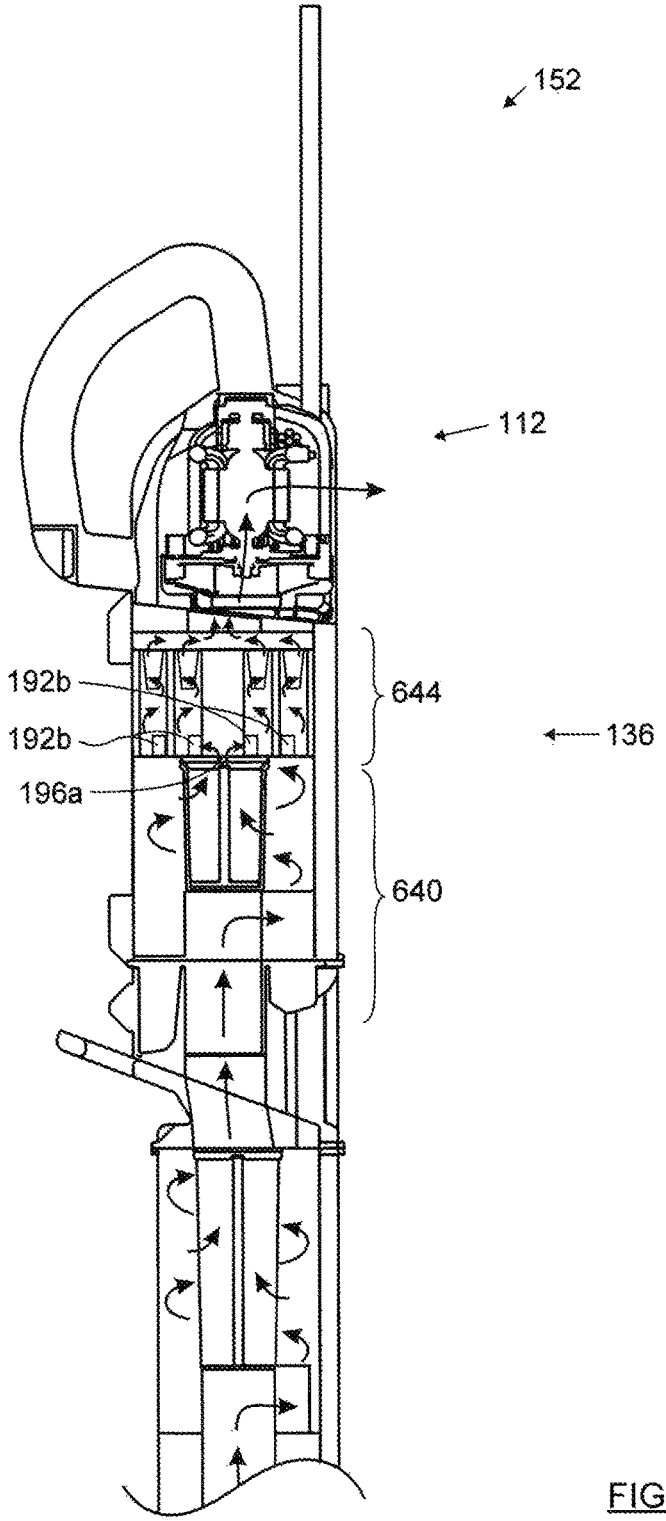
Figure 127:
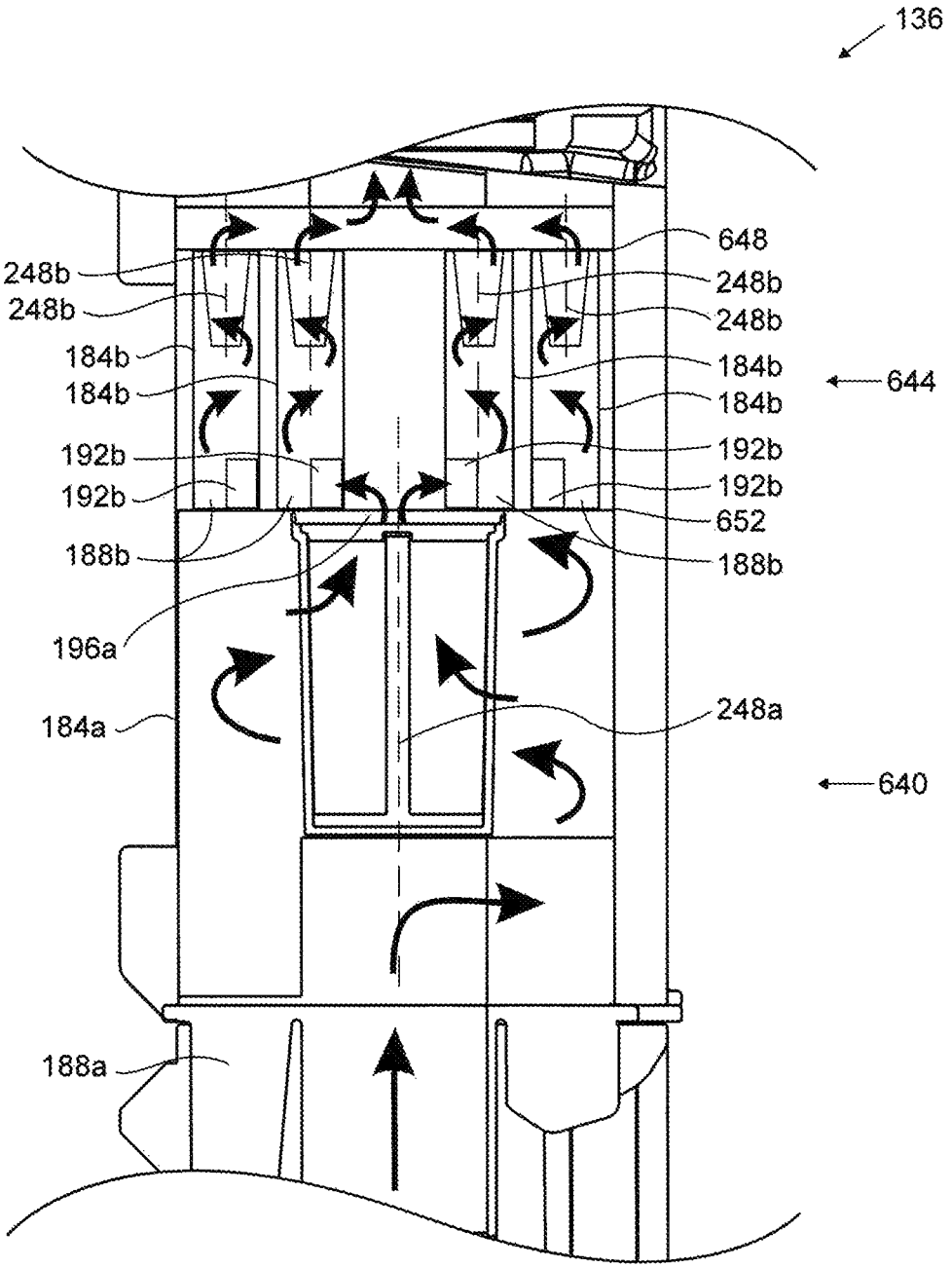

FIG. 99 is a partial cross-sectional view of a surface cleaning apparatus having a handvac disconnected from the upright section, and a bypass valve in a first closed position;

FIG. 100 is a cross-sectional view of the surface cleaning apparatus of FIG. 99 having a handvac connected to the upright section and the bypass valve in the first closed position;

FIG. 101 is a cross-sectional view of the surface cleaning apparatus of FIG. 99 having the handvac connected to the upright section and a supplementary cyclone bin assembly, and the bypass valve in a second open position;

FIG. 102 is a cross-sectional view of a surface cleaning apparatus having a having a bypass airflow path and a pre-motor filter in a supplemental cyclone bin assembly;

FIG. 103 is a cross-sectional view of a surface cleaning apparatus having a clean air suction motor in a surface cleaning head;

FIG. 104*a* is a cross-sectional view of a surface cleaning apparatus having a having a clean air suction motor in a supplemental cyclone bin assembly;

FIG. 104*b* is a cross-sectional view of another surface cleaning apparatus having a clean air suction motor in a supplemental cyclone bin assembly;

FIG. 105*a* is a perspective view of a surface cleaning apparatus having a supplemental cyclone bin assembly disconnected from an upright section;

FIG. 105*b* is a perspective view of a surface cleaning apparatus having a cyclone chamber and dirt collection chamber disconnected from an upright section;

FIG. 106 is a side elevation view a surface cleaning apparatus in accordance with another embodiment;

FIG. 107 is a partial side elevation view of the apparatus of FIG. 106 with a handvac disconnected from an upright section;

FIG. 108 is a side elevation view of the apparatus of FIG. 106 in a reclined in-use position with an arm assembly in a first position;

FIG. 109 is a side elevation view of the apparatus of FIG. 106 in a steeply reclined in-use position with the arm assembly in a second position;

FIG. 110*a* is a rear perspective view of the handvac of the apparatus of FIG. 1 in an open position;

FIG. 110*b* is a front perspective view of the handvac of FIG. 110*a* in the open position;

FIG. 111 is a front perspective view of the dirt collection chamber of the apparatus of FIG. 1 in an open position;

FIG. 112 is a rear perspective view of the dirt collection chamber of FIG. 111 in the open position;

FIG. 113 is a side elevation view of the dirt collection chamber of FIG. 111 in the open position;

FIG. 114 is a front perspective view of the upright section of the apparatus of FIG. 5 with a cyclone bin assembly in a closed position;

FIG. 115 is a front perspective view of the upright section of FIG. 114 with the cyclone bin assembly in an open position;

FIG. 116 is a cross-sectional view of the handvac of the apparatus of FIG. 1 having a pre-motor filter chamber in an open position;

FIG. 117 is a exploded view of the handvac of FIG. 116;

FIG. 118 is a cross-sectional view of a surface cleaning apparatus having a plurality of cyclone chambers in parallel;

FIG. 119*a* is a cross-sectional view of a surface cleaning apparatus having a dirty air suction motor in a surface cleaning head in series with a clean air suction motor in a handvac;

FIG. 119*b* is a cross-sectional view of the surface cleaning apparatus of FIG. 119*a* with a supplemental cyclone bin assembly removed;

FIG. 120 is a cross-sectional view of a surface cleaning apparatus having a clean air suction motor in a surface cleaning head in series with a clean air suction motor in a handvac;

FIG. 121*a* is a cross-sectional view of a surface cleaning apparatus having a clean air suction motor in a supplemental cyclone bin assembly in series with a clean air suction motor in a handvac;

FIG. 121*b* is a cross-sectional view of the surface cleaning apparatus of FIG. 121*a* with a hose connecting the handvac suction motor and the suction motor of the supplemental cyclone bin assembly;

FIG. 122 is a cross-sectional view of a surface cleaning apparatus having an airflow which bypasses the handvac;

FIG. 123 is a perspective view of a surface cleaning apparatus in accordance with another embodiment;

FIG. 124 is an exploded perspective view of the surface cleaning apparatus of FIG. 123;

FIG. 125 is a cross-sectional view taken along line 125-125 in FIG. 123;

FIG. 126 is enlarged partial view of FIG. 125; and
FIG. 127 is an enlarged partial view of FIG. 126.

DESCRIPTION OF VARIOUS EMBODIMENTS

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected directly in physical contact with each other. As used herein, two or more parts are said to be "rigidly coupled", "rigidly connected", "rigidly attached", or "rigidly fastened" where the parts are coupled so as to move as one while maintaining a constant orientation relative to each other. None of the terms "coupled", "connected", "attached", and "fastened" distinguish the manner in which two or more parts are joined together.

General Overview

Figure 2:
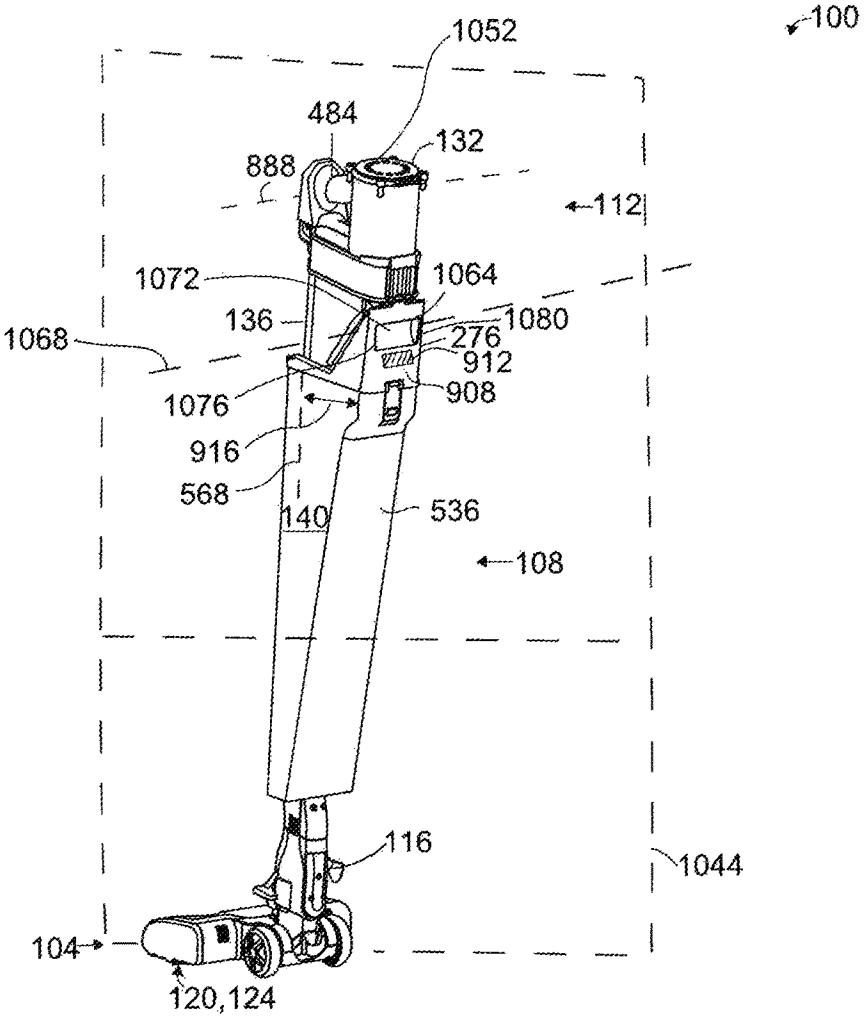
FIG. 2 is a rear perspective view of the apparatus of FIG. 1.
Figure 3:
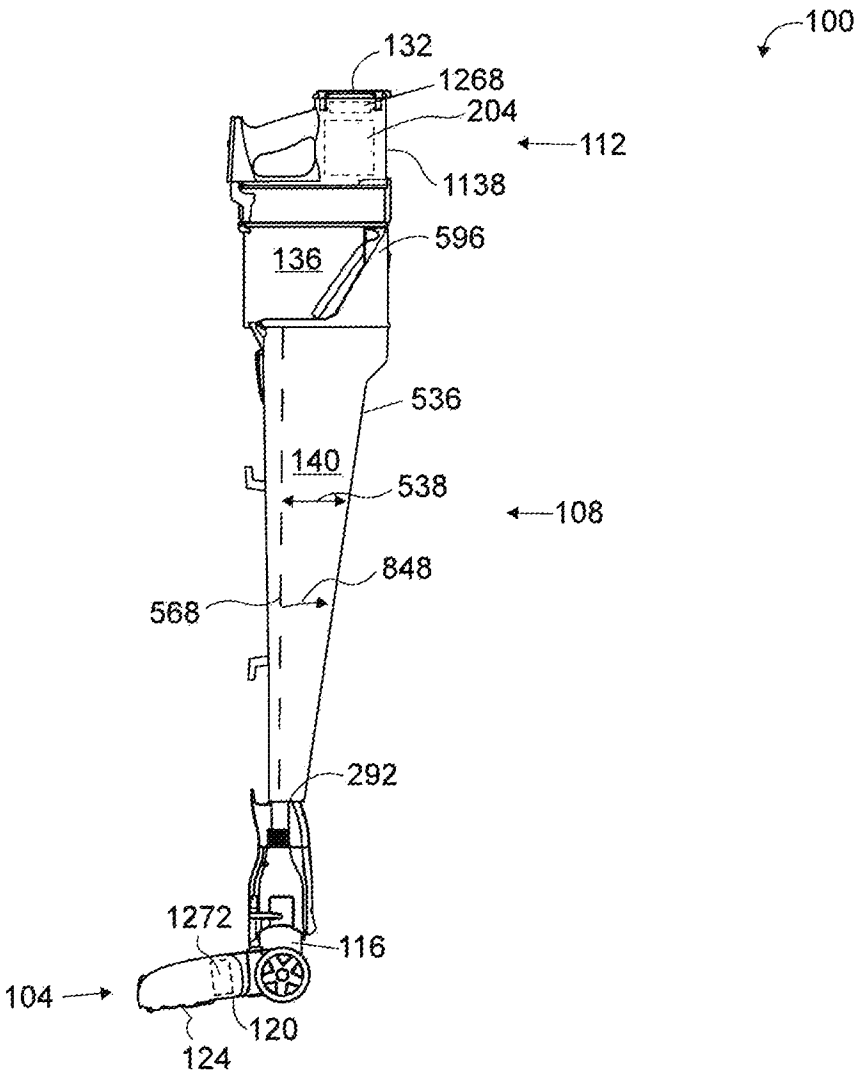
FIG. 3 is a side elevation view of the apparatus of FIG. 1.

Referring to FIGS. 1-3, a surface cleaning apparatus 100 is shown in accordance with a first embodiment. In the embodiment shown, the surface cleaning apparatus 100 is a type of upright vacuum cleaner which is referred to as a stick vacuum cleaner. As illustrated, surface cleaning apparatus 100 includes a surface cleaning head 104, an upright section 108, and a hand-carriable vacuum cleaner 112 (also referred to as handvac or hand vacuum cleaner 112).

Upright section 108 may be movably and drivingly connected to surface cleaning head 104. For example, upright section 108 may be permanently or removably connected to surface cleaning head 104 and moveably mounted thereto for movement from a storage position to an in use position, such as by a pivotable joint 116. Joint 116 may permit upright section 108 to pivot (i.e. rotate) with respect to surface cleaning head 104 about a horizontal axis. Accordingly, upright section 108 may be rotatable rearwardly so as to be positionable in a plurality of reclined floor cleaning positions (see for example FIGS. 81 and 108).

Upright section 108 may also be steeringly connected to surface cleaning head 104 for maneuvering surface cleaning head 104. For example, joint 116 may be a swivel joint.

Handvac 112 may be removably connected to upright section 108. When mounted to upright section 108, a user may grasp handvac 112 to manipulate upright section 108 to steer surface cleaning head 104 across a surface to be cleaned. Accordingly, when handvac 112 is mounted to upright section 108, handle 484 is the drive handle of surface cleaning apparatus 100

Surface cleaning apparatus 100 has at least one dirty air inlet, one clean air outlet, and an airflow path extending between the inlet and the outlet. In the illustrated example, lower end 120 of surface cleaning head 104 includes a dirty air inlet 124, and a rear end 128 of handvac 112 includes a clean air outlet 132. An airflow path extends from dirty air inlet 124 through surface cleaning head 104, upright section 108, and handvac 112 to clean air outlet 132.

As exemplified, at least one suction motor, and preferably the only suction motor, and one air treatment member, which may be the only air treatment member, is provided in the handvac 112 to permit handvac 112 to operate independently when disconnected from surface cleaning head 104 and optionally from upright section 108. It will be appreciated that while at least one suction motor and at least one air treatment member are positioned in the airflow path to separate dirt and other debris from the airflow, that when used with other aspects disclosed herein, each of the suction motor and the air treatment member may be provided in the surface cleaning head 104, the upright section 108, and/or the handvac 112.

The air treatment member may be any suitable air treatment member, including, for example, one or more cyclones, filters, and bags. Preferably, at least one air treatment member is provided upstream of the suction motor to clean the dirty air before the air passes through the suction motor. In the illustrated embodiment, handvac 112 includes a cyclone bin assembly 136 including a cyclone chamber and a dirt collection region. In some embodiments, the dirt collection region may be a portion (e.g., a lower portion) of the cyclone chamber. In other embodiments, the dirt collection region may be a dirt collection chamber that is separated from the cyclone chamber by a dirt outlet of the cyclone chamber. Plurality of Dirt Collection Chambers In accordance with one aspect of this disclosure, which may be used by itself or in combination with any one or more other aspects of this disclosure, a stick surface cleaning apparatus may have more than one dirt collection chamber. For example, the handvac may include a first dirt collection chamber, and the upright section may include a second dirt collection chamber. The second dirt collection chamber provides the surface cleaning apparatus with an enlarged dirt collection capacity in comparison with the dirt collection capacity of the handvac alone. Accordingly, the surface cleaning apparatus may operate for longer intervals before one or more of the dirt collection chambers needs to be emptied.

Figure 4:
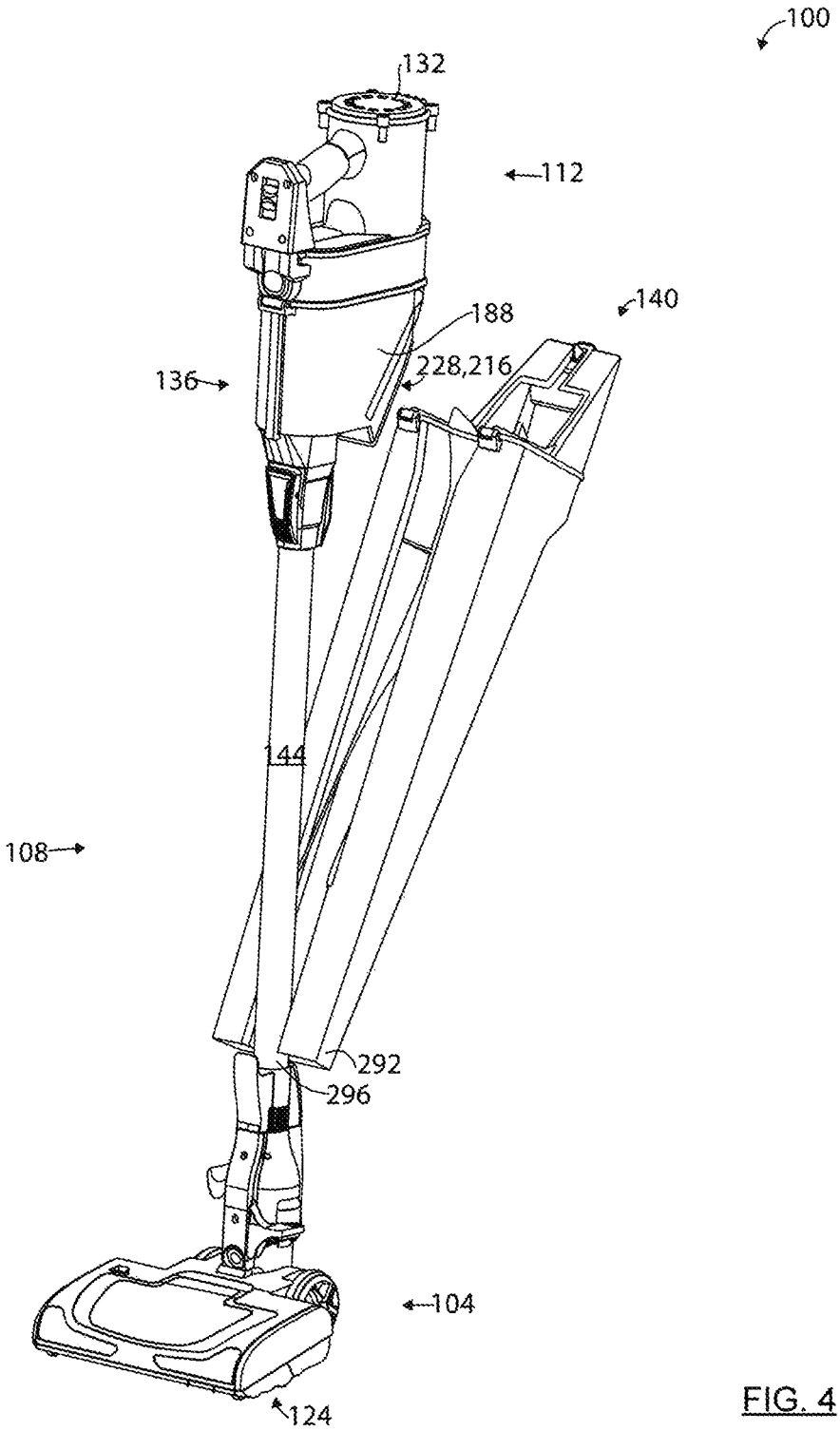
FIG. 4 is a front perspective view of the apparatus of FIG. 1 with a supplemental dirt collection chamber partially removed.

In accordance with this aspect, and as exemplified in FIG. 4, upright section 108 may have an auxiliary dirt collection assembly 140, which may comprise or consist of an auxiliary dirt collection chamber 141. For example, the auxiliary dirt collection chamber 140 may be the only component provided in the auxiliary dirt collection assembly and therefore the auxiliary dirt collection chamber 140 may be the auxiliary dirt collection assembly. Alternately, as disclosed in alternate embodiments, the auxiliary dirt collection assembly may also include one or more of a pre-motor filter, one or more cyclone chambers that may have one or more associated dirt collection chambers and a suction motor.

As illustrated, up flow duct 144 (also referred to as a wand if removable for use, e.g., in an above floor cleaning mode as exemplified in FIGS. 33 and 44*a*) may define the airflow path between surface cleaning head 104 and handvac 112. Auxiliary dirt collection chamber 140 may be a supplemental dirt collection chamber that is selectively mounted to up flow duct 144 and augments the dirt collection capacity of surface cleaning apparatus 100 when mounted to upper section 108.

It will be appreciated that if up flow duct 144 is the member that supports handvac 112 when auxiliary dirt collection assembly 140 is removed, the up flow duct is designed to be load supporting and may be a rigid tube. Further if the up flow duct is removable to function as an above floor cleaning wand, then the up flow duct may also be a rigid tube. In other embodiments, e.g., the up flow duct is not a load supporting member, then all or a portion of up flow duct 144 may be flexible, such as a flexible hose.

As exemplified in FIGS. 1 and 21, the dirt collection assembly 140 of the upright section 108 may collect at least a portion of the dirt separated from the dirty airflow by the handvac 112. Accordingly, the dirt collection assembly 140 of the upright section 108 may be in communication with the dirt collection chamber of handvac 112 all or a portion of the time when the handvac 112 is mounted to the upright section 108. For example, the dirt collection chamber of handvac 112 may have a door that automatically opens when handvac 112 is mounted to the upright section 108. Accordingly, dirt separated by handvac 112 may travel to the supplemental dirt collection assembly 140. Alternately, the door may be manually operable by a user. Accordingly, dirt may only be transferred to the supplemental dirt collection assembly 140 when a user elects to open the door. Alternately, the supplemental dirt collection assembly 140 may receive dirt from an auxiliary air treatment member, in which case the auxiliary dirt collection assembly may comprise a housing having both the auxiliary air treatment member and the auxiliary dirt collection chamber.

The dirt collection chamber of auxiliary dirt collection assembly 140 and handvac dirt collection chamber 188 may be of any suitable volumetric sizes. Preferably, the volumetric storage capacity of the dirt collection chamber of auxiliary dirt collection assembly 140 is at least equal to the volumetric storage capacity of handvac dirt collection chamber 188, and more preferably larger than the volumetric storage capacity of handvac dirt collection chamber 188. For example, the volumetric storage capacity of the dirt collection chamber of auxiliary dirt collection assembly 140 may be 1-20 times the volumetric storage capacity of handvac dirt collection chamber 188, more preferably 1.5-10 times, and most preferably 3-5 times. In alternative embodiments, the volumetric storage capacity of the dirt collection chamber of auxiliary dirt collection assembly 140 may be less than that of handvac dirt collection chamber 188.

As exemplified in FIG. 21, handvac 112 may include a cyclone bin assembly 136 including one or more cyclone chambers 184 and one or more dirt collection chambers 188. The cyclone chamber or chambers and the dirt collection chamber or chambers may be of any design. As exemplified, cyclone chamber 184 includes an air inlet 192 in fluid communication with wand 144, an air outlet 196 downstream of air inlet 192, and a dirt outlet 200 in fluid communication with dirt collection chamber 188. Suction motor 204 or another suction source may draw dirty air to enter air inlet 192 and travel cyclonically across cyclone chamber 184 to dirt outlet 200 where dirt is ejected into dirt collection chamber 188. Afterwards, the air is discharged from cyclone chamber 184 at air outlet 196.

As exemplified in FIGS. 21-23, cyclone bin assembly 136 may include laterally opposed side walls 208, a top wall 212, a bottom wall 216, a first end wall 220, and a second end wall 224. As shown, a common interior wall 226 may divide cyclone chamber 184 from dirt collection chamber 188. For example, cyclone chamber 184 may be defined by top wall 212 and interior wall 226 which extend between end walls 220 and 224. Top wall 212 and interior wall 226 may be curved to define a substantially cylindrical or frustroconical sidewall of cyclone chamber 184. In alternative embodiments, cyclone chamber 184 may have a sidewall of any other suitable shape that is conducive to cyclonic flow. In some alternative embodiments, interior wall 226 of cyclone chamber 184 may be discrete from dirt collection chamber 188 instead of forming a common wall dividing cyclone chamber 184 from dirt collection chamber 188.

Dirt collection chamber 188 may be defined by bottom wall 216, side walls 208, and interior wall 226. In some embodiments, bottom wall 216 may be openable for fluidly connecting handvac dirt collection chamber 188 to supplemental dirt collection assembly 140 of upright section 108. This may permit dirt separated by cyclone chamber 184 and discharged through dirt outlet 200 to move through opened bottom wall 216 and collect in supplemental dirt collection assembly 140.

Optionally, when the auxiliary dirt collection assembly is mounted to upright section 108, dirt separated in the cyclone chamber is collectable in the dirt collection chamber of the auxiliary dirt collection assembly. The auxiliary dirt collection assembly may be selectively connectable in communication with the dirt collection region of the hand vacuum cleaner by, e.g., an openable door 228 (also referred to as a dumping door). The door may be manually openable, such as by a handle, or automatically operated, such as when the auxiliary dirt collection assembly is mounted to upright section 108. In this case, dirt will collect in the handvac 112 and will remain there until door 228 is openable so as to allow the collected dirt to transfer to supplemental dirt collection assembly 140. In the latter case, supplemental dirt collection assembly 140 is automatically connected in communication with a dirt outlet of the cyclone chamber when the auxiliary dirt collection assembly is mounted to upright section 108. In this case, dirt will collect in the supplemental dirt collection assembly 140 when handvac 112 is mounted to the upright section 108.

In the illustrated example, bottom wall 216 includes a door 228, which may be a pivotally openable door 228. As shown, door 228 may be pivotally connected to dirt collection chamber 188 by a hinge 232 for rotation about a hinge axis 236. Door 228 may extend forwardly from a rear end 240 to a front end 244. Preferably, hinge 232 and hinge axis 236 are positioned at rear end 240 of door 228. In alternative embodiments, hinge 232 and hinge axis 236 may be positioned at front end 244 or intermediate front and rear ends 240 and 244.

Door 228 is preferably outwardly pivotal of dirt collection chamber 188. For example, door 228 may be movable between a closed position (FIG. 22) in which door 228 closes bottom wall 216, and an open position (FIG. 21) in which door 228 is rotated away from dirt collection chamber 188 for opening bottom wall 216 to permit dirt to move from handvac dirt collection chamber 188 to supplemental dirt collection assembly 140. As shown, in the open position front end 244 of door 228 may be moved away from handvac dirt collection chamber 188.

Hinge axis 236 may have any suitable orientation. In the illustrated example, hinge axis 236 extends laterally side-to-side of surface cleaning apparatus 100. Hinge axis 236 may be transverse to one or more of cyclone axis 248 of cyclone chamber 184, motor axis 252 of suction motor 204, or downstream direction 256 through air inlet 192. In the example shown, hinge axis 236 is perpendicular to cyclone axis 248, motor axis 252, and downstream direction 256. In alternative embodiments, hinge axis 236 may be substantially parallel to one or more of cyclone axis 248, motor axis 252, or downstream direction 256.

In some embodiments, door 228 may extend upwardly and forwardly between rear end 240 and front end 244. For example, front end 244 may be positioned closer to cyclone chamber 184 and cyclone axis 248 than rear end 240. When door 228 is opened (FIG. 21), this may provide a bottom opening 260 having a transverse width 264 between cyclone chamber 184 and bottom wall 216.

Optionally, the dirt collection region (the dirt collection chamber) of the hand vacuum cleaner is positioned above the supplemental dirt collection assembly 140. Accordingly, dirt that is received in the dirt collection chamber of the hand vacuum cleaner may be transferred by due to gravity to the supplemental dirt collection assembly 140. Accordingly, for example, dirt outlet 200 may be positioned on a bottom end 268 of cyclone chamber 184 for discharging dirt toward bottom wall 216 and opening 260 to be delivered by gravity into supplemental dirt collection assembly 140 of upright section 108.

Reference is now made to FIGS. 21, 22, and 24. Preferably, when handvac 112 is connected to upright section 108, opening 260 is fluidly coupled to an inlet to dirt collection assembly 140. In the illustrated example, door 228 and opening 260 of cyclone bin assembly 136 align with an inlet 272 of dirt collection assembly 140. As shown, inlet 272 may be formed as an opening in an upper portion 276 of dirt collection assembly 140. In some embodiments, inlet 272 may include a door (not shown) which opens automatically and concurrently with door 228. Optionally, the door of inlet 272 may be biased (e.g. by a spring) to close inlet 272 and seal dirt collection assembly 140 when door 228 is closed or handvac 112 is disconnected from upright section 108.

Preferably, opening 260 and inlet 272 of upper portion 276 of dirt collection assembly 140 are sized and positioned to receive at least a portion of door 228 when door 228 is in the open position. This may permit door 228 to open outwardly into the open position as shown in FIG. 21.

If door 228 is moveable from the closed position to the open position automatically upon connecting handvac 112 to upright section 108, then handvac 112 may include an actuator drivingly connected to door 228 to move door 228 (e.g., pivot door 228 about hinge axis 236) to the open position when handvac 112 is connected to upright section 108. In the illustrated embodiment, door 228 includes an arm 280 pivotally connected at hinge 232. As shown, arm 280 may include a lever portion 284 which extends rearwardly of hinge 232, and which may be depressed to pivot door 228 to the open position. Further, dirt collection assembly 140 is shown including an engaging member 288 positioned to align with lever portion 284 of arm 280. In use, engaging member 288 may depress lever portion 284 of arm 280 upon connecting handvac 112 to upright section 108 to automatically pivot door 228 into the open position, whereby opening 260 may be fluidly connected to inlet 272 of supplemental dirt collection assembly 140. In one aspect, this may permit a user, who has used handvac 112 when disconnected from upright section 108, to automatically empty handvac dirt collection chamber 188 by connecting handvac 112 to upright section 108. Afterwards, handvac 112 may be disconnected from upright section 108 with an empty dirt collection chamber 188.

If door 228 is manually moveable from the closed position to the open position then, as exemplified in FIGS. 97*a-b* and 98*a-b*, door 228 may be provided with an actuator, e.g., a manually operable lever portion 284. Lever portion 284 may extend downwardly from door 228 such that lever portion 284 is user-accessible and user-operable while handvac 112 is mounted to upright section 108. As exemplified, lever portion 284 may protrude from the bottom wall 216 of cyclone bin assembly 136 to provide user-accessibility to lever portion 284.

As exemplified in FIGS. 21, 22, 24, 97*a-b*, and 98*a-b*, whether door 228 is manually or automatically operable, door 228 may be biased to the closed position. For example, door 228 may be biased for rotation about hinge axis 236 toward the closed position by a biasing member (not shown), such as a torsion spring. This may permit door 228 to close automatically upon disconnecting handvac 112 from upright section 108, to prevent dirt from spilling from dirt collection chamber 188 and to permit immediate use of handvac 112 for cleaning. In alternative embodiments, door 228 may not be biased toward the closed position. For example, door 228 may remain in the open position upon disconnecting handvac 112 from upright section 108. In such a case, door 228 may remain open until manually closed. For example, referring to FIGS. 98*a-b*, door 228 may remain in the open position shown until lever portion 284 of arm 280 is user-activated to move door 228 to the closed position.

Removable Supplemental Dirt Collection Assembly

In accordance with another aspect of this disclosure, which may be used by itself or in combination with any one or more other aspects of this disclosure, a surface cleaning apparatus has two or more dirt collection chambers wherein one of the dirt collection chambers is optionally removable, and the surface cleaning apparatus is operable when the removable dirt collection chamber has been removed. Accordingly, as discussed with respect to the previous embodiment, a supplemental dirt collection chamber may be provided on the up flow duct or wand of a stick vacuum cleaner and may be the main dirt collection chamber (e.g., it may collect most or all of the separated dirt when the stick vacuum cleaner is operated with the supplemental dirt collection chamber in position). This may be referred to as a large dirt capacity upright mode or a second upright mode of operation.

The supplemental dirt collection chamber may be removable for emptying and to reconfigure the vacuum to a light weight upright mode or a first upright mode of operation. Once removed, the vacuum cleaner may be operable to separate dirt and collect the separated dirt in another dirt collection chamber (e.g. the handvac dirt collection chamber). An advantage of the light weight upright mode is that the size and weight of the vacuum cleaner may be reduced by removal of the supplemental dirt collection chamber. This may be of assistance when the vacuum cleaner is used to clean around and under furniture, and when the vacuum cleaner is to be carried upstairs.

As exemplified in FIGS. 1 and 4, dirt collection assembly 140 of upright section 108 may be removably connected to wand 144 and handvac 112. This may permit dirt collection assembly 140 to be removed for emptying, or to operate apparatus 100 in a light weight upright mode. It will be appreciated that, in alternate embodiments, wand 144 and dirt collection assembly 140 of upright section 108 may be integrally formed or permanently connected as a one piece assembly.

Dirt collection assembly 140 may be removably mounted to wand 144 in any suitable fashion. In the illustrated embodiment, a lower end 292 of dirt collection assembly 140 may be toed onto a lower end 296 of wand 144, and then dirt collection assembly 140 may be pivoted about lower end 292 toward wand 144 and held in position by a suitable releasable fastening mechanism.

In the illustrated embodiment, handvac 112 may remain in fluid communication with wand 144 and surface cleaning head 104 while supplemental dirt collection assembly 140 is disconnected from wand 144 and removed altogether from apparatus 100. This may permit dirt collection assembly 140 to be removed (e.g., for emptying or to operate apparatus 100 in a light weight upright mode) without disrupting the operation of apparatus 100.

Upstream Air Treatment Member

In accordance with another aspect of this disclosure, which may be used by itself or in combination with any one or more other aspects of this disclosure, an upstream air treatment member may be provided. The upstream air treatment member may be removably connectable upstream of the handvac. For example, the supplemental dirt collection assembly may have one or more cyclone chambers associated therewith. Accordingly, when the supplemental dirt collection assembly is positioned on upright section 108 (e.g., up flow duct 144), a supplemental cyclone chamber assembly 160 may be connected in series or parallel with the cyclone chamber of the handvac. Accordingly, when operated as an upright vacuum, the surface cleaning apparatus may be a dual cyclonic stage surface cleaning apparatus. When used in an above floor cleaning mode, the handvac may be a single cyclonic stage surface cleaning apparatus. Typically, the surface cleaning apparatus may be used as an upright vacuum cleaner (i.e., with the supplemental cyclonic bin assembly attached) for cleaning floors. This may represent the majority of area that is to be cleaned. Therefore, for a majority of the use of the surface cleaning apparatus, it may be used as a dual stage cyclonic surface cleaning apparatus.

In accordance with this aspect, the upright section may include a first air treatment member for separating at least large dirt particles from the airflow, and the air treatment member of the handvac may be positioned downstream of the first air treatment member for separating small dirt particles ("fines") from the airflow. In this case, the greatest volume of separated dirt may be collected in the dirt collection chamber of the upright section, and a lesser volume of fines may be collected in the dirt collection chamber of the handvac. This may reduce the rate at which the handvac dirt collection chamber may be filled, and reduce the frequency at which the handvac dirt collection chamber must be emptied. It will be appreciated that each cyclonic stage may be of any design and may be designed to remove any type of dirt.

It will be appreciated that, in some embodiments, dirt separated by the handvac may be collected in the supplemental dirt collection assembly. In such a case, the dirt collection region of the handvac may be in communication (automatically or manually selectively) with a dirt collection region in the supplemental dirt collection assembly, which region may be isolated from the dirt collection chamber for the cyclonic stage of the supplemental cyclone chamber assembly.

It will be appreciated that, if air travels through up flow duct 144 to handvac 112, when cyclone bin assembly 160 is connected to wand 144, air travelling through wand 144 may be diverted into cyclone bin assembly 160 and returned to wand 144 from cyclone bin assembly 160 downstream of the diversion. Optionally, in accordance with another aspect with is discussed in more detail subsequently, and which is exemplified in the embodiment of FIGS. 20 and 26, in some embodiments the diversion may occur automatically upon mounting of the supplemental cyclone bin assembly 160 to upright section 108. For example, cyclone bin assembly 160 may include a diversion member 428 which may be positionable in the conduit of wand 144 between the upstream and downstream ends 364 and 360 of wand 144. As shown, diversion member 428 may divide wand 144 into an upstream wand portion 440 and a downstream wand portion 444. Diversion member 428 may form an air-tight seal inside wand 144 for redirecting substantially all air travelling through upstream wand portion 440 into air inlet 316 of cyclone bin assembly 160. In turn, air outlet 320 of cyclone bin assembly 160 may discharge into downstream wand portion 444 for travel downstream to handvac 112.

As exemplified in the embodiment of FIGS. 5, 12, and 25 supplemental cyclone bin assembly 160, 160 may be any suitable cyclone bin assembly and may include a cyclone chamber 308 and a dirt collection chamber 141. Cyclone chamber 308 may include an air inlet 316 for receiving dirty air from the surface cleaning head, e.g., via wand 144, an air outlet 320 for discharging air, e.g., to handvac 112, a dirt outlet 324 for discharging separated dirt into dirt collection chamber 141, a vortex finder 400 and a cyclone axis 392. Wand 144 may include an upstream end 360 connected to surface cleaning head 104, and a downstream end 364 connected to air inlet 316 of cyclone chamber 308.

From cyclone bin assembly 160, the airflow may flow downstream to handvac 112. Accordingly, handvac cyclone bin assembly 136 is positioned downstream of and in series with supplemental cyclone bin assembly 160. The air may be received in handvac cyclone bin assembly 136 where additional particulate matter may be further separated from the airflow and deposited into dirt collection chamber 188. In many cases, the additional particulate matter separated by cyclone bin assembly 136 may constitute less than 30% of the total volume of dirt separated from apparatus 100, and may constitute all or a majority of the fines that are separated. Accordingly, dirt collection chamber 188 may be filled at a lower volumetric rate than supplemental dirt collection chamber 141. This may help to maintain dirt collection capacity in handvac 112.

In operation, air exiting air outlet 320 of cyclone bin assembly 160 may enter handvac 112 for a second stage of cleaning by cyclone bin assembly 136. As illustrated, handvac 112 may include a nozzle 412 having an upstream end 416 and a downstream end 420. When handvac 112 is connected to upright section 108, upstream end 416 may be fluidly connected with air outlet 320 of upright section 108, and downstream end 420 may be fluidly connected with inlet 192 of handvac cyclone chamber 184.

In operation, air may be drawn into dirty air inlet 124 and enter upstream wand portion 440. Diversion member 428 may redirect the air traveling through upstream wand portion 440 to enter air inlet 316 of cyclone chamber 308. Air may travel through air inlet 316 tangentially to sidewall 376 and spiral downwardly toward lower end wall 368, whereby dirt may be separated from the airflow and pass through dirt outlet 324 to accumulate in dirt collection chamber 141. The airflow may then travel downstream into vortex finder 400 and exit cyclone chamber 308 at air outlet 320 at downstream end 404 of vortex finder 400, into an outlet passage 476. Outlet passage 476 may have a downstream end fluidly connected to downstream wand portion 444. The air may travel through downstream wand portion 444 to downstream wand end 364 into handvac 112. In handvac 112, additional dirt may be separated from the airflow by cyclone bin assembly 136 before the air is discharged through clean air outlet 132.

It will be appreciated that, in accordance with this aspect, cyclone bin assembly 160 may be any suitable cyclone bin assembly. In the example shown in FIGS. 5, 12, and 25, cyclone chamber 308 includes a lower end wall 368, an upper end wall 372, and a sidewall 376 extending between the lower end wall 368 and the upper end wall 372. Preferably, sidewall 376 is substantially cylindrical or frustroconical in accordance with conventional cyclone chamber design.

Dirt outlet 324 may be formed as an opening in sidewall 376 for directing separated dirt into dirt collection chamber 141. In some embodiments, at least a portion of sidewall 376 of cyclone chamber 308 may form a common dividing wall between cyclone chamber 308 and dirt collection chamber 141. In this case, dirt outlet 324 may be formed as an opening in the common portion of sidewall 376.

Dirt outlet 324 may be formed at any suitable position on sidewall 376. In the illustrated example, dirt outlet 324 is positioned at an upper end of cyclone chamber 308 proximate upper end wall 372. More particularly, the illustrated embodiment includes a dirt outlet 324 defined by a slot 380 in sidewall 376 bordered by upper end wall 372. This may increase the capacity of dirt collection chamber 141. More specifically, dirt may accumulate by gravity from the bottom of dirt collection chamber 141 upwardly. Thus, the capacity of the dirt collection chamber 141 may be defined at least in part by the position of dirt outlet 324. Dirt collection chamber 141 is full when the level of dirt in dirt collection chamber 141 rises to dirt outlet 324. Accordingly, the capacity of dirt collection chamber 141 is the volume of the dirt collection chamber 141 below dirt outlet 324. Thus, the capacity of dirt collection chamber 141 may be increased by positioning dirt outlet 324 in an uppermost position, such as proximate the upper end wall 372 of cyclone chamber 308 as shown.

Alternately, in some embodiments as exemplified in FIG. 26, lower end wall 368 may comprise or be an arrester plate 1280 which separates cyclone chamber 308 from dirt collection chamber 141. In this case, dirt outlet 324 may be formed by a gap between arrester plate 1280 and sidewall 376, where dirt particles may fall by gravity into dirt collection chamber 141.

In accordance with another aspect which is discussed in more detail subsequently, as exemplified, cyclone chamber 308 may include an inlet passage 384 for redirecting axially-directed inlet air to flow tangentially to promote cyclonic action in cyclone chamber 308. An upstream end 388 of inlet passage 384 may face axially (i.e. substantially parallel to cyclone axis 392), and a downstream end (not shown) of inlet passage 384 may face tangentially to cyclone chamber 308. Air entering upstream end 388 of inlet passage 384 from air inlet 316 may travel along inlet passage 384 and exit downstream end (not shown) in a tangential direction. After spiraling upwardly around vortex finder 400 of cyclone chamber 308, the airflow may enter vortex finder 400 and exit cyclone chamber 308 through air outlet 320 at a downstream end 404 of vortex finder 400.

Handvac cyclone chamber 184 may be any suitable cyclone chamber. In some embodiments, cyclone chamber 184 is substantially similar to cyclone chamber 308. For example, cyclone chamber 184 may include an air inlet 192, an inlet passage 420, a dirt outlet 200, a vortex finder 424, a dirt outlet 200, an air outlet 196, and a cyclone axis 248. Air from upright section 108 may axially enter air inlet 192, be redirected to a tangential direction by inlet passage 420, spiral upwardly around vortex finder 424, deposit dirt into dirt outlet 200, and then exit cyclone chamber 184 through air outlet 196 at a downstream end of vortex finder 424.

Modes of Operation

In accordance with another aspect of this disclosure, which may be used by itself or in combination with any one or more other aspects of this disclosure, the surface cleaning apparatus is reconfigurable to operate in a plurality of different modes of operation. For example, the surface cleaning apparatus may be operable in two or more of a handvac mode, a stair-cleaning mode, an above-floor cleaning mode, a large dirt capacity upright mode, a lightweight upright mode, or a dual motor upright mode. In some cases, the surface cleaning apparatus may be reconfigurable between different modes of operation with a single act of connection or disconnection. This may permit the surface cleaning apparatus to be quickly reconfigured with minimal interruption.

Referring to FIGS. 1, 5, and 13, surface cleaning apparatus 100, 152, and 168 are shown in a large dirt capacity upright cleaning mode. In the large dirt capacity upright cleaning mode, surface cleaning apparatus 100, 152, and 168 may include surface cleaning head 104, upright section 108 including wand 144 and supplemental dirt collection assembly 140, and handvac 112. The airflow path may extend from dirty air inlet 124 of surface cleaning head 104 downstream through wand 144 and then cyclone bin assembly 136 of handvac 112 to separate dirt from the airflow and deposit that dirt into dirt collection chamber 141 of upright section 108 and/or handvac dirt collection chamber 188. In apparatus 152 and 168, cyclone bin assembly 160 is also positioned in the airflow path for separating and collecting dirt from the airflow and cyclone bin assembly 136 of handvac 112 may optionally be bypassed as discussed subsequently.

As exemplified in FIGS. 12 and 12*a* one or more of the surface cleaning head 104, upright section 108, and handvac 112 may be removably connected to each other so as to be able to be assembled in a number of different combinations to provide apparatus 152 with a number of different modes of operation. In some embodiments, the wand 144 and supplemental assembly 140, 160 of upright section 108 may also be removably connected to each other to provide additional modes of operation. For example, in the large dirt capacity upright cleaning mode, surface cleaning head 104 may be connected to upstream end 360 of wand 144, downstream end 364 of wand 144 may be connected to an air inlet 316 of cyclone bin assembly 160, and air outlet 320 of cyclone bin assembly 160 may connected to upstream end 416 of handvac nozzle 412.

The large dirt capacity upright cleaning mode as shown may be particularly effective for cleaning large surface areas (e.g. the floor of one or more rooms). The user may grasp handvac handle 484 to steer surface cleaning head 104 across the surface to be cleaned (i.e. handle 484 may be a drive handle of the surface cleaning apparatus). The tall height 492 of apparatus 100, 152, and 168 provided in part by the interposition of wand 144 between surface cleaning head 104 and handvac 112 may permit apparatus 100 to be operated by a user standing upright. The large dirt capacity of dirt collection chamber 141 of upright section 108 may permit extended usage of apparatus 100 before the dirt collection chamber 141 becomes full and must be emptied.

As exemplified in FIGS. 4, 5, 12, 12*a*, 20 and 27-30, and 37-44 dirt collection assembly 140 or cyclone bin assembly 160 may be selectively disconnected from upright section 108 to reconfigure apparatus 100, 152, or 168 from the large dirt capacity upright mode to a light weight upright mode. Likewise, dirt collection assembly 140 or cyclone bin assembly 160 may be selectively reconnected to upright section 108 to reconfigure apparatus 100, 152, or 168 from a light weight mode to a large dirt capacity upright mode.

Preferably, reconfiguring the apparatus from the large dirt capacity upright mode to the light weight upright mode may require only a single user action (e.g., disconnecting the dirt collection assembly 140 or cyclone bin assembly 160 from the upright section 108 may automatically close a dumping door of the handvac if the dumping door is open and may also automatically close a diversion member if the vacuum cleaner includes a supplemental cyclone bin assembly 160).

As exemplified in apparatus 100, door 228 which may have been open in the large dirt capacity upright mode for connecting dirt collection chambers 188 and 141, may close automatically (i.e. without any further user interaction) upon disconnecting dirt collection chamber 141, to seal bottom wall 216 of dirt collection chamber 141. Exemplary mechanisms include a biasing member, such as a spring and a mechanical or electrical drive member drivingly connected to the door to close the door as supplemental assembly 140, 160 is removed.

As exemplified in apparatus 168, disconnecting cyclone bin assembly 160 from wand 144 may automatically reroute the airflow path to extend directly from upstream wand end 360 to downstream wand end 364 without the intermediary diversion to cyclone bin assembly 160. Therefore, the airflow path between surface cleaning head 104 and handvac 112 is automatically reconfigured by disconnection of cyclone bin assembly 160 to reconfigure apparatus 168 to the light weight upright mode. Accordingly apparatus 168 may be continually operated while being reconfigured.

In alternative embodiments, door 228 of apparatus 100 may be manually closed as another step before, during or after dirt collection assembly 140 is disconnected from upright section 108 to complete the reconfiguration to the light weight upright mode. For example, a user may manually close the door. In other embodiments, as described in more detail below, a diversion valve of apparatus 168 may require manual closure as another step after cyclone bin assembly 160 is disconnected from wand 144 to complete the reconfiguration to the light weight upright mode. Alternately, a single actuator may be manually operated to close the door and the diversion valve.

As exemplified in FIG. 4, apparatus 152 may be reconfigurable from the large dirt capacity upright mode to a light weight upright mode by disconnecting assembly 140, 160 from wand 144. In some cases, it may be desirable to momentarily reconfigure an apparatus to the lightweight upright mode to complete a task (e.g. clean under an article of furniture), and afterward reconfigure the apparatus to the large dirt capacity upright mode. In the illustrated example, the airflow path between surface cleaning head 104 and handvac 112 persists during and after reconfiguration of apparatus 100 from the large dirt capacity upright mode to the lightweight upright mode. This may permit apparatus 100, to be operated continuously (i.e. air to continue to travel between inlet 124 and outlet 132) before, during, and after reconfiguration to the lightweight upright mode. In turn, this may allow for a quick reconfiguration with little or no disruption. It will be appreciated that if a cyclone is provided in the supplemental assembly (e.g., assembly 160), there may be a short period during which the diversion valve is not closed during the transition.

In some cases, reconfiguring apparatus 100, 152, or 168 from the large dirt capacity upright mode to the lightweight upright mode may provide a reduction in weight (i.e. by the removal of dirt collection assembly 140 or cyclone bin assembly 160), and a more slender profile. Thus, the lightweight upright mode may make apparatus 100, 152, or 168 easier to lift (e.g. carry upstairs), and easier to maneuver under and around furniture and the like. However, in this mode, all of the dirt separated by cyclone bin assembly 136 in the lightweight upright mode is collected in dirt collection chamber 188. Thus, apparatus 100, 152, or 168 may have less dirt collection capacity in the lightweight upright mode as compared with the large dirt capacity upright mode.

Referring now to FIGS. 31-33, 44*a*, and 44*b*, apparatus 100 and 168 are shown in an above-floor cleaning mode. As illustrated, apparatus 100 and 168 in the above-floor cleaning mode include handvac 112 and wand 144. Apparatus 100, 152, and 168 may be reconfigured from the lightweight upright mode to the above-floor cleaning mode by disconnecting surface cleaning head 104 from wand 144. It will be appreciated that assembly 140,160 may be retained in an above floor cleaning mode if desired. However, this would add extra weight to the apparatus in the above floor cleaning mode.

Referring to FIG. 36*a*, apparatus 152 is shown in another above-floor cleaning mode. As shown, apparatus 152 in an above-floor cleaning mode may include handvac 112 and an accessory wand 145. Accessory wand 145 may be provided supplementary to wand 144 of upright section 108. For example, accessory wand 145 may be removably mountable to a sidewall of upright section 108, as shown in FIG. 5. Still referring to FIG. 36*a*, in the above-floor cleaning mode shown, upstream end 360 may provide the dirty air inlet, and downstream end 364 may be removably fluidly connected to handvac nozzle 412. Accessory wand 145 may have any suitable length 516. For example, wand 144 may have a length sufficient to permit apparatus 100 to be used as an upright vacuum cleaner in the configuration of FIG. 5. Accordingly, wand 144 may be 2-4 feet long. In contrast, accessory wand 145 may be shorter than wand 144 (e.g., a user wants to be closer to the area to be cleaned in an above floor cleaning mode) and accordingly accessory wand 145 may be 6-18 inches.

In the above-floor cleaning mode, the upstream end 496 of wand 144 may provide the dirty air inlet of apparatus 100, 152, or 168. The above-floor cleaning mode may be well suited to cleaning surfaces above the floor, or more generally surfaces that are not substantially horizontal, and for cleaning in crevices which surface cleaning head 104 might be unable to access. The wand 144 may provide extended reach for distant cleaning surfaces (e.g. curtains, and ceilings). An auxiliary cleaning tool such as a crevice tool, brush or the like may be attached to the inlet end of the wand.

Preferably, apparatus 100, 152, or 168 may be reconfigured from the lightweight upright mode to the above-floor cleaning mode by a single user action—disconnection of surface cleaning head 104 from the upstream end 496 of wand 144. This may permit the apparatus to be quickly reconfigured with little or no disruption. For example, the apparatus may operate continuously before, during, and after reconfiguration from the lightweight upright mode to the above-floor cleaning mode. This may permit a user to conveniently reconfigure the apparatus to the above-floor cleaning mode to clean a surface inaccessible in the lightweight upright mode, and afterward reconfigure the apparatus to the lightweight upright mode to continue cleaning, e.g. the floor.

In some embodiments, the above-floor cleaning mode may further include dirt collection assembly 140. For example, a user may reconfigure apparatus 100, 152, or 168 from the large dirt capacity upright mode (FIGS. 1, 5, and 13) to the above-floor cleaning mode by disconnecting surface cleaning head 104 from wand 144, while maintaining dirt collection assembly 140 in place on wand 144. An above-floor cleaning mode of this configuration may provide apparatus 100 with the reach of the above-floor cleaning mode, and the storage capacity of the large dirt capacity upright mode. In some embodiments, dirt collection assembly 140 may be a one piece assembly with the wand 144 (i.e. irremovably connected to wand 144), in which case the wand 144 may be an up flow duct.

Referring to FIG. 22, apparatus 100, 152, and 168 may be reconfigured to a handvac mode from any other mode of operation by disconnecting handvac 112 (e.g. from wand 144). As illustrated, the handvac mode may include handvac 112 alone. In the handvac mode, upstream end 416 of nozzle 412 may provide the dirty air inlet. Optionally, one or more accessories (not shown), such as a brush, crevice tool, auxiliary wand 145 may be connected to nozzle 412. If a wand 144 is part of dirt collection assembly 140 then an accessory wand 145 may be provided which is connectable to nozzle 412.

The handvac mode of apparatus 100 may be lighter, smaller, and more agile than the other modes of operation. However, the handvac mode may have a smaller dirt collection capacity than the large dirt capacity upright mode (FIGS. 1, 5, and 13) for example.

In some cases, a user may wish to momentarily disconnect handvac 112 for use in the handvac mode (e.g. to clean a surface that is more accessible in the handvac mode), and then return the apparatus to the previous mode. For example, apparatus 100, 152, or 168 may be momentarily reconfigured from the large dirt capacity upright mode (FIGS. 1, 5, and 13) or from the lightweight upright mode (FIGS. 27 and 37) to the handvac mode be merely removing the handvac and afterward reconfigured again to the upright mode.

It may be beneficial for the dirt collection chamber 188 of handvac 112 to have capacity available for use in the handvac mode upon disconnecting handvac 112 from upright section 108. Further, it may be beneficial for dirt collection chamber 188 of handvac 112 to reclaim capacity after reconnecting handvac 112 to upright section 108. This may be achieved by having dirt collection chamber 188 empty into assembly 140, 160 continually while handvac 112 is attached to the assembly, manually before removal of the handvac or upon removal of the handvac. The dirt capacity may be reclaimed by having dirt collection chamber 188 empty into assembly 140, 160 upon replacing handvac 112 to the assembly (either manually or automatically upon replacement).

An example of such a reconfiguration is discussed with respect to the embodiment of FIG. 21, In the illustrated example, handvac dirt collection chamber 188 has a bottom wall 216 that remains open to dirt collection assembly 140 while the handvac is attached to permit dirt from handvac dirt collection chamber 188 to transfer (e.g., by gravity) to dirt collection chamber 141 thereby preventing dirt collection chamber 188 from being filled while the apparatus is used in one of the upright operating modes.

Apparatus 100 may be reconfigured from the handvac mode to the large dirt capacity upright mode by reconnecting handvac 112 to upright section 108. Preferably, reconnecting handvac 112 to upright section 108 automatically opens handvac dirt collection chamber 188 to dirt collection chamber 141 for transferring at least a portion of the dirt, collected while in the handvac mode, to dirt collection chamber 141 thereby emptying dirt collection chamber 188 so that dirt collection chamber 188 is not full when the handvac is once again used in the handvac mode.

In some embodiments, handvac dirt collection chamber 188 does not empty into assembly 140, 160 when attached to the assembly, manually or automatically. For example, FIGS. 25 and 26 show exemplary embodiments of apparatus 152 and 168 where assemblies 160 and 188 receive and store dirt separately at all times. As shown, upright dirt collection chamber 141 may receive and collect dirt separated by auxiliary cyclone bin assembly 160, and handvac dirt collection chamber 188 may separately receive and collect dirt separated by handvac cyclone bin assembly 136.

Turning now to FIGS. 123-126, apparatus 152 is shown in accordance with another embodiment. As exemplified, handvac cyclone bin assembly 136 may include a plurality of cyclonic cleaning stages arranged in series. For example, and referring to FIGS. 125 and 126, cyclone bin assembly 136 may include a first cyclonic cleaning stage 640 arranged in series upstream from a second cyclonic cleaning stage 644. First cyclonic cleaning stage 640 may include one or more air outlet(s) 196*a* which discharge into air inlet(s) 192*b* of second cyclonic cleaning stage 644.

Referring now to FIG. 127, each cyclonic cleaning stage 640 and 644 may include one or more cyclone chambers 184 in parallel. For example, cyclonic cleaning stages 640 and 644 may each include one cyclone chamber 184, or may each include a plurality of cyclone chambers 184. Alternatively, one of cyclonic cleaning stages 640 and 644 may include one cyclone chamber 184 and the other stage may include a plurality of cyclone chambers 184. In the illustrated example, first cyclonic cleaning stage 640 includes one cyclone chamber 184*a*, and second cyclonic cleaning stage 644 includes a plurality of cyclone chambers 184*b* arranged in parallel. For example, second cyclonic cleaning stage 644 may include four or more cyclone chambers 184*b* arranged in parallel.

Second stage cyclone chamber(s) 184*b* may have any suitable orientation relative to first stage cyclone chamber(s) 184*a*. For example, each of second stage cyclone chamber(s) 184*b* may have an air inlet 192*b* and an air outlet 196*b* both positioned proximate a rear end 648 of the second cyclonic cleaning stage 644 (rearward with respect to the inlet of the handvac), or both positioned proximate a front end 652 of the second cyclonic cleaning stage 644. Alternatively, each of second stage cyclone chamber(s) 184*b* may have an air inlet 192 positioned proximate one of the front and rear ends 648 and 652, and an air outlet 196*b* positioned proximate the other of the front and rear ends 648 and 652. In the illustrated example, second stage cyclone chambers 184*b* are shown including air inlets 192*b* at front end 648 and air outlets at rear end 652. This may reduce directional changes in the airflow which may reduce backpressure developed through second stage cyclone chambers 184*b* for enhanced airflow efficiency. As shown, axes 248*b* of second stage cyclone chamber 184*b* may be parallel to axis 248*a* of first stage cyclone chamber 184*a*.

Handvac cyclone bin assembly 136 may include one or more dirt collection regions 188. For example, cyclone chambers 184 of first and second cyclonic cleaning stages 640 and 644 may separate dirt into one common dirt collection region 188, or each cyclonic cleaning stage 640 and 644 may include a separate dirt collection region 188. In the latter case, all first stage cyclone chamber(s) 184*a* may discharge dirt into the first stage dirt collection region 188*a*, and all second stage cyclone chamber(s) 184*b* may discharge dirt into the second stage dirt collection region 188*b*. In the illustrated embodiment, handvac cyclone bin assembly 136 includes one first stage dirt collection region 188*a*, and a plurality of second stage dirt collection regions 188*b*, where each second sage dirt collection region 188*b* receives dirt discharged by a respective second stage cyclone chamber 184*b*.

Reference is now made to FIGS. 34-36, which show apparatus 100, 152, or 168 in a stair-cleaning mode of operation. As shown, apparatus 100, 152, or 168 in stair-cleaning mode may include handvac 112 directly connected to surface cleaning head 104. For example, nozzle 412 may be connected to pivot joint 116 of surface cleaning head 104.

The stair-cleaning mode of operation may be especially suitable for cleaning stairs and the like, where frequent lifting is required to clean the desired surface areas.

Handvac Center of Gravity in the Upright Modes

In accordance with another aspect of this disclosure, which may be used by itself or in combination with any one or more other aspects of this disclosure, when the apparatus is in an upright mode and, in particular in a large dirt capacity upright mode, the center of gravity of the handvac may be located directly above the cyclone bin assembly (or dirt collection chamber) of the upright section.

As exemplified in FIGS. 21 and 25, apparatus 100 is shown in a large dirt capacity upright mode in a storage position. In the illustrated example, handvac 112 is shown including a handvac center of gravity 524. As shown, center of gravity 524 may be positioned vertically above dirt collection assembly 140/cyclone bin assembly 160 between the front and rear ends 532, 544 and 536, 548 of dirt collection assembly 140/cyclone bin assembly 160. Preferably, center of gravity 524 is positioned substantially centrally between front and rear ends 532, 544 and 536, 548 of dirt collection assembly 140/cyclone bin assembly and may be aligned with the wand.

Alternately, or in addition, as exemplified, center of gravity 524 is positioned between cyclone bin assembly 136 and suction motor 204, inside premotor filter chamber 556 of handvac 112.

Configuration of the Auxiliary Assembly

In accordance with another aspect of this disclosure, which may be used by itself or in combination with any one or more other aspects of this disclosure, a surface cleaning apparatus may have an upright section with an auxiliary dirt collection assembly 140 or auxiliary cyclone bin assembly 160 sized, shaped, and positioned according any one of a plurality of different configurations relative to the wand of the upright section and the handvac.

In some embodiments, a surface cleaning apparatus is provided having an upright mode wherein the auxiliary assembly 140, 160 and the handvac are positioned on the same side of the wand. As exemplified in FIGS. 1, 21, 24, 45, and 46, auxiliary assembly 140, 160 and handvac dirt collection chamber 188 may both extend rearwardly of wand 144. Referring to FIG. 21, rear end 536 of dirt collection assembly 140 is shown positioned a rearward distance 564 from wand axis 568. Bottom wall 216 of dirt collection chamber 188 is shown positioned a rearward distance 576 from wand axis 568. Preferably, distances 564 and 576 are substantially equal. In alternative embodiments, distances 564 and 576 may be different. For example, distance 560 may be greater than distance 576, or distance 576 may be greater than distance 564. If rear end 536 is at an angle to the vertical as exemplified, then the handvac is preferable designed such that the rear end does not extend rearwardly past a projection of the line of rear end 536. Accordingly, the lowest extend to which upright section 108 may be pivoted rearwardly is determined by the auxiliary assembly and not the handvac.

In some embodiments, a surface cleaning apparatus is provided having a upright mode wherein the auxiliary assembly 140, 160 and the handvac are positioned on opposite sides of the wand. As exemplified in FIG. 26, dirt collection assembly 140 of upright section 108 is positioned forwardly of wand 144, and handvac dirt collection chamber 188 is positioned rearwardly of wand 144. An advantage of this design is that the weight of the auxiliary assembly 140, 160 is on the opposite side of wand 144 from the handvac and may assist in offsetting the hand weight of the handvac felt by a user holding the handle of the handvac.

In some embodiments, a surface cleaning apparatus is provided having a upright mode where the auxiliary assembly 140, 160 and handvac are positioned on opposite left and right sides of the wand. For example, in apparatus 168, cyclone bin assembly 160 may be mounted to one of the left or right sides of upright section 108, and handvac 112 may be oriented relative to the upright section 108 such that dirt collection chamber 188 extends to the other of the left or right sides of upright section 108.

In some embodiments, the auxiliary assembly 140, 160 of the upright section surrounds at least a portion of the wand. Referring to FIGS. 1, 21, 24, 45 and 46, apparatus 100 is shown including an upright section 108 having dirt collection assembly 140 which partially surrounds wand 144. In the illustrated example, dirt collection assembly 140 includes a channel 584 for receiving at least a portion of wand 144. As shown, channel 584 may extend the height 588 of dirt collection assembly 140 between lower and upper ends 292 and 596. Channel 584 may also extend in depth from front end 532 rearwardly toward rear end 536.

As exemplified, dirt collection assembly 140 includes left and right portions 600 and 604 on opposite left and right sides of channel 584. In the upright mode of apparatus 100, wand 144 may be at least partially received in channel 584, whereby left and right portions 600 and 604 are positioned to the left and right sides of wand 144. As shown, a front end 532 of dirt collection assembly 140 may extend forwardly of wand 144, such that at least a portion of wand 144 is positioned between the front and rear ends 532 and 536 of dirt collection assembly 140.

In the illustrated embodiment, dirt collection assembly 140 may also surround at least a portion of handvac 112 in the upright mode of apparatus 100. In the illustrated embodiment, an outlet end 608 of wand 144 may be received in channel 584 of dirt collection assembly 140. Accordingly, a front portion of handvac 112 may extend into channel 584 for connection with outlet end 608 of wand 144. In the illustrated embodiment, nozzle 412 and inlet passage 420 of handvac 112 may be positioned inside channel 584 of dirt collection assembly 140 in the upright mode of apparatus 100.

Upright Section with a Plurality of Cyclones

In accordance with another aspect of this disclosure, which may be used by itself or in combination with any one or more other aspects of this disclosure, the supplemental cyclone bin assembly 160 may have a plurality of cyclones positioned in series and/or in parallel in the airflow path. The cyclones may be positioned to the same side of the upright section (e.g., front or back, left or right), or on different sides of the upright section (e.g., one front and one back or one on the right side and one on the left side). In one embodiment, the upright section may use two cyclones and the wand may be positioned between the two cyclones.

As exemplified in FIGS. 47-51, auxiliary cyclone assembly 160 comprises first and second supplemental cyclone bin assemblies 161, which may be individual units or may be formed as a single unit or housing. Each cyclone bin assembly 161 is shown including a cyclone chamber 308 and a dirt collection chamber 141. Dirt collection chambers 141 may be combined to form a common repository for dirt separated by both cyclone bin assemblies 161 or each cyclone bin assembly 161 may have a separate dirt collection chamber 141.

Each cyclone chamber 308 may be any suitable cyclone chamber and maybe the same or different. As shown, each cyclone chamber 308 may include a tangential air inlet 344 proximate upper end 374, and an axial air outlet 320 at a downstream end of vortex finder 400.

Cyclone bin assemblies 161 may be positioned in parallel in the airflow path between surface cleaning head 104 and handvac 112. As exemplified, the airflow path may extend from surface cleaning head 104 through an upstream wand portion 440, diverge into the inlets 316 of cyclone chambers 308 through cyclone chambers 308 to their respective air outlets 320. Each cyclone bin assembly 161 may include an outlet passage 476 connecting air outlets 320 to downstream portion 444 of wand 144 where the airflow path converges. From downstream portion 444 of wand 144, the airflow path may extend through handvac 112 and exit out clean air outlet 132.

As exemplified, upstream and downstream portions 440 and 444 of wand 144 may be divided by a diversion member 712, which is described subsequently with respect to a further alternate aspect. Air traveling downstream through upstream portion 440 may contact diversion member 712 and be redirected laterally into air inlets 316 of cyclone chambers 308. Outlet passages 476 of cyclone bin assemblies 161 may converge to form a single airflow path in downstream portion 444 of wand 144 above diversion member 712.

Diversion Valve

In accordance with another aspect of this disclosure, which may be used by itself or in combination with any one or more other aspects of this disclosure, a diversion valve is provided which diverts air travelling through upright section 108 (e.g., the wand 144) into the auxiliary assembly 160 (e.g., supplemental cyclone or cyclones 308). Preferably, the diversion valve operates automatically upon the auxiliary assembly 160 being disconnected from and/or connected to the surface cleaning apparatus.

As exemplified in FIG. 20, cyclone bin assembly 160 may be selectively connected to upright section 108 whereby the airflow path may be reconfigured to extend through cyclone bin assembly 160. Similarly, cyclone bin assembly 160 may be selectively disconnected from upright section 108 whereby the airflow path may be reconfigured to extend through wand 144 from end to end without diversion. Preferably, the airflow path reconfiguration is automatic upon connection and/or disconnection of cyclone bin assembly 160 to upright section 108.

In some embodiments, wand 144 may include a diversion outlet 704 and a diversion inlet 708 positioned between the upstream and downstream ends 360 and 364 of wand 144. The diversion outlet 704 and diversion inlet 708 may be selectively opened when connecting cyclone bin assembly 160 to upright section 108 to reconfigure the airflow path to divert into the cyclone bin assembly 160 at diversion outlet 704, and to return to the wand 144 from cyclone bin assembly 160 at diversion inlet 708. Upright section 108 may include a diversion valve for opening and closing diversion outlet 704 and inlet 708.

A diversion valve 712 according to a first embodiment is exemplified in FIGS. 52-57. As exemplified, diversion valve 712 may include a sleeve 716 positioned inside of wand 144, and a pedal 720 for moving sleeve 716 between an open position and a closed position.

Sleeve 716 may be a conduit for fluidly coupling upstream and downstream wand portions 440 and 444 in the closed position of diversion valve 712 (see FIGS. 52 and 55) to bypass diversion outlet and inlet 704 and 708. Preferably, sleeve 716 may be a rigid conduit. Alternatively, sleeve 716 may include flexible and/or collapsible elements. Effectively, sleeve 716 may close diversion outlet and inlet 704 and 708 in the closed position of diversion valve 712. Optionally, diversion valve 712 may include one or more sealing members (e.g. O-rings) which may form an air-tight seal between sleeve 716 and upstream wand portion 440, and between sleeve 716 and downstream wand portion 444 to help prevent the escape of air through diversion outlet and inlet 704 and 708 in the closed position of diversion valve 712.

Sleeve 716 may be movable axially along wand 114 between the closed position (FIGS. 52 and 55) and the open position (FIGS. 54 and 57). Preferably, sleeve 716 is moved to the open position automatically by mounting cyclone bin assembly 160 to upright section 108 (e.g. connecting to wand 144), and/or moved to the closed position automatically by dismounting cyclone bin assembly 160 from upright section 108 (e.g. disconnecting from wand 144). In the illustrated embodiment, sleeve 716 is drivingly coupled to a pedal 720. Pedal 720 may be depressed to move sleeve 716 from the closed position of FIGS. 52 and 55 to the open position of FIGS. 54 and 57. As shown, pedal 720 may be positioned axially below sleeve 716 and extend outwardly of wand 144 to be depressed by cyclone bin assembly 160 when mounting cyclone bin assembly 160 to upright section 108. Pedal 720 and sleeve 716 may be integrally molded, or separately formed and connected, to move axially up and down as a unit.

As exemplified, pedal 720 and sleeve 716 may be movably mounted to wand 144 for axial movement between the open and closed position. As shown, pedal 720 and sleeve 716 may move downwardly from the closed position (FIGS. 52 and 55) to the open position (FIGS. 54 and 57). In the closed position, sleeve 716 may extend the airflow path directly across the threshold between the upstream and downstream wand portions 440 and 444. In the open position, sleeve 716 may be retracted into the upstream wand portion 440 to open diversion outlet 704 and inlet 708, and thereby permit the airflow path to be diverted through diversion outlet 704, cyclone bin assembly 160 and diversion inlet 708. As shown, diversion outlet 704 may be positioned at a downstream end 724 of upstream wand portion 440, and diversion inlet 708 may be positioned at an upstream end 728 of downstream wand portion 444.

In an alternative embodiment, sleeve 716 may have one or more openings which align with diversion outlet and inlet 704 and 708 in the open position of valve 712. In the closed position, the openings in sleeve 716 may be closed by alignment with solid wall portions of wand 144, and diversion outlet and inlet 704 and 708 may be closed by alignment with solid wall portions of sleeve 716. In this case, sleeve 716 may be positioned inside the upstream and downstream wand portions 440 and 444 in both the open and closed positions of valve 712.

Preferably, sleeve 716 is biased to the closed position. For example, valve 712 may include a biasing member which acts on sleeve 716 to bias sleeve 716 to the closed position. In the illustrated example, valve 712 includes a spring 732 which acts on pedal 720 to urge pedal 720 and sleeve 716 upwardly to the closed position. In alternative embodiments, sleeve 716 may not be biased to the closed position. For example, sleeve 716 may include an actuator, such as a switch or lever, which must be manually activated to move sleeve 716 to the closed position or is moved by assembly 160 when assembly 160 is removed.

Still referring to FIGS. 52-57, cyclone bin assembly 160 may include an engagement member for mating with pedal 720 to mount cyclone bin assembly 160 on pedal 720. In the illustrated example, a cavity 736 is formed in sidewall 376 of cyclone bin assembly 160 for receiving pedal 720. In use, cyclone bin assembly 160 may be set onto pedal 720 such that pedal 720 is received in cavity 736. Preferably, the weight of cyclone bin assembly 160 on pedal 720 is sufficient to overcome the bias of valve biasing member 732, and move pedal 720 and sleeve 716 downwardly to the open position. In alternative embodiments, additional downward force must be applied by the user to move pedal 720 and sleeve 716 downwardly against the bias of the biasing member 732 and/or an actuator, such as a foot pedal, may be utilized.

Cyclone bin assembly 160 may be toed onto pedal 720 (see e.g., FIGS. 53, 56), and then pivoted on pedal 720 into position (see e.g., FIGS. 54, 57) after pedal 720 and sleeve 716 have moved downwardly to the open position. In the illustrated example, cyclone bin assembly 160 may be set onto pedal 720 with cyclone axis 392 extending at a (non-zero) angle to wand axis 740, and then lowered with pedal 720 to move valve 712 to the open position, and finally pivoted about pedal 720 toward wand 144 to complete the connection of cyclone bin assembly 160 to wand 144. An locking member, such as a latch 744, which may be located at the end of the upper end or wand 144, may be provided to secure assembly 160 in position. In some embodiments, cyclone axis 392 may be substantially parallel to wand axis 740 when cyclone bin assembly 160 is connected to wand 144.

Cyclone bin assembly 160 may include a diversion member 428 for dividing wand 144 into upstream and downstream wand portions 440 and 444, and for diverting flow from the upstream wand portion 440 into cyclone bin assembly inlet 316. Diversion member 428 may take any suitable form. In the illustrated embodiment, diversion member 428 is a substantially flat plate which extends outboard of sidewall 376 for protruding into wand 144 through one of diversion outlet 704, diversion inlet 708, or another opening into wand 144. Alternatively, diversion member 428 may be curved to provide a less abrupt change in airflow direction, which may reduce the pressure drop across the diversion member 428. Optionally, diversion member 428 may include or interface with a sealing member (e.g. a deformable elastomeric seal) to form an airtight barrier between upstream and downstream wand portions 440 and 444. Alternately, the diversion member may be a separate member that is installed as a separate step when (i.e. before, during, and/or after) connecting cyclone bin assembly 160 to the wand 144.

As exemplified, when cyclone bin assembly 160 is mounted to wand 144, as shown in FIGS. 54 and 57, air inlet 316 of cyclone chamber 308 is connected to diversion outlet 704 for receiving air from upstream wand portion 440 into cyclone chamber 308, and outlet passage 476 is connected to diversion inlet 708 for discharging air from cyclone bin assembly 160 into downstream wand portion 444.

Cyclone bin assembly 160 may be removably mounted to wand 144 by any suitable mechanism. In the illustrated embodiment, cyclone bin assembly 160 includes a latch 744 on handle 616 for engaging a tab 746 which extends outwardly of wand 144. Latch 744 may be user-operable by a user grasping handle 616 to release latch 744 from tab 746 for disconnecting cyclone bin assembly 160 from wand 144. Preferably, biasing member 732 of valve 712 automatically and immediately moves sleeve 716 to the closed position upon disconnection of cyclone bin assembly 160 to reconfigure the airflow pathway by closing diversion inlet and outlet 704 and 708.

A diversion valve 712 according to a second embodiment is exemplified in FIGS. 58-63, Diversion valve 712 is similar to diversion valve 712 of FIGS. 52-57 in many respects except, for example that sleeve 716 is embodied by a collapsible hose 716 instead of a more rigid conduit.

As exemplified, diversion valve 712 includes a collapsible sleeve 716 positioned inside of wand 144, and a pedal 720 for moving hose 716 been an open position and a closed position.

Sleeve 716 may be a collapsible conduit for fluidly coupling upstream and downstream wand portions 440 and 444 in the closed position of diversion valve 712 (see FIGS. 60 and 63) to bypass diversion inlet and outlet 708 and 712. Optionally, diversion valve 712 may include one or more seals (e.g. O-rings) which form an air-tight seal between sleeve 716 and upstream wand portion 440, and between sleeve 716 and downstream wand portion 444 to help prevent the escape of air through diversion inlet and outlet 704 and 708 in the closed position of diversion valve 716.

In the illustrated embodiment, sleeve 716 has a fixed-position upstream end 756 sealed to upstream wand portion 440, and a downstream end 760 axially movable inside wand 144. Downstream end 760 may be movable toward upstream end 756 to the open position (FIGS. 60 and 63) whereby sleeve 716 is partially collapsed with downstream end 760 positioned in the upstream wand portion 440 upstream of diversion outlet 704. Downstream end 760 may also be movable away from upstream end 756 to the closed position (FIGS. 58 and 61) whereby sleeve 716 is extended with downstream end 760 position in the downstream wand portion 444 downstream of diversion inlet 708.

As exemplified, pedal 720 may be drivingly coupled to downstream end 760 of sleeve 716. Pedal 720 may be depressed (e.g. by the weight of cyclone bin assembly 160) to move downstream end 760 into the upstream wand portion 440, collapsing sleeve 716 into the open position of FIGS. 60 and 63. Pedal 720 may also be raised (e.g. automatically by action of biasing member 732 upon release of pedal 720 or pulled upwardly by assembly 160) to move downstream end 760 into the downstream wand portion 444, extending sleeve 716 into the closed position of FIGS. 58 and 61. Alternately, a manual actuator may be used.

A diversion valve 712 according to a third embodiment is exemplified in FIGS. 64-71. As exemplified, diversion valve 712 may include a diversion outlet door 772 and a diversion inlet door 776. Doors 772 and 776 may be opened when cyclone bin assembly 160 is connected to wand 144 for reconfiguring the airflow path to extend through cyclone bin assembly 160. Doors 772 and 776 may also be closed when cyclone bin assembly 160 is disconnected from wand 144 for reconfiguring the airflow path to extend directly across the threshold between upstream and downstream wand portions 440 and 444.

In the illustrated embodiment, doors 772 and 776 are pivotally mounted to wand 144 for movement between a closed position (see FIGS. 64 and 67-69) in which doors 772 and 776 seal diversion outlet 704 and inlet 708 respectively, and an open position (see FIGS. 66 and 71) in which doors 772 and 776 are open to allow air to flow through doors 772 and 776 between wand 144 and cyclone bin assembly 160. Doors 772 and 776 may be pivotally mounted to wand 144 in any suitable manner. In the example shown, doors 772 and 776 are pivotally mounted to wand 144 by a common hinge 780. As shown, door 772 may pivot inwardly about hinge 780 toward a downstream direction, and door 776 may pivot inwardly about hinge 780 toward an upstream direction. In alternative embodiments, each of doors 772 and 776 may be pivotally mounted to wand 144 by a different hinge.

Preferably, doors 772 and 776 open automatically by connecting cyclone bin assembly 160 to wand 144. In the illustrated example, cyclone bin assembly 160 includes an inlet nose 784 for pushing open diversion outlet door 772, and an outlet nose 788 for pushing open diversion inlet door 776. As shown, noses 784 and 788 may extend outwardly of sidewall 376 for projecting through diversion outlet and inlet 704 and 708 respectively upon connecting cyclone bin assembly 160 to wand 144.

Preferably, when cyclone bin assembly 160 is connected to wand 144, an airflow path is formed between diversion outlet 704 and air inlet 316, and between diversion inlet 708 and air outlet 320, such that the airflow path from upstream wand portion 440 to downstream wand portion 444 is reconfigured to extend through cyclone bin assembly 160. In the illustrated example, connecting cyclone bin assembly 160 to wand 144 may include pushing noses 784 and 788 into diversion outlet and inlet 704 and 708 respectively to open doors 772 and 776.

Noses 784 and 788 may take any suitable form. As exemplified, nose 784 may be formed as a diversion member including an inlet passage having an upstream end 792 and a downstream end 796. Upstream end 792 may extend into wand 144 and form a seal with upstream wand portion 440 to redirect the airflow in upstream wand portion 440 to enter nose 784 toward downstream end 796. In the illustrated embodiment, upstream wand portion 440 includes a sealing ring 800 adjacent an upstream side 804 of diversion outlet door 772 onto which downstream end 796 may be seated for forming an airtight seal between upstream wand portion 440 and downstream end 796. Alternatively, or in addition, upstream side 804 may include a sealing member. Downstream end 796 of nose 784 may be integrally formed or otherwise connected with air inlet 316.

In the illustrated example, nose 788 is formed as a triangular plate which projects outwardly from air outlet 320. In other embodiments, nose 788 may have another suitable form for pushing diversion inlet door 776, such as a circular or rectangular plate or a rod for example. As shown, when cyclone bin assembly 160 is connected to wand 144, nose 788 projects into diversion inlet 708 pushing open diversion inlet door 776. This may permit air outlet 320 to sealingly abut diversion inlet 708 for forming an airflow path between air outlet 320 and downstream wand portion 444. Optionally, a seal 808 may be provided at the interface between air outlet 320 and diversion inlet 708 for enhancing the airtightness of the connection.

It will be appreciated that in alternative embodiments, nose 788 may be formed as an outlet passage, which may be curved similar to nose 784. This may make the change in airflow direction across nose 788 less abrupt, which may reduce pressure losses.

Preferably, when cyclone bin assembly 160 is disconnected from wand 144, doors 772 and 776 automatically close to reconfigure the airflow passage to extend directly from upstream wand portion 440 to downstream wand portion 444 without diversion through diversion outlet 704 or inlet 708. For example, doors 772 and 776 may be biased to the closed position by a biasing member, such as a spring. In the illustrated embodiment, diversion valve 712 includes a torsional spring 812. Spring 812 may be positioned to bias both of doors 772 and 776 to the closed position. In the illustrated embodiment, spring 812 is held in a spring housing 816 mounted to an inside face 820 of diversion outlet door 772. As shown, spring 812 may have an arm 824 connected to diversion inlet door 776, effectively biasing doors 772 and 776 away from each other to their respective closed positions. In alternative embodiments, each of doors 772 and 776 may have a separate biasing member.

A diversion valve 712 according to a fourth embodiment is exemplified in FIGS. 72-77. Diversion valve 712 is similar to diversion valve 712 of FIGS. 64-71 in many respects except, for example, the door which selectively closes diversion outlet 704 and inlet 708.

In the illustrated embodiment, diversion valve 712 includes a door 772. Door 772 may be movable between a closed position (FIGS. 72 and 75) in which door 772 seals diversion outlet 704 and inlet 708, and an open position (FIGS. 74 and 77) in which door 772 is unsealed from outlet 704 and inlet 708 to allow the airflow to pass through diversion outlet 704 and inlet 708. As exemplified, diversion valve 712 may include one door 772 for closing both of diversion outlet 704 and inlet 708, or separate doors 772 for diversion outlet 704 and inlet 708.

As shown, door 772 may be pivotally mounted to wand 144 in any suitable manner for movement between the open and closed positions. For example, door 772 may be pivotally mounted outside of wand 144 by a hinge 780. In the illustrated example, door 772 may pivot outwardly about hinge 780 away from wand 144 to the open position, and may pivot inwardly about hinge 780 toward wand 144 to the closed position. Preferably, door 772 is manually openable, whereby a user may grasp door 772 and manually move door 772 from the closed position to the open position. For example, door 772 may have a lever 840, a handle, or another gripping member for a user to grasp for manipulating the position of door 772.

Once door 772 is opened, as shown in FIGS. 73 and 76, cyclone bin assembly 160 may be connected to wand 144. In the illustrated embodiment, cyclone bin assembly 160 includes a diversion member 428 of the type describe above with reference to FIGS. 52-57. Diversion member 428 may be moved into wand 144 through diversion outlet 704, diversion inlet 708, or another opening in wand 144, for dividing wand 144 into an upstream portion 440 and a downstream portion 444, substantially as described above.

When cyclone bin assembly 160 is disconnected from wand 144, door 772 may be moved back into the closed position for reconfiguring the airflow path in wand 144 to extend directly from upstream portion 440 to downstream portion 444 without diversion. For example, door 772 may be manually moved from the open position to the closed position by hand, or door 772 may move automatically to the closed position by the bias of a biasing member (e.g. a spring).

In some embodiments, door 772 may be held in the closed position by the bias of a biasing member, or by a releasable locking mechanism (e.g. a latch). This may permit door 772 to form a tight seal against diversion outlet 704 and inlet 708.

In some embodiments, pedal 720 may be foot operable and may be located close to or on the surface cleaning head.

Angular Surface of Upright Section

In accordance with another aspect of this disclosure, which may be used by itself or in combination with any one or more other aspects of this disclosure, a surface cleaning apparatus is provided having an upright section with a dirt collection chamber or cyclone bin assembly having a side profile that tapers or narrows from top to bottom. For example, the rear wall of the supplemental dirt collection chamber or supplemental cyclone bin assembly may extend upwardly at an acute angle relative to the wand axis such that the rear wall is farther from the wand axis at the top end than at the bottom end of the dirt collection chamber or cyclone bin assembly. An advantage of this design is that the surface cleaning apparatus may extend under furniture while providing a large dirt collection capacity.

Figure 7:
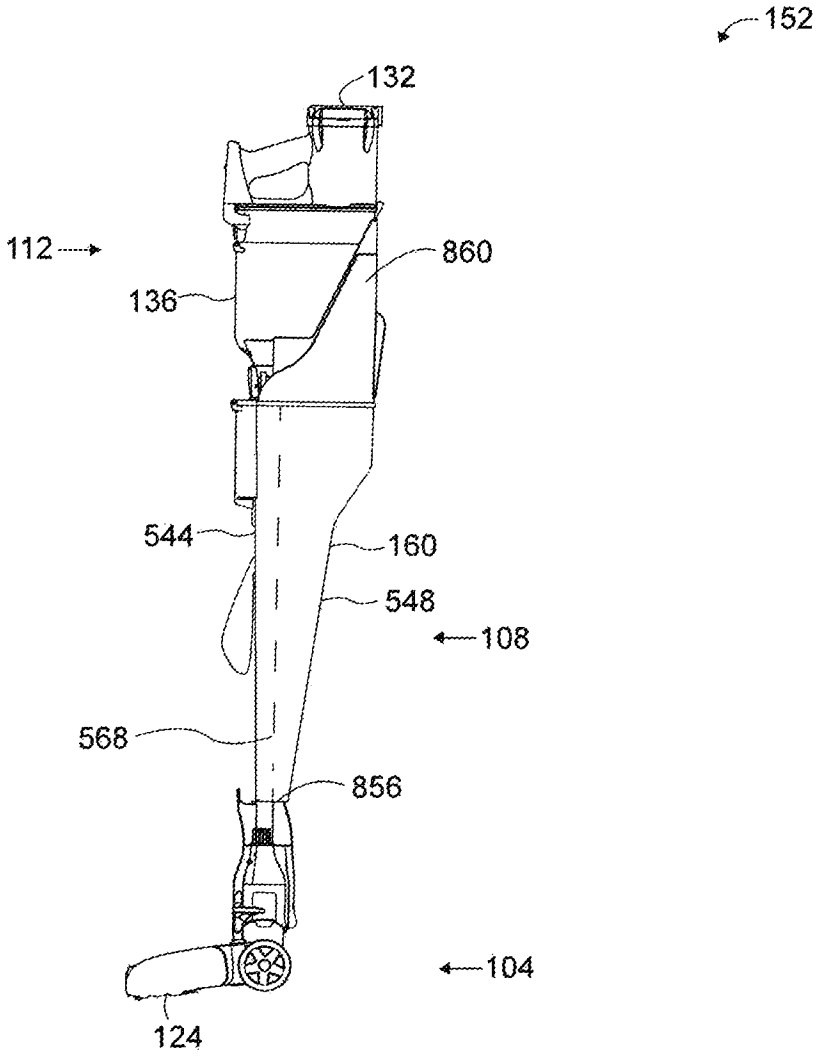
FIG. 7 is a side elevation view of the apparatus of FIG. 5 with an electrical cord bag.
Figure 8:
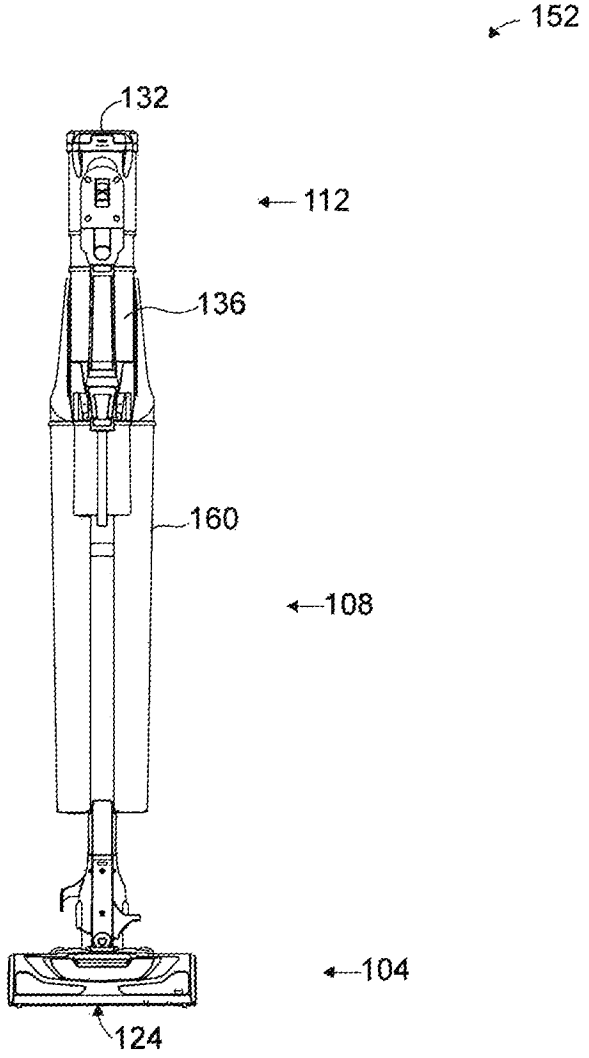
FIG. 8 is a front elevation view of the apparatus of FIG. 5.
Figure 9:
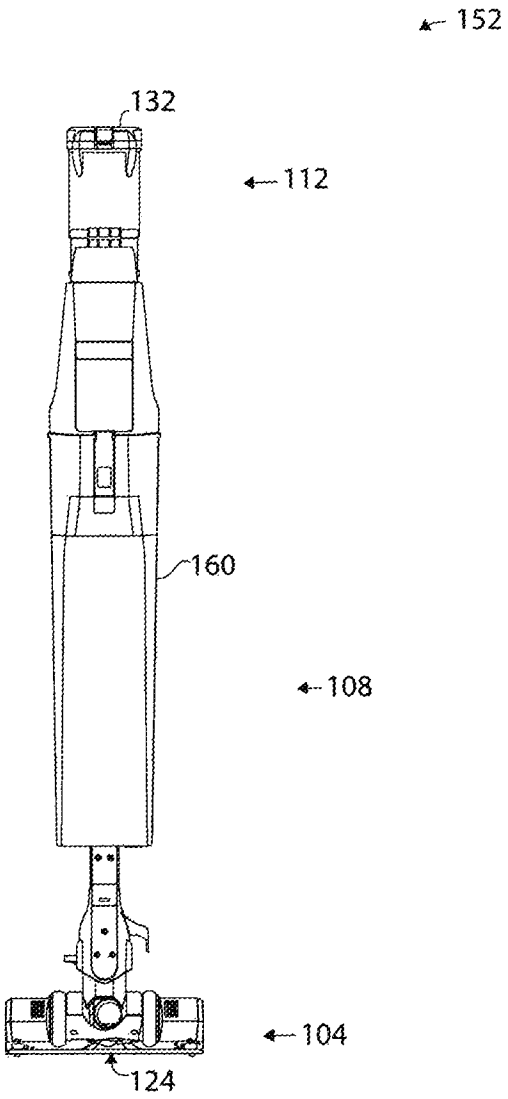
FIG. 9 is a rear elevation view of the apparatus of FIG. 5.
Figure 10:
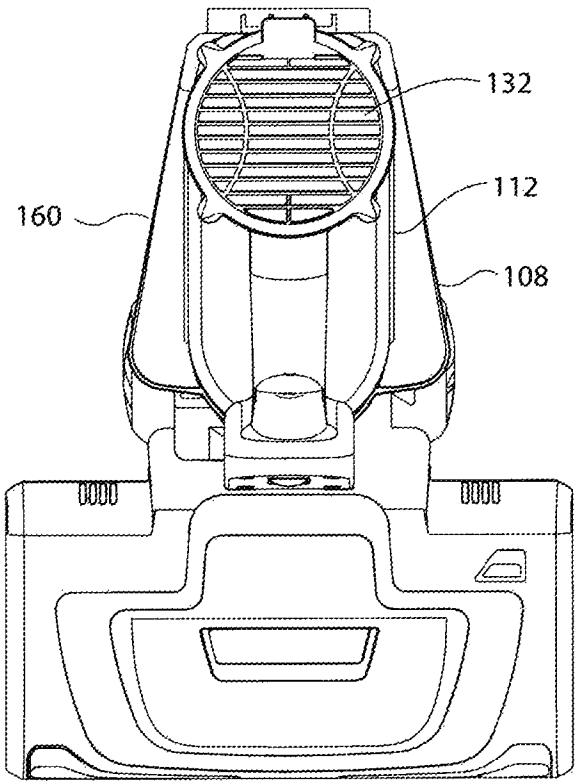
FIG. 10 is a top plan view of the apparatus of FIG. 5.
Figure 11:
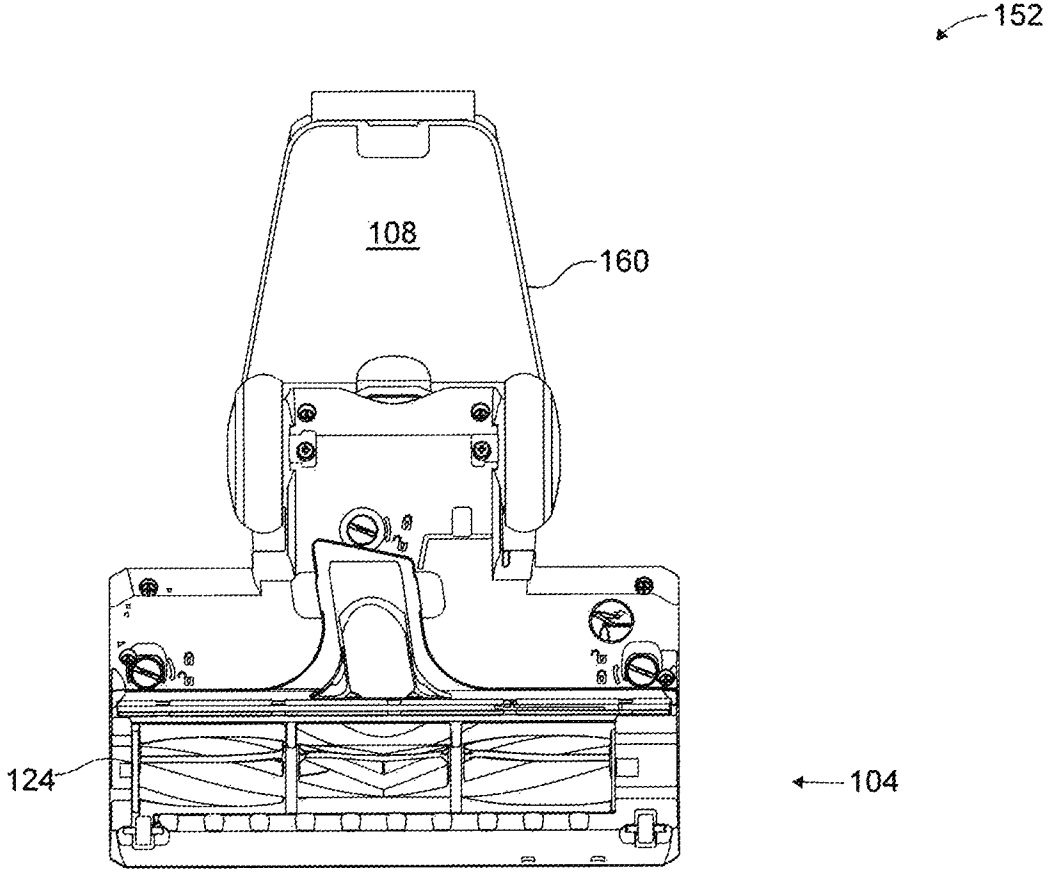
FIG. 11 is a bottom plan view of the apparatus of FIG. 5.

As exemplified in FIGS. 3 and 7, surface cleaning apparatus 100 and 152 include an upright section 108 having a dirt collection chamber 140 or cyclone bin assembly 160 that extends from a lower end 292, 856 proximate surface cleaning head 104 to an upper end 596, 860. A rear end 536, 548 of auxiliary assembly 140/160 may extend upwardly from lower end 292 or 856 at a (non-zero) acute angle 848 to wand axis 568. Angle 848 is preferably between 10 and 70 degrees, and more preferably between 20 and 40 degrees. For example, a distance 538 between wand axis 568 and rear end 536, 548, measured normal to wand axis 568, may increase continually or generally continuously from lower end 292, 856 upwardly. As shown, distance 538 is greater at upper end 596. 860 than at lower end 292, r 856.

Handvac with Angled Bottom Wall

In accordance with another aspect of this disclosure, which may be used by itself or in combination with any one or more other aspects of this disclosure, a handvac may be provided having a bottom, such as a flat bottom wall, for supporting the handvac on a horizontal surface, and which extends at an acute angle (e.g., between 20 and 40 degrees) away from the inlet nozzle axis, and optionally at about the in-use orientation of the hand vac. This may provide the handvac with a resting orientation that is closer to or essentially at the in-use orientation of the handvac. For example, the in-use orientation of the handvac may normally have the inlet nozzle axis extending at a downward angle relative to a horizontal surface to be cleaned. Thus, a user may not have to substantially reorient the handvac upon grasping the handvac in the resting orientation to reposition the handvac into the in-use orientation.

Reference is now made FIG. 78, where handvac 112 is shown resting on a horizontal surface 876. As shown, nozzle axis 884 extends at an angle 880 to horizontal surface 876. Angle 880 may be an acute angle which may be between 10 and 80 degrees, and preferably between 25 and 65 degrees, more preferably between 35 and 55 degrees or between 20 and 40 degrees. It will be appreciated that handvac 112 may be stably supported in any suitable manner, with nozzle axis 884 extending at angle 880 to horizontal surface 876. For example, handvac 112 may include one or more support elements (e.g. a wall or feet) which collectively provide a support for handvac 112 on a horizontal planar surface at a desired acute angle, and a center of gravity 524 vertically aligned with or between the support elements for stability when handvac 112 is so supported by the support element(s) on the horizontal surface.

As exemplified, bottom wall 216 of handvac 112 may extend at an angle 880 to inlet nozzle axis 884 of nozzle 412. Bottom wall 216 may be planar, and the plane of bottom wall 216 may intersect with nozzle axis 884 at angle 880. Bottom wall 216 may provide a flat planar surface for making broad contiguous contact with horizontal surface 876, or bottom wall 216 may include a plurality of discrete contact points or surfaces which collectively contact the horizontal surface 876 to support the handvac 112 (e.g. as in the feet of a tripod, or the wheels of a car). Preferably, handvac center of gravity 524 is preferably aligned vertically above bottom wall 216 when handvac 112 is supported on horizontal surface 876 by bottom wall 216. This may permit handvac 112 to rest stably (i.e. statically without tipping over) on horizontal surface 876 while supported solely by bottom wall 216.

Handvac 112 may have an in-use orientation relative to horizontal surface 876 at which a user may comfortably operate handvac 112 during cleaning. Typically, handvac 112 is most comfortably operated in an orientation that does not require an application of torque by the user's hands when the handvac 112 is held by handle 484. This may be the case where the center of gravity 524 of the handvac 112 is aligned vertically below the user's hand. Accordingly, the center of gravity 524 may be vertically aligned below handle 484 in comfortable in-use orientations of handvac 112.

Preferably, center of gravity 524 is aligned vertically below handle 484 when handvac 112 is supported on horizontal surface 876. In the illustrated embodiment, center of gravity 524 is aligned vertically below handle 484 when bottom wall 216 is horizontal and supporting handvac 112 on a horizontal surface 876. Thus, the resting orientation of handvac 112 supported by bottom wall 216 on a horizontal surface 876 may be substantially the same as the in-use orientation of handvac 112. Accordingly, when a user grasps handvac 112 by handle 484 and lifts handvac 112, handvac 112 may already be in a balanced in-use position with the center of gravity 524 aligned below the user's hands.

In many cases, handvac 112 may be stored on a surface below a user's elbows. A user may angle their forearm downwardly to grasp handle 484 of handvac 112. In this case, the user's fingers and palm may be naturally aligned for grasping a handle which is angled forwardly of vertical. For example, to grasp a vertically oriented handle that is positioned below a user's elbow, a user may need to contort their wrist to conform to the orientation of the handle.

In the illustrated embodiment, handle axis 888 of handle 484 extends at a (non-zero) forward angle 892 to the vertical (e.g., e.g. when bottom wall 216 is horizontal). This may provide a comfortable handle alignment for grasping by a user when picking up handvac 112, and when using handvac 112 for cleaning surfaces below the user's elbows. Preferably, angle 892 is an acute angle of between 10 and 80 degrees, more preferably between 20 and 70 degrees and most preferably between 30 and 60 degrees.

Bottom wall 216 may be a wall of any component of handvac 112. In the illustrated embodiment, bottom wall 216 is a wall of cyclone bin assembly 136. Preferably, bottom wall 216 is a wall of dirt collection chamber 188. In the example shown, bottom wall 216 is an openable wall of dirt collection chamber 188. FIG. 79 shows another embodiment of handvac 112 where bottom wall 216 is not openable.

Referring to FIG. 78, bottom wall 216 of handvac 112 may include front wheels, rear wheels, or both. Wheels may provide rolling support for handvac 112 when cleaning under furniture, for example. In alternative embodiments, handvac 112 may not include wheels on bottom wall 216 as shown.

Handle Position

In accordance with another aspect of this disclosure, which may be used by itself or in combination with any one or more other aspects of this disclosure, a floor cleaning apparatus is provided having a handvac with a handle, and an upright section with a cyclone bin assembly or dirt collection chamber with a handle. Preferably, the handles are centrally aligned with a plane of symmetry of the apparatus. This may permit the handles to be grasped for a balanced control of the apparatus. For example, the handles may be parallel to the same plane of symmetry.

Alternately, as exemplified in FIG. 2, one handle may be parallel to a plane of symmetry and the other transverse thereto but positioned such that the plane of symmetry extends through the transversely oriented handle. In the illustrated example, handvac 112 includes a handle 484 which extends along a handle axis 888. As exemplified, handle axis 888 may lie in a vertical plane 1044, which is aligned centrally between left and right sides of apparatus 100 (i.e., a plane of symmetry). Turning to FIG. 78, handle 484 is shown extending in length between a first handle end 1048 at the upper end 1052 of handvac 112, and a second handle end 1056 intermediate the upper and lower ends 1052 and 1060 of handvac 112.

Returning to FIG. 2, assembly 140 is shown including a handle 1064. As illustrated, handle 1064 may have a handle axis 1068 which extends perpendicularly or transverse to plane 1044 and handle axis 888. Handle 1064 may be formed in a rear end 536 of assembly 140. For example, handle 1064 may be flush with rear end 536 and include a concave finger cavity 1072 to facilitate grasping handle 1064. Preferably, handle 1064 is positioned laterally centrally such that plane 1044 intersects handle 1064, and optionally bisects handle 1064 at a midpoint between handle ends 1076 and 1080.

Handles 484 and 1064 may be positioned on opposite sides of surface cleaning apparatus 100. For example, handle 484 is shown extending from an upper end 1052 proximate the front surface of apparatus 100, and handle 1064 is shown extending flush with a rear surface of apparatus 100.

Apparatus 100 may include one or more actuator controls (e.g. buttons, levers, or switches) for controlling various functionality such as opening or disconnected elements, or connecting power to elements. Preferably, at least some of the actuator controls are positioned on or within finger reach of a handle to permit the control to be activated while grasping the handle. This may permit single handed operation of the function provided by the control.

Referring to FIG. 1, apparatus 100 is shown including a power switch 1084 located on upper end 1052 of handvac 112 proximate first handle end 1048 within finger-reach when grasping handvac handle 484. As illustrated, power switch 1084 may be laterally centrally positioned such that plane 1044 intersects and more preferably bisects power switch 1084.

Referring now to FIGS. 15 and 16, apparatus 168 is shown including an upright section 108 having a cyclone bin assembly 160 with a handle 616, and handvac 112 with handle 484. As shown, handle axis 1092 of handle 616, and handle axis 888 of handvac handle 484 may extend in a same plane 1096. Preferably, plane 1096 is a vertical plane positioned laterally centrally between left and right sides of apparatus 168 as shown. In the illustrated embodiment, plane 1096 bisects handles 616 and 484.

In the illustrated embodiment, handvac 112 includes a power switch 1084 located on upper end 1052 of handvac 112 which is bisected by plane 1044. Handle 616 of cyclone bin assembly 160 is also shown including a button 1100 for releasing latch 744 to disconnect cyclone bin assembly 160 from wand 144. As illustrated, button 1100 may be positioned laterally centrally between left and right sides of apparatus 168 such that button 1100 is bisected by plane 1096.

Handvac Axial Alignment

In accordance with another aspect of this disclosure, which may be used by itself or in combination with any one or more other aspects of this disclosure, a plurality of airflow path segments in the handvac may extend in parallel. In some cases, this may reduce the number of bends in the airflow path through the handvac, which may reduce the pressure drop across the airflow path.

As exemplified in FIG. 96, handvac inlet nozzle 412 may extend in length from an upstream nozzle end 416 rearwardly along a nozzle axis 884, handvac cyclone chamber 184 may extend from an air inlet 192 along a cyclone axis 248 to an air outlet 196, and handvac suction motor 204 may extend from a motor inlet 1108 along a motor axis 252 to a motor outlet 1112.

In some embodiments, two or more of nozzle axis 884, cyclone axis 248, and motor axis 252 may be parallel. For example, in the illustrated embodiment, nozzle axis 884, cyclone axis 248, and motor axis 252 are parallel. In some embodiments, two or more of nozzle axis 884, cyclone axis 248, and motor axis 252 may be co-axial. For example, in the illustrated embodiment, nozzle axis 884 and cyclone axis 248 are co-axial. In other embodiments, nozzle axis 884, cyclone axis 248, and motor axis 252 may all be co-axial.

In the illustrated embodiment, handvac 112 may include an electrical connector 1116 for providing power to an upstream attachment (e.g. a surface cleaning head). As shown, connector 1116 may extend from a front connector end 1120 along a connector axis 1124 to a rear connector end 1128. In some embodiments, connector axis 1124 may be parallel to one or more of nozzle axis 884, cyclone axis 248, and motor axis 252. In the illustrated embodiment, connector axis 1124 is parallel to nozzle axis 884, cyclone axis 248, and motor axis 252.

In some embodiments, handvac 112 may include one or more electrical cables 1132 which extend from electrical connector 1116 rearwardly to electrically couple electrical connector 1116 with a source of power (not shown). In the illustrated embodiment, electrical cables 1132 extend from electrical connector 1116 rearwardly along vortex finder 1136 of cyclone chamber 184 toward motor housing 1138. As shown, at least the portion of electrical cables 1132 which along vortex finder 1136 across cyclone chamber 184 is parallel to cyclone axis 248.

Axial Cyclone Inlet

In accordance with another aspect of this disclosure, which may be used by itself or in combination with any one or more other aspects of this disclosure, a handvac may be provided having a cyclone chamber with an axial inlet. That is, the inlet axis may be parallel to the cyclone axis, and more preferably co-axial with the cyclone axis. In some cases, this may reduce the bends in the airflow path through the cyclone, which may reduce the pressure drop across the cyclone for better pneumatic efficiency. Preferably, the cyclone is a uniflow cyclone wherein the air outlet is at the opposite end from the air inlet. Alternately, or in addition, the axial inlet includes a portion that converts the axial flow to a tangential flow wherein the portion is provided within the diameter of the cyclone chamber. Optionally, the axial inlet is parallel to and may be co-axial with the handvac air inlet.

As exemplified in FIG. 96, handvac cyclone chamber 184 includes an air inlet 192 and an air outlet 196. As shown, air inlet 192 may include an inlet axis 1140 which is parallel to cyclone axis 248. Air inlet 192 may have a circular section transverse to axis 1140 with an inlet diameter 1144, or rectangular with a side dimension 1144. Preferably, the cross-sectional area of air inlet 192 is approximately equal to the cross-sectional area of inlet nozzle 412. Preferably, the cross-sectional area of air inlet 192 is between 80%-125% of the cross-sectional area of the inlet nozzle 412, more preferably 90%-120%, and most preferably 100%-115%.

Preferably, inlet 192 is in fluid communication with an upstream end 388 of an inlet passage 384. Inlet passage 384 may redirect the axial flow through inlet 192 to a tangential flow for developing a cyclonic motion inside cyclone chamber 184. Referring to FIGS. 23 and 23*a*, inlet passage 384 may extend from upstream passage end 388 to downstream passage end 396 across an arcuate angular extent 1148. Preferably angular extent 1148 is between 45 and 300°, more preferably between 60 and 250°, and most preferably between 90 and 200°.

Returning to FIG. 96, inlet passage 384 is shown having a width 1152, and a height 1108. In some embodiments, the cross-sectional area of inlet passage 384 may be approximately equal to the cross-sectional area of air inlet 192. Preferably, the cross-sectional area of inlet passage 384 is between 80%-125% of the cross-sectional area of the inlet passage 384, more preferably 90%-120%, and most preferably 100%-115%.

Vortex finder 1136 may define an outlet passage to air outlet 196 of cyclone chamber 184. As shown, vortex finder 1136 may be substantially cylindrical having a diameter 1160. In the illustrated embodiment, the cross-sectional area of vortex finder 1136 may be approximately equal to the cross-sectional area of inlet nozzle 412. For example, diameter 1160 may be approximately equal to diameter 1164 of inlet nozzle 412. Preferably, the cross-sectional area of vortex finder 1136 is between 80%-125% of the cross-sectional area of the inlet nozzle 412, more preferably 90%-120%, and most preferably 100%-115%.

Uniflow Cyclone

In accordance with another aspect of this disclosure, which may be used by itself or in combination with any one or more other aspects of this disclosure, a handvac may be provided having a cyclone chamber wherein the air outlet is at the opposite end from the air inlet. In some cases, this may reduce the bends in the airflow path through the cyclone, which may reduce the pressure drop across the cyclone for better pneumatic efficiency. Optionally, the cyclone inlet is at the front or inlet end of the handvac and may be parallel to or co-axial with the handvac air inlet.

As exemplified in FIG. 96, handvac inlet 192 is shown positioned at a front end 220 of cyclone chamber 184, and outlet 196 is shown positioned at a rear end 224 of cyclone chamber 184. Inlet 192 may have an inlet axis 1140 that is parallel to the outlet axis 1168 of air outlet 196. In the illustrated embodiment, inlet axis 1140 is co-axial with outlet axis 1168.

Optionally, the suction motor axis may be parallel to or co-axial with axis 1140, 1168. Accordingly, air may travel in a generally uniform direction through the components of the handvac.

Handvac Cyclone Dirt Collection Chamber

In accordance with another aspect of this disclosure, which may be used by itself or in combination with any one or more other aspects of this disclosure, the dirt collection chamber of the handvac may have a dirt inlet which is located at the upper end of the dirt collection chamber when the hand vac is oriented for cleaning a floor (see e.g., FIGS. 81 and 103). In addition, the dirt collection chamber may be shaped to encourage dirt to collect at another end of the handvac away from the dirt outlet of the cyclone chamber (e.g., it may extend downwardly away from the dirt inlet). This may clear the dirt inlet to permit additional dirt to enter.

As exemplified in FIG. 96, dirt may enter dirt collection chamber 188 from cyclone chamber 184 through dirt outlet 200 of cyclone chamber 184. In the illustrated embodiment, dirt outlet 200 is at a rear end 224 of cyclone chamber 184. In use, handvac 112 may be normally oriented with the nozzle 412 at the front end oriented downwardly for cleaning a surface below. Accordingly, dirt entering dirt collection chamber 188 from dirt outlet 200 may fall by gravity toward front end 220 of dirt collection chamber 188 away from dirt outlet 200. This may help to keep dirt outlet 200 clear for subsequent dirt to move through dirt outlet 200 during use.

In the illustrated embodiment, handvac 112 may be supportable on a horizontal surface 876 by contact between dirt collection chamber 188 and the horizontal surface 876. For example, dirt collection chamber 188 may include a bottom wall 216 for supporting handvac 112 on horizontal surface 876. Preferably, as discussed previously, handvac 112 is inclined with nozzle 412 facing downwardly when handvac 112 is supported on horizontal surface 876 by bottom wall 216. In the illustrated embodiment, bottom wall 216 is angled downwardly between front end 220 and rear end 224 for orienting nozzle axis 884 downwardly to horizontal when handvac 112 is supported on horizontal surface 876. As shown, this may provide dirt collection chamber 188 with a wedge-like shape having a height 1172 measured between upper and lower dirt collection chamber walls 226 and 216 which increases from the front end 220 to the rear end 224.

Pre-motor Filter Housing

In accordance with another aspect of this disclosure, which may be used by itself or in combination with any one or more other aspects of this disclosure, a pre-motor filter housing may be provided in the airflow path between the cyclone bin assembly and the suction motor for directing the airflow through one or more pre-motor filters contained therein.

As exemplified in FIGS. 96 and 117, handvac 112 has a pre-motor filter chamber 556 containing pre-motor filters 1176 and 1180, and a suction motor housing 1138 containing suction motor 204. The airflow path from inlet nozzle 412 to clean air outlet 132 may extend downstream from cyclone bin assembly 136 to pre-motor filter chamber 556 to suction motor housing 1138. That is, cyclone bin assembly 136, pre-motor filter chamber 556, and suction motor housing 1138 may be positioned in the airflow path with pre-motor filter chamber 556 downstream of cyclone bin assembly 136 and suction motor housing 1138 downstream of pre-motor filter chamber 556.

In the illustrated example, pre-motor filter chamber 556 extends in height 1184 between an upper end 1188 to a lower end 1192 in the direction of pre-motor filter axis 560, and extends in depth 1216 between front wall 1220 and rear wall 1224. In some embodiments, cyclone axis 248 and motor axis 252 may be parallel and vertically offset as shown. For example, each of cyclone axis 248 and motor axis 252 may intersect pre-motor filter chamber 556 as shown. In some embodiments, outlet axis 1168 of cyclone chamber outlet 196 and, motor inlet axis 1196 of motor inlet 1108 may be parallel and vertically offset. For example, each of outlet axis 1168 and motor inlet axis 1196 may intersect pre-motor filter chamber 556 as shown.

In some embodiments, cyclone chamber outlet 196 discharges air from cyclone chamber 184 into pre-motor filter chamber 556, and pre-motor filter chamber 556 discharges air into motor inlet 1108. For example, cyclone chamber outlet 196 may be positioned at the threshold between cyclone chamber 184 and pre-motor filter chamber 556, and motor inlet 1108 may be positioned at the threshold between pre-motor filter chamber 556 and suction motor housing 1138. In alternative embodiments, one or more conduits (not shown) may separate pre-motor filter chamber 556 from cyclone chamber outlet 196 and/or motor inlet 1108.

In the illustrated embodiment, pre-motor filter chamber 556 extends in length between a front end 1200 and a rear end 1204. As shown, pre-motor filter chamber 556 may hold pre-motor filters 1176 and 1180 in the airflow path between cyclone chamber outlet 196 and motor inlet 1108 for filtering residual dirt particles remaining in the airflow. In some embodiments, pre-motor filter chamber 556 may hold pre-motor filters 1176 and 1180 in spaced apart relation to front and rear ends 1200 and 1204. An upstream plenum 1208 may be provided in the space between upstream pre-motor filter 1176 and front end 1200. A downstream plenum 1212 may be provided in the space between downstream pre-motor filter 1176 and rear end 1204. Air entering upstream plenum 1208 from cyclone bin assembly 136 may distribute across the surface area of pre-motor filter 1176 for traversing filters 1176 and 1180 to downstream plenum 1212.

In the illustrated embodiment, cyclone chamber outlet 196 may direct air into an upper portion of upstream plenum 1208. For example, cyclone chamber outlet 196 may be connected to pre-motor filter chamber 556 proximate upper end 1188. In the illustrated embodiment, motor inlet 1108 may receive air from a lower portion of downstream plenum 1212. For example, motor inlet 1108 may be connected to pre-motor filter chamber 556 proximate lower end 1192. Accordingly, pre-motor filter chamber 556 may be used to redirect the air from transversely to the cyclone and motor axis without requiring conduits having bends therein.

Battery Power

In accordance with another aspect of this disclosure, which may be used by itself or in combination with any one or more other aspects of this disclosure, the surface cleaning head or upright section of the surface cleaning apparatus may include one or more batteries for powering the handvac when the handvac is connected to the surface cleaning head or upright section. The handvac may also include handvac batteries which may power the handvac when connected to or disconnected from the upright section and surface cleaning head (e.g. in an above-floor cleaning mode or handvac mode). When the handvac is electrically connected to the surface cleaning head, the batteries in the surface cleaning head may supplement the batteries in the handvac or be the sole power source.

As exemplified in FIG. 3, surface cleaning apparatus 100 (or any other surface cleaning apparatus embodiment disclosed herein) may include one or more handvac batteries 1268 mounted to the handvac 112, and one more supplemental batteries 1272. Supplemental batteries 1272 may be mounted to any other suitable component of apparatus 100 other than handvac 112. For example, supplemental batteries 1272 are shown mounted to surface cleaning head 104. Alternatively or additionally, supplemental batteries 1272 may be mounted to upright section 108.

As used herein, the plural term "batteries" means one or more batteries. For example, supplemental batteries 1272 may be one battery or a plurality of batteries. Similarly, handvac batteries 1268 may be one battery or a plurality of batteries. Batteries 1272 and 1268 may be any suitable form of battery such as NiCad, NiMH, or lithium batteries, for example. Preferably, batteries 1272 and 1268 are rechargeable, however, in alternative embodiments, one or both of batteries 1272 and 1268 may be non-rechargeable single-use batteries.

In the illustrated embodiment, when handvac 112 is connected to upright section 108, an electrical connection may be formed between supplemental batteries 1272 and handvac 112, e.g. for powering suction motor 204.

In some embodiments, supplemental batteries 1272 may provide handvac 112 with enhanced power for generating greater suction with suction motor 204. For example, suction motor 204 may operate in a high power consumption mode, drawing power from supplemental batteries 1272, or supplemental batteries 1272 and handvac batteries 1268 simultaneously.

In some embodiments, supplemental batteries 1272 may provide the handvac 112 with extra energy for prolonged cleaning time between charges. For example, supplemental batteries 1272 may have a greater energy capacity (e.g. measured in Watt-hours) than handvac batteries 1268, such that handvac 112 may be sustained by supplemental batteries 1272 for a longer operating time. In some embodiments, handvac 112 may draw power from both of supplemental batteries 1272 and handvac batteries 1268, which have a greater combined energy storage capacity than handvac batteries 1268 alone.

In some embodiments, supplemental batteries 1272 may supply power to the handvac in preference to the handvac batteries 1268 to delay or avoid draining the handvac batteries 1268. For example, handvac 112 may draw power from supplemental batteries 1272 until substantially depleted before drawing power from handvac batteries 1268. This may conserve power in handvac batteries 1268 for use when handvac 112 is disconnected from supplemental batteries 1272 (e.g. in an above-floor cleaning mode, or handvac mode of apparatus 100). In some embodiments, handvac 112 may never draw power from handvac batteries 1268 when handvac 112 is electrically connected to supplemental batteries 1272.

In some embodiments, handvac 112 may draw power from supplemental batteries 1272 to recharge handvac batteries 1268. This may help to ensure that handvac batteries 1268 are not depleted when handvac 112 is disconnected from supplemental batteries 1272 (e.g. for use in an above-floor cleaning mode, or handvac mode of apparatus 100). In some cases, supplemental batteries 1272 may recharge handvac batteries 1268 only when apparatus 100 is not turned on.

In some embodiments, supplemental batteries 1272 may be recharged whenever the surface cleaning apparatus is connected to an external power outlet. In some cases, handvac batteries 1268 may be recharged when handvac 112 is electrically connected to an external power outlet (e.g. when surface cleaning head 104 or upright section 108 is connected to a power outlet by an electrical cord (not shown), and handvac 112 is connected to the surface cleaning head 104 or upright section 108).

In some embodiments, one or more of supplemental batteries 1272 and handvac batteries 1268 may be positioned in the airflow path. This may provide cooling for the batteries so positioned, which may help to prevent the batteries from overheating and may improve the performance of the batteries. In the illustrated example, handvac batteries 1268 are positioned in the airflow path inside motor housing 1138. For example, handvac batteries 1268 may be positioned inside motor housing 1138 between suction motor 204 and clean air outlet 132. The air passing over the handvac batteries 1268 may help to keep the batteries 1268 cool.

Supplemental batteries 1272 may be positioned in the airflow path to promote cooling of the batteries 1272. In the illustrated example, supplemental batteries 1272 are shown positioned inside surface cleaning head 104 in the airflow path between dirty air inlet 124 and downstream end 1240. The air passing over batteries 1272 may help to keep batteries 1272 cool.

In alternative embodiments, one or both of supplemental batteries 1272 and handvac batteries 1268 may be positioned outside of the airflow path (e.g. to be cooled passively).

Handvac Wheels

In accordance with another aspect of this disclosure, which may be used by itself or in combination with any one or more other aspects of this disclosure, the handvac may be provided with one or more sets of wheels, and a handle which may articulate to facilitate different cleaning postures.

As exemplified in FIGS. 106-109, surface cleaning apparatus 1292 may include a surface cleaning head 104, an upright section 108 (which may receive any assembly 140, 160 discussed previously), and a handvac 112. An airflow path through apparatus 1292 may extend from dirty air inlet 124 in surface cleaning head 104, downstream through upright section 108 and then handvac 112 to clean air outlet 1304. Upright section 108 may include a wand 144 having an upstream end 360 drivingly connected to a pivot joint 116 of surface cleaning head 104, and a downstream end 364 connected to an inlet nozzle 412 of handvac 112.

Handvac 112 may include an air treatment member positioned in the airflow path between inlet nozzle 412 for separating dirt from the airflow. In the illustrated example, handvac 112 includes a cyclone bin assembly 136 including a cyclone chamber 184, and a dirt collection chamber 188. Optionally, a bottom wall 216 of dirt collection chamber 188 may be pivotally openable for emptying dirt collection chamber 188.

As exemplified, apparatus 1292 may be movable between an upright storage position (FIG. 106) in which handvac 112 is substantially vertically aligned above surface cleaning head 104 and wand 144 is substantially vertically oriented, and an in-use floor cleaning position (FIG. 108) in which surface cleaning head 104 is positioned behind surface cleaning head 104 and wand 144 extends at an angle to vertical.

In the illustrated example, apparatus 1292 may include a handle 1340. Handle 1340 may be connected to wand 144 by an arm assembly 1344. As shown, arm assembly 1344 may include a first arm 1348 joined to a second arm 1352 by an articulating joint 1356. First arm 1348 may be connected to wand 144 and joint 1356, and second arm 1352 may be connected to handle 1340. Alternately, joint 1356 may be used to connect second arm 1352 to wand 144.

As shown, first arm 1348 may be rigidly connected to wand 144, and extend transversely to wand 144. For example, first arm 1348 may extend perpendicularly to wand 144. Second arm 1352 may be rotatable about joint 1356 between at least two positions. In the first position (FIG. 108), second arm 1352 may extend at an angle to first arm 1348 substantially in parallel with wand 144. In the second position (FIG. 109), second arm 1352 may extend substantially parallel to first arm 1348. An actuator (e.g., a button) 1358 may be provided on handle 1340 for toggle joint 1356 between an unlocked position in which second arm 1352 can move with respect to first arm 1348, and a locked position in which the position of second arm 1352 is fixed with respect to first arm 1348. Optionally, joint 1356 may be locked in a number of alternate positions. Alternately, joint 1356 may not be locked in the second bent position shown in FIG. 109.

The first position (FIG. 108) may be suitable for cleaning open areas where vertical clearance is not an issue. The second position (FIG. 109) may be suitable for cleaning under furniture and the like, where wand 144 must be lowered to clear the furniture height. In the second position, the orientation of second arm 1352 may permit a user to grasp handle 1340 and lower wand 144 while conveniently standing upright.

In some embodiments, handvac 112 may include one or more front wheels 1364. Front wheel 1364 may be positioned to make rolling contact with a horizontal surface when wand 144 is lowered sufficiently. Thus, front wheel 1364 may assist with supporting the weight of handvac 112 and permit handvac 112 to roll across the horizontal surface. In the illustrated example, a front end 1360 of bottom wall 216 is provided with one or more front wheels 1364.

It will be appreciated that if rear end of assembly 140,160 is tapered as discussed previously, then assembly 140, 160 is configured to permit the vacuum cleaner to extend further under furniture than if the assembly 140,160 had the depth (front to back when in an upright storage position) as the upper end of the assembly 140, 160.

Openable Handvac Cyclone Bin Assembly

In accordance with another aspect of this disclosure, which may be used by itself or in combination with any one or more other aspects of this disclosure, the cyclone bin assembly of the handvac may be opened to empty the cyclone chamber and/or the dirt collection chamber, to access the pre-motor filter or access a door to open the cyclone chamber and/or the dirt collection chamber by moving part or all of the cyclone bin assembly relative to a main body of the handvac which include the suction motor while the parts remain connected together. For example, the parts may be pivotally mounted to each other.

Referring to FIGS. 110*a* and 110*b*, front portion 1372 of handvac 112 may be pivotally connected to rear portion 1376 of handvac 112 for pivoting between the open position shown and a closed position. In the open position, cyclone bin assembly 136 may be accessible, e.g. for emptying or cleaning.

Front portion 1372 may be pivotally connected to rear portion 1376 in any suitable fashion. In the illustrated embodiment, front portion 1372 is pivotally connected to rear portion 1376 by a hinge 1380 for rotation about a hinge axis 1384 between the open and closed positions.

In the illustrated embodiment, front portion 1372 and rear portion 1376 separate at the interface between cyclone bin assembly 136 and pre-motor filter chamber 556. For example, front portion 1372 may include cyclone bin assembly 136 except for second end wall 224, and rear portion may include pre-motor filter chamber 556 and second end wall 224 of cyclone bin assembly 136. Accordingly, in the open position, access may be provided to empty and clean dirt collection chamber 188 and cyclone chamber 184 of cyclone bin assembly 136.

Referring to FIG. 116, in some embodiments handvac 112 may include a handle assembly 300 including handle 484 and suction motor 204. As exemplified, handle assembly 300 and rear wall 1224 of pre-motor filter chamber 556 may be removable from (entirely, or pivotally connected to) pre-motor filter chamber 556 as a unit to access the pre-motor filters 1176 and 1180 inside pre-motor filter chamber 556, e.g. for cleaning or replacement. As shown in FIG. 117, in some embodiments, handle assembly 300 may also be removably connected to rear wall 1224. In alternative embodiments, handle assembly 300 may be permanently connected to rear wall 1224.

Openable Dirt Collection Chamber

In accordance with another aspect of this disclosure, which may be used by itself or in combination with any one or more other aspects of this disclosure, the supplemental assembly may have a top and/or bottom openable portion.

As exemplified in FIGS. 111-113, dirt collection assembly 140 is shown including an upper portion 276 in an open position. Upper portion 276 may be moveably connected to (e.g., pivotally) or removable from dirt collection assembly 140 in any suitable manner. As exemplified, upper portion 276 may be connected to dirt collection chamber 140 by a hinge 1392 for rotation about a hinge axis 1 (not shown) between the open and closed positions.

Upper portion 276 may be retained in the closed position in any suitable fashion. In the illustrated example, dirt collection chamber 140 includes a latch 1400 for securing upper portion 276 in the closed position. Latch 1400 may be user operable for selectively releasing upper portion 276 for movement to the open position.

As exemplified in FIGS. 114 and 115, upright section 108 of surface cleaning apparatus 152 is shown including a cyclone bin assembly 160. Cyclone bin assembly 160 is preferably openable for accessing cyclone chamber 308 and dirt collection chamber 141, e.g. for cleaning or emptying. Preferably, an upper and/or lower portion of cyclone bin assembly 160 may be openable. In the illustrated embodiment, upright section 108 includes an upper portion 1408 and a lower portion 1412. As shown, upper portion 1408 may be moveably connected to (e.g., pivotally connected to) or removable from lower portion 1412 for movement been a closed position (FIG. 114) and an open position (FIG. 115).

Upper portion 1408 may be pivotally connected to lower portion 1412 in any suitable manner. In the illustrated embodiment, lower portion 1412 is pivotally connected to lower portion 1412 by a hinge 1416 for rotation about a hinge axis 1420 between the closed and open positions.

Upper portion 1408 may be retained in the closed position in any suitable manner. For example, upper portion 108 may include a releasable catch for selectively securing upper portion 1408 to lower portion 1412 in the closed position.

Handvac Cyclone Bin Assembly Bypass

In accordance with another aspect of this disclosure, which may be used by itself or in combination with any one or more other aspects of this disclosure, the cyclonic air treatment member of the handvac may be bypassed when a supplemental cyclonic bin assembly is provided. This may prevent accumulation of dirt in the handvac so that the handvac may have more or all of its dirt collection capacity available when disconnected from the upright section. Alternately or in addition, a pre-motor filter of handvac 112 may be bypassed when a supplemental cyclonic bin assembly is provided. For example, the supplemental cyclonic bin assembly may be provided with a pre-motor filter. The pre-motor filter may have a larger surface area than the pre-motor filter of handvac 112. Accordingly, by bypassing the pre-motor filter of handvac 112, the pre-motor filter of handvac 112 may only be used in an above floor cleaning mode thereby extending the useable time of the pre-motor filter of handvac 112 before cleaning or replacement may be needed.

Referring to FIGS. 99-101, handvac 112 may include a primary airflow path 1228 and a bypass airflow path 1232. As shown, primary airflow path 1228 may extend from air inlet 192 through cyclone bin assembly 136 to suction motor 204, and bypass airflow path 1232 may extend from air inlet 192 to suction motor 204 bypassing cyclone bin assembly 136. In some embodiments, bypass airflow path 1232 may extend through the pre-motor filters of pre-motor filter chamber 556, and in other embodiments, bypass airflow path 1232 may bypass pre-motor filters of pre-motor filter chamber 556. It will be appreciated that the cyclone and/or the pre-motor filter of the handvac may be bypassed. If both are bypassed, then the handvac may be used to provide some or all of the motive force to draw air through apparatus 168 but not any air treatment upstream of the suction motor.

In the illustrated embodiment, bypass airflow path 1232 is formed in part by a bypass passage 1236. Bypass passage 1236 may have an upstream end 1238 in airflow communication with handvac inlet 416, and a downstream end 1240 in airflow communication with motor inlet 1108. As exemplified by the embodiment illustrated in FIG. 101, upstream end 1238 may be formed in a sidewall of handvac nozzle 412, and downstream end 1239 may be formed in a wall of premotor filter chamber 556. In some embodiments, downstream end 1239 may direct air from bypass passage 1236 into upstream plenum 1208 for routing bypass airflow path 1228 through pre-motor filters 1176 and 1180 as shown. In alternative embodiments, downstream end 1239 may direct air from bypass passage 1236 into downstream plenum 1212 for bypassing pre-motor filters 1176 and 1180.

As exemplified, apparatus 168 may include a bypass valve 1240 for selectively opening and closing primary and bypass airflow paths 1228 and 1232. Bypass valve 1240 may be positioned in any one or more of handvac 112, wand 144, and supplemental cyclone bin assembly 160, and may take any suitable form. For example, in some embodiments bypass valve 1240 may include components parts positioned in two or more of handvac 112, wand 144, and supplemental cyclone bin assembly 108 which cooperate and interact to open and close primary and bypass airflow paths 1228 and 1232.

In the illustrated embodiment bypass valve 1240 is positioned in inlet nozzle 412 of handvac 112. Bypass valve 1240 may be movable between a first position (FIGS. 99 and 100) in which bypass airflow path 1232 is closed and primary airflow path 1228 is open, and a second position (FIG. 101) in which bypass airflow path 1232 is open and primary airflow path 1228 is closed.

As exemplified in FIGS. 99-101, bypass valve 1240 may include a wheel 1242, a door 1244, and an actuator 1246. Wheel 1242 may be rotatably connected to nozzle 412 for rotation about its center. Door 1244 may be rigidly connected to wheel 1242 for rotation as one with wheel 1242. For example, door 1244 and wheel 1242 may rotate together as a unit. As shown, door 1244 and wheel 1242 may be rotatable between a first position (FIGS. 99 and 100) in which door 1244 seals an upstream end 1238 of bypass passage 1236, and a second position (FIG. 101) in which door 1244 seals an air inlet 192 of cyclone chamber 184.

As exemplified, actuator 1246 may include an upper end 1248 connected to wheel 1242 radially outboard of the center of wheel 1242. Actuator 1246 may be movable vertically between a lowered position (FIGS. 99 and 100), and a raised position (FIG. 101). As shown, moving actuator 1246 from the lowered position to the raised position may rotate wheel 1242 and door 1244 clockwise which may move door 1244 to the second position (FIG. 101) in which door 1244 seals air inlet 192 of cyclone chamber 184. Further, moving actuator 1246 from the raised position to the lowered may rotate wheel 1242 and door 1244 counter clockwise which may move door 1244 to the first position (FIGS. 99 and 100) in which door 1244 seals upstream end 1238 of bypass passage 1236.

In some embodiments, actuator 1246 may be biased to the lowered position (FIGS. 99 and 100). Consequently, door 1244 and wheel 1242 may be biased to the first position (FIGS. 99 and 100) in which door 1244 seals an upstream end 1238 of bypass passage 1236. Actuator 1246 may be biased in any suitable fashion, such as by a linear coil spring 1250. In alternative embodiments, wheel 1242 may be biased clockwise in a suitable manner, such as by a torsional spring.

Actuator 1246 may have a lower end 1252 which extends outside of the airflow path. Lower end 1252 may be acted upon to move actuator 1246 vertically from the lowered position to the raised position for opening bypass airflow path 1232 and closing primary airflow path 1228. As shown, when handvac 112 is disconnected from wand 144 (FIG. 99), bypass valve 1240 may close the bypass airflow path 1232 (e.g. under the bias of spring 1250). Further, when handvac 112 is connected to wand 144 without supplemental cyclone bin assembly 160 (FIG. 100), bypass valve 120 may also close the bypass airflow path 1232. In each of these cases, the air entering handvac 112 is directed through handvac cyclone bin assembly 136 to separate dirt from the airflow. This may permit handvac 112 to operate when disconnected from supplemental cyclone bin assembly 160.

As shown in FIG. 101, when handvac 112 and cyclone bin assembly 160 are both connected to wand 144, an upper end 1254 of cyclone bin assembly 160 (handle 1254 in the illustrated example) may push against actuator lower end 1252 thereby moving actuator 1246 upwardly. This may rotate wheel 1242 and door 1244 counter clockwise, opening bypass airflow path 1232 and closing primary airflow path 1228. As shown, air exiting cyclone bin assembly 160 may travel through bypass airflow path 1232 toward suction motor 204 bypassing cyclone chamber 184. This may permit supplemental cyclone bin assembly 160 to separate and collect dirt from the airflow path instead of handvac cyclone bin assembly 136. In turn, this may inhibit dirt accumulation in handvac dirt collection chamber 188, which may help to maximize the available dirt collection capacity of handvac dirt collection chamber 188 when the user chooses to disconnect cyclone bin assembly 160.

In the illustrated example, lower end 1252 is sloped. This may permit supplemental bin assembly 160 to be toed into wand 144 and then rotated horizontally towards wand 144 to complete the connection with wand 144, whereby the upper end 1254 of supplemental bin assembly 160 may ride the slope of lower end 1252 to push actuator 1246 upwardly.

Accordingly, bypass valve 1240 may be actuated to reconfigure the airflow path through handvac 112 automatically upon connecting and disconnecting supplemental bin assembly 160 from airflow communication with handvac 112. For example, bypass valve 1240 may be biased to close bypass airflow path 1232 whenever handvac 112 is not in airflow communication with supplemental bin assembly 160 so that the air treatment member of handvac 112 may separate dirt from the airflow. Similarly, bypass valve 1240 may be configured to open bypass airflow path 1232 and close primary airflow path 1228 whenever handvac 112 is in airflow communication with supplemental bin assembly 160 so that the air treatment member of handvac 112 does not separate and store dirt from the airflow.

The following is a description of numerous embodiments of surface cleaning apparatus 168. In the figures associated with some embodiments, a bypass valve 1232 and/or a diversion valve 712 may be represented schematically. It will be appreciated that the embodiments may be practiced using the bypass valves 1232 and/or diversion valves 712 described above, or other suitable valves.

Referring to FIG. 102, in some embodiments supplemental cyclone bin assembly 160 may include one or more pre-motor filters 1256 (herein after referred to as pre-motor filter 1256 in the singular) positioned in the airflow path. Preferably, pre-motor filter 1256 is positioned downstream of cyclone chamber 308. As shown, pre-motor filter 1256 may be positioned between cyclone chamber air outlet 320 and outlet passage 476.

In some embodiments, pre-motor filter 1256 may separate fine dirt particles from the airflow in substitution for the pre-motor filters 1176 and 1180 of handvac 112. As shown, bypass valve 1232 may divert air from supplemental cyclone bin assembly 160 into a bypass airflow path which bypasses handvac cyclone bin assembly 136 and pre-motor filters 1176 and 1180. For example, downstream end of 1239 of bypass passage 1236 may direct the bypass airflow path 1232 to downstream plenum 1212 for bypassing pre-motor filters 1176 and 1180.

It will be appreciated that a pre-motor filter will have a certain filtering capacity of fine particles at which point the filter should be cleaned or replaced. By incorporating a pre-motor filter into the supplemental cyclone bin assembly 160, and using this filter whenever the supplemental cyclone bin assembly 160 is connected to the handvac, the filtering capacity of the handvac pre-motor filters may be preserved. This may permit extended use of the handvac pre-motor filters before they require cleaning or replacement.

It will also be appreciated that there will be a measurable pressure drop across a pre-motor filter placed in an airflow path. If positioned in series, too many filters may produce a pressure drop that materially reduces air flow at the dirty air inlet. By filtering the airflow alternately by the supplemental pre-motor filter 1256 and by the handvac pre-motor filter when the handvac is used without assembly 140, 160 attached the operational life of the handvac pre-motor filter may be extended.

As exemplified in the alternate embodiment of FIG. 103, surface cleaning head 104 may include a second suction motor 1258. Second suction motor 1258 may operate in parallel with or alternately instead of handvac suction motor 204 when handvac 112 is attached in flow communication with surface cleaning head 104. For example, a portion of air exiting supplemental cyclone bin assembly 160 may proceed to handvac suction motor 204 and a different portion may proceed to second suction motor 1258. In the illustrated embodiment, a second airflow path 1260 from diversion valve 712 to second suction motor 1258 is formed by an airflow conduit 1262 which connects diversion valve 712 to surface cleaning head 104.

As shown, when supplemental cyclone bin assembly 160 is in airflow communication with handvac 112, the airflow path extends through the air treatment member(s) of supplemental cyclone bin assembly 160 (e.g. cyclone chamber 308 and pre-motor filter 1256) and then divides into two parallel air flow paths 1232 and 1260. Bypass airflow path 1232 directs one portion of the airflow to the handvac suction motor 204 bypassing handvac cyclone chamber 184 (and optionally bypassing handvac pre-motor filters 1176 and 1180), and second airflow path 1260 directs a second portion of the airflow path to the second suction motor 1258 in head 104.

It will be appreciated that suction motors 1258 and 204 operating in parallel may generate greater suction at surface cleaning head 104 than any one of suction motors 1258 and 204 may generate operating alone. This may also permit supplemental cyclone bin 160 to include a pre-motor filter 1256 having greater surface area than the pre-motor filter of the handvac, where the additional pressure drop due to the use of two pre-motor filters may be compensated for by the enhanced suction generation of the parallel motors 1258 and 204.

As exemplified in the alternate embodiment of FIG. 104*a*, supplemental suction motor 160 may include a second suction motor 1258 which may operate in the same way as the embodiment of FIG. 103. Second suction motor 1258 may operate in parallel with handvac suction motor 204. For example, a portion of air exiting supplemental cyclone chamber 160 may proceed to handvac suction motor 204 and a different portion may proceed to second suction motor 1258. In the illustrated embodiment, a second airflow path 1260 from outlet passage 478 to second suction motor 1258 is formed by an airflow conduit 1262.

As shown, when supplemental cyclone bin assembly 160 is in airflow communication with handvac 112, the airflow path extends through the air treatment member(s) of supplemental cyclone bin assembly 160 (e.g. cyclone chamber 308 and pre-motor filter 1256) and then divides into two parallel air flow paths 1232 and 1260. Bypass airflow path 1232 directs one portion of the airflow to the handvac suction motor 204 bypassing handvac cyclone chamber 184 (and optionally bypassing handvac pre-motor filters 1176 and 1180), and second airflow path 1260 directs a second portion of the airflow path to the second suction motor 1258.

As shown, second suction motor 1258 may be positioned below dirt collection chamber 140 and cyclone chamber 308 of supplemental cyclone bin assembly 160, and second suction motor 1258 may be vertically aligned above surface cleaning head 104. This may help to lower the center of gravity of the apparatus 168 for enhanced stability against tipping.

In some embodiments, a pre-motor filter may be positioned in each of bypass airflow path 1232 and second airflow path 1260, as shown. For example, a pre-motor filter 1256 may be positioned in the second airflow path 1260 between outlet passage 478 and second suction motor 1258, and bypass airflow path 1232 may direct the airflow through handvac pre-motor filters 1176 and 1180. In the illustrated embodiment, pre-motor filter 1256 is shown positioned below dirt collection chamber 140 of supplemental cyclone bin assembly 160.

In alternative embodiments, air exiting cyclone chamber 308 may pass through a common pre-motor filter before dividing between the second airflow path 1260 and bypass airflow path 1232. For example, in FIG. 104*b* pre-motor filter 1256 is shown positioned downstream of cyclone chamber 308 and upstream of outlet passage 478. As shown, bypass airflow path 1232 may bypass handvac pre-motor filters 1176 and 1180. This may permit the filtration capacity of handvac pre-motor filters 1176 and 1180 to be preserved for use when supplemental cyclone bin assembly 160 is disconnected from airflow communication with handvac 112. In alternative embodiments, pre-motor filters 1176 and 1180 may be positioned in the bypass airflow path 1232.

As exemplified in FIG. 105*a* dirt collection chamber 140 and cyclone chamber 308 may be removable as a sealed unit from wand 144 and second suction motor 1258. For example, second suction motor 1258 may be mounted or removably mounted to wand 144 so that dirt collection chamber 140 and cyclone chamber 308 may be removed while second suction motor 1258 remains mounted to wand 144. This may permit cleaning and/or emptying of dirt collection chamber 140 and cyclone chamber 308 (e.g. carrying the same to a garbage bin to dump their contents) without having to carry second suction motor 1258 (which may have a non-trivial weight). Also, assembly 160 may be removable as a unit to convert the apparatus to a lightweight or above floor operating mode.

As exemplified in FIG. 118, the air treatment members of handvac 112 and supplementary cyclone bin assembly 160 may operate in parallel. For example, handvac 112 and supplementary cyclone bin assembly 160 may separate dirt from mutually exclusive portions of the airflow entering dirty air inlet 124.

In the illustrated example, wand 144 may define two airflow paths. A first airflow path 1428 may be formed by a first division of wand 144 and may direct airflow moving therein to supplemental cyclone bin assembly 160 for cleaning, and then from supplemental cyclone bin assembly 160 to bypass airflow path 1232 of handvac 112. A second airflow path 1432 may be formed by a second division of wand 144 and may direct airflow moving therein to primary airflow path 1228 of handvac 112 for cleaning by cyclone bin assembly 136.

As exemplified, dirty air entering dirty air inlet 124 may divide into two airflows at wand upstream end 360 and then travel through the first and second airflow paths 1428 and 1432. Dirt may be separated from each airflow stream by a different one of supplementary cyclone bin assembly 160 and handvac 112. In the illustrated embodiment, the two airflows may recombine in pre-motor filter chamber 556. For example, the two airflows may recombine at the upstream plenum 1208 so that both airflows pass through pre-motor filters 1176 and 1180 before exiting through suction motor 204. In alternative embodiments, the two airflows may recombine at the downstream plenum 1212. For example, supplemental cyclone bin assembly 160 may have its own pre-motor filter for filtering the air of the first airflow path 1428.

In some embodiments, surface cleaning apparatus 168 may include two or more suction motors operating in series. In one aspect, this may enhance the suction at dirty air inlet 124 and/or compensate for suction loss from additional or higher efficiency air treatment members.

Referring to FIGS. 119*a* and 119*b*, a second suction motor 1258 may be positioned in the airflow path between dirty air inlet 124 and handvac 112. For example, second suction motor 1258 may be a dirty air suction motor positioned in surface cleaning head 104. As shown, dirty air entering dirty air inlet 124 may be drawn through second suction motor 1258 before the airflow is cleaned by supplemental dirt collection chamber 160 and/or handvac 112 and discharged through handvac suction motor 204.

Referring to FIG. 120, second suction motor 1258 may be a clean air motor positioned downstream of handvac suction motor 204. As exemplified, motor outlet 1112 of handvac suction motor 204 may be fluidly connected to second suction motor 1258 in surface cleaning head 104 by an airflow path 1436. As shown, airflow path 1436 may be formed by a conduit 1440.

Referring to FIG. 121*a*, in some embodiments second suction motor 1258 may be positioned in supplementary cyclone bin assembly 160. For example, second suction motor 1258 may be positioned below dirt collection chamber 140. As shown, airflow path 1436 from motor outlet 1112 may direct air from suction motor 204 to second suction motor 1258 in supplementary cyclone bin assembly 160. For example, conduit 1440 may extend from motor outlet 1112 to second suction motor 1258. Conduit 1440 may take any suitable form. For example, conduit 1440 may be a rigid conduit as shown. Alternatively, FIG. 121*b* shows an embodiment where conduit 1440 is a flexible hose.

In some embodiments, when handvac is connected with supplement cyclone bin assembly 160, handvac 112 may not be positioned in the airflow path through the surface cleaning apparatus. For example, air entering the dirty air inlet 124 of the surface cleaning head may be cleaned by the supplementary cyclone bin assembly 160 and discharged without ever passing through handvac 112. In this way, handvac 112 may act as a handgrip for manipulating and steering surface cleaning apparatus 168 in the upright mode but not as an air cleaning implement.

In some embodiment, as exemplified in FIG. 122, the handvac may be bypassed when assembly 160 is attached to upright section 108. As exemplified, air entering dirt air inlet 124 may move through wand 144 to supplemental cyclone bin assembly 160 and be discharged without moving through handvac 112. For example, the airflow path through surface cleaning apparatus 168 may direct all air from dirty air inlet 124 through wand 144 to cyclone chamber 308 to outlet passage 476 to second airflow path 1260 to suction motor 1258 of supplemental cyclone bin assembly 160, which may discharge the air to the outside environment.

Still referring to FIG. 122, in some embodiments there may be a plurality of suction motors in series. In the illustrated embodiment, surface cleaning head 104 includes a suction motor 1258 positioned in the airflow path between dirty air inlet 124 and wand 144. In alternative embodiments, suction motor 1258 may be the only suction motor in the airflow path.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

I claim:

1. A surface cleaning apparatus comprising:

(a) a hand vacuum cleaner comprising:

(i) a main body comprising a bottom, a handle, the main body housing a suction motor and fan assembly, the suction motor and fan assembly having a suction motor axis of rotation, the handle having a hand grip portion that extends upwardly and forwardly when the hand vacuum cleaner is positioned with the bottom on a horizontal surface; and, (ii) a cyclone unit provided on a front end of the main body, the cyclone unit comprising a cyclone chamber having a cyclone axis of rotation, a front end and a rear end wherein air enters the cyclone chamber at the front end of the cyclone chamber and air exits the cyclone chamber at the rear end of the cyclone chamber;

(b) a surface cleaning head having a front end, a rear end, a dirt air inlet and a cleaning head air outlet; and, (c) a rigid air flow conduit extending between the cleaning head air outlet and a hand vacuum cleaner air inlet, the rigid air flow conduit having a longitudinally extending conduit axis which is parallel to the cyclone axis of rotation, the rigid air flow conduit is removably mounted to the surface cleaning head, wherein the hand vacuum cleaner is removably mounted to a downstream end of the rigid air flow conduit and when the hand vacuum cleaner is mounted to the downstream end of the rigid air flow conduit, the handle is a driving handle for the surface cleaning apparatus.

2. The surface cleaning apparatus of claim 1 wherein the cyclone axis of rotation is rearward of the longitudinally extending conduit axis when the hand vacuum cleaner is mounted to the rigid air flow conduit and the rigid air flow conduit extends generally vertically upwardly from the surface cleaning head.

3. The surface cleaning apparatus of claim 2 wherein a projection of the longitudinally extending conduit axis intersects the hand grip portion when the hand vacuum cleaner is mounted to the rigid air flow conduit.

4. The surface cleaning apparatus of claim 2 wherein the suction motor axis of rotation is generally parallel to the longitudinally extending conduit axis.

5. The surface cleaning apparatus of claim 1 wherein a projection of the longitudinally extending conduit axis intersects the hand grip portion when the hand vacuum cleaner is mounted to the rigid air flow conduit.

6. The surface cleaning apparatus of claim 1 wherein the suction motor axis of rotation is generally parallel to the longitudinally extending conduit axis.

7. The surface cleaning apparatus of claim 1 wherein the cyclone unit has an outlet conduit and the outlet conduit extends in a direction that is generally parallel to the cyclone axis of rotation.

8. The surface cleaning apparatus of claim 1 wherein the hand vacuum cleaner air inlet is provided on the cyclone unit and the rigid air flow conduit is removably attachable to the hand vacuum cleaner air inlet.

9. The surface cleaning apparatus of claim 8 wherein the hand vacuum cleaner air inlet comprises a hand vacuum cleaner inlet passage that is generally parallel to the longitudinally extending conduit axis, the hand vacuum cleaner inlet passage having an inlet end and an outlet end, the outlet end communicating with a cyclone chamber air inlet.

10. The surface cleaning apparatus of claim 9 wherein the cyclone chamber air inlet comprises a tangential air inlet provided at the outlet end of the hand vacuum cleaner inlet passage.

11. The surface cleaning apparatus of claim 9 wherein the hand vacuum cleaner inlet passage is coaxial with the longitudinally extending conduit axis.

12. The surface cleaning apparatus of claim 1 wherein the hand vacuum cleaner air inlet comprises a hand vacuum cleaner inlet passage that has an inlet axis that is generally parallel to the longitudinally extending conduit axis and a projection of each of the inlet axis and the cyclone axis intersects the suction motor.

13. The surface cleaning apparatus of claim 1, wherein when the hand vacuum cleaner is mounted to the downstream end of the rigid air flow conduit, the handle is at an upper end of the surface cleaning apparatus.

14. A surface cleaning apparatus comprising:

(a) hand vacuum cleaner comprising:

(i) a main body comprising a bottom, a handle, the main body housing a suction motor and fan assembly, the suction motor and fan assembly having a suction motor axis of rotation, the handle having a hand grip portion that extends upwardly and forwardly when the hand vacuum cleaner is positioned with the bottom on a horizontal surface; and, (i) an air treatment member provided on a front end of the main body, the air treatment member having a front end and a rear end, the front end having an air treatment member air inlet and the rear end having an air treatment member air outlet whereby air exits the air treatment member in a rearward direction;

(b) a surface cleaning head having a front end, a rear end, a dirt air inlet and a cleaning head air outlet; and, (c) a rigid air flow conduit extending between the cleaning head air outlet and a hand vacuum cleaner air inlet, the rigid air flow conduit having a longitudinally extending conduit axis which is parallel to the rearward direction and when the hand vacuum cleaner is mounted to a downstream end of the rigid air flow conduit, the handle is a driving handle for the surface cleaning apparatus, the rigid air flow conduit is removably mounted to the surface cleaning head.

15. The surface cleaning apparatus of claim 14 wherein the air treatment member air outlet comprises an outlet conduit having an outlet conduit axis that is generally parallel to longitudinally extending conduit axis.

16. The surface cleaning apparatus of claim 14 wherein the outlet conduit axis is rearward of the longitudinally extending conduit axis when the hand vacuum cleaner is mounted to the rigid air flow conduit and the rigid air flow conduit extends generally vertically upwardly from the surface cleaning head.

17. The surface cleaning apparatus of claim 16 wherein a projection of the longitudinally extending conduit axis intersects the hand grip portion when the hand vacuum cleaner is mounted to the rigid air flow conduit.

18. The surface cleaning apparatus of claim 17 wherein the suction motor axis of rotation is generally parallel to the longitudinally extending conduit axis.

19. The surface cleaning apparatus of claim 14 wherein the suction motor axis of rotation is generally parallel to the longitudinally extending conduit axis.

20. The surface cleaning apparatus of claim 14 wherein the air hand vacuum cleaner air inlet is provided on the treatment member, the rigid air flow conduit is removably attachable to the hand vacuum cleaner air inlet and the hand vacuum cleaner air inlet comprises a hand vacuum cleaner inlet passage that is generally parallel to the longitudinally extending conduit axis.

21. The surface cleaning apparatus of claim 20 wherein the hand vacuum cleaner inlet passage is coaxial with the longitudinally extending conduit axis.

22. The surface cleaning apparatus of claim 14 wherein the hand vacuum cleaner air inlet comprises a hand vacuum cleaner inlet passage that has an inlet axis that is generally parallel to the longitudinally extending conduit axis and a projection of each of the inlet axis and an outlet conduit axis of the air treatment member intersects the suction motor.

23. The surface cleaning apparatus of claim 14, wherein when the hand vacuum cleaner is mounted to the downstream end of the rigid air flow conduit, the handle is at an upper end of the surface cleaning apparatus.

24. A surface cleaning apparatus comprising:

(a) a hand vacuum cleaner comprising:

(i) a main body comprising a handle, the main body housing a suction motor and fan assembly, the suction motor and fan assembly having a suction motor axis of rotation, wherein the handle has a handle axis that intersects the suction motor axis of rotation; and, (ii) a cyclone unit provided on a front end of the main body, the cyclone unit comprising a cyclone chamber having a cyclone axis of rotation, a front end and a rear end wherein air enters the cyclone chamber at the front end of the cyclone chamber and air exits the cyclone chamber at the rear end of the cyclone chamber;

(b) a surface cleaning head having a front end, a rear end, a dirt air inlet and a cleaning head air outlet; and, (c) a rigid air flow conduit extending between the cleaning head air outlet and a hand vacuum cleaner air inlet, the rigid air flow conduit having a longitudinally extending conduit axis which is parallel to the cyclone axis of rotation, the rigid air flow conduit is removably mounted to the surface cleaning head, wherein the hand vacuum cleaner is removably mounted to a downstream end of the rigid air flow conduit and when the hand vacuum cleaner is mounted to the downstream end of the rigid air flow conduit, the handle is a driving handle for the surface cleaning apparatus.

25. The surface cleaning apparatus of claim 24 wherein the main body comprises a suction motor and fan assembly housing and the handle extends from a sidewall of the suction motor and fan assembly housing.

26. The surface cleaning apparatus of claim 24 wherein the hand vacuum cleaner comprises a hand vacuum cleaner inlet passage that has an inlet axis that is generally parallel to the longitudinally extending conduit axis and a projection of each of the inlet axis and the cyclone axis intersects the suction motor.

27. The surface cleaning apparatus of claim 24, wherein when the hand vacuum cleaner is mounted to the downstream end of the rigid air flow conduit, the handle is at an upper end of the surface cleaning apparatus.

* * * * *